US010975560B2

(12) United States Patent
Goldsmith

(10) Patent No.: US 10,975,560 B2
(45) Date of Patent: Apr. 13, 2021

(54) HYBRID TRAP WITH WATER INJECTION

(71) Applicant: Falcon Water Technologies, LLC, Los Angeles, CA (US)

(72) Inventor: Edward Michael Goldsmith, Encino, CA (US)

(73) Assignee: FALCON WATER TECHNOLOGIES, LLC, Los Angeles, CA (US)

( * ) Notice: Subject to any disclaimer, the term of this patent is extended or adjusted under 35 U.S.C. 154(b) by 0 days.

(21) Appl. No.: 16/397,978

(22) Filed: Apr. 29, 2019

(65) Prior Publication Data

US 2020/0063427 A1 Feb. 27, 2020

Related U.S. Application Data

(62) Division of application No. 14/264,037, filed on Apr. 28, 2014, now Pat. No. 10,273,675.

(Continued)

(51) Int. Cl.
*E03D 13/00* (2006.01)
*E03C 1/29* (2006.01)

(Continued)

(52) U.S. Cl.
CPC ..... *E03D 13/007* (2013.01); *E03C 1/1227* (2013.01); *E03C 1/281* (2013.01);

(Continued)

(58) Field of Classification Search
CPC ..... E03D 13/00; E03D 13/007; E03D 13/005; E03C 1/281

(Continued)

(56) References Cited

U.S. PATENT DOCUMENTS 1,745,010 A 1/1930 Lamprecht
2,675,823 A 4/1954 Langdon (Continued)

FOREIGN PATENT DOCUMENTS

AU 8303367 9/2008
AU 8303368 9/2008

(Continued)

OTHER PUBLICATIONS

International Search Report and the Written Opinion of the International Searching Authority for PCT/US2014/035758; dated Oct. 13, 2014.

(Continued)

*Primary Examiner* — Christine J Skubinna
(74) *Attorney, Agent, or Firm* — Tope-McKay & Associates

(57) ABSTRACT

A hybrid flushing system for water free urinals is presented with a housing having a wall portion forming a cavity for receiving a cartridge. The housing also includes a flushing fluid inlet portion for receiving a flushing fluid and a flushing fluid directing portion configured to direct the flushing fluid. A cartridge for installation into a housing is presented, including a cartridge wall, a flushing fluid receiving portion and a flushing fluid directing portion to direct flushing fluid received to any portion to clean areas of the housing, the cartridge, and connected plumbing. Steps for cleaning a hybrid flushing system are presented with an act of directing a flushing fluid into an area, where the area is one of a cartridge for a hybrid flushing system, a housing for a hybrid flushing system, and a plumbing system connected with the hybrid flushing system.

7 Claims, 108 Drawing Sheets

Related U.S. Application Data

(60) Provisional application No. 61/816,697, filed on Apr. 26, 2013, provisional application No. 61/828,165, filed on May 28, 2013, provisional application No. 61/911,594, filed on Dec. 4, 2013, provisional application No. 61/929,132, filed on Jan. 20, 2014, provisional application No. 61/828,153, filed on May 28, 2013, provisional application No. 61/928,999, filed on Jan. 17, 2014.

(51) Int. Cl.

| | |
|---|---|
| ***E03C 1/28*** | (2006.01) |
| ***E03C 1/288*** | (2006.01) |
| ***E03C 1/298*** | (2006.01) |
| ***E03C 1/122*** | (2006.01) |
| ***E03D 5/01*** | (2006.01) |

(52) U.S. Cl.
CPC ..... *E03C 1/288* (2013.01); *E03C 1/29* (2013.01); *E03C 1/298* (2013.01); *E03D 5/01* (2013.01)

(58) Field of Classification Search
USPC ..... 4/301, 144.1
See application file for complete search history.

(56) References Cited

U.S. PATENT DOCUMENTS

| | | | |
|---|---|---|---|
| 3,047,013 | A | 7/1962 | Baumbach |
| 3,967,645 | A | 7/1976 | Gregory |
| 4,518,014 | A | 5/1985 | McAlpine |
| 4,574,400 | A | 3/1986 | Annowsky |
| 4,574,403 | A | 3/1986 | Dintemann et al. |
| 4,578,207 | A | 3/1986 | Holdt et al. |
| 4,595,346 | A | 6/1986 | Bozoyan |
| 4,683,071 | A | 7/1987 | Holdt et al. |
| 4,937,892 | A | 7/1990 | Syrenne |
| 5,193,585 | A | 3/1993 | Proffitt et al. |
| 5,386,596 | A | 2/1995 | Hennesy |
| 5,581,823 | A | 12/1996 | Kuo |
| 5,604,937 | A | 2/1997 | Davenport |
| 5,606,995 | A | 3/1997 | Raftis |
| 5,711,037 | A | 1/1998 | Reichardt et al. |
| 5,727,593 | A | 3/1998 | Duer |
| 5,813,058 | A | 9/1998 | Quigley et al. |
| 6,009,567 | A | 1/2000 | Dean et al. |
| 6,053,197 | A | 4/2000 | Gorges |
| 6,105,916 | A | 8/2000 | Zlotnik et al. |
| 6,247,189 | B1 | 6/2001 | Dean et al. |
| 6,286,153 | B1 | 9/2001 | Keller |
| 6,401,266 | B1 | 6/2002 | Mitchell et al. |
| 6,425,411 | B1 | 7/2002 | Gorges |
| 6,502,251 | B1 | 1/2003 | Teshima et al. |
| 6,640,356 | B1 | 11/2003 | Hans |
| 6,644,339 | B2 | 11/2003 | Gorges et al. |
| 6,701,541 | B2 | 3/2004 | Romagna et al. |
| 6,750,773 | B2 | 6/2004 | Higgins |
| 6,959,723 | B2 | 11/2005 | Gorges |
| 6,973,939 | B2 | 12/2005 | Georges et al. |
| 6,977,005 | B2 | 12/2005 | Erdmann et al. |
| D544,574 | S | 6/2007 | Cummings |
| 7,243,681 | B2 | 7/2007 | Dahm |
| 7,422,034 | B2 | 9/2008 | Dahm |
| 7,511,004 | B2 | 3/2009 | Cheung et al. |
| D598,523 | S | 8/2009 | McAlpine |
| D598,987 | S | 8/2009 | McAlpine |
| 7,571,741 | B2 | 8/2009 | Higgins |
| 7,575,022 | B2 | 8/2009 | Higgins |
| 7,636,957 | B2 | 12/2009 | Funari |
| 7,709,433 | B2 | 5/2010 | Veltman et al. |
| D618,322 | S | 6/2010 | Keller |
| D620,584 | S | 7/2010 | McAlpine |
| 7,757,312 | B2 | 7/2010 | Stack et al. |
| 7,900,288 | B2 | 3/2011 | Fima |
| 8,006,324 | B2 | 8/2011 | Ophardt et al. |
| 8,007,707 | B1 | 8/2011 | Brown et al. |
| D644,717 | S | 9/2011 | Larkin et al. |
| 8,234,723 | B2 | 8/2012 | Allen |
| 8,277,715 | B2 | 10/2012 | Arora et al. |
| 8,291,522 | B2 | 10/2012 | Kueng |
| 8,444,771 | B2 | 5/2013 | Leipold et al. |
| 8,485,216 | B2 | 7/2013 | Higgins |
| 8,510,875 | B2 | 8/2013 | Helbig et al. |
| 8,590,068 | B2 | 11/2013 | Stack et al. |
| 8,646,117 | B2 | 2/2014 | Avetisian |
| 2002/0069913 | A1 | 6/2002 | Gorges et al. |
| 2002/0116753 | A1 | 8/2002 | Mitchell et al. |
| 2002/0120981 | A1 | 9/2002 | Gorges |
| 2003/0089397 | A1 | 5/2003 | Georges |
| 2004/0010843 | A1 | 1/2004 | Erdmann et al. |
| 2004/0134534 | A1 | 7/2004 | Gorges et al. |
| 2004/0211267 | A1 | 10/2004 | Higgins |
| 2005/0039248 | A1 | 2/2005 | Demarco |
| 2005/0229297 | A1 | 10/2005 | Higgins |
| 2005/0229971 | A1 | 10/2005 | Higgins |
| 2005/0247342 | A1 | 11/2005 | Higgins |
| 2006/0064805 | A1 | 3/2006 | Yamamoto et al. |
| 2006/0101565 | A1 | 5/2006 | Cummings |
| 2006/0118176 | A1 | 6/2006 | Ring et al. |
| 2006/0207005 | A1 | 9/2006 | Jenssen |
| 2006/0225195 | A1 | 10/2006 | Scholer |
| 2007/0006370 | A1 | 1/2007 | Schroder |
| 2007/0048247 | A1 | 3/2007 | Martin et al. |
| 2007/0083989 | A1 | 4/2007 | Higgins et al. |
| 2007/0186337 | A1 | 8/2007 | Emr |
| 2007/0209979 | A1 | 9/2007 | Helbig et al. |
| 2007/0257218 | A1 | 11/2007 | Bood et al. |
| 2008/0028504 | A1 | 2/2008 | Higgins et al. |
| 2008/0093845 | A1 | 4/2008 | Higgins |
| 2008/0295233 | A1 | 4/2008 | Fima |
| 2008/0189845 | A1 | 8/2008 | Yang et al. |
| 2008/0256695 | A1 | 10/2008 | Allen |
| 2008/0269097 | A1 | 10/2008 | Cheung et al. |
| 2008/0303186 | A1 | 12/2008 | Lu |
| 2008/0313795 | A1 | 12/2008 | Lu |
| 2009/0165197 | A1 | 7/2009 | Seibt |
| 2009/0235443 | A1 | 9/2009 | Arora et al. |
| 2010/0024892 | A1 | 2/2010 | Higgins |
| 2010/0095445 | A1 | 4/2010 | Rice et al. |
| 2010/0120648 | A1 | 5/2010 | Veltman et al. |
| 2010/0186156 | A1 | 7/2010 | Ophardt et al. |
| 2010/0192291 | A1 | 8/2010 | Burt et al. |
| 2010/0192295 | A1 | 8/2010 | Fima |
| 2010/0199412 | A1 | 8/2010 | McAlpine |
| 2010/0199415 | A1 | 8/2010 | Fima |
| 2010/0205725 | A1 | 8/2010 | McAlpine |
| 2010/0230333 | A1 | 9/2010 | Avetisian |
| 2011/0010833 | A1 | 1/2011 | Fima |
| 2011/0016619 | A1 | 1/2011 | Keller |
| 2011/0036417 | A1 | 2/2011 | McAlpine |
| 2011/0203048 | A1 | 8/2011 | Fima |
| 2011/0209276 | A1 | 8/2011 | Lu et al. |
| 2011/0219528 | A1 | 9/2011 | Cadavid |
| 2011/0223059 | A1 | 9/2011 | Lu et al. |
| 2011/0252552 | A1 | 10/2011 | Janssen |
| 2011/0296597 | A1 | 12/2011 | Brown et al. |
| 2012/0023649 | A1 | 2/2012 | Helbig et al. |
| 2012/0066822 | A1* | 3/2012 | Kueng ..... E03D 13/007 4/144.1 |
| 2012/0167295 | A1 | 7/2012 | Fima |
| 2012/0167296 | A1 | 7/2012 | Nomura et al. |
| 2012/0228800 | A1 | 9/2012 | Arora et al. |
| 2012/0317707 | A1* | 12/2012 | Romero ..... E03D 13/00 4/144.1 |
| 2013/0000766 | A1 | 1/2013 | McAline et al. |
| 2013/0015388 | A1 | 1/2013 | Keller |
| 2013/0031708 | A1 | 2/2013 | Sensel |
| 2013/0067651 | A1 | 3/2013 | Brown et al. |
| 2013/0104305 | A1 | 5/2013 | Stack et al. |

(56) References Cited

U.S. PATENT DOCUMENTS

FOREIGN PATENT DOCUMENTS

| | | | |
|---|---|---|---|
| AU | 10320652 | | 11/2010 |
| AU | 11235550 | | 3/2011 |
| CA | 2700702 | | 4/2009 |
| CA | 2700704 | | 4/2009 |
| CA | 2786552 | | 5/2011 |
| CN | 2386089 | | 8/1999 |
| CN | 2559699 | | 7/2003 |
| CN | 2656515 | | 11/2004 |
| CN | 2699813 | | 5/2005 |
| CN | 2781131 | | 5/2006 |
| CN | 101260686 | A | 9/2008 |
| CN | 201198591 | | 2/2009 |
| CN | 201343756 | | 11/2009 |
| CN | 201367367 | | 12/2009 |
| CN | 101260686 | | 6/2010 |
| CN | 201649272 | | 11/2010 |
| CN | 201843191 | | 5/2011 |
| CN | 201843210 | | 5/2011 |
| CN | 102425223 | | 4/2012 |
| CN | 202273300 | | 6/2012 |
| CN | 102635151 | | 8/2012 |
| CN | 202577519 | | 12/2012 |
| DE | 362324 | | 7/1920 |
| EP | 0628667 | | 12/1994 |
| EP | 0 916 774 | A2 | 11/1998 |
| EP | 0 916 774 | A3 | 11/1998 |
| EP | 1 174 549 | | 1/2002 |
| EP | 1 174 549 | A2 | 1/2002 |
| EP | 1 174 549 | A3 | 1/2002 |
| EP | 1 785 077 | | 5/2007 |
| EP | 2 472 014 | | 6/2013 |
| GB | 0422136 | | 7/1933 |
| GB | 0468282 | | 12/1935 |
| GB | 0520277 | | 8/1938 |
| GB | 0718597 | | 3/1951 |
| GB | 0725125 | | 11/1953 |
| GB | 0915103 | | 7/1961 |
| GB | 1006930 | | 10/1961 |
| GB | 1006945 | | 4/1962 |
| GB | 1103425 | | 5/1965 |
| GB | 1103426 | | 5/1965 |
| GB | 1203608 | | 12/1967 |
| GB | 2 153 048 | | 8/1985 |
| GB | 153 048 | | 8/1985 |
| GB | 2 190 466 | | 11/1987 |
| GB | 2 296 309 | | 6/1996 |
| GB | 2 320 310 | | 6/1998 |
| GB | 2 346 198 | | 2/2000 |
| GB | 2 346 198 | | 12/2002 |
| GB | 2467669 | A | 8/2010 |
| GB | 2469585 | A | 10/2010 |
| GB | 2 470 839 | A | 12/2010 |
| GB | 2473055 | | 3/2011 |
| GB | 2488664 | | 9/2012 |
| GB | 2 470 839 | B | 1/2013 |
| GB | 2467669 | B | 2/2013 |
| GB | 2469585 | B | 2/2013 |
| JP | 49 5434 | | 4/1972 |
| JP | 63166772 | | 7/1988 |
| JP | 1993090063 | | 4/1993 |
| JP | 07-207741 | | 8/1995 |
| JP | 10-252118 | | 9/1998 |
| JP | 2005-180064 | | 7/2005 |
| JP | 2005180064 | | 7/2005 |
| JP | 04905434 | | 1/2012 |
| JP | 05090063 | | 12/2012 |
| KR | 877603 | | 1/2009 |
| KR | 2010013602 | | 2/2010 |
| KR | 2010076858 | | 7/2010 |
| NZ | 0543551 | | 11/2005 |
| NZ | 0586547 | | 6/2010 |
| RU | 2010130666 | A | 12/2008 |
| TW | I331179 | | 2/1996 |
| TW | 476837 | | 2/2002 |
| TW | 200934933 | | 8/2009 |
| TW | 201116674 | | 5/2011 |
| WO | WO 99/07953 | | 2/1999 |
| WO | WO 99/57382 | | 11/1999 |
| WO | WO 01/45075 | | 6/2001 |
| WO | WO 2004059198 | | 7/2004 |
| WO | WO 2004/090245 | | 10/2004 |
| WO | WO 2004/100742 | | 11/2004 |
| WO | WO 2009/026733 | | 3/2009 |
| WO | WO 2009/040524 | | 4/2009 |
| WO | WO 2009/040525 | | 4/2009 |
| WO | WO 2009/081155 | | 7/2009 |
| WO | WO 2009/144479 | | 12/2009 |
| WO | WO 2010/074411 | | 1/2010 |
| WO | WO 2010/067049 | | 6/2010 |
| WO | WO 2010/091862 | | 8/2010 |
| WO | WO 2011/012860 | | 2/2011 |
| WO | WO 2011/061515 | | 5/2011 |
| WO | WO 2011/094880 | | 8/2011 |
| WO | WO 2011/120177 | | 10/2011 |
| WO | WO 2011/120178 | | 10/2011 |
| WO | WO 2011/120179 | | 10/2011 |
| WO | WO 2012/117221 | | 9/2012 |
| WO | WO 2013/017373 | | 2/2013 |
| WO | WO 2013/017424 | | 2/2013 |
| ZA | 198303028 | A | 4/1983 |

OTHER PUBLICATIONS

Notification Concerning Transmittal of International Preliminary Report on Patentability for PCT/US2014/035758; dated Nov. 5, 2015.

International Preliminary Report on Patentability for PCT/US2014/035758; dated Nov. 5, 2015.

Office Action 1 for Australian patent application No. 2014256875; dated Jul. 17, 2017.

Response to Office Action 1 for Australian patent application No. 2014256875; dated Feb. 20, 2018.

Office Action 2 for Australian patent application No. 2014256875; dated Mar. 26, 2018.

Response to Office Action 2 for Australian patent application No. 2014256875; dated Jun. 15, 2018.

Office Action 3 for Australian patent application No. 2014256875; dated Jul. 9, 2018.

Examination Report 1 for Australian patent application No. 2018206724; dated Mar. 7, 2019.

Response to Examination Report 1 for Australian patent application No. 2018206724; dated Dec. 10, 2019.

Examination Report 2 for Australian patent application No. 2018206724; dated Dec. 13, 2019.

Response to Examination Report 2 for Australian patent application No. 2018206724; dated Dec. 16, 2019.

Notice of Acceptance for Australian patent application No. 2018206724; dated Dec. 17, 2019.

English translation for Office Action 1 for Colombian patent application No. 15282862; dated Feb. 16, 2016.

Response to Office Action 1 for Colombian patent application No. 15282862; dated Mar. 29, 2016.

Office Action 2 for Colombian patent application No. 15282862; dated Jun. 2, 2017.

Office Action 3 for Colombian patent application No. 15282862; dated Jan. 17, 2018.

Office Action 3 Claim Amendments for Colombian patent application No. 15282862; dated Feb. 15, 2018.

Notice of Allowance for Colombian patent application No. 15282862; dated Jul. 9, 2018.

Office Action 1 for Divisional Colombian patent application No. NC2018/0003835; dated Jul. 9, 2018.

Response to Office Action 1 for Divisional Colombian patent application No. NC2018/0003835; dated Sep. 24, 2018.

English translation of amended specification for Response to Office Action 1 for Divisional Colombian patent application No. NC2018/0003835; dated Sep. 24, 2018.

(56) References Cited

OTHER PUBLICATIONS

Office Action 1 for Mexican patent application No. MX/a/2015/014943; dated May 14, 2019.
English translation of Office Action 1 for Mexican patent application No. MX/a/2015/014943; dated May 14, 2019.
Response to Office Action 1 for Mexican patent application No. MX/a/2015/014943; dated Jul. 23, 2019.
Office Action 2 for Mexican patent application No. MX/a/2015/014943; dated Sep. 20, 2019.
Response to Office Action 2 for Mexican patent application No. MX/a/2015/014943; dated Dec. 5, 2019.
Office Action 1 Translation and Remarks for Taiwan patent application No. 103115178; dated May 10, 2016.
English Claims Response to Office Action 1 for Taiwan patent application No. 103115178; dated Nov. 9, 2016.
Notice of Allowance for Taiwan patent application No. 103115178; dated Apr. 7, 2017.
Office Action 1 Translation and Remarks for Taiwan patent application No. 105136471; dated Jun. 9, 2017.
English Claims Response to Office Action 1 for Taiwan patent application No. 105136471; dated Aug. 29, 2017.
Office Action 2 Decision of Rejection Translation and Remarks for Taiwan patent application No. 105136471; dated Dec. 11, 2017.
Notice of Allowance for Taiwan patent application No. 105136471; dated Mar. 16, 2018.
English translation for Office Action 1 for Chinese patent application No. 201480029767.5; dated Jul. 19, 2016.
Response to Office Action 1 for Chinese patent application No. 201480029767.5; dated Feb. 3, 2017.
English translation for Office Action 2 for Chinese patent application No. 201480029767.5; dated Mar. 9, 2017.
Amended Claims for Response to Office Action 2 for Chinese patent application No. 201480029767.5; dated May 10, 2017.
Response to Office Action 2 for Chinese patent application No. 201480029767.5; dated May 24, 2017.
English translation for Office Action 3 for Chinese patent application No. 201480029767.5; dated Sep. 30, 2017.
Response to Office Action 3 for Chinese patent application No. 201480029767.5; dated Dec. 14, 2017.
English translation of Rejection Decision for Chinese patent application No. 201480029767.5; dated Jun. 14, 2018.
Request for Reexamination for Chinese patent application No. 201480029767.5; dated Sep. 21, 2018.
Amended claims for the Request for Reexamination for Chinese patent application No. 201480029767.5; dated Sep. 21, 2018.
Response to Reexamination Notice for Chinese patent application No. 201480029767.5; dated May 5, 2019.
Amended claims for the Response to Reexamination Notice for Chinese patent application No. 201480029767.5; dated May 5, 2019.
Rejection to Reexamination Request for Chinese patent application No. 201480029767.5; dated Aug. 23, 2019.
Partial Search Report for European patent application No. EP 14 78 8063; dated Feb. 14, 2017.
Rule 70(2) and 70a(2), Search Report & Search Opinion for European patent application No. EP 14 78 8063; dated Sep. 22, 2017.
Response to Opinion for European patent application No. EP 14 78 8063; dated Jul. 18, 2018.

* cited by examiner

Z-Z

Prior Art Back

HYBRID TRAP WITH WATER INJECTION

CROSS-REFERENCE TO RELATED APPLICATIONS

The present application is a Divisional application of U.S. application Ser. No. 14/264,037, filed on Apr. 28, 2014, entitled, "Hybrid Trap with Water Injection," which is a Non-Provisional application of U.S. Provisional Application No. 61/816,697, filed on Apr. 26, 2013, entitled "Hybrid Trap with Water Injection Cleaning," U.S. Provisional Application No. 61/828,165, filed on May 28, 2013, entitled "Hybrid Trap with Water Injection Cleaning," U.S. Provisional Application No. 61/911,594, filed on Dec. 4, 2013, entitled "Hybrid Trap with Water Injection," U.S. Provisional Application No. 61/929,132, filed on Jan. 20, 2014, entitled "Hybrid Trap with Water Injection," U.S. Provisional Application No. 61/828,153, filed on May 28, 2013, entitled "Tapered High Velocity Exit with Flexible Tip," and U.S. Provisional Application No. 61/928,999, filed on Jan. 17, 2014, entitled "Tapered High Velocity Exit with Flexible Tip," the entirety of which are incorporated herein by reference.

BACKGROUND OF THE INVENTION

(1) Field of the Invention

The present invention relates to waterless urinals, and more particularly to a hybrid waterless flushing system that has the benefit of a waterless urinal cartridge but also includes a flushing system for cleaning portions of a housing in which the cartridge can be fitted; a cartridge that is fitted within the housing; and plumbing connected with the housing.

(2) Description of Related Art

Water is a scarce and diminishing resource in many areas of the world. It is widely recognized that more has to be done to conserve its usage as populations grow and climate changes drive need. Water conserving products are becoming more and more important not only for the quality of human life but also for sanitary and subsistence reasons.

There have been many water conserving measures taken all over the world in an effort to deal with limited and diminishing resources. Many municipalities have implemented rationing plans. Others have invested in wastewater recycling treatment and re-use. There have also been many water conserving products introduced into the marketplace. These products have become more and more widely used by industry and homeowners as regulations and the rising cost of water usage drive change.

Two major lines of product designed to save water are non-flushing urinals and

High Efficiency Urinals (HEUs). Both the non-flushing urinals and HEUs use far less water than traditional urinals. Savings of water per year for a single urinal can amount to as much as 40,000 gallons in the case of water-free systems, and roughly 20,000 to 30,000 gallons when a HEU is installed in place of a traditional urinal.

Non-flushing urinals use the least amount of water of any urinal system and are comprised of three major components: a porcelain urinal, a housing, and a cartridge. The porcelain urinal component is very similar to that of a traditional urinal. The housing and cartridge replace the traditional P-trap, which normally would connect a urinal to a building's plumbing. Thus, the housing sits in-line between the building's plumbing and the bottom of the urinal where the drain pipe would normally connect. The cartridge which contains the trap fits in the housing and can be removed for servicing and replacement.

There are two types of cartridge styles: liquid traps and mechanical valves. The liquid trap-style cartridge serves two purposes. First, it acts as a barrier from sewer gasses and odors coming into the restroom. Second, it acts as a filter for removing some of the solids that precipitate from the human urine (a super-saturated liquid). Human urine is an aqueous solution of greater than 95% water, with the remaining constituents, in order of decreasing concentration: urea 9.3 g/L, chloride 1.87 g/L, sodium 1.17 g/L, potassium 0.750 g/L, creatinine 0.670 g/L, and other dissolved ions, inorganic and organic compounds; according to the NASA Contractor Report No. NASA CR-1802, D. F. Putnam, July 1971.

The liquid trap-style cartridge works by using the following mechanisms. First, urine fills the P-trap of the cartridge forming a barrier against sewer gasses; just as water does in a traditional P-trap-based urinal. Second, a layer of low density fluid, such as oil, is poured into the trap so that it floats on top of the urine. This floating oil forms a barrier, helping to keep unpleasant urine smells from entering the bathroom. As the user urinates into the urinal, fresh urine enters the cartridge, sinks through the floating oil barrier, and presses out the old urine from the trap through the housing exit tube and into the building's plumbing.

The mechanical valve non-flushing urinals work in a slightly different manner. All components are similar to the above-mentioned liquid trap-style non-flushing urinal, except for the cartridge. In this case, rather than using a liquid sealant, some form of a mechanical valve is utilized. The mechanical valve allows urine to pass through while blocking the gas and the odor from escaping back through the system and into the restroom. The valve can be housed in a cartridge or, if replaceable, serve as the cartridge itself. One example of a mechanical valve cartridge is that made by Liquidbreaker, LLC (5575 Magnatron Blvd., San Diego, Calif. 92111); the subject of a U.S. Pat. No. 7,900,288 (hereinafter the '288 patent). In this model, two silicone flaps rest on plastic seats in a cartridge; forming a one-way barrier. When urine flows down, it puts weight onto the silicon flaps at the center of the cartridge and the flaps open up. When the urine drips off of the flaps and into the housing, the valves close; thus sealing out gasses. Another example of a mechanical valve cartridge, similar to one manufactured and sold by Enswico AG (Gewerbestrasse 20, 8132 Egg bei Zürich, Switzerland), uses a duckbill type valve rather than the style used in the '288 patent. Another type of a mechanical valve cartridge, similar to one manufactured and sold under the Whiffaway and Saracen brands (WhiffAway Ltd., Unit 6, Premacto Business Estate, Queensmead Road, High Wycombe HP10 9XA, UK), uses a mechanical valve itself as the cartridge. Still yet another type of mechanical valve cartridge, similar to the one manufactured and sold under the Helvex brand (Helvex S.A. de C.V./Calzada Coltongo 293, Colonia Industrial Vallejo, 02300, Mexico), uses a sphere-shaped ball that forms a seal by seating into a hole at the bottom of a cartridge and then floating up when surrounded by urine; consequently opening the valve when urine is present and closing it when the cartridge is empty. There are advantages and shortcomings to both liquid trap and mechanical valve-type non-flushing urinals; however before these are discussed, an explanation of the workings of HEUs and their components is presented.

The High Efficiency Urinals (HEUs) have three major components: a urinal, a flush valve, and a trap. An example of a flush valve is model Royal 186-0.125, manufactured by The Sloan Valve Company (10500 Seymour Ave., Franklin Park, Ill. 60131); and associated piping and actuator mechanisms. However, other water control valves would be suitable in place of the Sloan Royal 186-0.125. The trap is sometimes built into the porcelain urinal and is sometimes made of metal tubing and attached to the bottom of the porcelain urinal to act as a drain. To save water over traditional urinals, HEUs are designed with P-traps of a much smaller diameter than those used in the traditional flush urinals and their flush valves are designed to flush using a lesser quantity of water per flush. The smaller diameter trap naturally holds a lower volume of water and thus needs less water to be flushed. The water provides a barrier to the sewer gasses escaping into the room just as in a traditional urinal.

Non-flushing urinals have significant advantages over HEUs. Non-flushing urinals use virtually no water. HEUs, on the other hand, while using less water than the traditional urinals, still use 25% to 50% as much as traditional urinals (or even more). The non-flushing urinals also have a key advantage in cleanliness and bacteria growth management. Multiple studies, for example those performed by the St. Louis County Health Department On Bio-Aerosols and the UCLA Waterfree Urinal Research Project, show that less bacteria forms on the porcelain surface of a urinal where no water is introduced as compared to a traditional urinal.

With both the HEU and non-flushing systems on the market today, there are big gains in water savings over the traditional urinals; however, both are still relatively new technologies and have some well-known shortcomings. With non-flushing urinals, a greater amount of care and service is required for proper operation. This care is not always taken. The liquid cartridge cannot be easily flushed with outside water (for example with a bucket of water that has been used for mopping). Dumping of a bucket of water in a non-flushing urinal may have the effect of overwhelming the oil barrier and washing it out of the system, leaving urine odor free to fill the restroom. Also, due to the slow velocity of the urine, along with the natural turbulence created as it flows down the pipes of the building, solids tend to precipitate out of the urine and build up in the piping. While various forms of buildup are common for all urinals, it is also true that there is little water available to clear or washout certain types of buildup. Struvite buildup has been found to be particularly problematic. Struvite (magnesium ammonium phosphate) is a phosphate mineral with the formula: $NH_4MgPO_4.6H_2O$. Struvite crystallizes in the orthorhombic system as white to yellowish or brownish-white pyramidal crystals or in platey mica-like forms. It is a soft mineral with Mohs hardness of 1.5 to 2 and has a low specific gravity of 1.7. It is sparingly soluble in neutral and alkaline conditions, but readily soluble in acid.

With HEU's the amount of water per flush is dramatically reduced as compared with traditional flush urinals. HEUs are required to flush with each use, but the amount of water introduced to a building's plumbing system each time is minimal. Many models flush only a pint of water—where older urinals flushed between a gallon and three gallons. Thus the pipes experience a trickle of water that is flowing at a relatively slow speed rather than a rush of water with a more significant flow the pipes were designed to take. This trickling of the small amounts of water stresses the plumbing system, as water sits in the imperfectly sloped pipes of older buildings or deposits solids like struvite as it slowly flows through the bumpy iron piping.

Struvite buildup can be particularly problematic in the leg between the urinal and the building's down pipes. This is a problem in both mechanical and liquid trap non-flushing systems unless they are regularly flushed out with water. Past that area, the building's down-pipes are often rinsed out with water from other sources in the building. Struvite also tends to build up on the bottom of the urinal housing, leaving a very unpleasant odor and appearance. This makes changing the cartridge an unpleasant chore for the maintenance staff. Because the liquid trap acts as a filter, holding solids inside, flushing could push trapped solids out of the cartridge and into the building's piping with no means to rinse them away after that if not done thoroughly—which could lead to more clogged pipes—so flushing a liquid trap cartridge with water can have negative effects. When pipes are clogged, they must be snaked out. This can be a difficult and unpleasant process.

Struvite also builds up in areas prone to splashing, such as the area underneath the exit of the cartridge. The splashing of urine causes solids to precipitate out and significant buildup can occur at the point of splash. Additionally, struvite will build up where urine flow is slow or still. When the urinal is used, there is initially a strong stream of urine, but it tapers off to a few droplets at the end of the use. These droplets move slowly through the system, building up struvite residue on drip edges and surfaces along the outlet compartment, the housing, and the housing exit tube in particular. One of the advantages of the present invention is that it can be placed to target these areas and simultaneously bring a high pressure jet of water or targeted flow of water that scrubs the key surfaces prone to buildup.

With non-flushing mechanical cartridge valves, there are other issues. When a mechanical cartridge valve fails (for example if it were to get jammed with an object like gum or hair), it fails in the open position. This is a significant problem as sewer gasses are then free to enter the restroom. Struvite is known to build up on the working surfaces of the mechanical valves and can jam them open or glue them shut. In fact, the current United States Plumbing Code strictly forbids the mechanical valves of any kind as a replacement for liquid traps due to failure concerns. Struvite buildup tends to occur on and around the sealing surface of the mechanical valves and below the valve in the housing area where the drip edge of the mechanical valve drips. These drips cause splash, and splash causes the urine to precipitate its solids. As previously mentioned, it is a known fact that urine is a super-saturated material and that super-saturated materials can precipitate due to turbulence or shock. Thus it is important to regularly flush mechanical valves with water—which can be onerous on the maintenance team who may not have a good source for filling heavy buckets for many urinals each day. For this reason, mechanical valves often fail due to the requirements of constant service.

HEUs also have shortcomings as compared with the performance of the traditional urinals. First, the smaller traps are prone to clogging. Clogging causes flooding. Flooding is an expensive and dangerous situation in many restrooms. Second, the traps, which often hold as little as a pint or less, are prone to evaporation. If the trap evaporates to a certain level, sewer gasses are free to flow into the restroom. Third, because water is mixed with urine regularly as it goes down the pipes, there is the general buildup in the pipes of hard calcified material that occurs with all water-using urinals. While this would normally be no worse than a traditional urinal; due to the small inside diameter of the HEU models, it is very difficult, if not impossible, to properly snake out the plumbing without removing the entire urinal from the wall—a costly and unpleasant job. A fourth known issue with the existing HEUs is that while they use less water than the traditional urinals, they still require flushing with every use to remove standing urine from the trap.

For all of these reasons, there is a demand for a better urinal solution. One such solution is a hybrid flushing system, in which a significant amount of water can be saved over traditional urinals with the system being more robust against the common failures outlined above. It is the focus of the present invention to create a hybrid flushing system that solves the problems outlined above and provides both service personnel and end users with a more trouble free experience while saving a significant amount of water over traditional urinal and HEU models.

The present invention is intended to overcome many of the shortcomings of both traditional and non-flushing systems by providing a hybrid flushing system that uses an odor and gas blocking mechanism in combination with a high efficiency flushing system. This hybrid flushing system uses only slightly more water than a non-flushing urinal, while delivering performance and ease of service matching or better than a High Efficiency Urinal (HEU) or a traditional urinal. It accomplishes this by using known gas sealing systems available in today's non-flushing urinals that use mechanical valves or liquid traps to seal off gasses, combined with focused flushing and cleaning and/or timed flushing and cleaning. By bringing this highly focused and/or timed flush to a water free urinal, one can accomplish the goal of using very little water, while keeping pipes clean and the valve or trap mechanisms free from clog and buildup.

SUMMARY OF INVENTION

The present invention relates to waterless urinals, and more particularly to a hybrid waterless flushing system that has the benefit of a waterless urinal cartridge but also includes a flushing system for cleaning portions of a housing in which the cartridge can be fitted, a cartridge that is fitted within the housing, and plumbing connected with the housing.

In one aspect, the present invention relates to a housing comprising a wall portion forming a cavity for receiving a cartridge. The housing further comprises a flushing fluid inlet portion for receiving a flushing fluid and a flushing fluid directing portion configured to receive the flushing fluid from the flushing fluid inlet portion and to direct the flushing fluid.

In another aspect, the flushing fluid directing portion is integral with the flushing fluid inlet portion.

In still another aspect, the flushing fluid directing portion is configured to direct the fluid from the flushing fluid inlet into the cavity such that the flushing fluid flows substantially tangentially with respect to the wall and exits through a fluid exit portion.

In yet another aspect, the flushing fluid directing portion is on a flange of the cavity of the housing.

In a further aspect, the housing further comprises a fluid exit portion configured to accelerate the flushing fluid.

In a still further aspect, the housing further comprises a sealing surface for connecting the housing with a cartridge such that flushing fluid may flow therebetween in a fluid-tight manner.

In a yet further aspect, the housing further comprises a fluid exit portion configured to be connected with a cartridge.

In another aspect, the housing further comprises a fluid exit portion comprising a compliant inlet director.

In still another aspect, the hybrid flushing system further comprises a vent channel from a plumbing vent pipe to the housing cavity to allow airflow therethrough.

In yet another aspect, the present invention comprises a cartridge for a hybrid flushing system. The cartridge comprises a cartridge wall, a flushing fluid receiving portion and a flushing fluid directing portion where the cartridge directs flushing fluid received from the fluid receiving portion into the hybrid flushing system.

In a further aspect, the flushing fluid directing portion is configured to direct a portion flushing fluid into a location, examples of which include: before a trap portion of the cartridge, into a mid-trap portion of the cartridge, and after a trap portion of the cartridge.

In a still further aspect, the cartridge is formed such that when mated with a housing, forms a channel there between for directing the flushing fluid.

In a yet further aspect, the fluid directing portion is configured to modify the flow of the flushing fluid in a manner selected from a group consisting of accelerating and aiming the flushing fluid.

In another aspect, the flushing fluid directing portion is a narrowed aperture.

In still another aspect, the cartridge further comprises a control for providing instructions to a flush system.

In yet another aspect, the control is selected from a magnet, an electronic control device, and a mechanical control device.

In a further aspect, the control provides instructions to a flush system for adjusting a flushing characteristic, examples of which include flush volume, flush frequency, flush enable/disable, flush pressure, flush type, flush location, and flushes available after cartridge removal.

In a still further aspect, the control is configured to provide identifying information to the flush system.

In a yet further aspect, the hybrid flushing system further comprises a fluid trap formed between the flushing fluid receiving portion and the flushing fluid directing portion.

In another aspect, the hybrid flushing system comprises a housing for receiving a cartridge, a flushing fluid system comprising a flushing fluid receiving portion and a flushing fluid exit portion, and a pump for pumping flushing fluid to the flushing fluid receiving portion of the flushing fluid system.

In still another aspect, the hybrid flushing system further comprises an air-gap system for providing flushing fluid to the pump.

In yet another aspect, the air-gap system is a cistern.

In a further aspect, the pump is configured to pump flushing fluid in a mode selected from a group of pulsing, pressure-varying, and volume-varying.

In a still further aspect, the hybrid flushing system comprises a housing for receiving a cartridge, a flushing fluid system comprising a flushing fluid receiving portion and a flushing fluid directing portion.

In a yet further aspect, the hybrid flushing system further comprises a trap disposed between the air-gap device and the housing.

In another aspect, the invention comprises a method for cleaning a hybrid flushing system comprising an act of directing a flushing fluid into an area, where the area is one or more of a cartridge for a hybrid flushing system, a housing for a hybrid flushing system, and a plumbing system connected with the hybrid flushing system.

In still another aspect, in the act of directing the flushing fluid, the flushing fluid is directed through a fluid path, where the fluid path passes through an area selected from a group consisting of a housing for a hybrid flushing system, a cartridge for a hybrid flushing system, and a path formed by a combination of a housing for a hybrid system and a cartridge for a hybrid flushing system.

BRIEF DESCRIPTION OF THE DRAWINGS

The objects, features and advantages of the present invention will be apparent from the following detailed descriptions of the various aspects of the invention in conjunction with reference to the following drawings, where:

FIG. 77A shows the cartridge in an unlocked position and FIG. 77B shows the cartridge in a locked position after being rotated clockwise into position to mate the fluid interfaces, according to the present invention;

DETAILED DESCRIPTION

Figure 1:
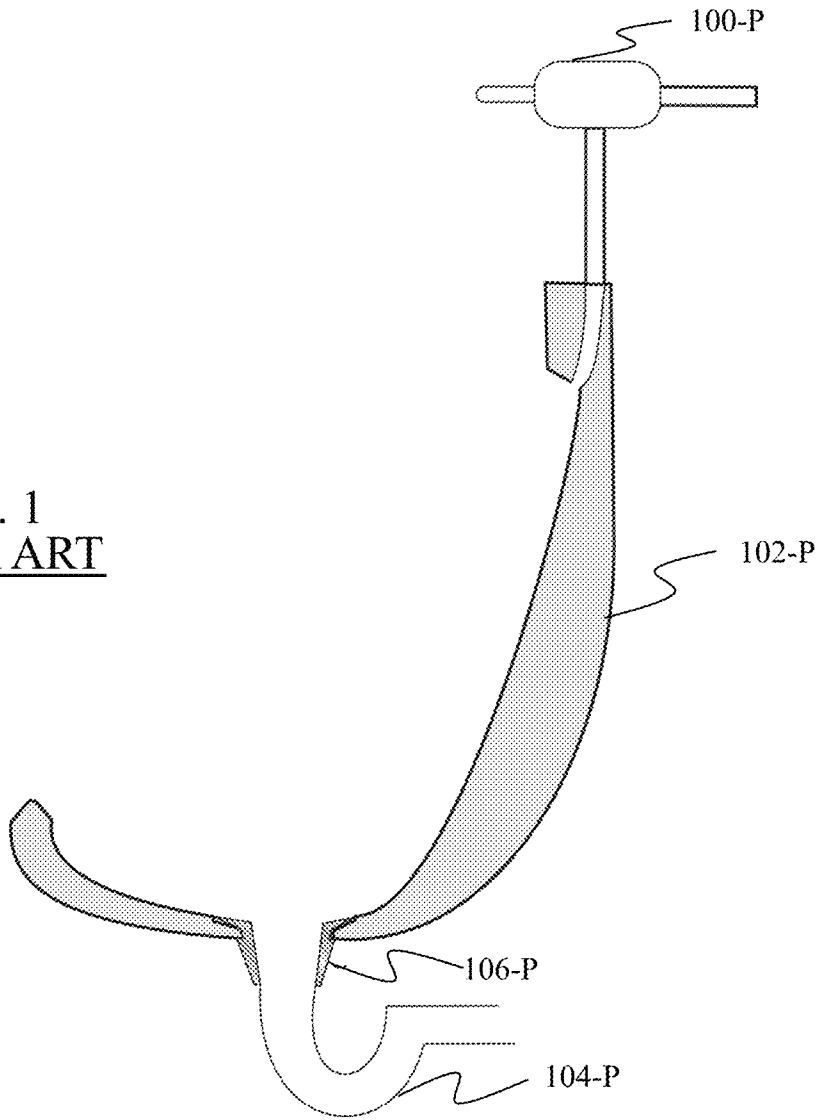
FIG. 1 PRIOR ART
FIG. 1 is an illustration of a cutaway side view schematic showing a prior art "wash down" urinal design where water enters through a flush valve, runs down the side and the back of a urinal and into a traditional trap through a urinal drain.

The present invention relates to creating a hybrid flushing system, more particularly, a system that uses an odor and gas blocking mechanism in combination with a high efficiency flushing and cleaning system. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. For example, the individual components described may be formed as discrete parts or integrated together as a single unit. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

Further, where appropriate, numbers for elements shown in figures depicting prior art devices are followed by a "-P" to indicate that they are referring to prior art figures. The actual structure used with respect to the present invention may be the same or different than that used in the prior art; specific similarities and/or differences being understandable in context.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Before describing the invention in detail, an introduction is provided to give the reader a general understanding of the present invention. Next, a description of various aspects of the present invention is provided to give an understanding of the specific details.

(1) Introduction

This section presents information regarding the various types of urinals currently in use and how they operate. There are three types of urinals currently in use: traditional urinals, High Efficiently Urinals (HEUs), and non-flushing urinals.

An example of a traditional (prior art) "wash down" urinal design is illustrated in a cutaway side view in FIG. 1. Water enters through a flush valve 100-P and runs down the side and back of the urinal 102-P into a traditional trap 104-P through a urinal drain 106-P. The flush valve 100-P is responsible for controlling when and how much water will flush out the urinal. The trap 104-P holds the liquid and consequently blocks sewer gasses from coming up through the building's plumbing and back into the restroom. The liquid that fills the trap needs to be clean, as it is exposed to the room's atmosphere. Thus, it is important that after each use, the urine is flushed out completely from the trap 104-P. This requires the entire volume of the trap water (oftentimes more) to be replaced with fresh water to fill the trap 104-P and to eliminate all of the urine therein via the building's plumbing.

High Efficiency Urinals (HEUs) operate with the same mechanisms, but use a trap 104-P with a much smaller volume. This means that they require less water to flush out the trap 104-P, but they still require a flush with each use. Non-flushing urinals use the least amount of water, relying on one of two mechanisms to seal out gas and odor: the first is a mechanical means with a mechanical odor barrier and the second is a liquid trap with a lighter-than-wastewater liquid barrier.

The present invention is intended to overcome many of the shortcomings of the current systems, through a hybrid flushing system solution that uses only slightly more water than the non-flushing urinal, while delivering performance and ease of service comparable to the HEU or the traditional urinal. It accomplishes this by using the known gas sealing systems available in today's non-flushing urinals and combining them with the focused flushing and cleaning systems. This system also keeps the pipes clean and the valve or the trap mechanisms free from any clog and buildup by using efficient flushing and cleaning with little water use. Additionally, this focused flushing and cleaning lends itself well to existing technology for timed flushes, which means that the user never has to touch the urinal and will not override the system with waste-water. Furthermore, the placement of the focused flushing combined with the high pressure spray heads or increased velocity bring the power wash to critical areas adding even more efficiency in water use, while avoiding the buildup of lime, struvite, and other substances.

Accordingly, the present invention includes several aspects: a housing for a hybrid flushing system, a cartridge for a hybrid flushing system, and combination of a housing and a cartridge for a hybrid flushing system, and a method for cleaning a hybrid urinal system. Further, although the housing and cartridge may be formed as separate devices, one of skill in the art will appreciate that they could be formed integrally as well.

(2) Housing

Figure 2:
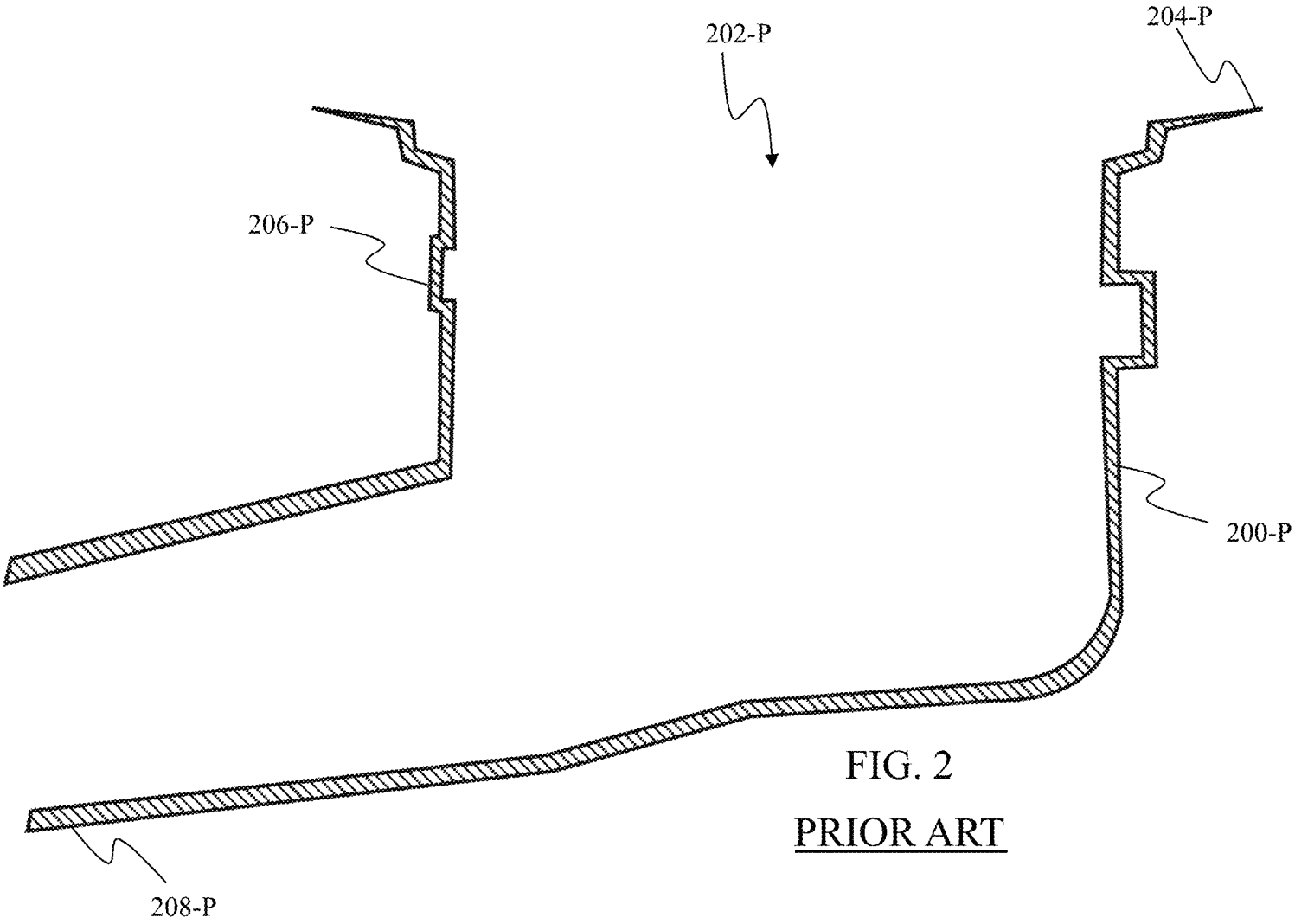
FIG. 2 PRIOR ART
FIG. 2 is an illustration of a cutaway side view of a prior art housing with a housing fluid interface on the side wall of the housing.

An example of a prior art housing for a water free urinal is show in a cutaway view FIG. 2. The housing includes a housing body 200-P with a cavity 202-P formed therein for receiving a cartridge (not shown). The housing also includes a housing flange 204-P, a housing locking mechanism 206-P, and a housing exit tube 208-P, through which fluids can exit the housing body 200-P to a building's plumbing (not shown). Due to the slow flow of fluids through this type of housing, buildup of precipitates is a significant concern.

Figure 3:
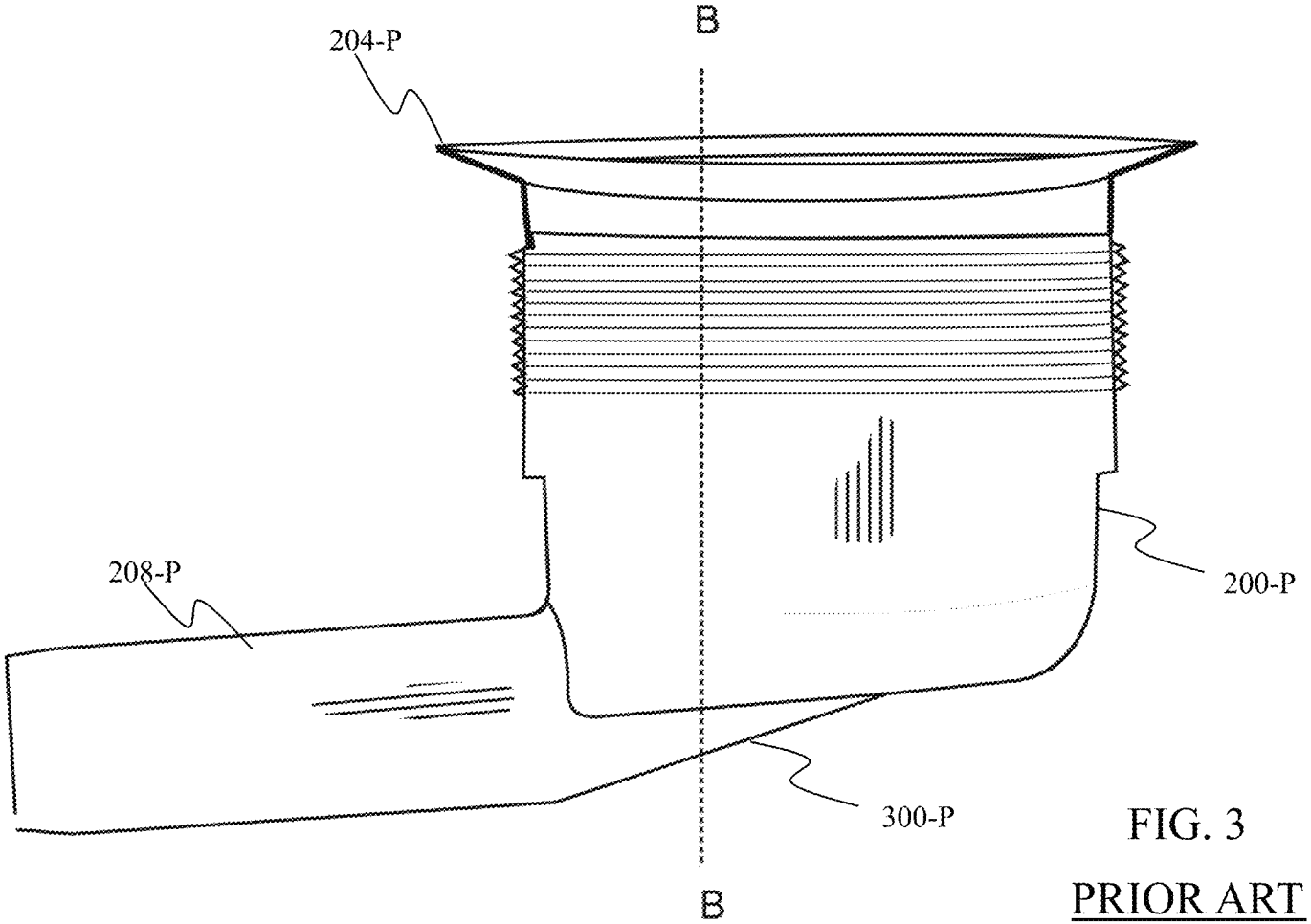
FIG. 3 PRIOR ART
FIG. 3 is an illustration of a prior art housing shown from the left side.

The prior art housing of FIG. 2 is shown in an external side view in FIG. 3. The external view of the housing body 200-P also shows the housing trough 300-P, which serves as a transition from the housing body to the housing exit tube 208-P.

Figure 4:
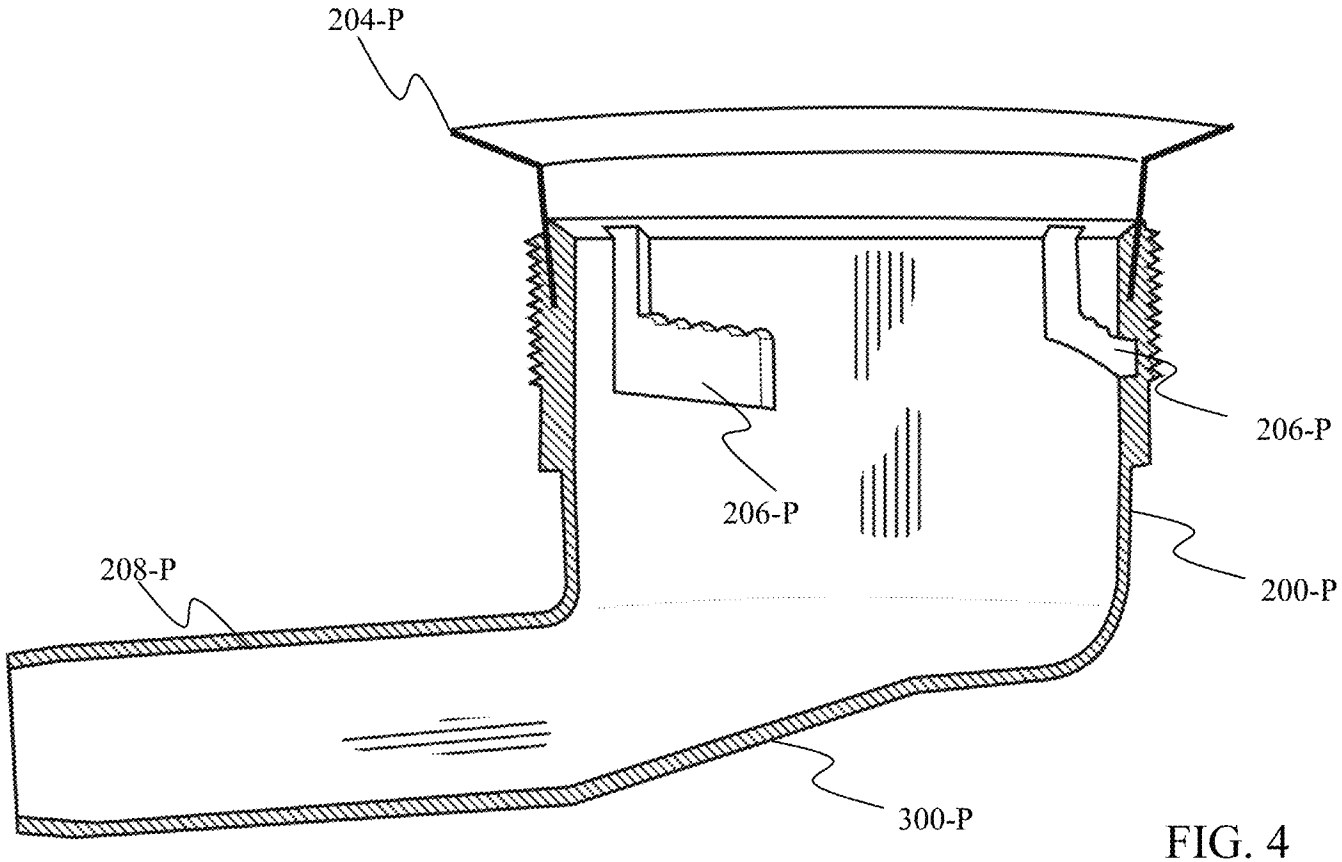
FIG. 4 PRIOR ART
FIG. 4 is an illustration of a prior art housing as seen in FIG. 3, here shown in a cross section.

Another side cross-sectional view of the prior art housing 200-P is presented in FIG. 4, where the housing locking mechanism 206-P is shown in greater detail.

Figure 5:
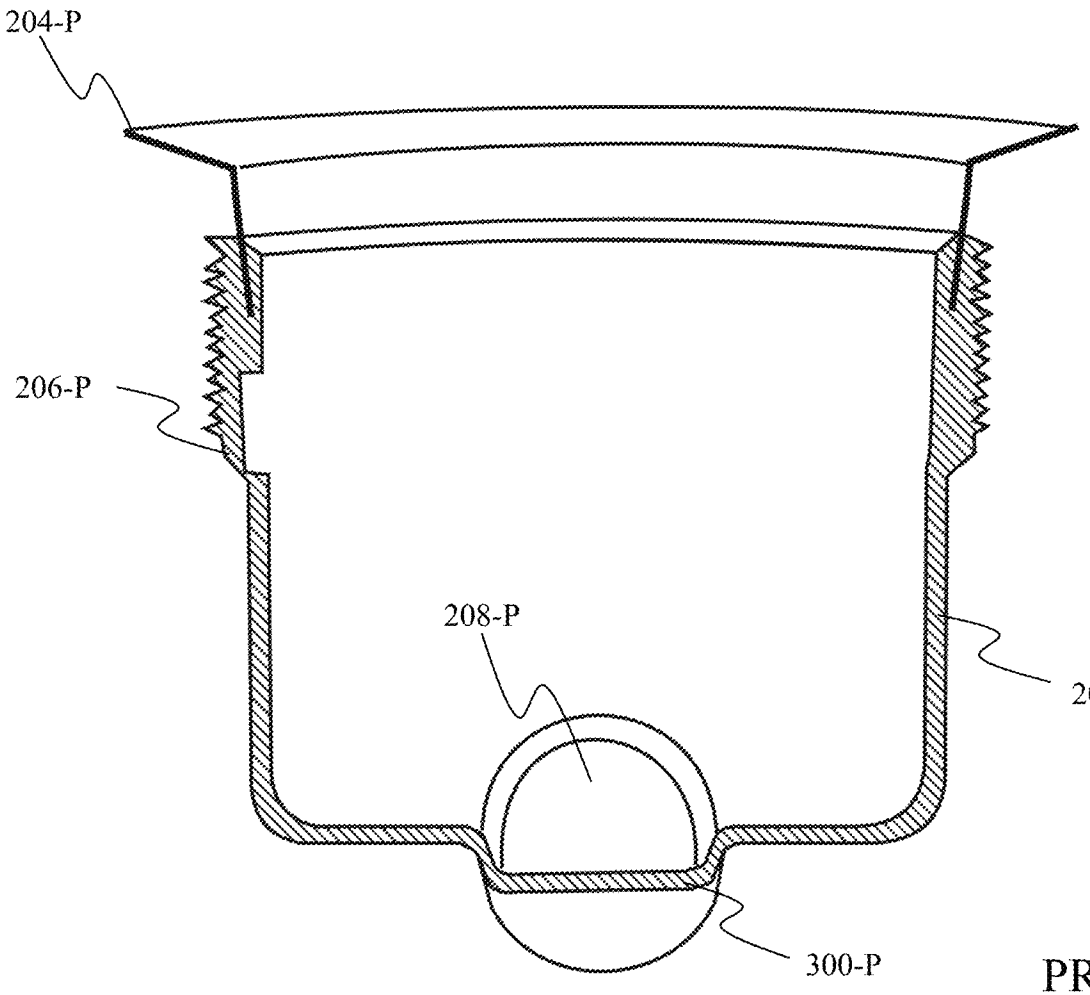
FIG. 5 PRIOR ART
FIG. 5 is an illustration of a prior art housing with a trough and a locking key way.

A front cross-sectional view of the prior art housing 200-P is presented in FIG. 5.

Figure 6:
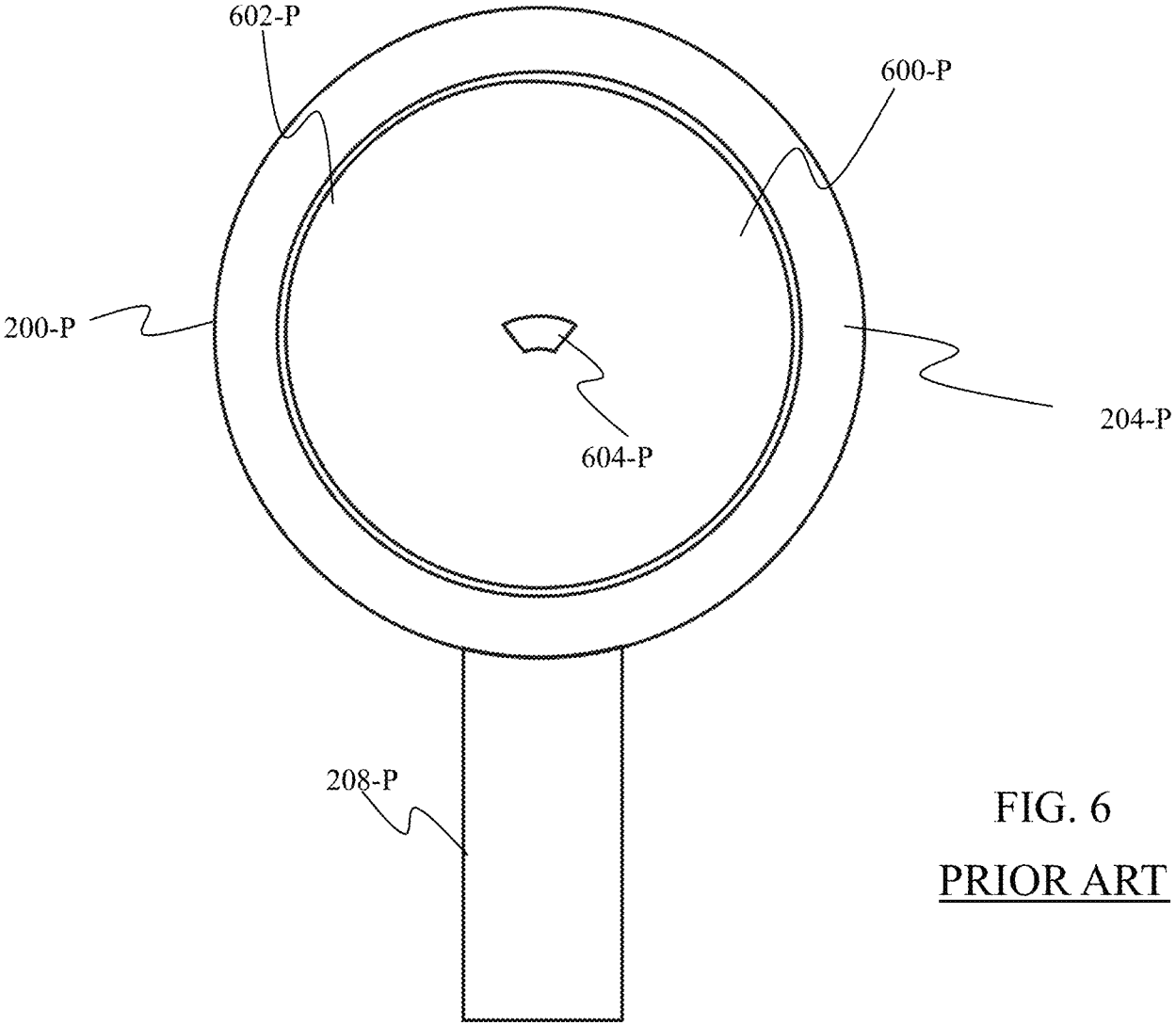
FIG. 6 PRIOR ART
FIG. 6 is a top view illustration of a prior art housing with an inserted cartridge.

A top view of the prior art housing 200-P is presented in FIG. 6 with a cartridge 600-P installed. A disc-shaped housing flange 204-P is shown as well as a top wall flange 602-P and inlet 604-P of the cartridge.

Figures 7A, 7B:
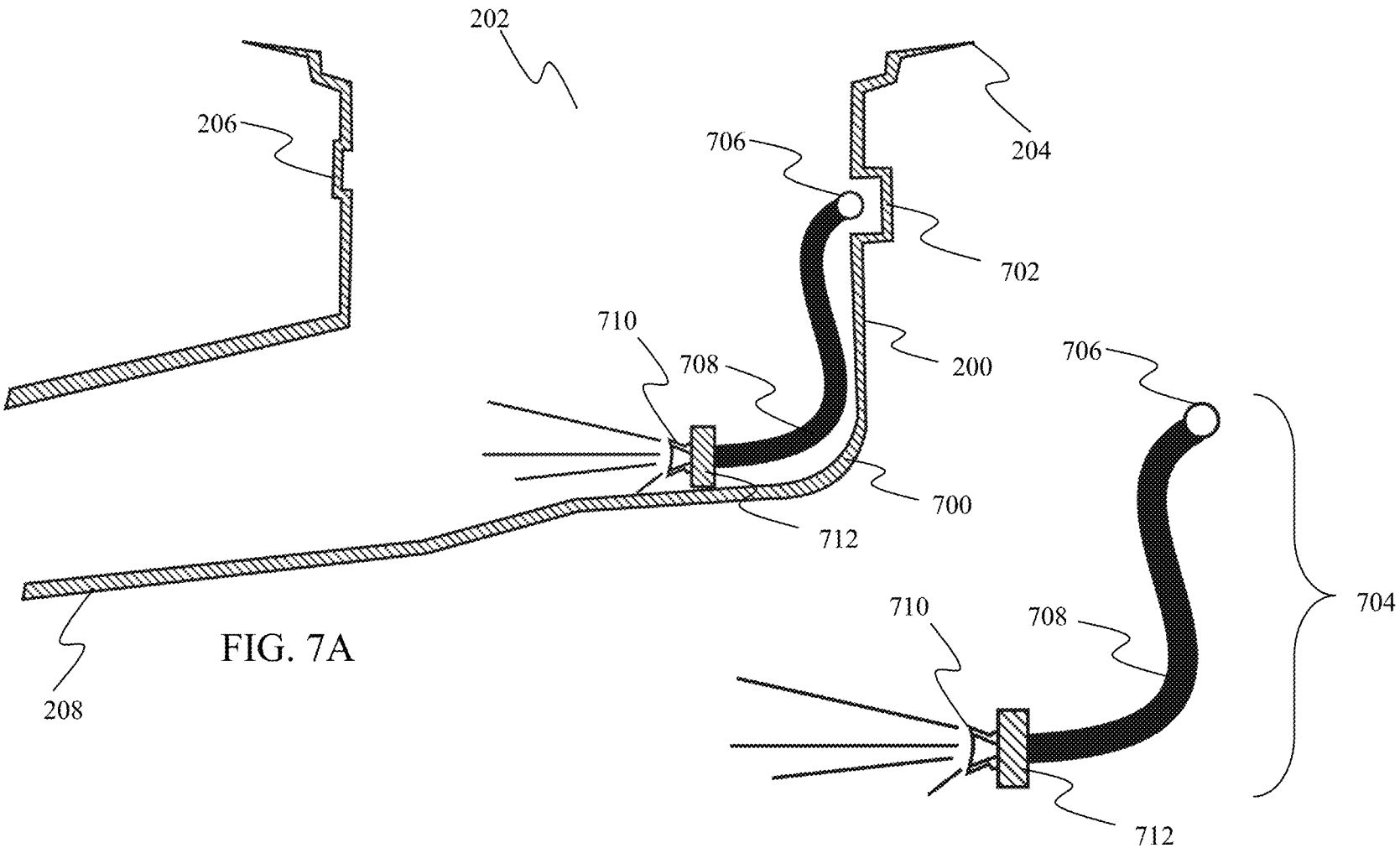
FIG. 7A is an illustration of a cutaway side view of a housing with a housing fluid interface on a side wall of the housing and a spray kit added so that a traditional cartridge can be used effectively, according to the present invention.
FIG. 7B is an illustration of a spray kit made of a self-clean mechanism for an adapting housing with a fluid feed to a spray clean model that can be used with a broad range of traditional water free valves, according to the present invention.
Figure 11B:
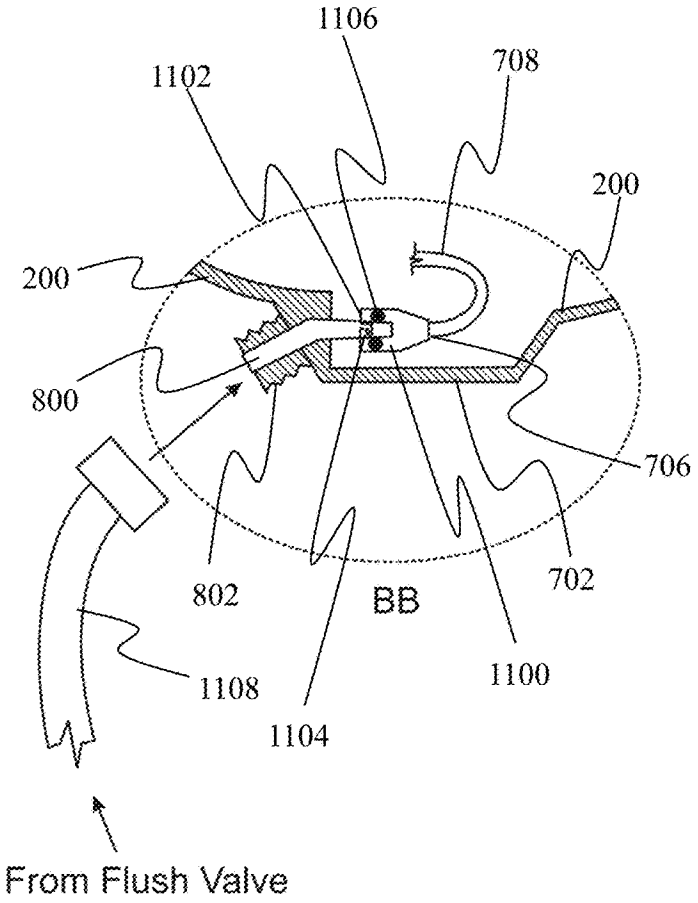
FIG. 11B is a blown-up detail of the connection of the self-cleaning mechanism and the housing at the housing fluid interface area as presented in FIG. 11A.
Figure 11A:
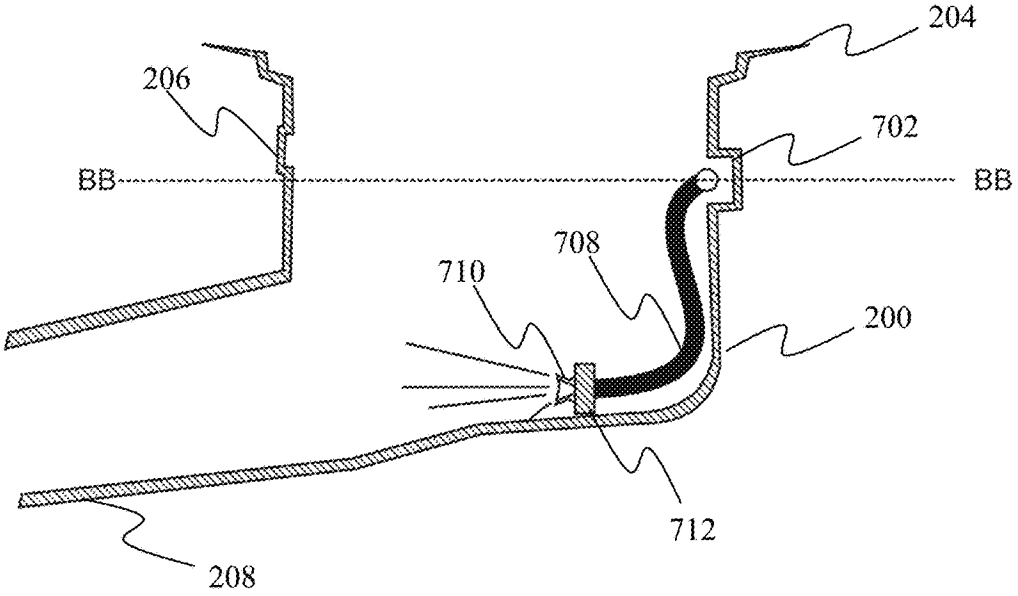
FIG. 11A is an illustration of a cutaway side view of a self-cleaning mechanism inserted in a housing, according to the present invention.

In order to eliminate buildup, a hybrid housing body 200 according to the present invention, and as shown in FIG. 7A may be used. The hybrid housing body 200 includes a wall portion 700 forming a cavity 202 for receiving a cartridge (not shown) therein. The hybrid housing body 200 also includes a housing flange 204, a housing locking mechanism 206, and a housing fluid interface 702. The housing fluid interface 702 may be formed at any desired location on the hybrid housing body 200 and serves to permit flushing fluids to pass to a self-clean kit 704, shown generally in FIG. 7B. The self-clean kit 704 comprises a fluid interface 706 for receiving a flushing fluid. Typically, water is used as the flushing fluid, though other cleaning fluids/ingredients may be used as well (chemical cleaning fluids and solid particulate additives being examples). As shown, the self-clean kit 704 further comprises a flushing fluid transfer tube 708 for carrying a flushing fluid to a flushing fluid directing portion 710, shown as a high pressure spray head in this particular example. The fluid directing portion 710 is held in place by a retainer clip 712 and may be directed in any manner desired. As a result, spray from the flushing fluid directing portion can be directed into the housing body 200 or through the housing exit tube 208 into connected plumbing as needed for cleaning and to eliminate precipitate buildup. Flushing fluid is received into the housing body 200 from a flushing fluid supply line external to the housing body 200 (as shown in FIGS. 11A and 11B).

A high pressure spray head is an advantage in most situations; however, it may be preferred in some instances to simply focus the flushing fluid rather than increasing the intensity of the flow. In these cases, the invention can be used as described but without the high pressure spray head. Further, the flushing fluid directing portion 710 can operate in any manner desired for shaping and directing the flushing fluid spray. Additionally, the flushing fluid directing portion 710 can be located in a variety of places, such as near the housing exit tube 208, adjacent the building's drainage pipe or further within the trap (these examples will be illustrated further below (see, e.g., FIGS. 79, 80A-80C, and 81A-81C)).

Gravity fed low pressure systems are also contemplated by the present invention. In these cases, rather than saving water by making the cleaning process more efficient through the use of pressure, or shape of spray, a higher volume used in a less frequent manner can be applied. Here, pipes, in particular those of existing and older buildings, can receive the volume of water they were designed to take to carry the waste away, a process known by those skilled in the art as line carry. However, this volume can be introduced on a timed/periodic basis; allowing the urinal to operate water-free between flushes to save water. This type of volume flush can be combined with a focusing and aiming of the water to add efficiency.

Figure 8:
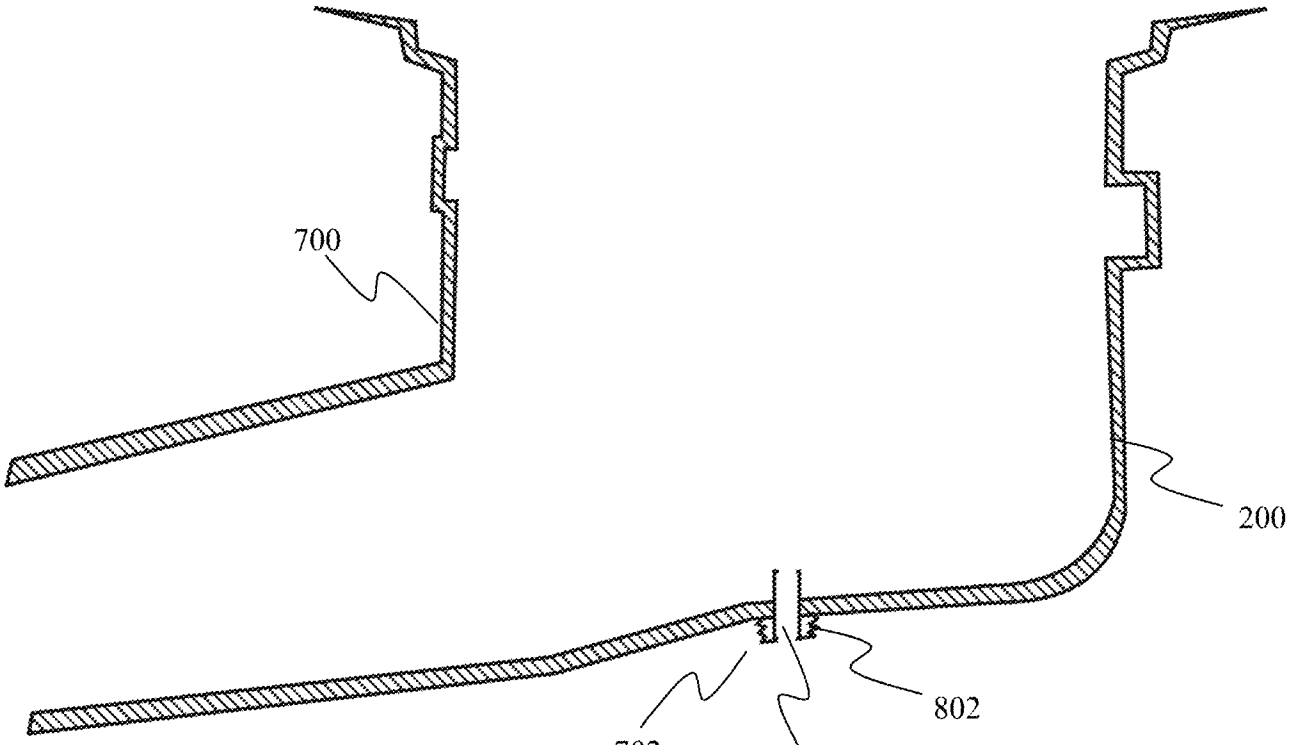
FIG. 8 is an illustration of a cutaway side view of a housing with a housing fluid interface on the bottom wall of the housing, according to the present invention.

Another example of a hybrid housing body 200 is shown in a cutaway view in FIG. 8. In this case, rather than being formed on the side of the wall portion 700, as was shown in FIG. 7, the housing fluid interface 702 is formed on a bottom portion of the hybrid housing body 200. In this example, the housing fluid interface 702 includes a (male) supply 800 and a supply fitting 802. Although the supply fitting 802 is depicted as a set of threads, any desired connecting mechanism may be used.

Figure 9:
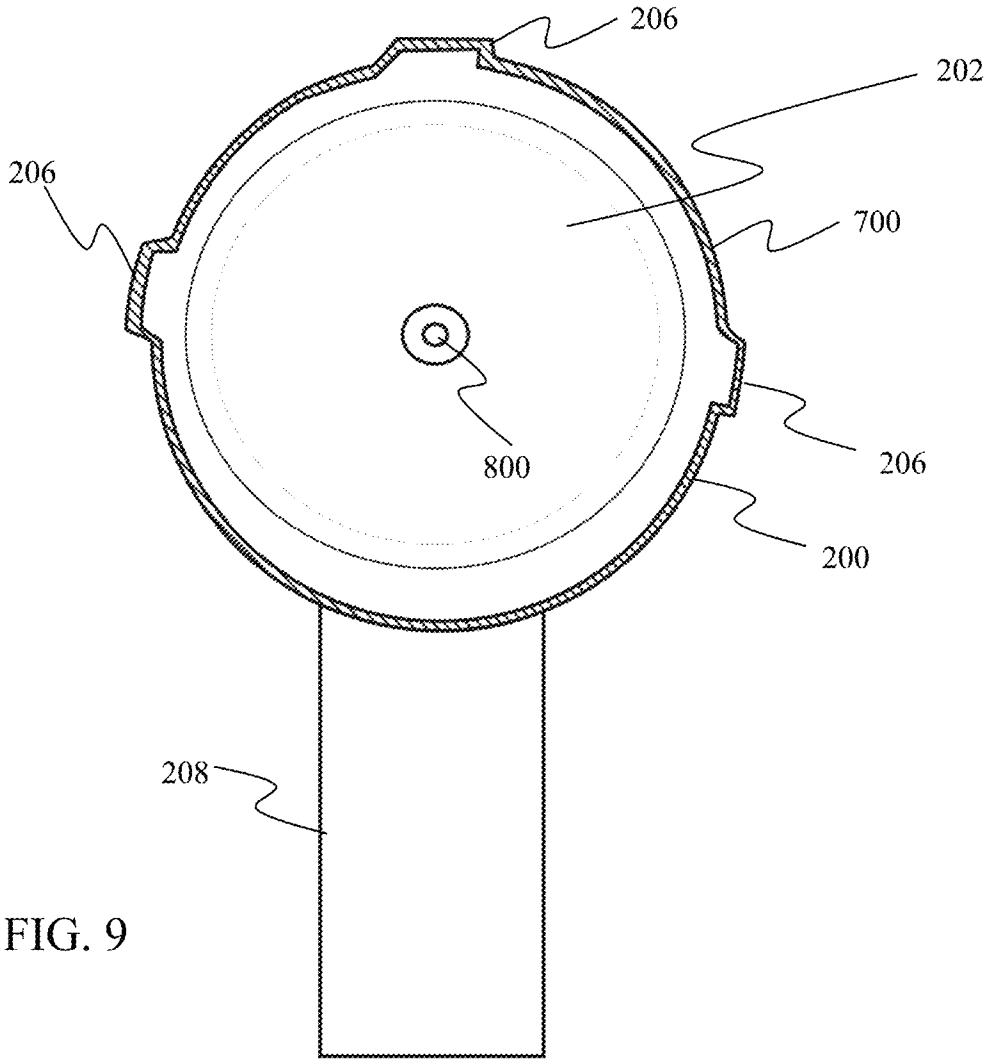
FIG. 9 is an illustration of a cutaway top view of a housing with a fluid interface on a bottom wall of the housing, according to the present invention.

A top view of the hybrid housing body 200 presented in FIG. 8 is shown in FIG. 9. In this particular view, the housing locking mechanisms 206 are disposed about the wall portion 700 to assist in retaining a cartridge (not shown) when placed within the cavity. The housing fluid interface 702 is shown in the form of a (male) supply 800 as was depicted in FIG. 8. It is important to note that although a male supply 800 is presented for these examples, it is merely intended to be a non-limiting example of potential housing fluid interface 702 designs.

Figure 10:
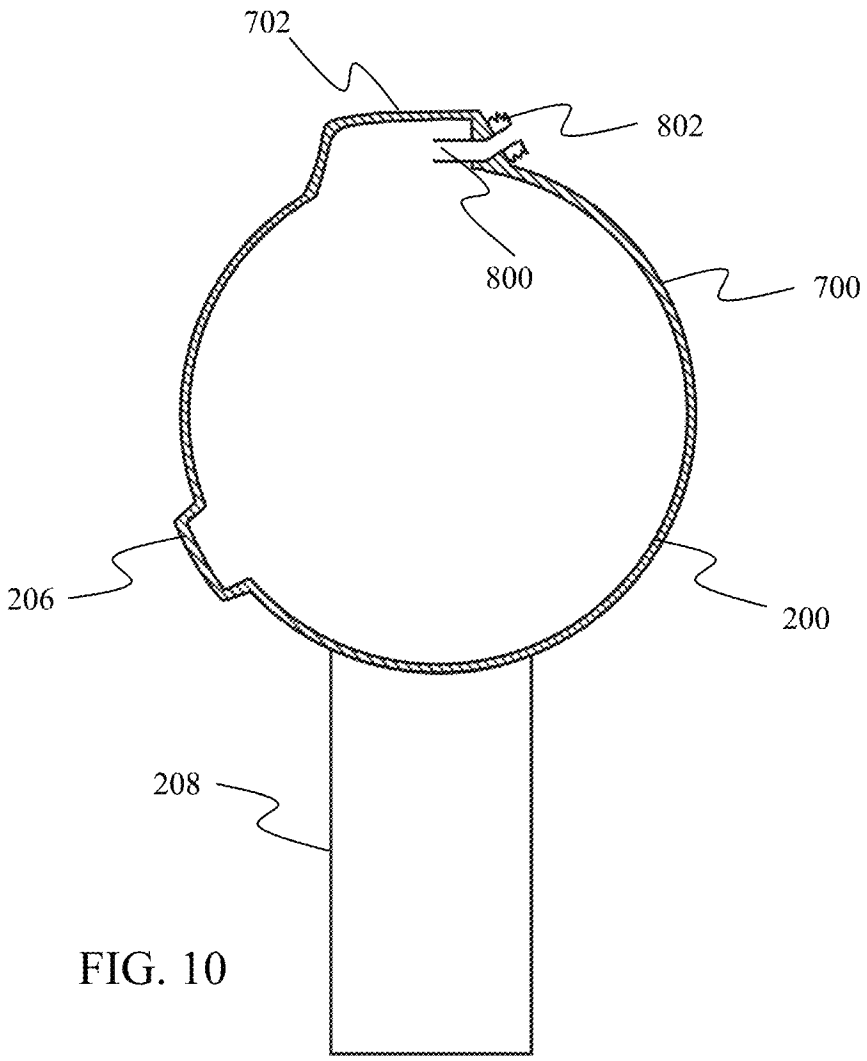
FIG. 10 is an illustration of a cutaway top view of a housing with a fluid interface on a side wall of the housing, according to the present invention.

A cutaway top view of another non-limiting example of a hybrid housing body 200 is presented in FIG. 10. In this case, the fluid interface 702 is formed as a male supply 800 and a supply fitting 802 and disposed directly on the side of the wall portion 700 of the hybrid housing body 200.

A cutaway side view of the self-cleaning mechanism inserted into a hybrid housing body 200 is presented in FIG. 11A, with a blown-up detail of the connection of the self-cleaning mechanism and the hybrid housing body 200 at the housing fluid interface 702 shown in FIG. 11B. This is essentially the same configuration shown in FIGS. 7A and 7B, but now presented in greater detail.

In the detail view shown in FIG. 11B, a connector fitting 1100 has been slid over a male supply line 800. The male supply line 800 is disposed with a locking pin 1102 which holds the connector fitting 1100 from being blown-off due to water pressure forcing the male supply line 800 and the connector fitting 1100 apart. The connector fitting 1100 has a locking slot 1104, which is shaped generally in an "L" configuration, so that when it is put on to the male supply line 800, the locking slot 1104 is aligned with the locking pin 1102. The connector fitting 1100 is then further slid on to the male supply line 800 so that the locking pin 1102 slides as deeply into the locking slot 1104 as possible, before the connector fitting 1100 is twisted leaving the locking pin 1102 at the extreme end of the L-shaped locking slot 1104. The connector fitting 1100 is integrally connected with a flushing fluid transfer tube 708. An O-ring 1106 helps create a substantially water tight seal between the male supply line 800 and the flushing fluid transfer tube 708. This allows the water, which has come through the supply line 1108 and into the male supply line 800, to pass into the flushing fluid transfer tube 708 while maintaining pressure, which is then transferred all the way to the flushing fluid directing portion 710 (shown in FIG. 11A), which can be positioned and aimed using a retainer clip 712 or through any mechanical means, non-limiting examples of which include gravity, press fit, adhesive, hardware, and welds. Thus, the hybrid housing body 200 can be used with any traditional water-free urinal cartridge and still provide focused, high pressure cleaning directed strategically to clean areas that are prone to the buildup—which have previously been described. This same general configuration can be used for mechanical cartridges as depicted below in FIGS. 37, 39, 41, 70, 71, and 80A-80C.

It is important to note that many of the ideas presented in this section are also applicable to a cartridge (either mechanical or liquid trap types) to be disposed within the hybrid housing body 200. FIG. 11B shows a cartridge fluid interface 706 whereby fluid may be passed through the hybrid housing body 200 and into a cartridge (not shown).

Figures 12A, 12B:
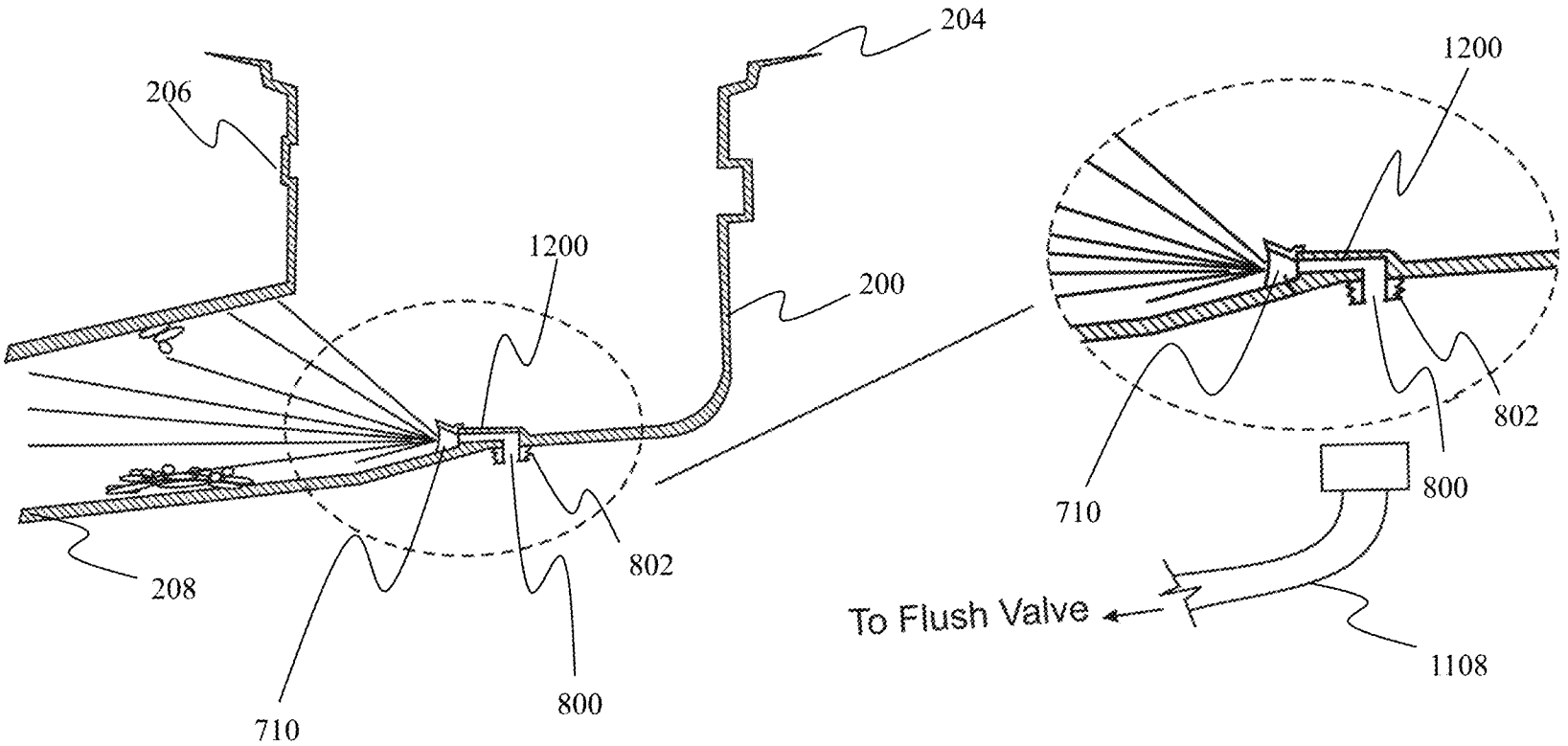
FIG. 12A is an illustration of a cross section of a housing that has a built-in high pressure spray head, according to the present invention.
FIG. 12B is a blown-up detail of the area of the high pressure head of FIG. 12A.

A cross section of a hybrid housing body 200 with a built-in high pressure spray head 710 (as the flushing fluid directing portion) is shown in FIGS. 12A and 12B. The hybrid housing body 200 has a built-in fluid channel 1200 and a male supply line 800. Flushing fluid enters through the male supply line 800 and is transferred to a flushing fluid directing portion 710 through the built-in fluid channel 1200.

Figure 13:
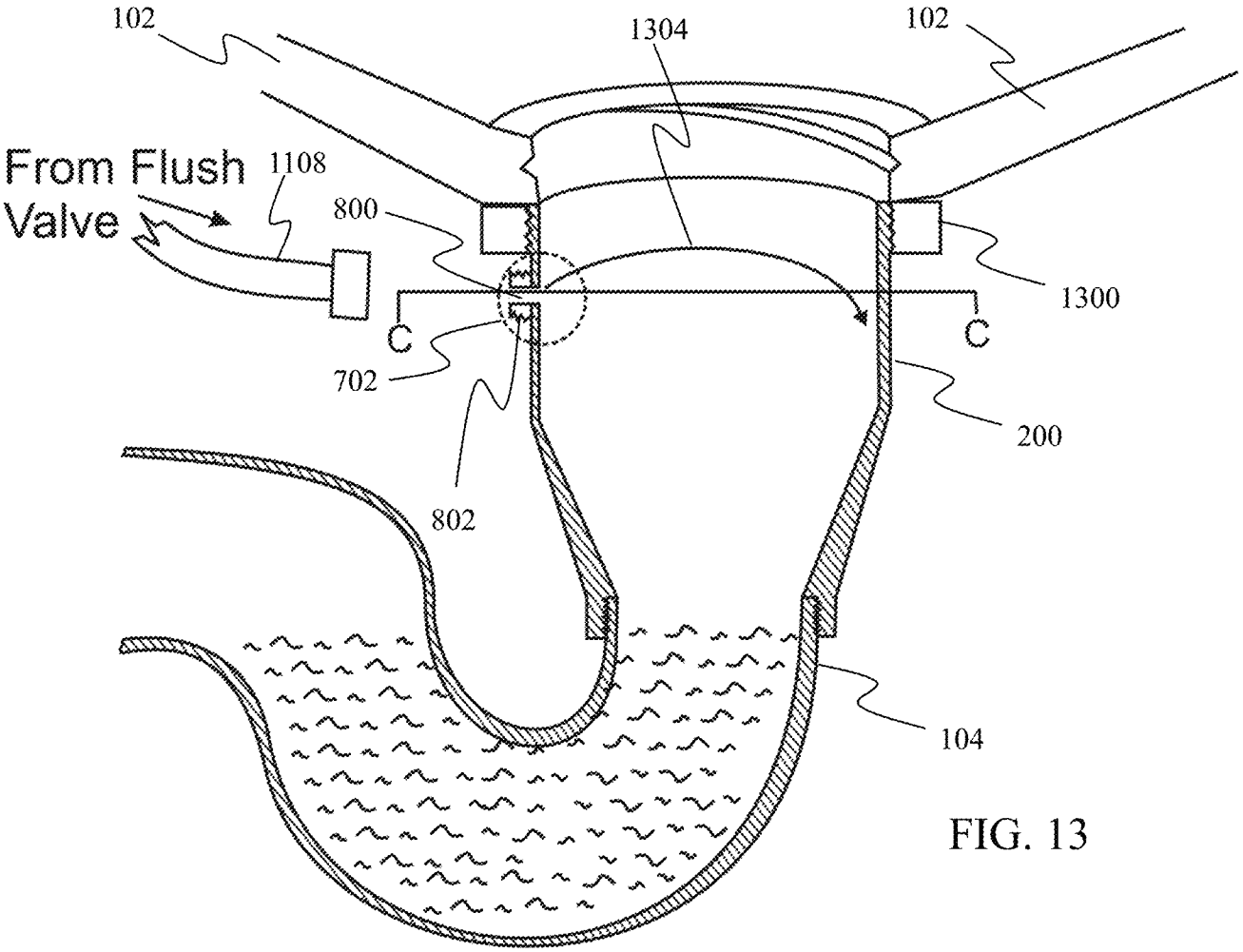
FIG. 13 is an illustration of a hybrid flushing system without a cartridge inserted, according to the present invention.

A hybrid housing body 200 connected with a porcelain urinal 102 and a trap 104, but without a cartridge inserted, is shown in FIG. 13. The hybrid housing body 200 is connected with the porcelain urinal 102 by use of a locking nut 1300. Here, an arrow 1304 shows how the flushing water will enter the hybrid housing body 200 in a tangential fashion so that it swirls. This is a benefit to a cleaning staff when they replace the cartridge.

Figure 14:
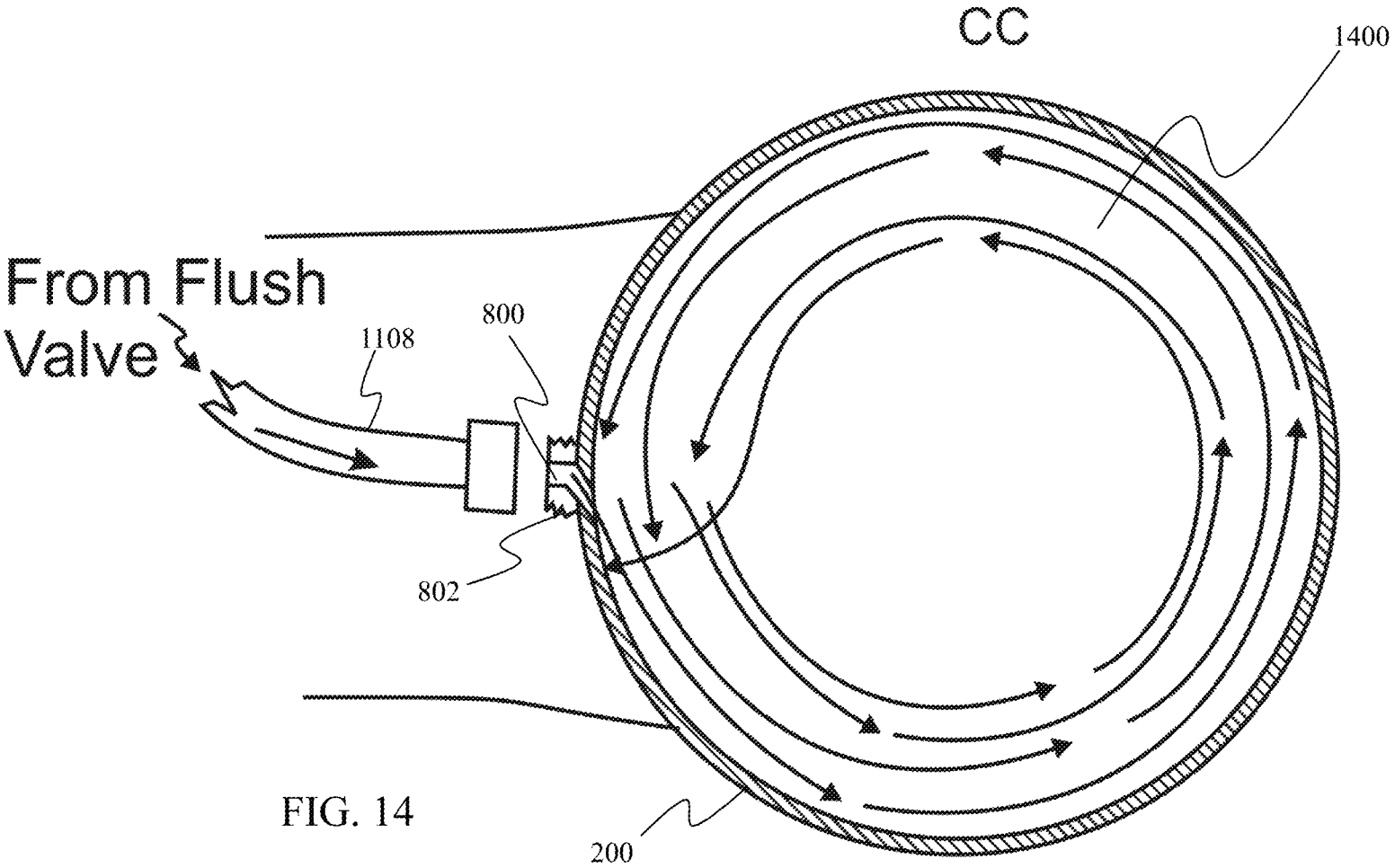
FIG. 14 is an illustration of a cross section (through line CC seen in FIG. 13) of a housing with no cartridge inserted and with the arrows indicating the flow of water into the housing swirl where no cartridge is present, according to the present invention.

A cross section taken through line CC in FIG. 13 is shown in FIG. 14. The flushing water enters the housing body 200 through the channel tangent with the housing wall so that it swirls (as indicated by swirling lines 1400) rather than sprays directly across or up in the air or out of the urinal, should the cartridge be removed when the urinal is flushed.

Figure 15:
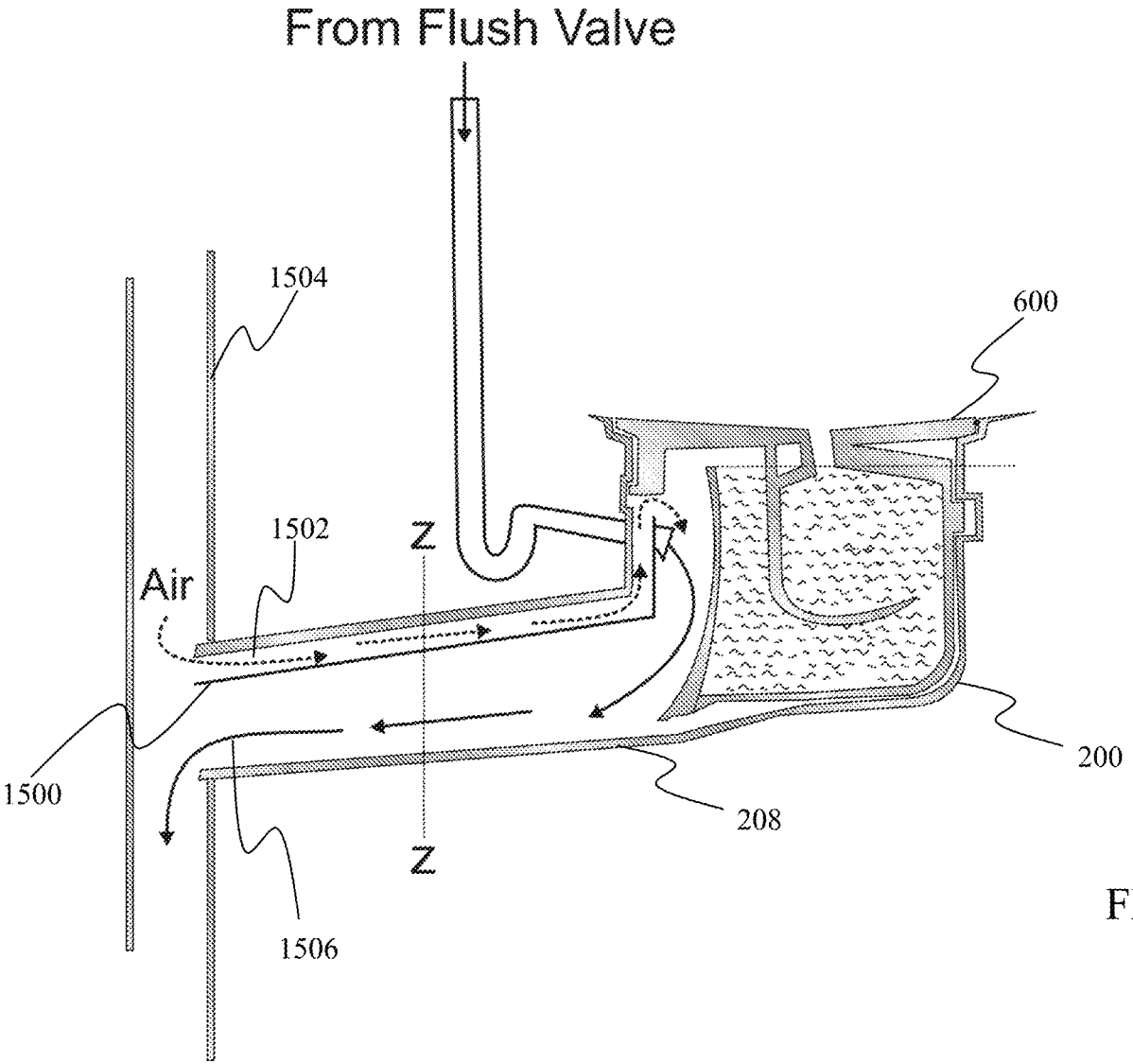
FIG. 15 is an illustration of a cutaway side view of a housing with a vent added to the housing exit tube allowing communication of air (depicted with dashed lines) from the housing to the building plumbing's vent, according to the present invention.

A hybrid housing body 200 is shown in FIG. 15 with a vent 1500 added to the housing exit tube. The vent 1500 allows the communication of air (shown with dashed arrows 1502) from the housing to the building's plumbing vent 1504. Thus, if the water, the urine, or the combination of the two, flows through the housing exit tube 208 (shown with solid arrows 1506) in such a manner to create a siphon, the air can be drawn in through the vent 1500. In use, fluid flows out of the housing exit tube 208 and into building plumbing while the air is free to flow through the plumbing vent 1504. In this manner, there is no negative pressure or siphon formed on the cartridge 600. This avoids the cartridge fluid barrier being siphoned down the building plumbing.

Figure 16:
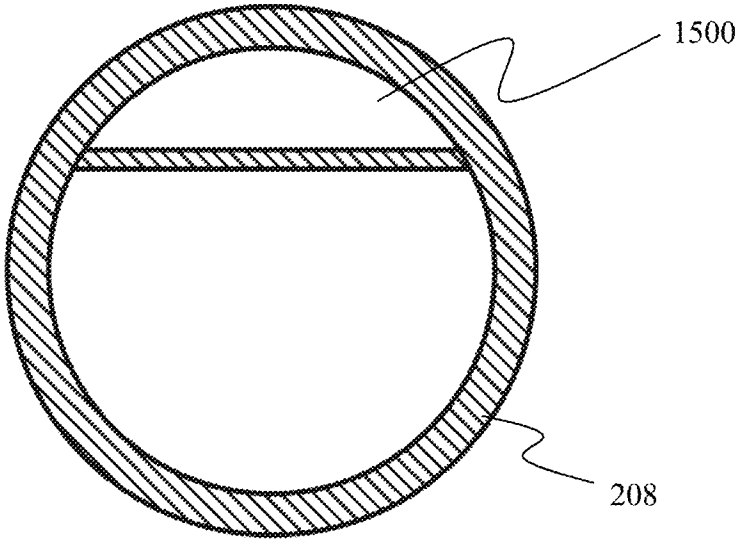
FIG. 16 is an illustration of a cross section of an exit tube from a housing, where the exit tube has a built-in or an attached vent to allow communication of air into housing even when the exit tube has large flows, according to the present invention.

A cross section of the housing exit tube 208 taken along line ZZ in FIG. 15 is shown in FIG. 16. The exit tube 208 has a built-in or an attached vent 1500 to allow the communication of air into the housing even when the exit tube 208 has large flows capable of creating a siphon.

(3) Cartridge

Figure 17:
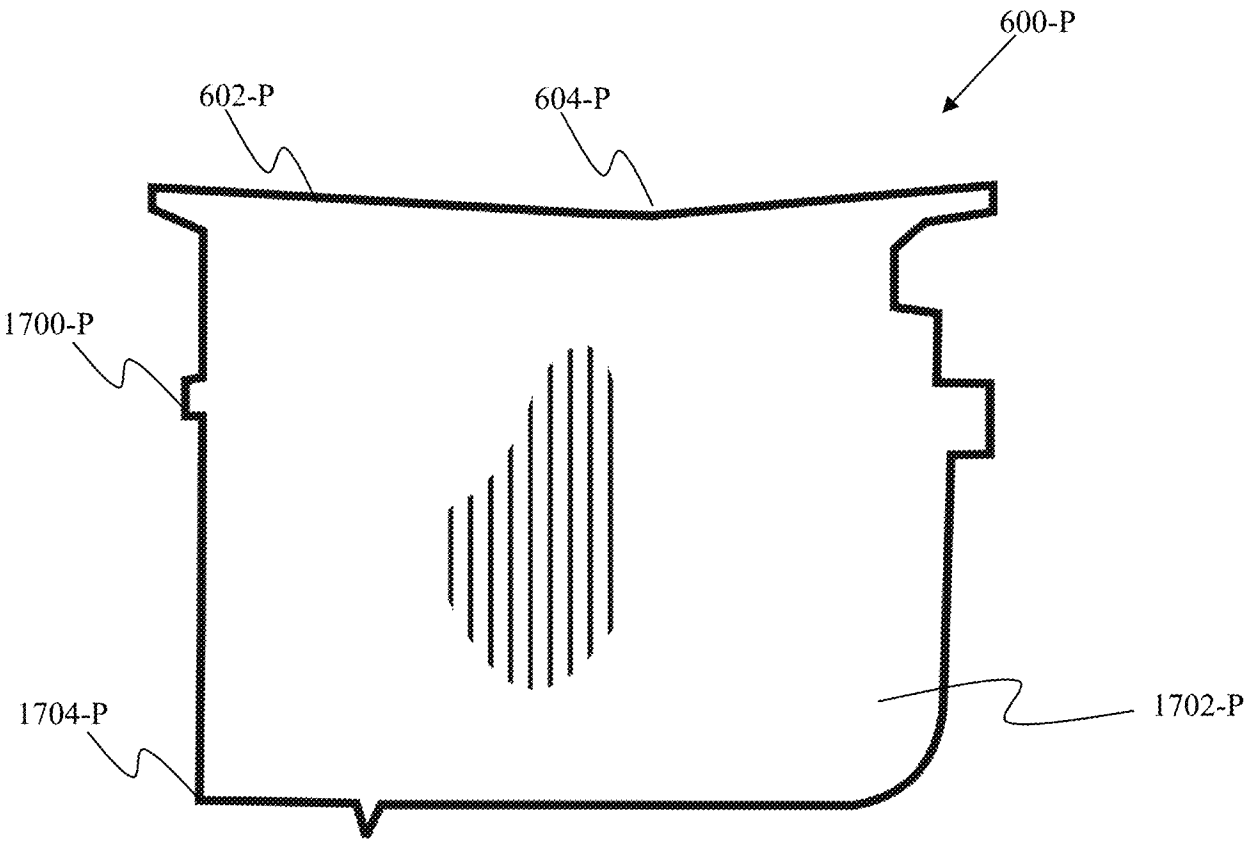
FIG. 17 PRIOR ART
FIG. 17 is an illustration of a prior art cartridge shown from the left side where an exit is shown at the lower left and an inlet is shown at the top center.
Figure 18A:
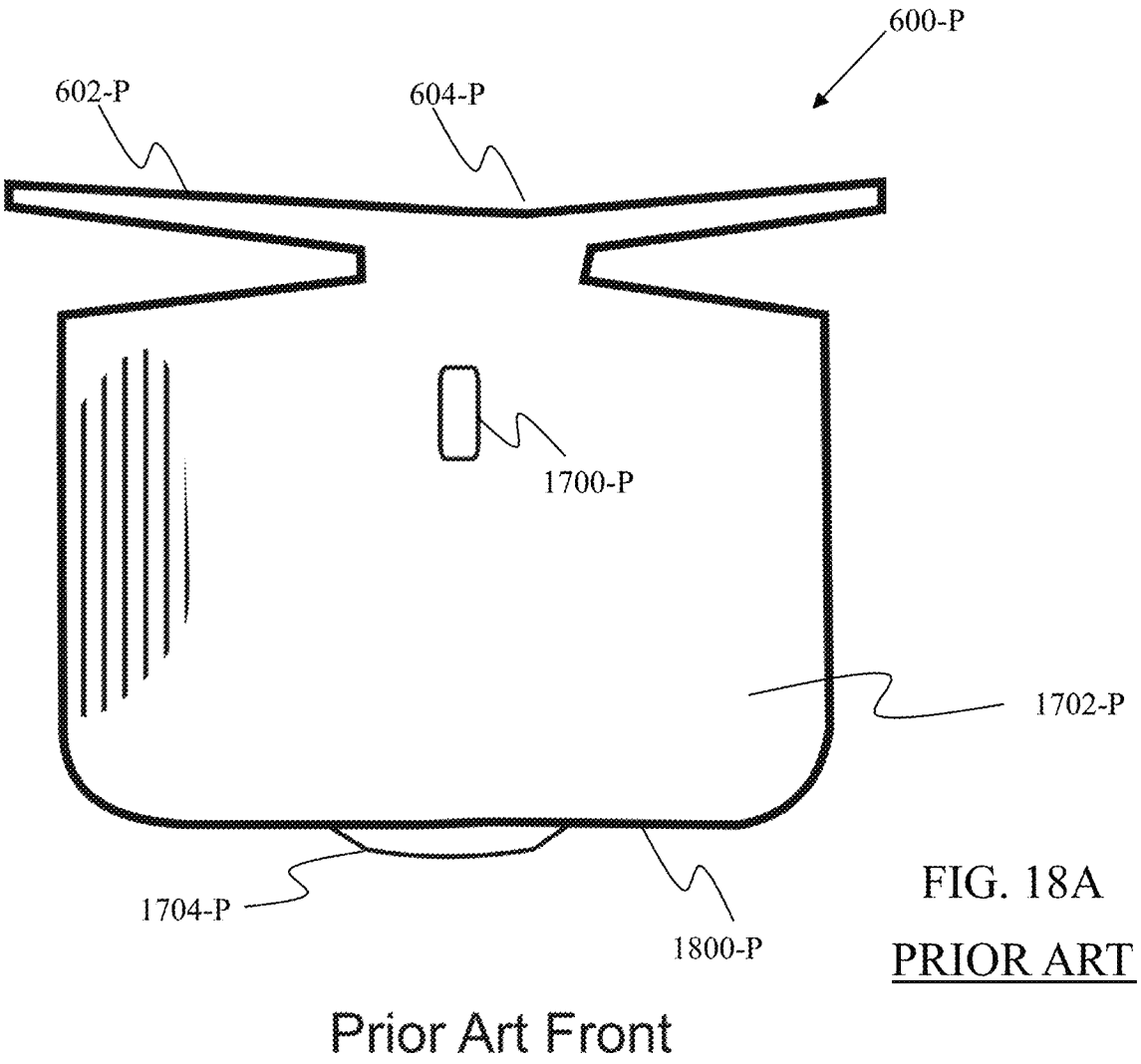
FIG. 18A PRIOR ART
FIG. 18A is an illustration of a prior art cartridge shown from the front where an exit is shown at the bottom center and an inlet is shown at the top center.
Figure 18B:
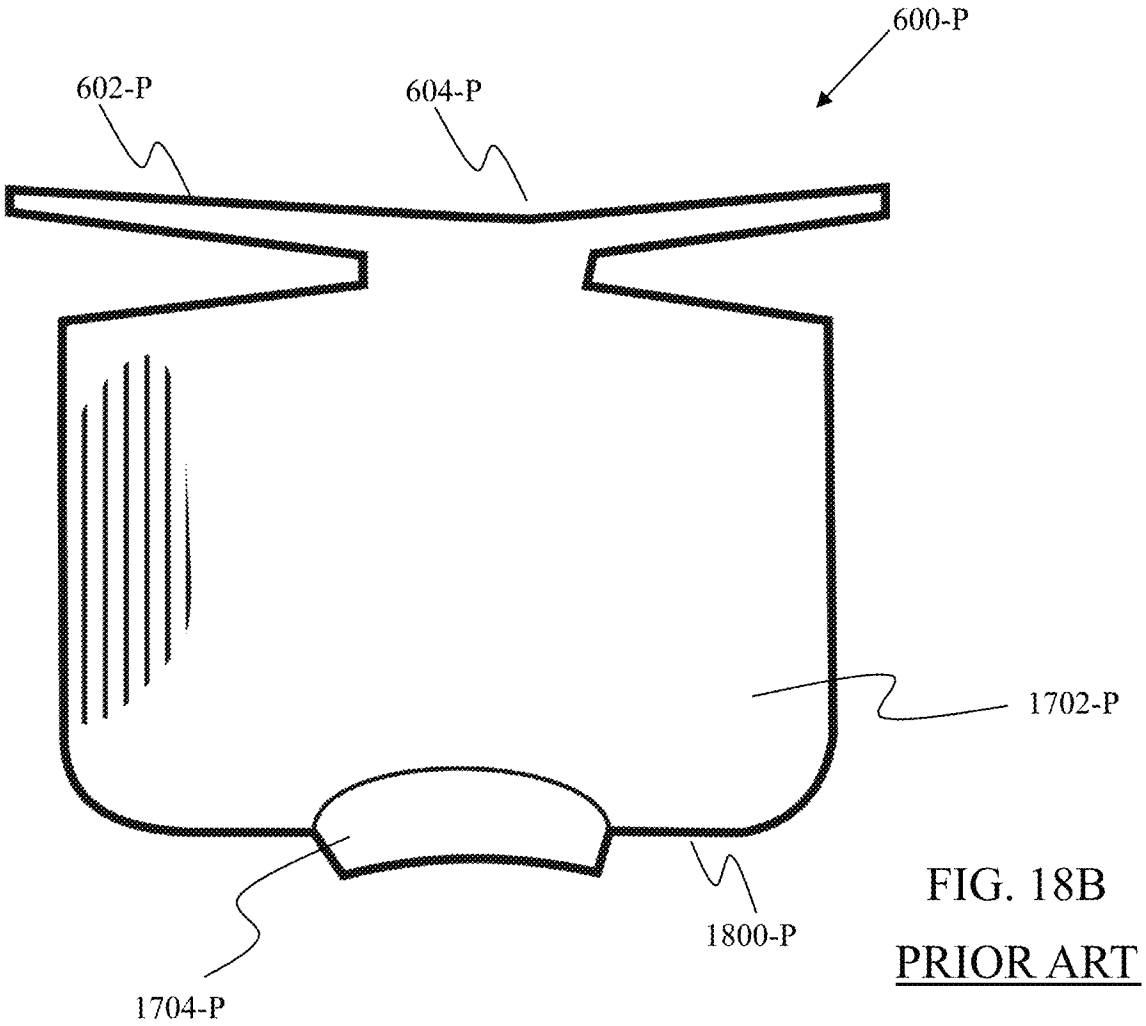
FIG. 18B PRIOR ART
FIG. 18B is an illustration of the prior art cartridge of FIG. 18A shown from the back where an exit is shown at the bottom center and an inlet is shown at the top center.

Many of the general ideas used in the hybrid housing body 200 just presented are applicable to cartridges for use in hybrid urinals. For reference, a prior art cartridge 600-P is presented in left view in FIG. 17, in front view in FIG. 18A, and in rear view in FIG. 18B. The cartridge 600-P includes a top wall flange 602-P, a cartridge inlet 604-P, and a locking tine 1700-P for retaining the cartridge 600-P within the prior art housing body 200-P. Also shown are the cartridge side wall 1702-P, the cartridge exit 1704-P, and the cartridge bottom wall 1800-P.

Figure 19:
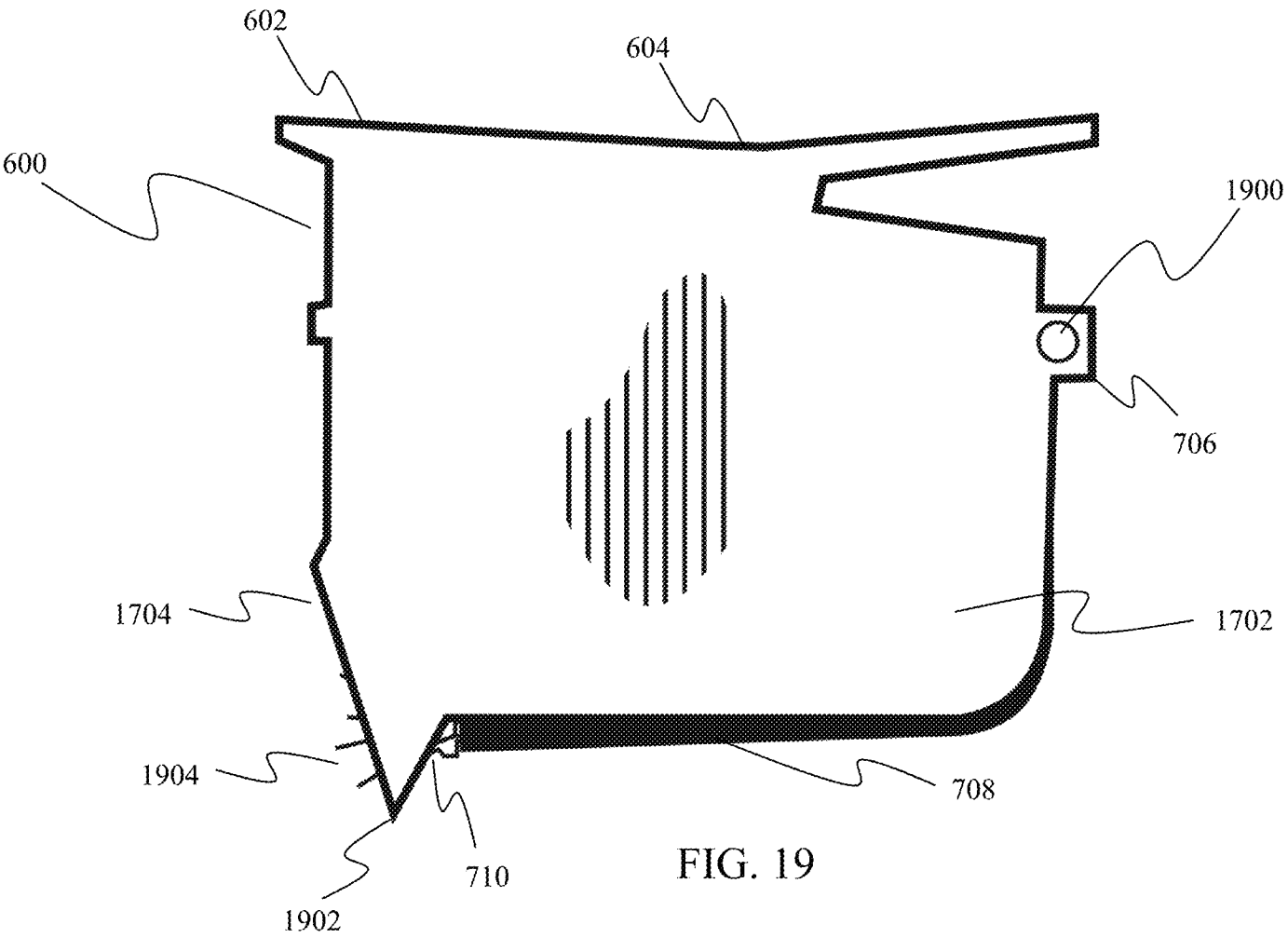
FIG. 19 is a side view illustration of a cartridge with an under-mount self-clean mechanism and a spray focused on a housing exit tube, according to the present invention.

A cartridge 600 according to the present invention is shown in FIG. 19. The cartridge includes a top wall flange 602 to interface with a housing 200 according to the present invention. A urine inlet 604 is provided to allow for urine to enter the cartridge 600. A flush fluid receiving portion 1900 is provided proximate a cartridge fluid interface 706 which interacts with the housing 200 to create a fluid-tight seal. As shown in this example, the flush fluid receiving portion 1900 and the cartridge fluid interface 706 are formed on a side wall 1702 of the cartridge 600. However as will be appreciated by one of skill in the art, the flush fluid receiving portion 1900 and the cartridge fluid interface 706 may be formed on any desired part of the cartridge 600. The flushing fluid receiving portion 1900 is connected with a flushing fluid transfer tube 708 that transfers flushing fluid to a flushing fluid directing portion 710 (in this case, depicted as a high pressure spray head) for dispersal (in this case) as a high pressure spray 1904. In this case, the flushing fluid directing portion 710 resides near the exit drip edge 1902 of the exit of the cartridge 600.

Figure 20:
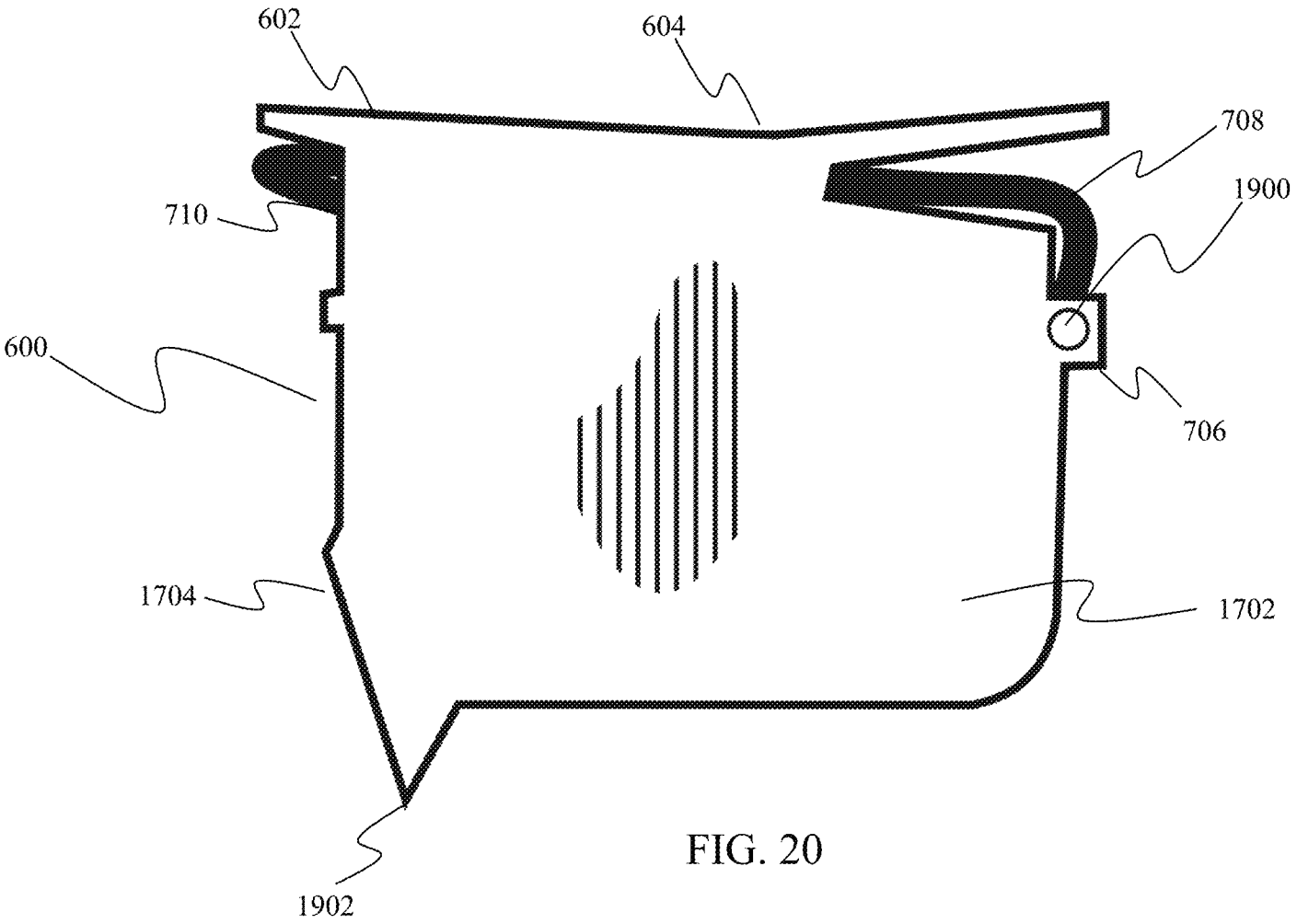
FIG. 20 is a side view illustration of a cartridge with a side mount self-clean mechanism and a spray focused on a discharge section, according to the present invention.

A side view illustration of a cartridge with a side mount self-clean mechanism is shown in FIG. 20. The self-clean mechanism includes a flushing fluid transfer tube 708 in fluid-tight communication with a flushing fluid receiving portion 1900 to transfer flushing fluid from the flushing fluid receiving portion 1900 to a flushing fluid directing portion 710 (such as a high pressure spray head), occluded from view in this illustration.

Figure 21:
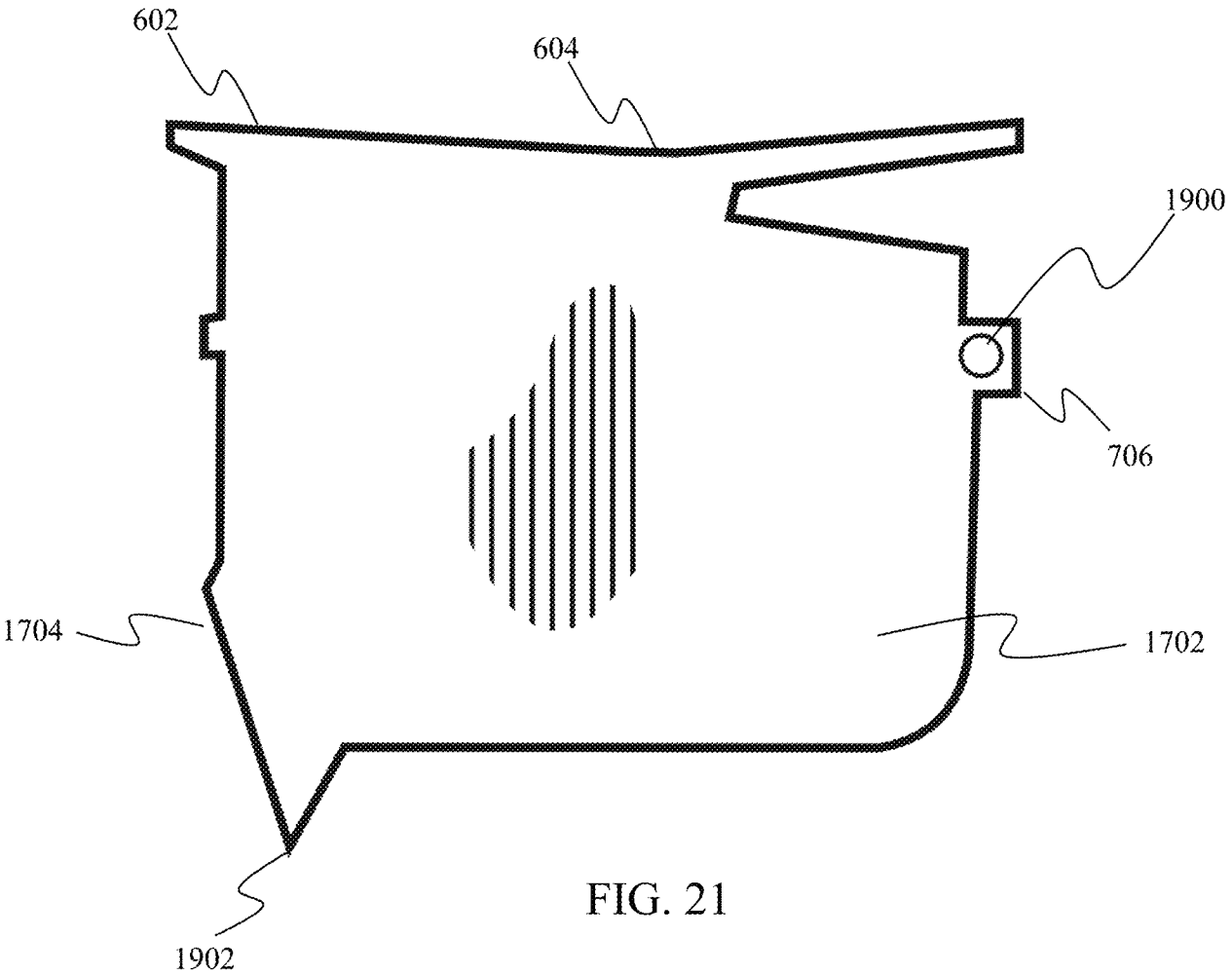
FIG. 21 is a side view illustration of a cartridge with an internal self-clean mechanism, according to the present invention.

A side view illustration of a cartridge with an internal self-clean mechanism according to the present invention is presented in FIG. 21. The exposed portions of the self-clean mechanism are the flushing fluid receiving portion 1900 and the cartridge fluid interface 706.

Figure 22:
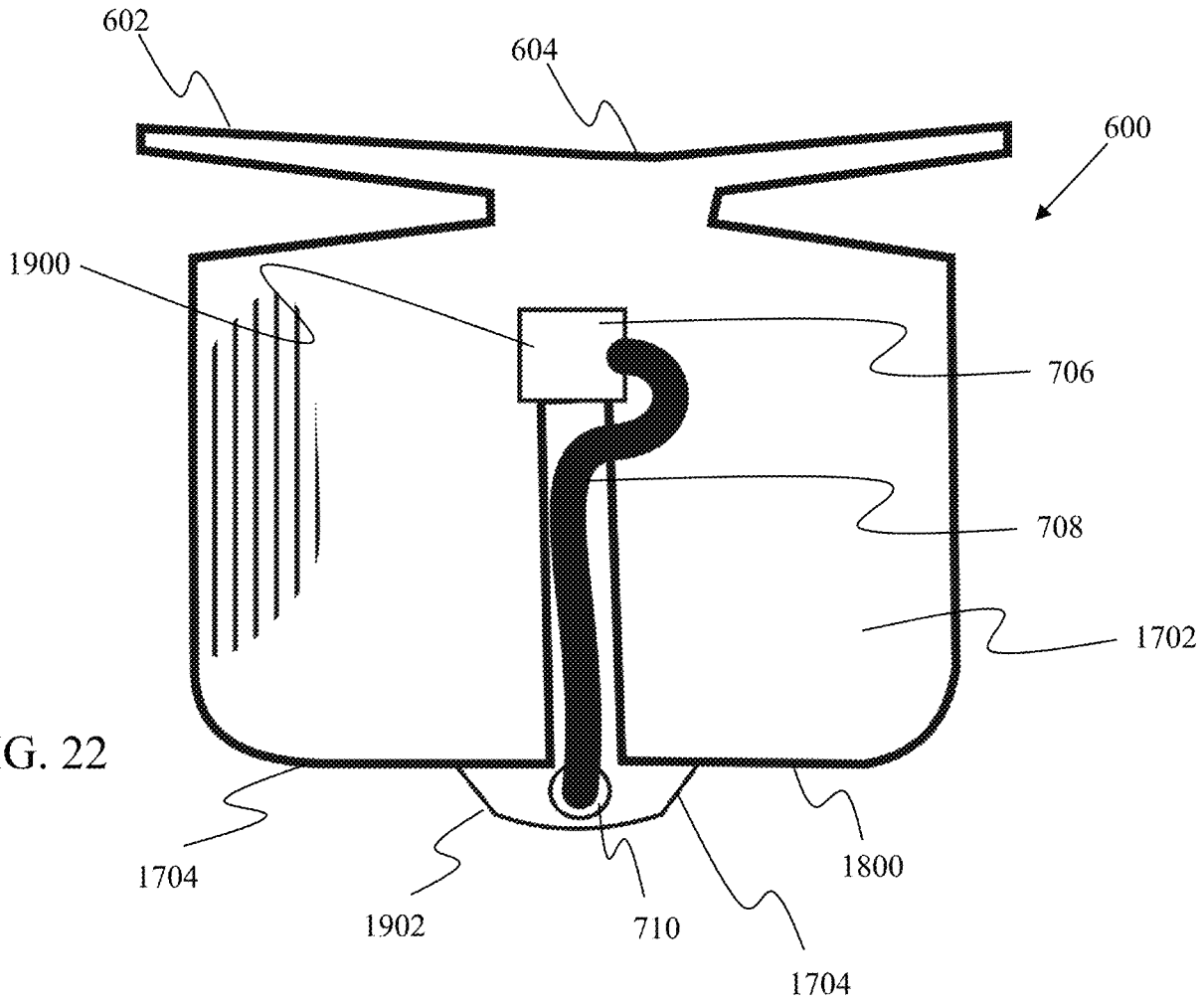
FIG. 22 is a front view illustration of a cartridge with an under-mount self-clean mechanism and a spray focused on a housing exit tube, according to the present invention.

A front view illustration of a cartridge with an under-mount self-clean mechanism and a spray focused on a housing exit tube according to the present invention is presented in FIG. 22. In this case, the flushing fluid transfer tube 708 resides externally with respect to the cartridge 600 and provides flushing fluid to the flushing fluid directing portion 710 on the bottom wall 1800 of the cartridge 600 proximate the exit 1704 of the cartridge 600.

Figure 23:
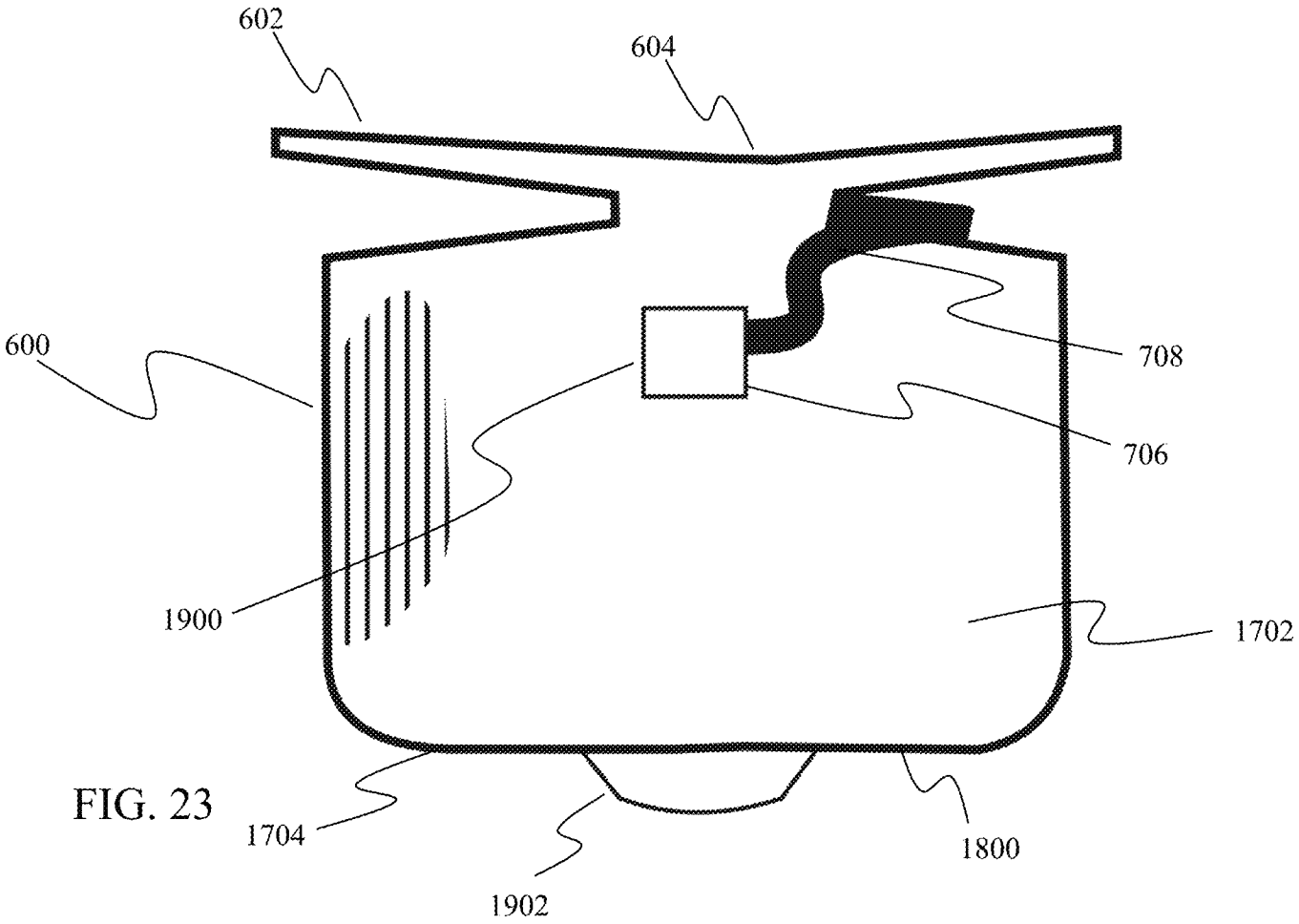
FIG. 23 is a front view illustration of a cartridge with an internal self-clean mechanism focused on a discharge section, according to the present invention.

A front view illustration of a cartridge 600 with an internal self-clean mechanism focused on a discharge section according to the present invention is presented in FIG. 23. In this case, the flushing fluid transfer tube 708 transfers flushing fluid into the interior of the cartridge 600.

Figure 24:
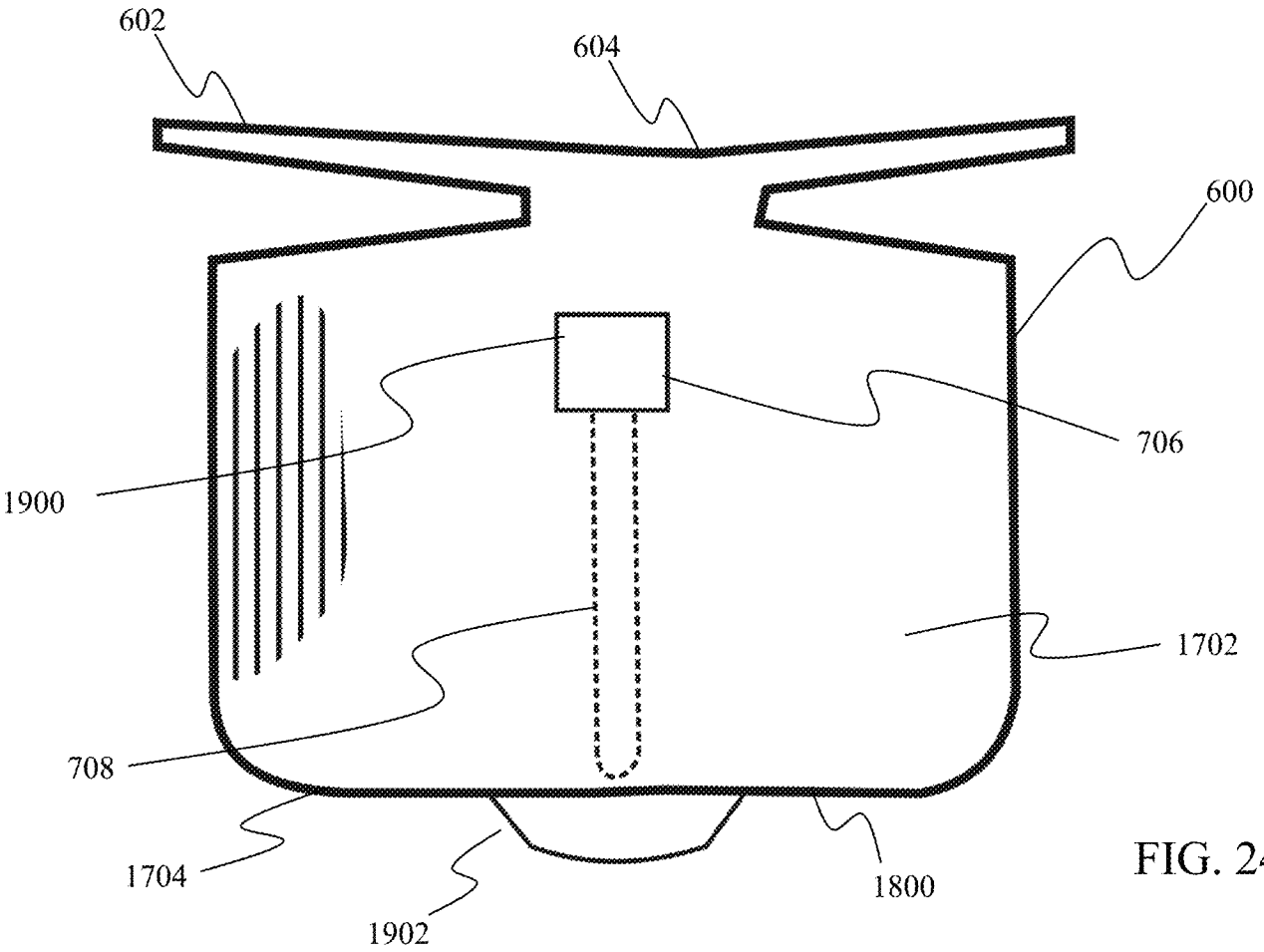
FIG. 24 is a front view illustration of a cartridge with an internal or an integrated self-clean mechanism, according to the present invention.

A front view illustration of a cartridge 600 with an internal or an integrated self-clean mechanism according to the present invention is presented in FIG. 24. In this case, the flushing fluid transfer tube 708 is internal to the cartridge 600 (as represented by dashed lines).

Figure 25:
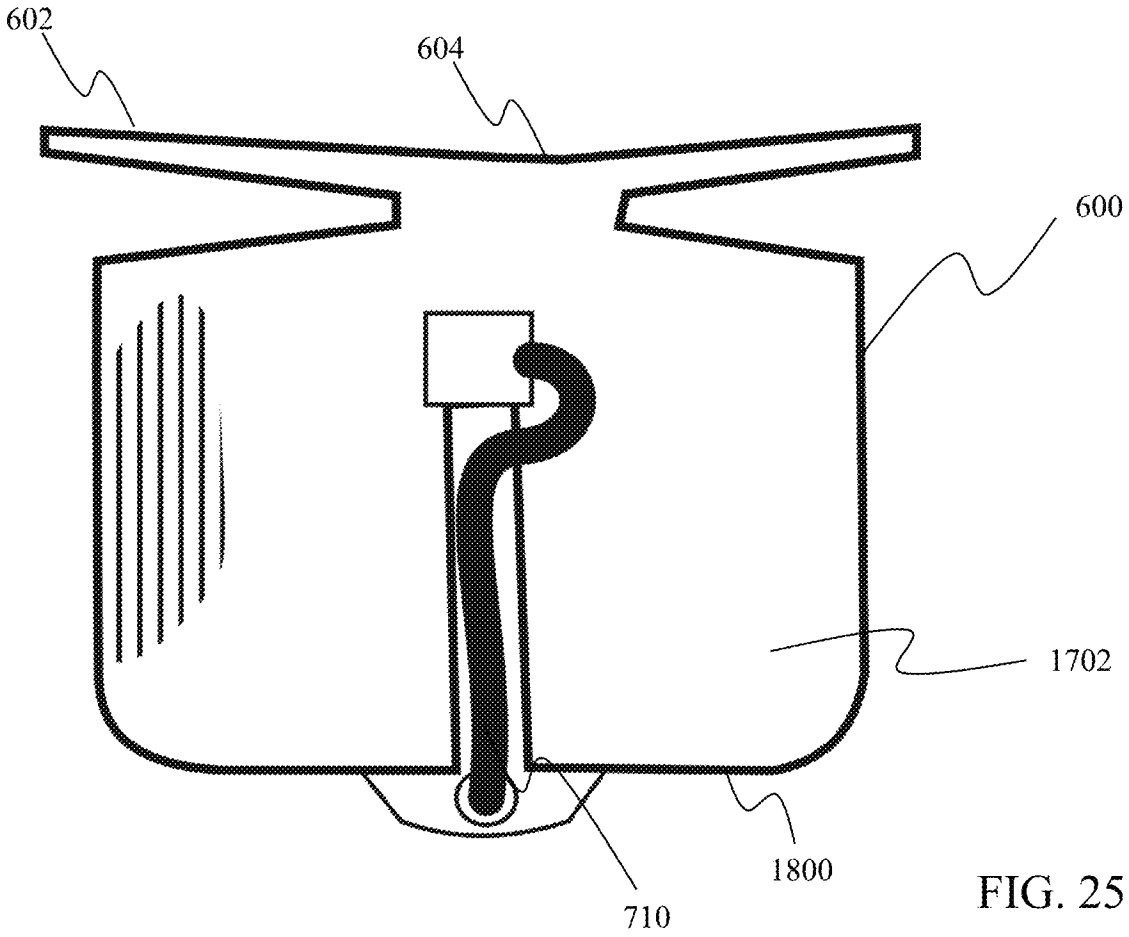
FIG. 25 is a rear view illustration of a cartridge with an internal, an external, or an integrated self-clean mechanism focused on a housing exit tube, according to the present invention.

A rear view illustration of a cartridge 600 with an internal, an external, or an integrated self-clean mechanism focused on a housing exit 208 (not shown) according to the present invention is presented in FIG. 25. In this example, the flushing fluid directing portion 710 directs flushing fluid to clean the housing exit 208, a connected housing (not shown), or connected building plumbing (not shown).

Figure 26:
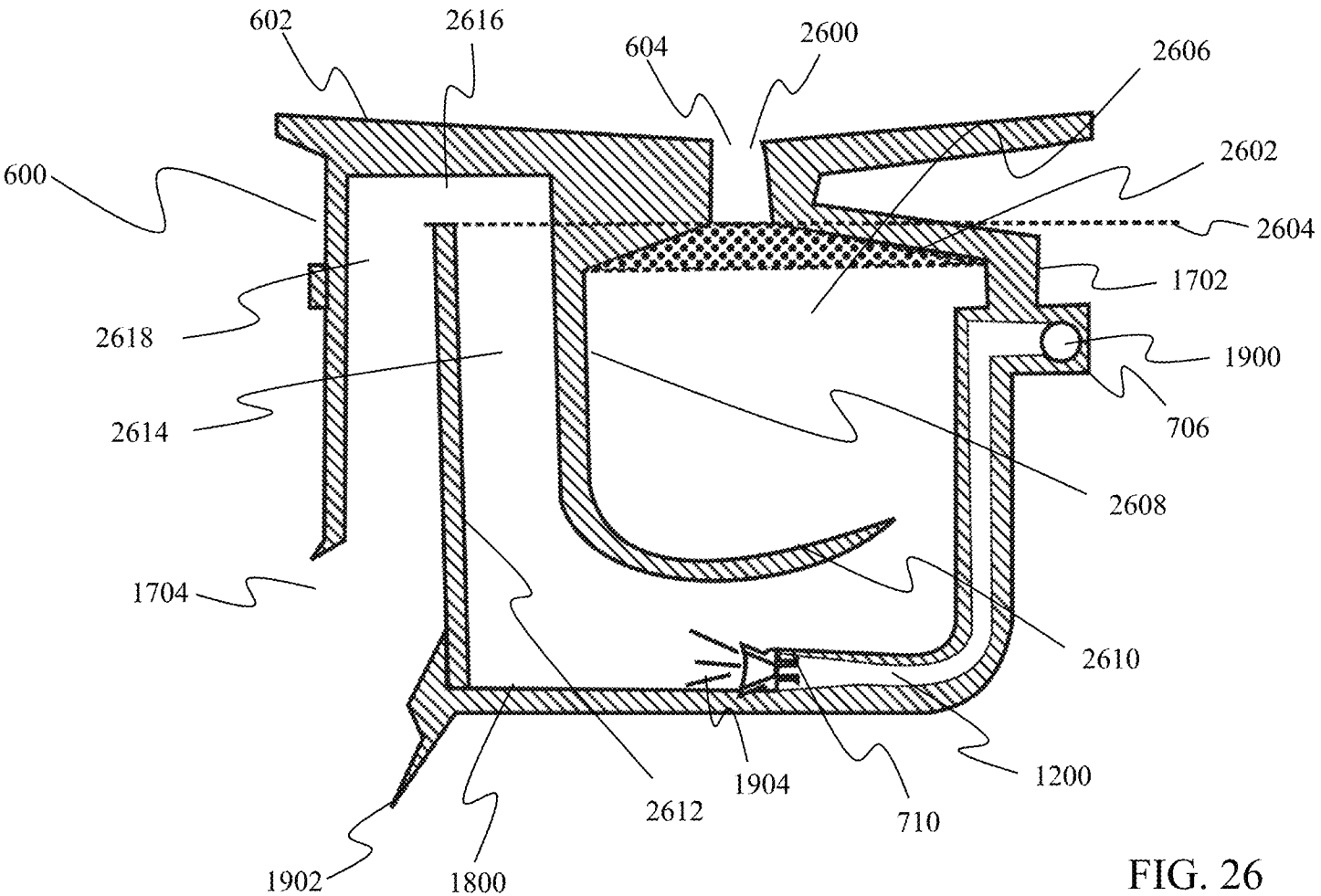
FIG. 26 is an illustration of a cutaway side view of a cartridge with an integrated self-clean mechanism and an internal flush, according to the present invention.

An illustration of a cutaway side view of a cartridge 600 with an integrated self-clean mechanism and an internal flush according to the present invention is shown in FIG. 26. Internally, the cartridge 600 includes a throat section 2600 that permits urine to flow from the urine inlet 604 through the ceiling 2602 beneath the overflow level 2604 of the fluid barrier and into the inlet compartment 2606. Inside the cartridge 600 are a vertical separator 2608, a baffle 2610, an outlet compartment vertical separator 2612, an outlet compartment 2614, an overflow gap 2616, and a discharge section 2618. In this example, a fluid channel 1200 is built into the cartridge for connecting with the flushing fluid receiving portion 1900 at the cartridge fluid interface 706 and for providing the fluid to the fluid directing portion 710 to exit into the cartridge 600 as a high pressure spray 1904.

Figure 27:
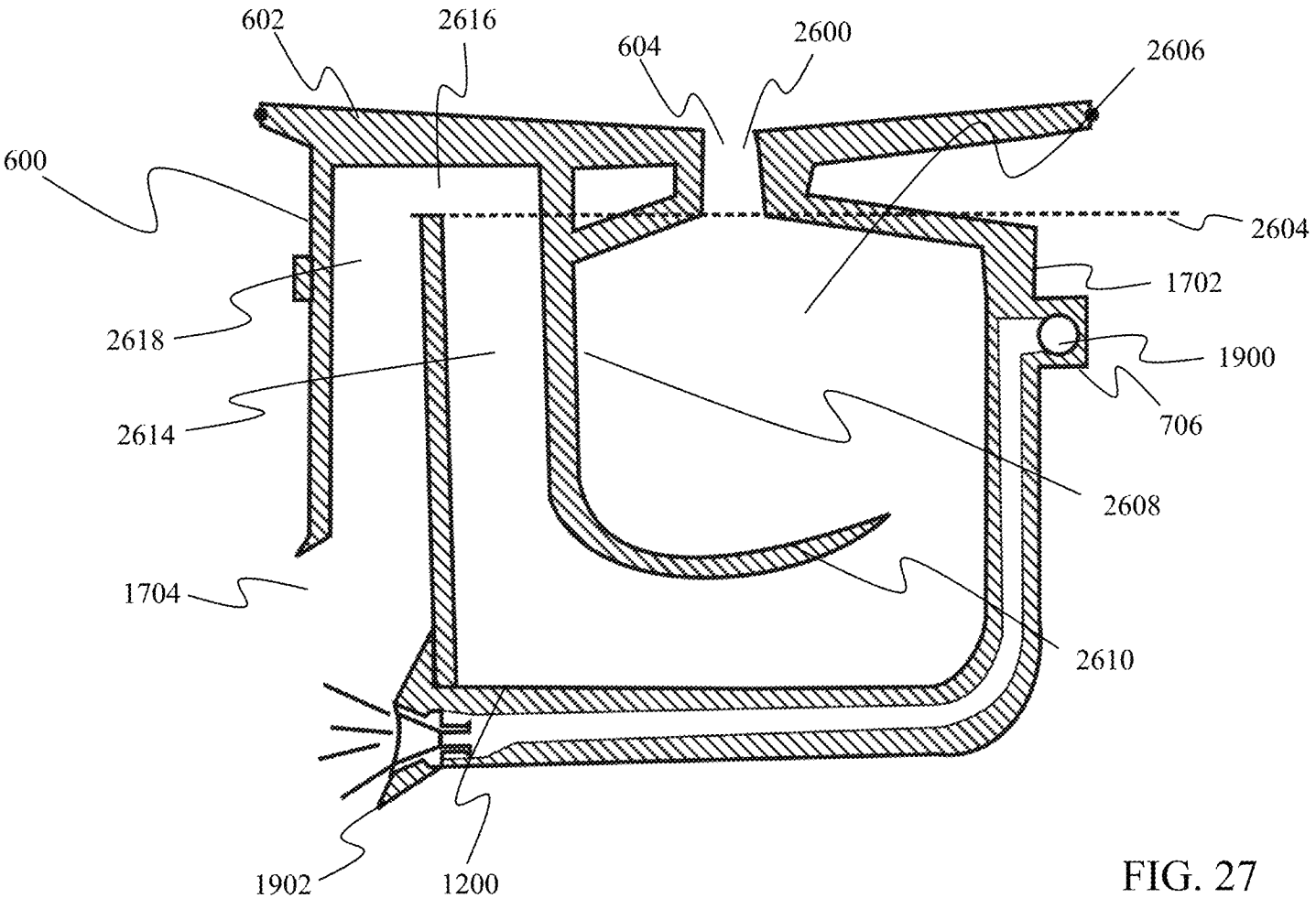
FIG. 27 is an illustration of a cutaway side view of a cartridge with an integrated self-clean mechanism and an external flush focused on a housing exit tube, according to the present invention.

An illustration of a cutaway side view of a cartridge 600 with an integrated self-clean mechanism and an external flush focused on a housing exit 208 (not shown), according to the present invention is presented in FIG. 27. In this case, the built-in fluid channel 1200 extends along the bottom of the cartridge and through the exit drip edge 1902 in order to direct flushing fluid through the exit 1704 of the cartridge 600.

An example of a fluid trap cartridge 600 is the C1M2+ model by Falcon Waterfree Technologies, LLC (2255 Barry Avenue, Los Angeles, Calif. 90064 USA). These cartridges can be better understood with reference to U.S. Pat. No. 7,571,741. The chambers are prone to struvite buildup and are made to be disposable so that when struvite builds to the point that a cartridge no longer permits sufficient urine flow therethrough, the cartridge 600 can be changed.

Figure 28:
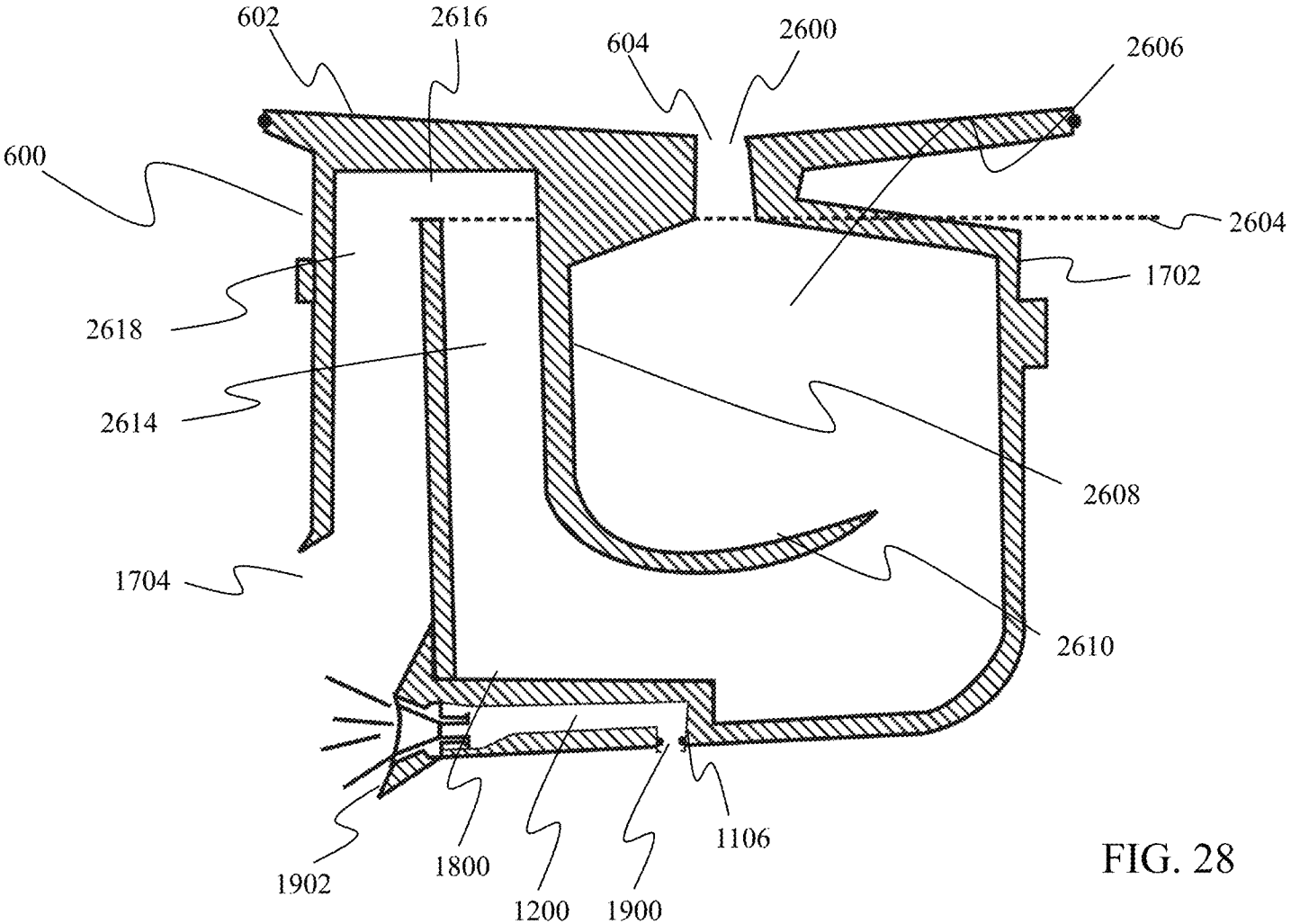
FIG. 28 is an illustration of a cutaway side view of a cartridge with an integrated self-clean mechanism and an external flush focused on a housing exit tube, where the self-clean mechanism cartridge fluid interface is on the bottom of the cartridge rather than the side, according to the present invention.

An illustration of a cutaway side view of a cartridge with an integrated self-clean mechanism and an external flush focused on a housing exit tube, where the self-clean mechanism cartridge fluid interface is on the bottom of the cartridge rather than the side according to the present invention, is shown in FIG. 28. In this case, the flushing fluid enters through a flushing fluid receiving portion 1900 that is formed on the bottom 1800 of the cartridge 600. An O-ring 1106 is provided to assist in creating a fluid-tight seal for the fluid receiving portion 1900. In this case, the built-in fluid channel 1200 extends along the bottom of the cartridge and through the exit drip edge 1902 in order to direct flushing fluid through the exit 1704 of the cartridge 600.

Figure 29:
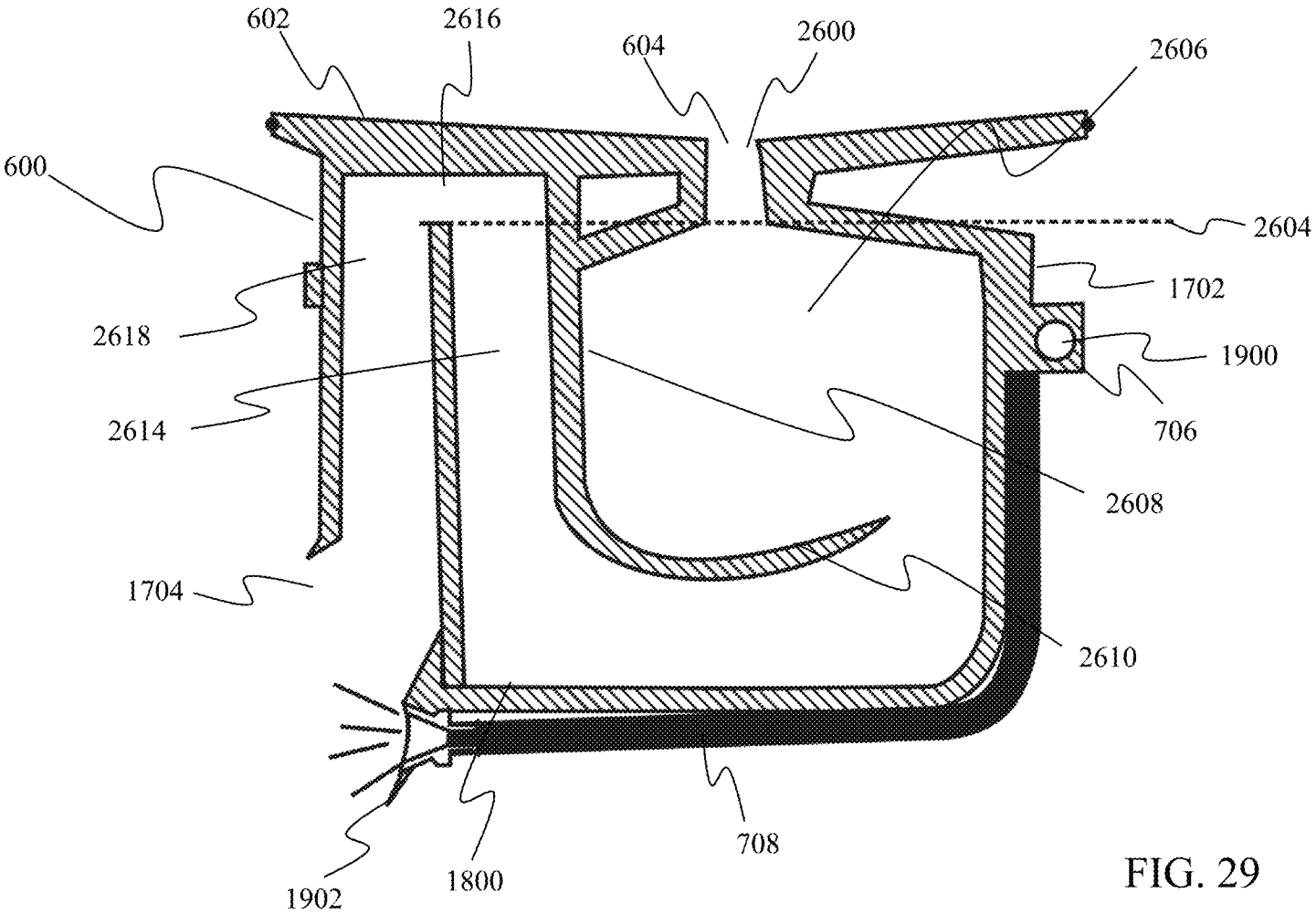
FIG. 29 is an illustration of a cutaway side view of a cartridge with an under-mount self-clean mechanism, as seen in FIG. 19, according to the present invention.

An illustration of a cutaway side view of a cartridge with an under-mount self-clean mechanism, similar to that seen in FIG. 19, according to the present invention is presented in FIG. 29. In this case, the flushing fluid transfer tube 708 extends along the bottom of the cartridge and through the exit drip edge 1902 in order to direct flushing fluid through the exit 1704 of the cartridge 600.

Figure 30:
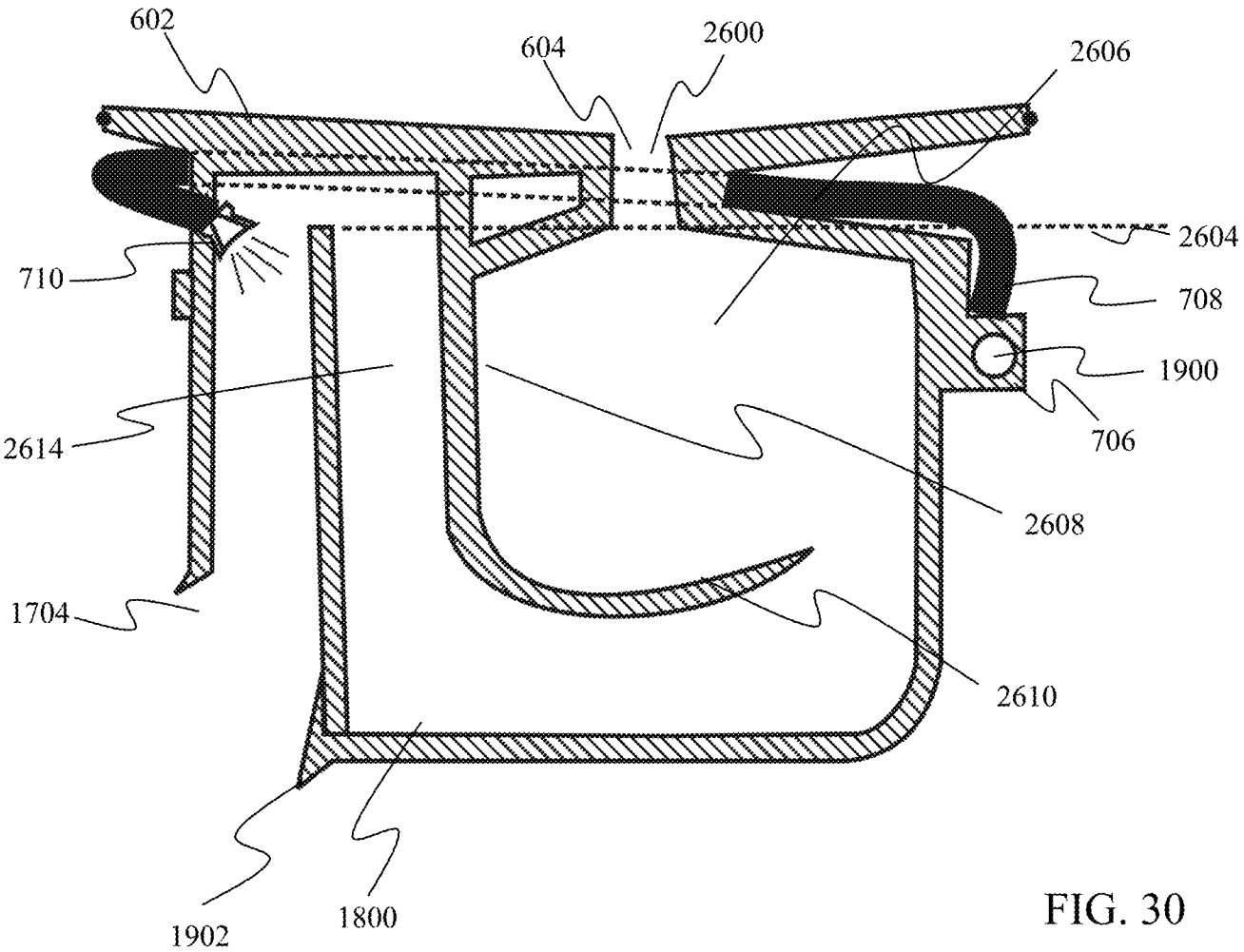
FIG. 30 is an illustration of a cutaway side view of a cartridge with a side mount self-clean mechanism and a discharge section focus, according to the present invention.

An illustration of a cutaway side view of a cartridge with a side mount self-clean mechanism and a discharge section focus according to the present invention is presented in FIG. 30. In this case, the fluid directing portion 710 directs flushing fluid into the interior of the cartridge 600 with a non-integrated flushing fluid transfer tube 708. Flushing fluid transfer tubes 708 can be run either externally or internally with respect to the cartridge 600. It is contemplated that many different connection types may be made between the cartridge 600 and the housing body 200 and that various combinations may be used to create a desired effect.

Figure 31:
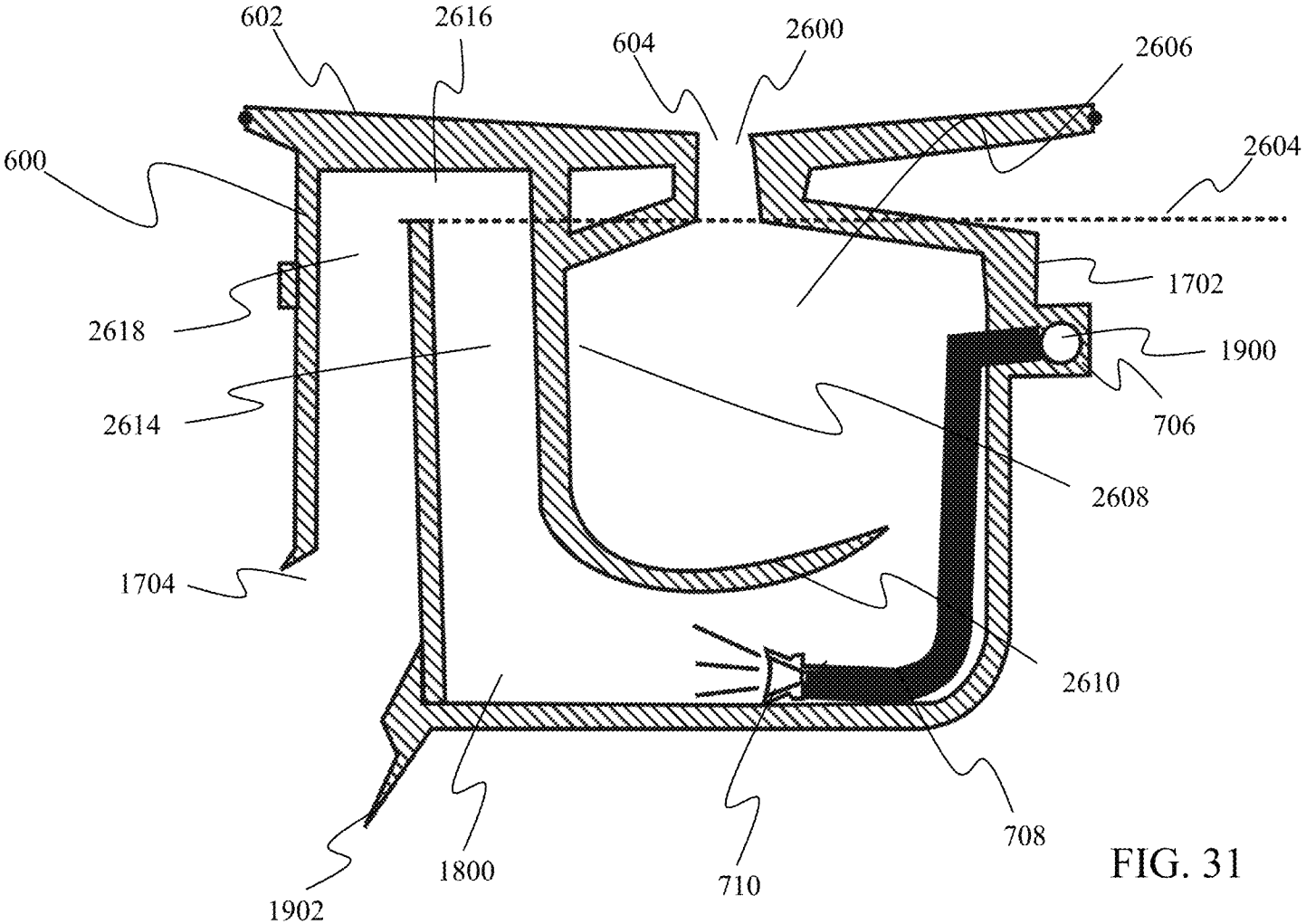
FIG. 31 is an illustration of a cutaway side view of a cartridge with an internal self-clean mechanism with a spray focused on the internal chambers, according to the present invention.

An illustration of a cutaway side view of a cartridge with an internal self-clean mechanism with a spray focused on the internal chambers according to the present invention is presented in FIG. 31. In this case, the fluid directing portion 710 directs flushing fluid into the bottom 1800 of the interior of the cartridge 600.

Figure 32:
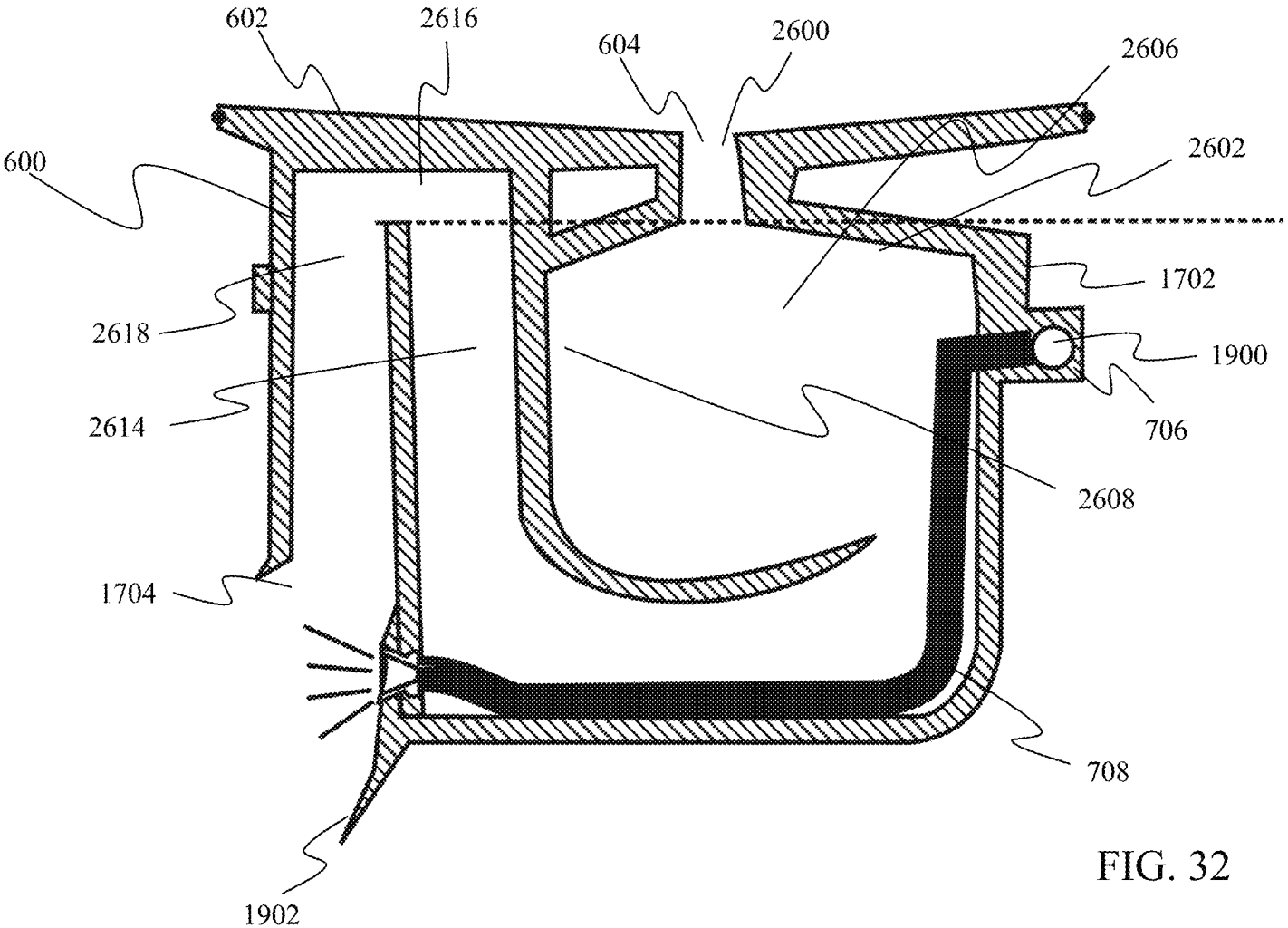
FIG. 32 is an illustration of a cutaway side view of a cartridge with an internal self-clean mechanism with a spray focused on a housing exit tube, according to the present invention.

An illustration of a cutaway side view of a cartridge with an internal self-clean mechanism with a spray focused out of the cartridge 600 toward/on a housing exit tube (not shown) according to the present invention is presented in FIG. 32. In this case, a non-integrated flushing fluid transfer tube 708 extends along the bottom of the cartridge and to the exit drip edge 1902 in order to direct flushing fluid through the exit 1704 of the cartridge 600.

Figure 34:
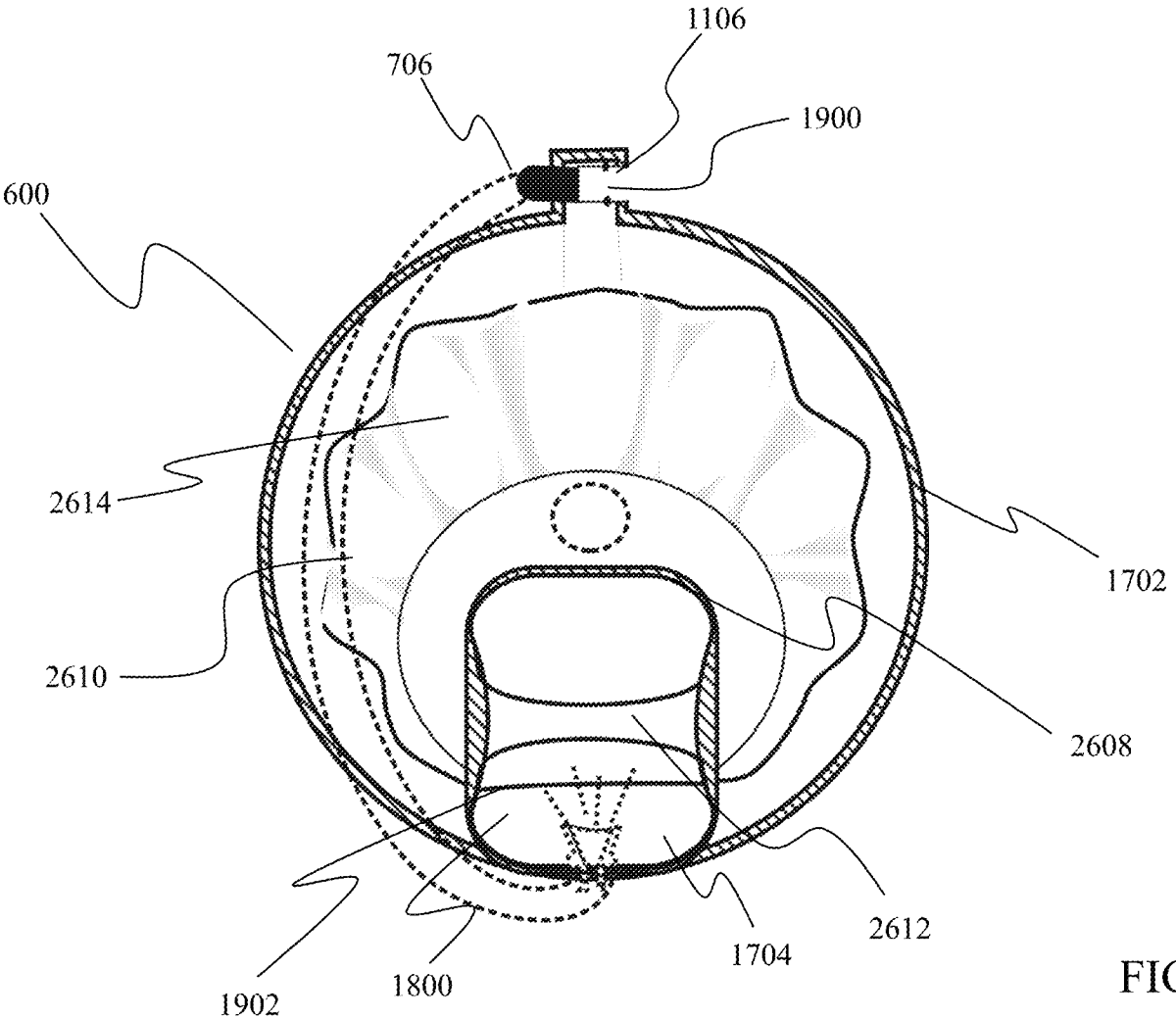
FIG. 34 is an illustration of a cutaway top view of a cartridge with a self-clean mechanism focused on a discharge section, according to the present invention.

An illustration of a cutaway top view of a cartridge 600 with an under-mount self-clean mechanism with a spray focused through a housing exit 1704 is presented in FIG. 34 according to the present invention.

An illustration of a cutaway top view of a cartridge 600 with a self-clean mechanism focused into the interior of the cartridge 600 along the cartridge bottom 1800 or at the area of the cartridge exit 1704 is presented in FIG. 34 according to the present invention.

Figure 35:
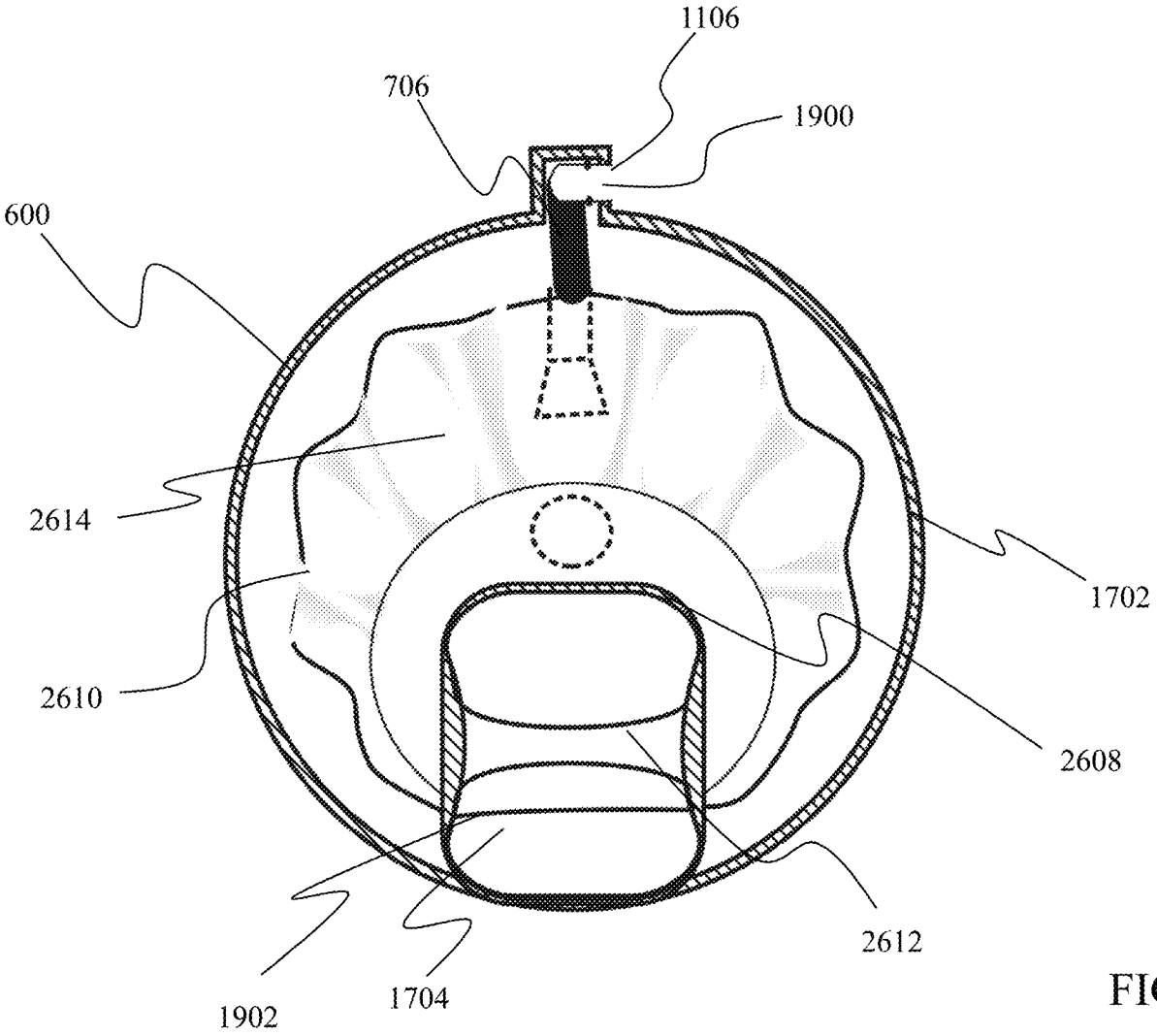
FIG. 35 is an illustration of a cutaway top view of a cartridge with an internal self-clean mechanism and an internal flush, according to the present invention.

An illustration of a cutaway top view of a cartridge 600 with an internal self-clean mechanism and an internal flush according to the present invention is presented in FIG. 35. In this case, the flushing fluid is directed to an interior of the cartridge 600.

Figure 36:
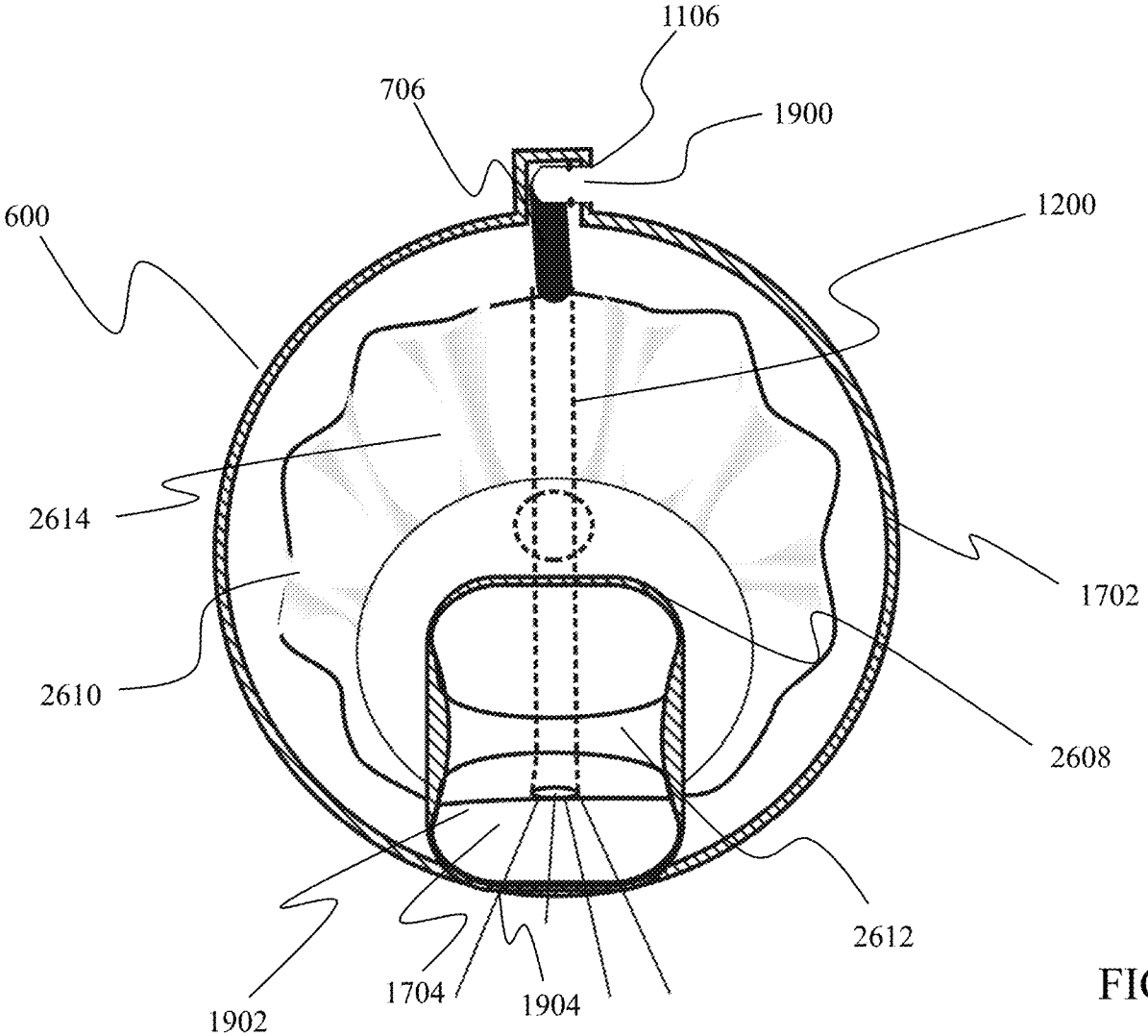
FIG. 36 is an illustration of a cutaway top view of a cartridge with an internal self-clean mechanism focused on a housing exit tube, according to the present invention.

An illustration of a cutaway top view of a cartridge 600 with an internal self-clean mechanism (as indicated by the dashed line portion of the fluid transfer tube 1200) focused on a housing exit tube 208, according to the present invention, is presented in FIG. 36.

FIGS. 26, 30, 31, 34, and 35 show various cross sections depicting a flushing fluid directing portion 710 (i.e, spray head) placed inside of a cartridge 600. However, the invention need not be limited to a single fluid directing portion 710. Multiple fluid directing portions 710 to direct flushing fluid to multiple locations within the cartridge 600, the housing 200, a building's plumbing or any desirable combination thereof.

FIGS. 26, 27, and 28 show cutaway side views of the cartridges 600 that utilize the built-in fluid channel 1200. The advantage of such a channel is that it is created when the cartridge 600 is molded, thus decreasing labor and cost by not having to add a flushing fluid transfer tube 708. Non-integrated flushing fluid transfer tubes 708 can be made of any range of standard tubing materials. Polypropylene, silicone, and polyethylene are all non-limiting examples of materials suitable for the flushing fluid transfer tube 708 should such a device be utilized instead of a built-in fluid channel 1200.

Figure 37:
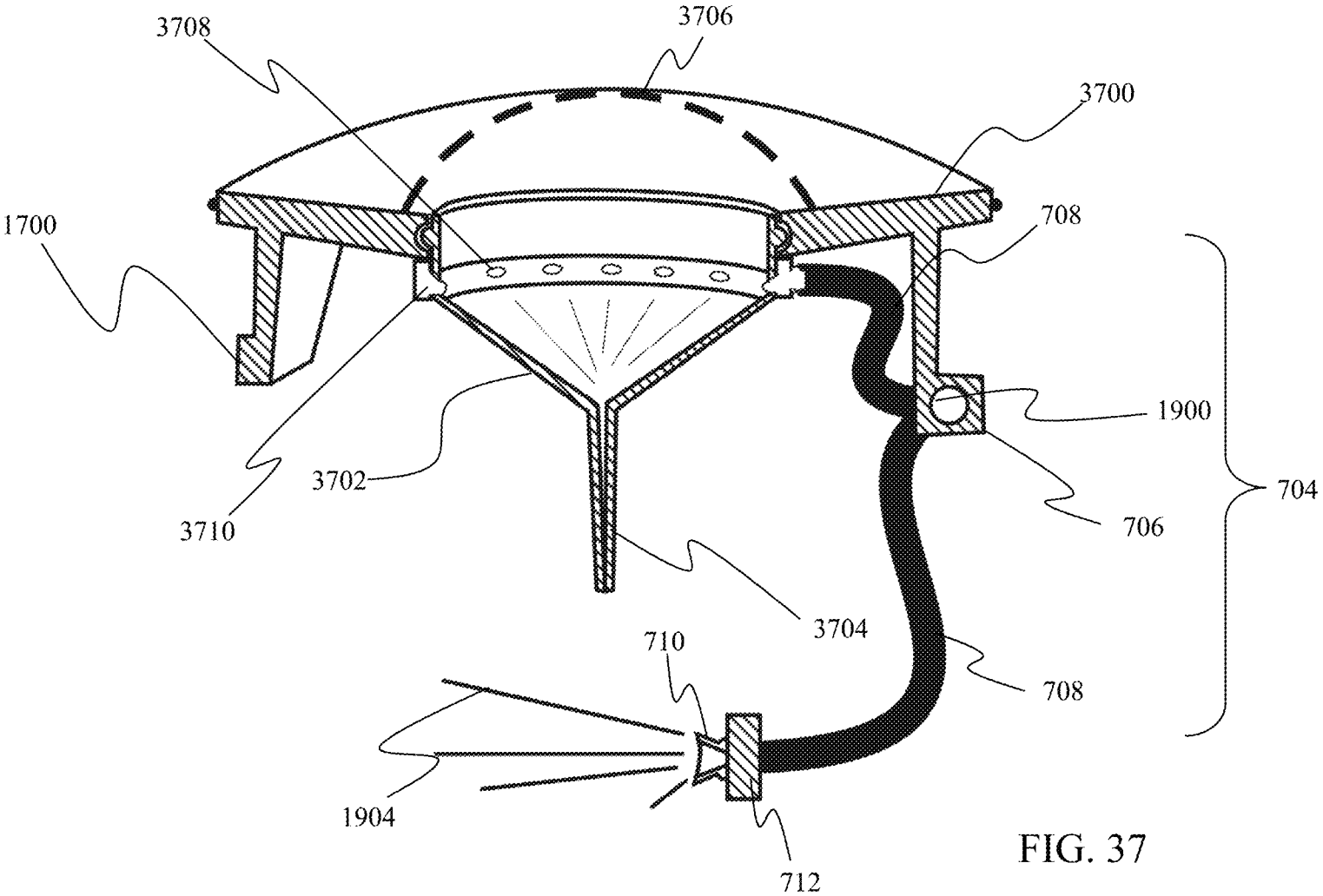
FIG. 37 is an illustration of a cutaway side view of a mechanical valve cartridge with a spray kit where a self-rinse valve is installed in the cartridge and connected to a water transfer tube, according to the present invention.

An illustration of a cutaway side view of a mechanical valve cartridge 3700 with a spray kit where a self-rinse valve is installed in the cartridge 3700 and connected with a flushing fluid transfer tube 708 according to the present invention is presented in FIG. 37. In this case, the mechanical valve cartridge 3700 includes a mechanical valve 3702 with a sealing portion 3704. The mechanical valve cartridge 3700 further includes locking tines 1700 and a debris screen 3706 for preventing objects from becoming lodged in the mechanical valve 3702. A cartridge fluid interface 706 receives flushing fluid into a flushing fluid receiving portion 1900. The flushing fluid is then transported to a fluid directing portion 710 that is attached with the cartridge 3700 or a housing by a mechanism such as a retainer clip 712. The flushing fluid is also transported to a set of rinse holes 3708 disposed about the mechanical valve 3702 and connected by a fluid communication channel 3710 in order to flush and clean the mechanical valve 3702.

Figure 38:
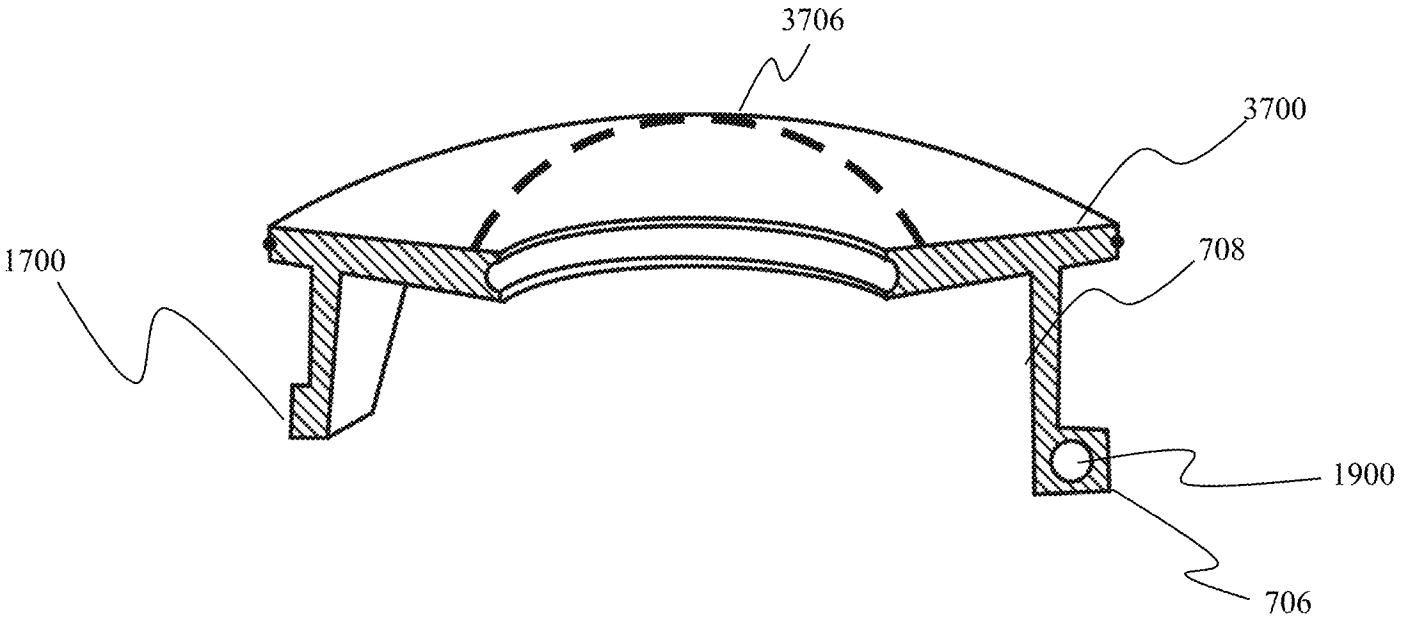
FIG. 38 is an illustration of a cartridge with the valve removed and showing a cartridge fluid inlet and a debris screen, according to the present invention.

An illustration of a mechanical valve cartridge 3700 with the mechanical valve 3702 removed and showing a flushing fluid receiving portion 1900 and a debris screen 3706 according to the present invention is presented in FIG. 38.

Figure 39:
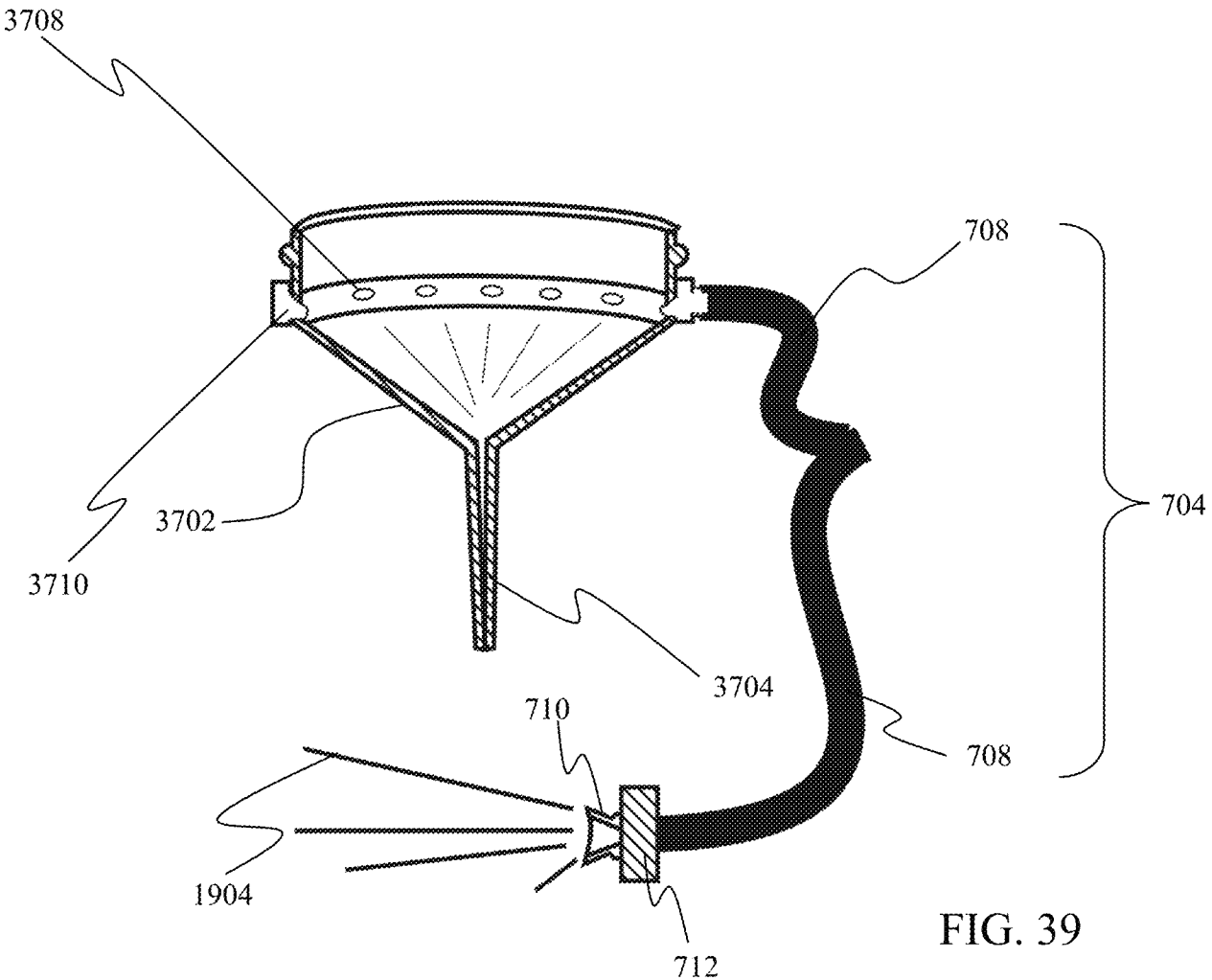
FIG. 39 is an illustration of a cutaway side view of a mechanical self-rinse valve with a spray kit and connected to a water transfer tube, according to the present invention.

An illustration of a cutaway side view of a mechanical self-rinse valve with a spray self-clean kit 704 and connected to a flushing fluid transfer tube 708, according to the present invention is presented in FIG. 39.

Figure 40:
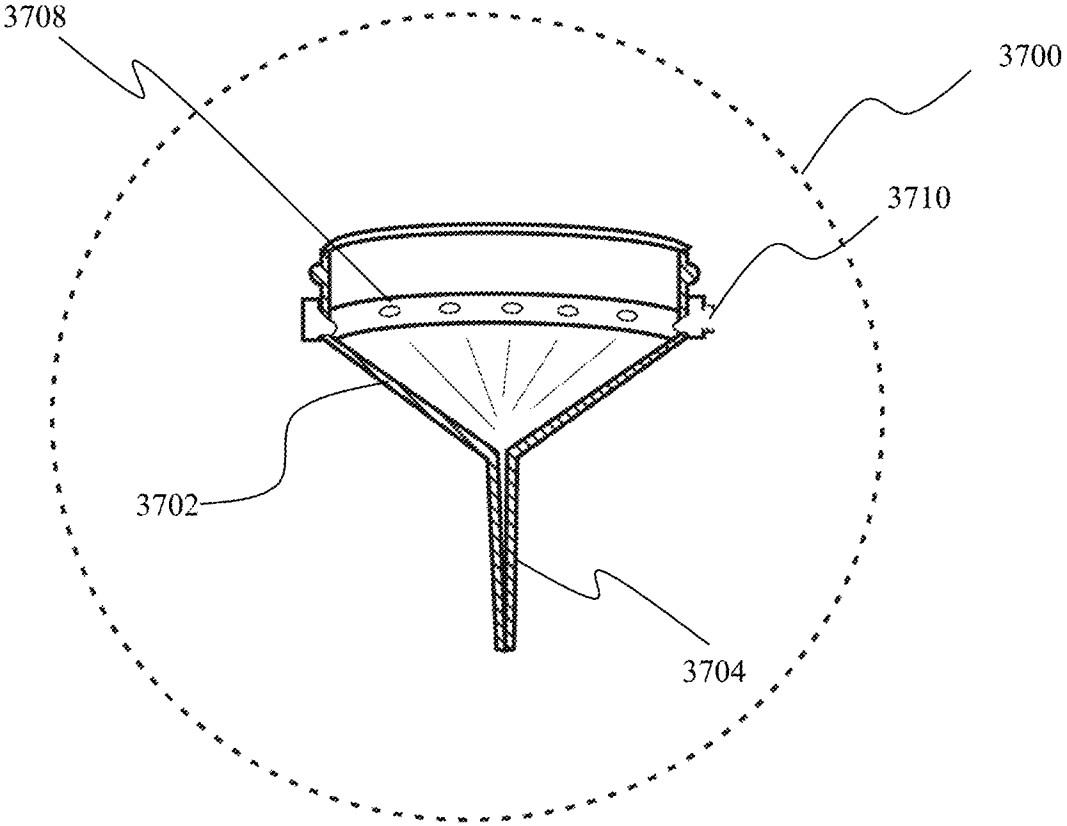
FIG. 40 is an illustration of a cutaway side view of a mechanical self-rinse valve or a cartridge with the holes to allow the water to pass through the valve wall and rinse the valve and the holes placed above a sealing section of the valve, according to the present invention.

An illustration of a cutaway side view of a self-rinse mechanical valve cartridge 3700 with the rinse holes 3708 to allow the flushing fluid to pass through the valve wall and rinse the valve and the holes placed above a sealing section of the valve according to the present invention is presented in FIG. 40.

Figure 41:
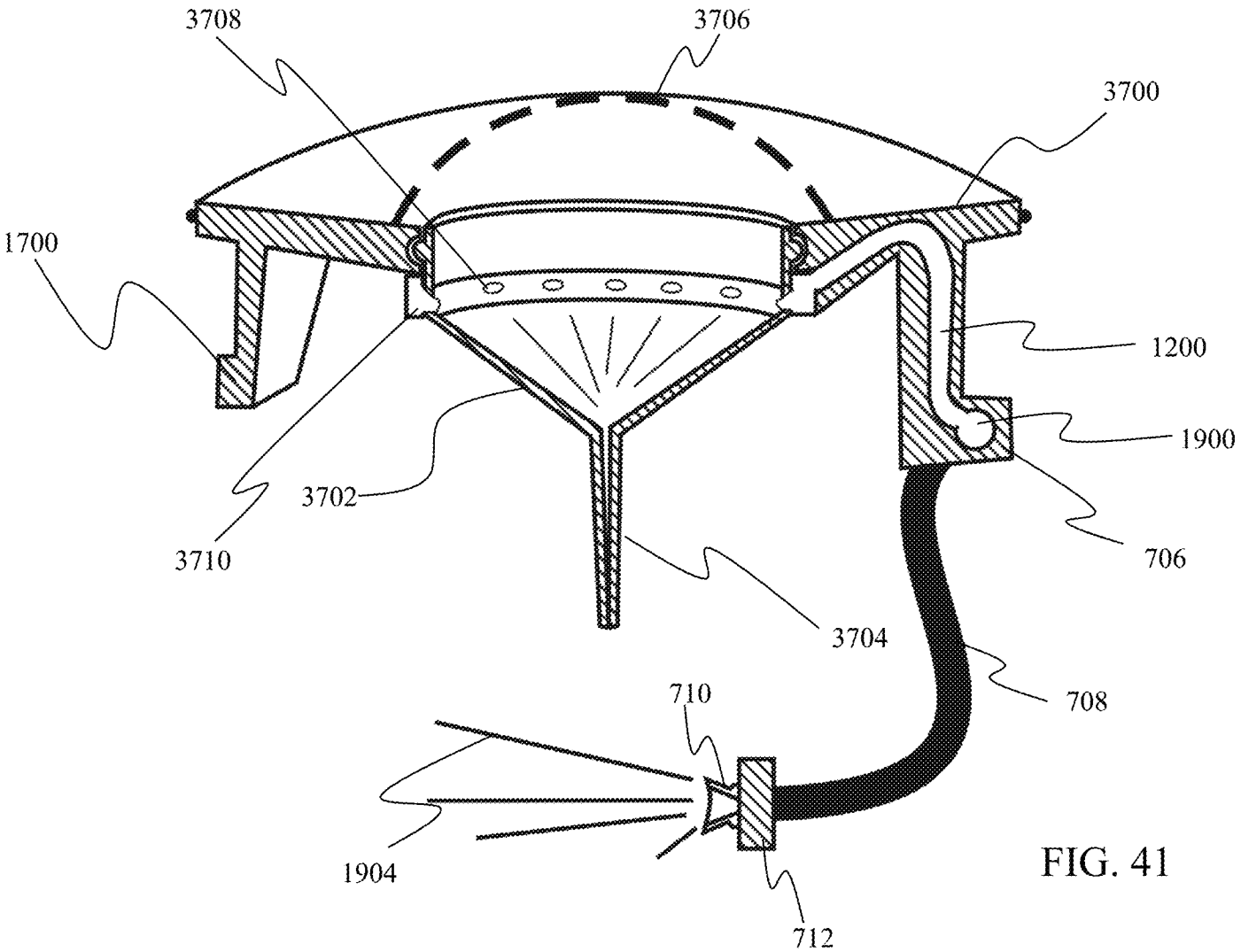
FIG. 41 is an illustration of a cutaway side view of a mechanical valve cartridge with a self-clean mechanism where the self-rinse valve is installed in the cartridge and connected through an integrated fluid passage from a side inlet through the cartridge and to a self-rinse valve's fluid communication channel, according to the present invention.

An illustration of a cutaway side view of a mechanical valve cartridge 3700 with a self-clean mechanism where the self-rinse mechanical valve 3702 is installed in the cartridge and connected through an integrated fluid channel 1200 (a built-in fluid channel) from a side inlet (flushing fluid receiving portion 1900) through the cartridge 3700 and to a flushing fluid communication channel 3710 according to the present invention is shown in FIG. 41. Note that with the mechanical valves 3702, cleaning the valve sealing section 3704 is particularly important because the main cause of failure of a mechanical valve 3702 is the wear of the rubber and the buildup of precipitants on the valve 3702, causing it to become less compliant. Mechanical valves 3702 often use silicon rubber for its superior resistance to hardening; however, they need replacement on a regular basis as they gain buildup and eventually become less compliant.

Figure 42:
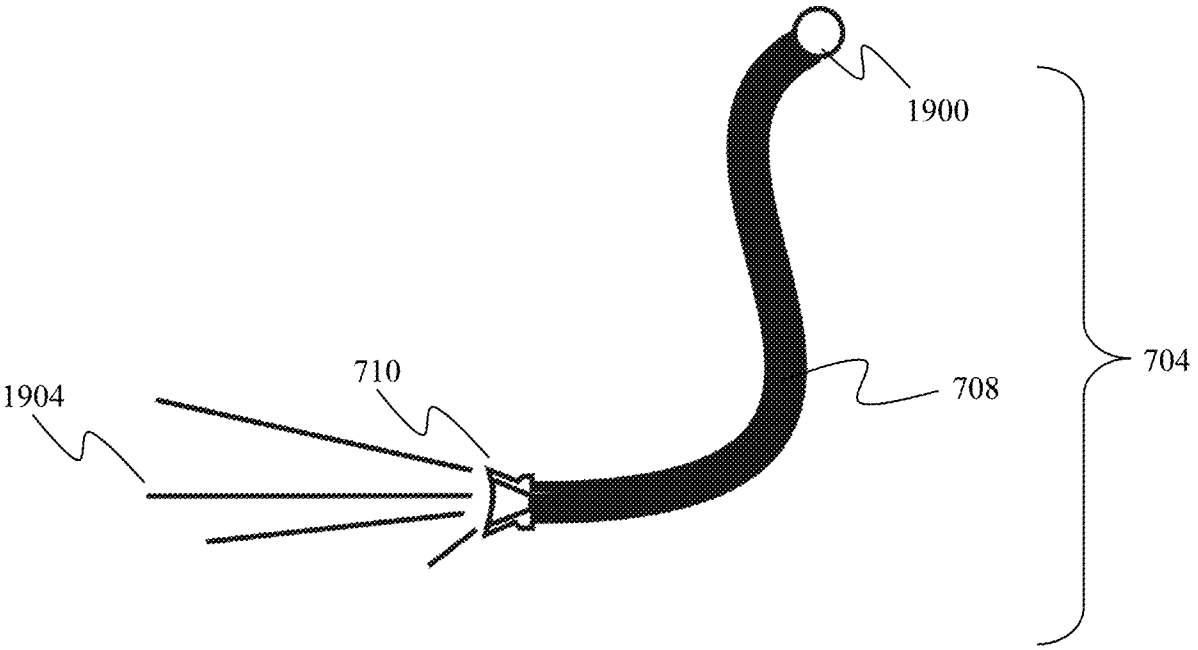
FIG. 42 is an illustration of a self-cleaning mechanism that carries fluid from a housing to a desired spot for focused flushing and cleaning, according to the present invention.

An illustration of a self-cleaning mechanism/kit 704 that carries fluid from a housing 200 to a desired spot for focused flushing and cleaning according to the present invention is presented in FIG. 42 without a cartridge 3700.

Figure 43:
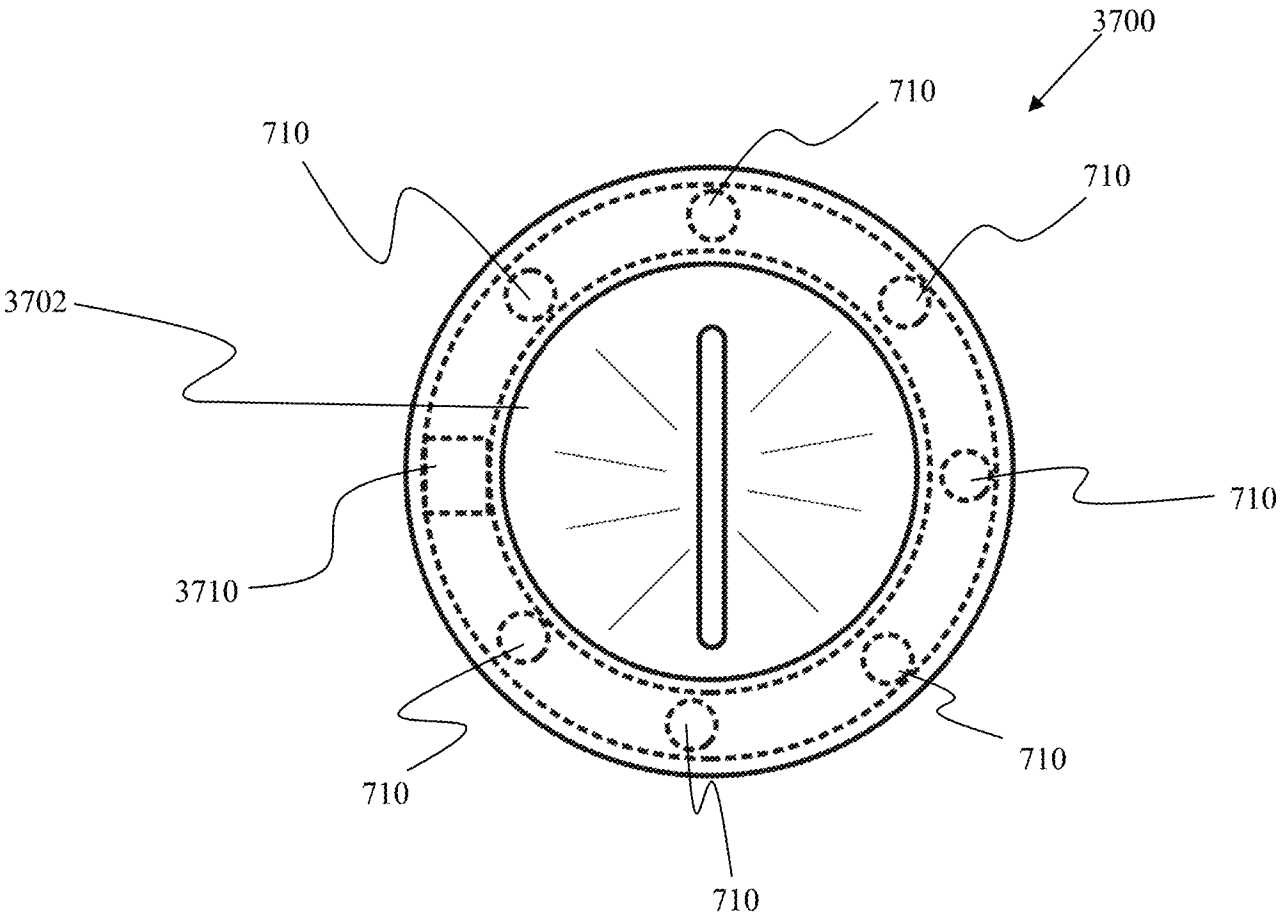
FIG. 43 is an illustration of a top view of a mechanical valve hybrid flushing system urinal cartridge, with the spray heads shown in dotted line, according to the present invention.
Figure 44:
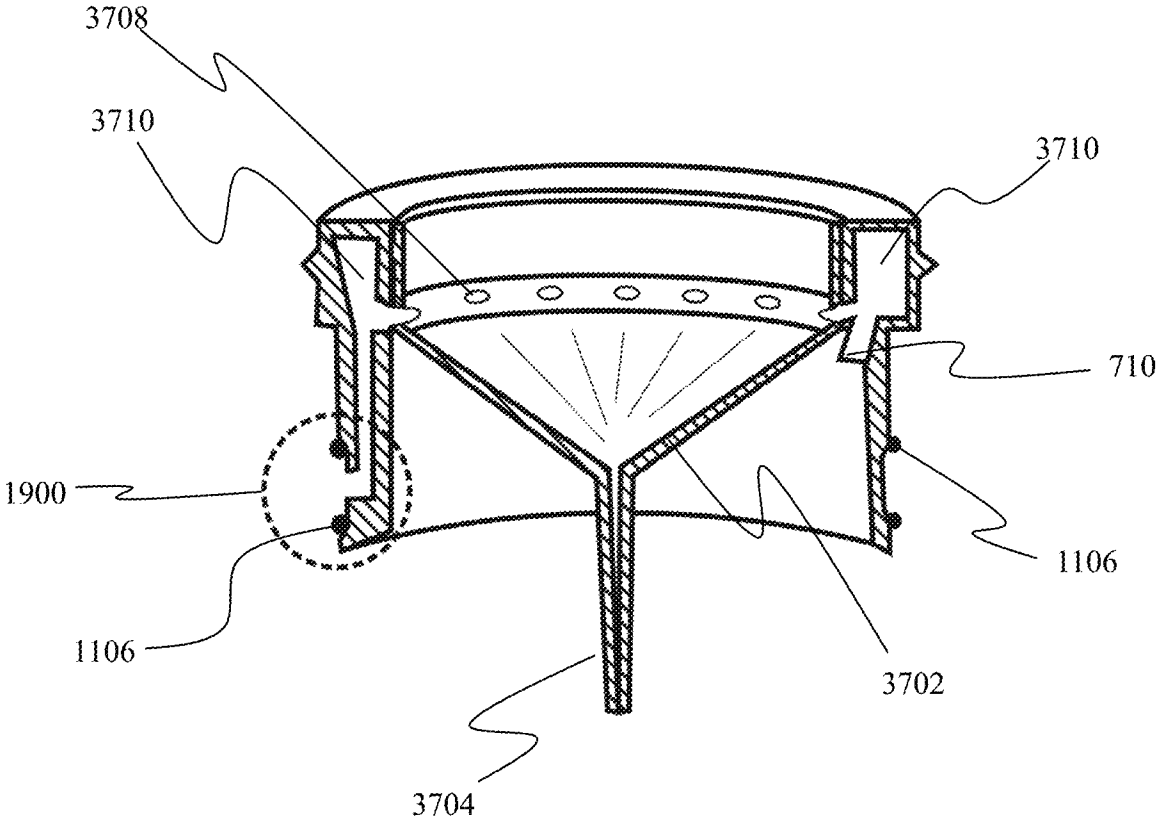
FIG. 44 is an illustration of a similar mechanical valve cartridge as shown in FIG. 43, shown from the side in a cutaway view, according to the present invention.

A top view of a hybrid flushing system mechanical cartridge 3700 is shown in FIG. 43, with flushing fluid directing portions 710 shown in a dashed line. The high pressure spray heads deliver flushing fluid into an area (not shown) beneath the mechanical valve 3702. A similar cartridge 3700 is shown in FIG. 44, only this time it is shown from the side in a cutaway view. The flushing water enters through a cartridge the flushing fluid receiving portion 1900, where it can travel to the spray heads 710 or the rinse holes 3708, or both. A fluid communication channel 3710 carries the flushing fluid to the spray heads 710 through the rinse holes 3708. O-rings 1106 are used to seal the fluid path between the cartridge 3700 and a housing (not shown) and prevent leakage.

Figure 45:
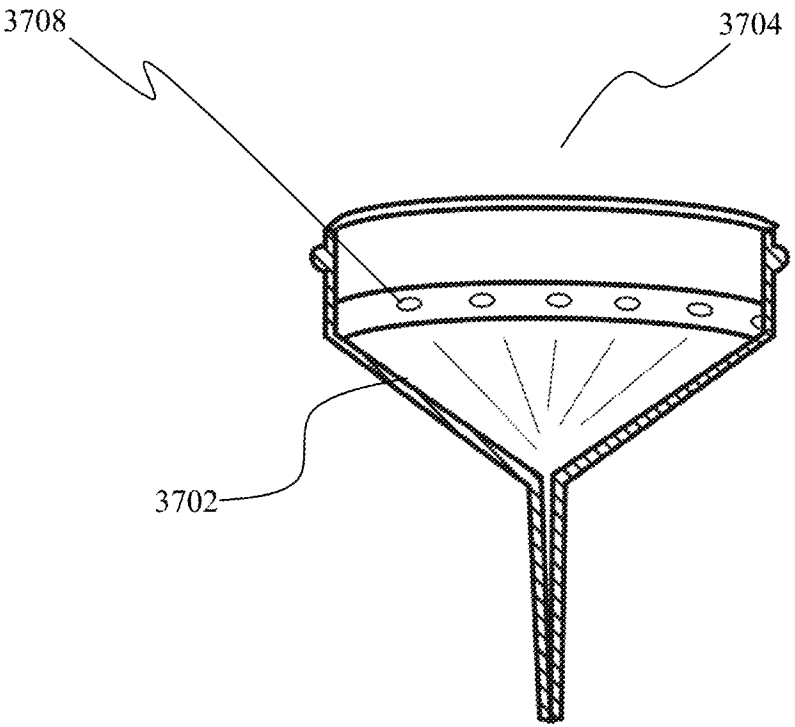
FIG. 45 is an illustration of a valve or a cartridge for a water-free urinal with the rinsing holes that allow flushing water to pass through them and into the valve to help clean it, according to the present invention.

An illustration of a mechanical valve 3702 for a mechanical cartridge 3700 for a water-free urinal with the rinsing holes 3708 that allow flushing water to pass therethrough and into the valve 3702 to help clean it according to the present invention is shown in FIG. 45.

Figure 46:
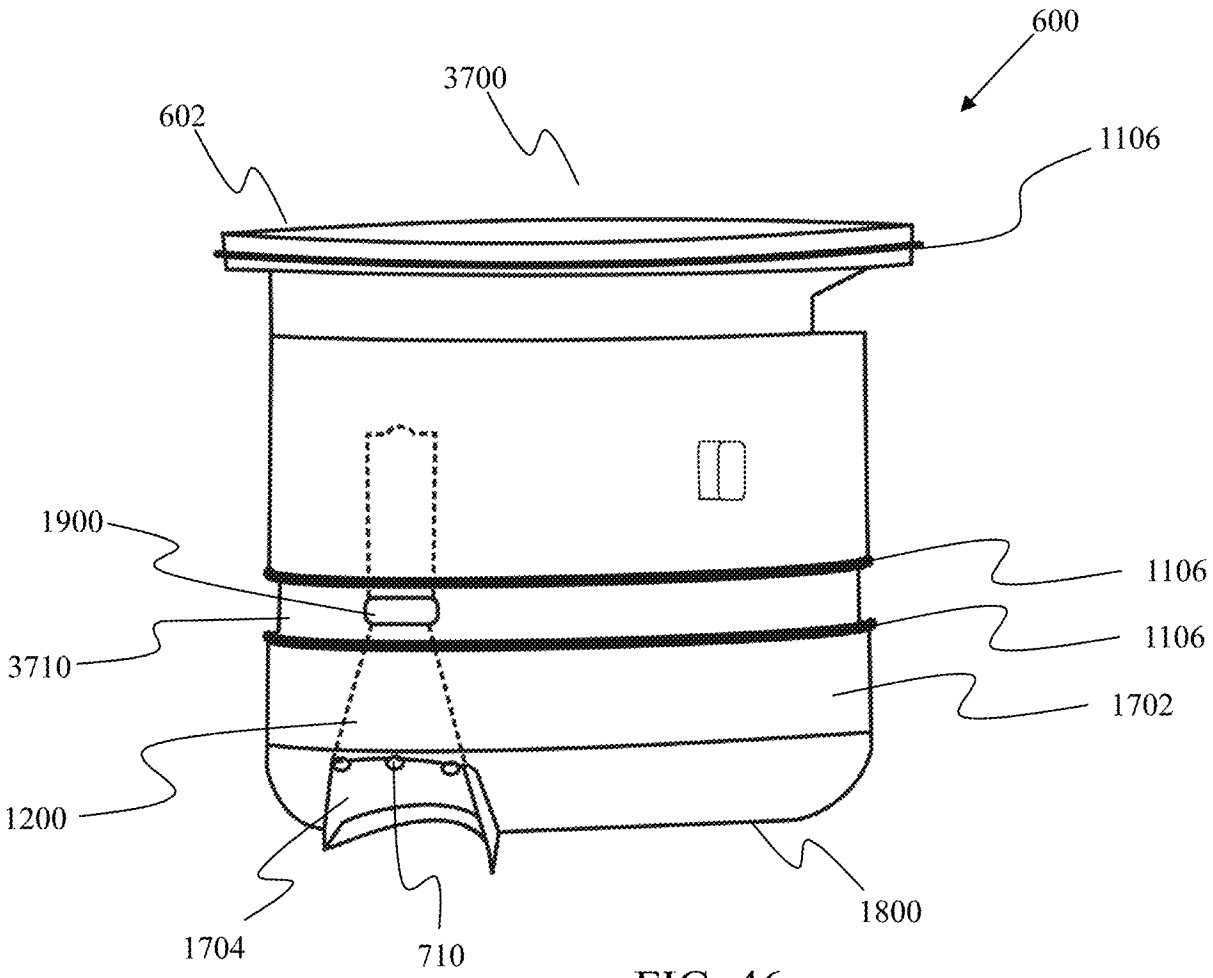
FIG. 46 is an illustration of a cartridge for a hybrid flushing system in an isometric view, according to the present invention.
Figure 47:
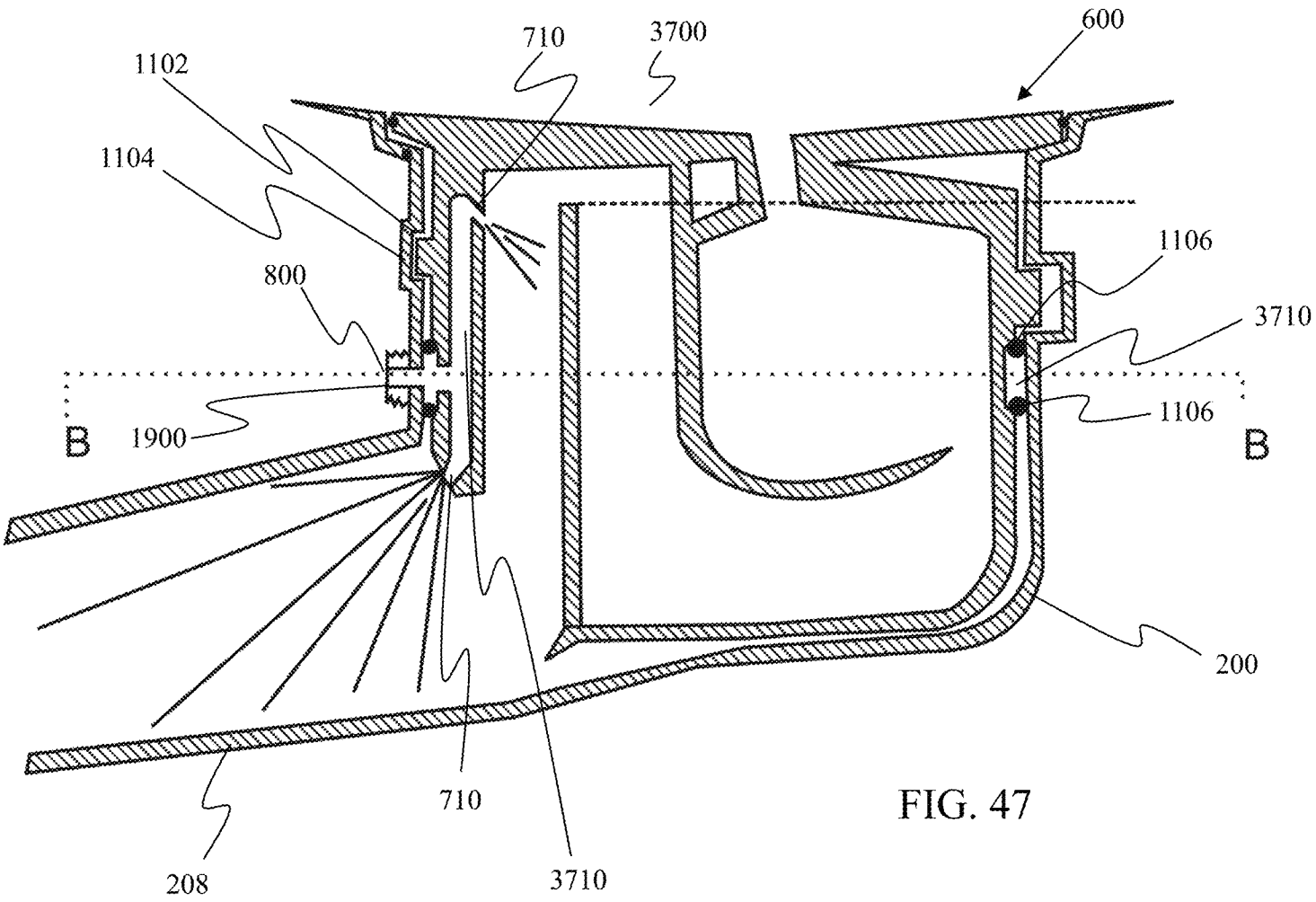
FIG. 47 is an illustration of a cartridge and a housing for a hybrid flushing system where the cartridge is inserted into the housing and the O-rings seal against the side wall of the housing such that a water tight seal is created, according to the present invention.

An isometric view of a cartridge 600 for a hybrid flushing system is presented in FIG. 46. Although depicted as a fluid-trap type cartridge, the cartridge 600 may be either a fluid-trap or a mechanical cartridge. O-rings 1106 can be seen wrapping the perimeter of the cartridge 600 above and below the flushing fluid receiving portion 1900; forming a fluid communication channel 3710 between the cartridge 600 and the housing when the cartridge 600 is inserted into a housing that seals against the O-rings 1106 as shown in FIG. 47. The flushing fluid receiving portion 1900 can be seen to fluidly communicate with the built-in fluid channel 3710 which has the fluid intensifying outlets/fluid directing portions 710 for the flushing fluid to exit. FIG. 47 shows the cartridge 600 and the housing 200 for the hybrid flushing system. In this case, the cartridge 600 is inserted into the housing 200 and the O-rings 1160 seal against the side wall of the housing 200 such that a fluid tight seal is created. Thus when the flushing fluid enters the channel, it is carried into the cartridge through the flushing fluid receiving portion 1900, through the various portions of the built-in fluid channel 3710 and to the fluid directing portions 710 (depicted as velocity intensifying spray heads). Note that the flushing fluid is able to traverse the circumference of the cartridge 600 via the fluid communication channel 3710 in the area sealed by the O-rings 1160. Also note that the cartridge 600 is shown with locking pins 1102 which connect with locking slots 1104 of the housing 200 to retain the cartridge 600 therein. Also, the housing 200 is shown having a male supply line 800 to receive flushing fluid therefrom. The use of the male supply lines 800 is simply intended to provide one example of fittings that could be used with the present invention and not intended to be limiting.

Figure 48B:
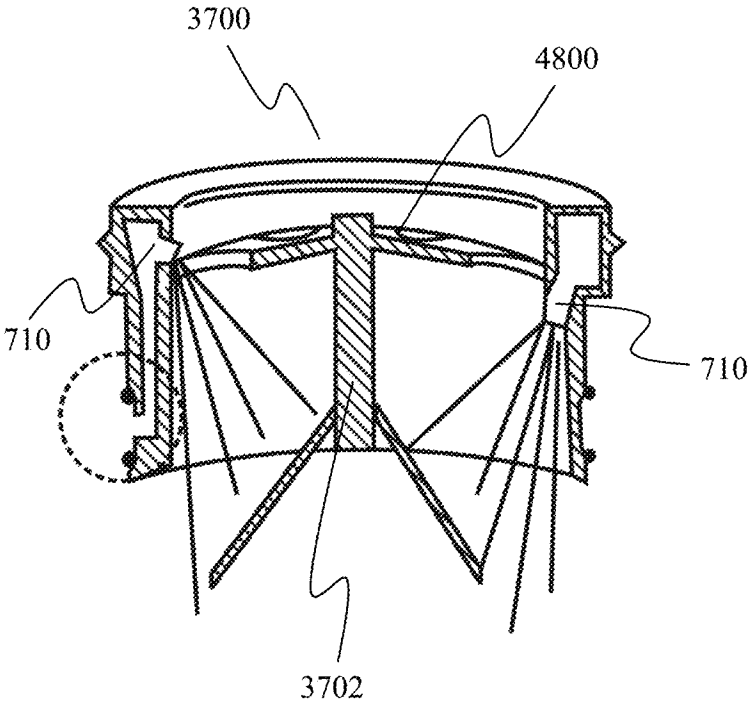
FIGS. 48A and 48B are the illustrations of a cutaway side view of a mechanical valve, utilizing an umbrella style valve, where the spray heads are strategically located upstream from the valve, so that they may force the opening of the opening of the valve when actuated and rinse off the cartridge, according to the present invention.
Figure 48A:
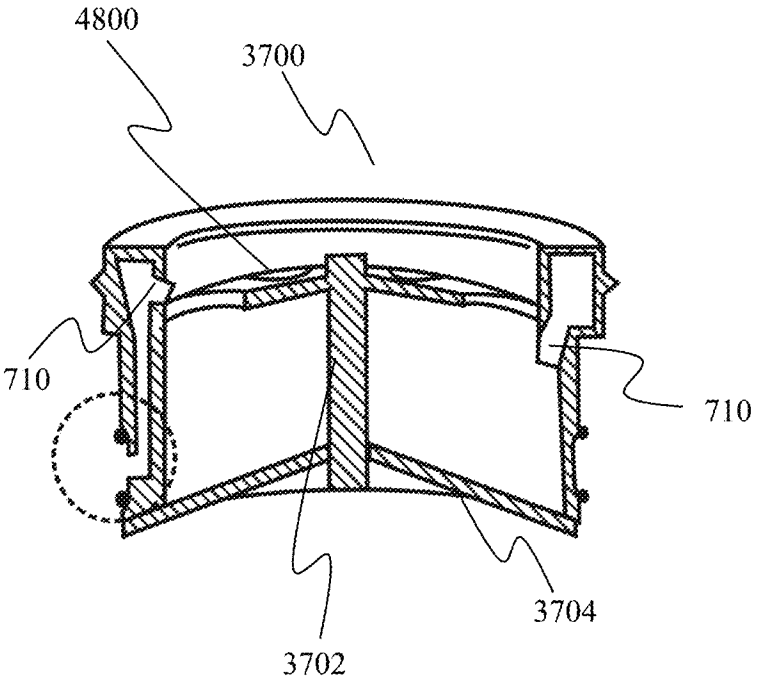
Figure 49B:
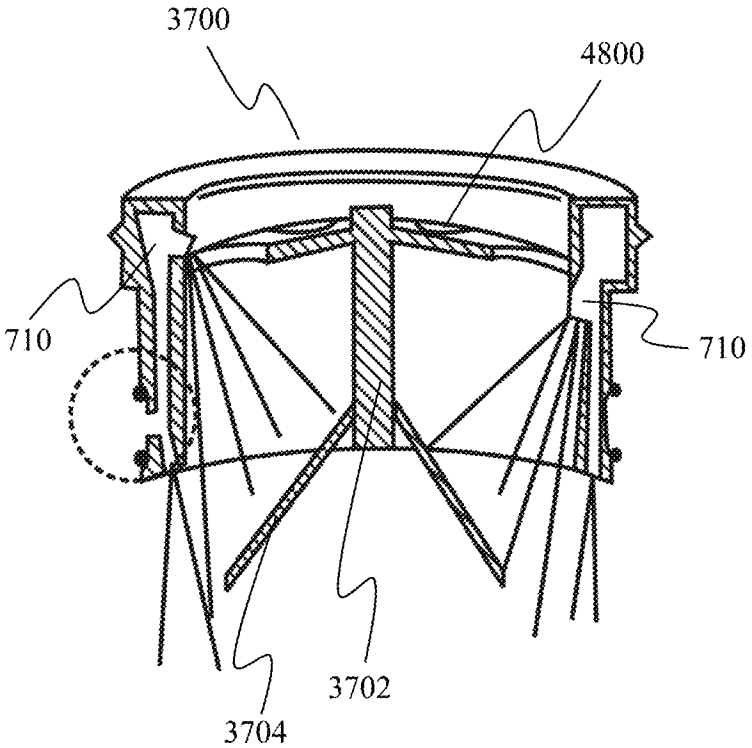
FIGS. 49A and 49B are the illustrations of a cutaway side view of a mechanical valve similar to that shown in FIGS. 48A and 48B, however here the high pressure spray heads are located also in the valve seat itself, according to the present invention.
Figure 49A:
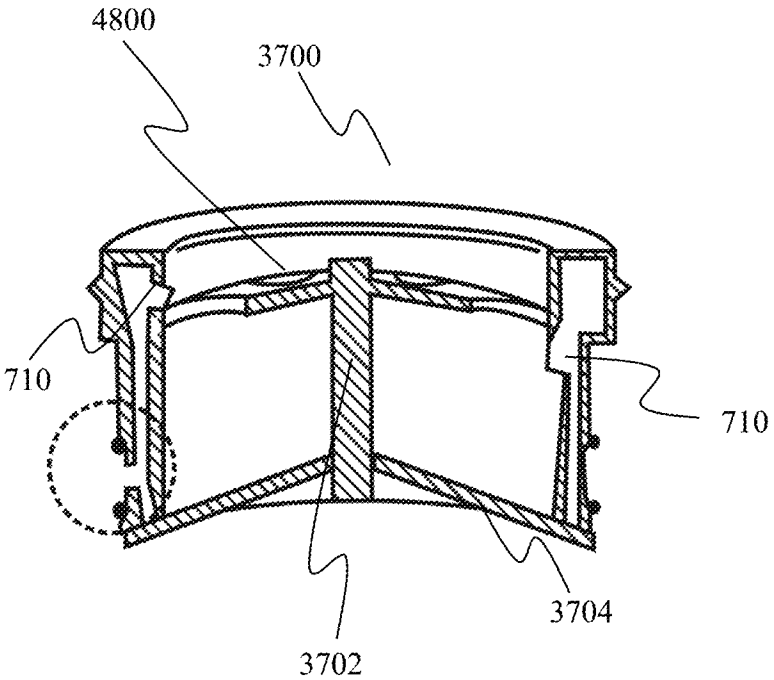

A side cutaway view of a mechanical valve cartridge 3700, utilizing an umbrella style mechanical valve 3702 with fluid pass through portions 4800 is shown in FIGS. 48A and 48B. Spray heads 710 are strategically located upstream from the sealing section 3704 of the valve 3702, so that they may force the valve 3702 open when actuated and rinse out the cartridge 3700 (as shown in FIG. 48B). The spray can be configured to rinse off the valve 3702 and the surrounding area. The spray can be combined with the downstream flushing (not shown). The valve 3702 can sit in a housing 200 similar to that depicted previously in FIG. 13 and reside above the trap 104. FIGS. 49A and 49B are very similar to FIGS. 48A and 48B; however in this example, the high pressure spray heads 710 are also located in the valve seat itself. This allows the flushing water to clean off the valve seat with each spray, while simultaneously rinsing the valve 3702 and feeding the trap 104—which can be configured similarly to the one seen in FIG. 13.

Figure 50:
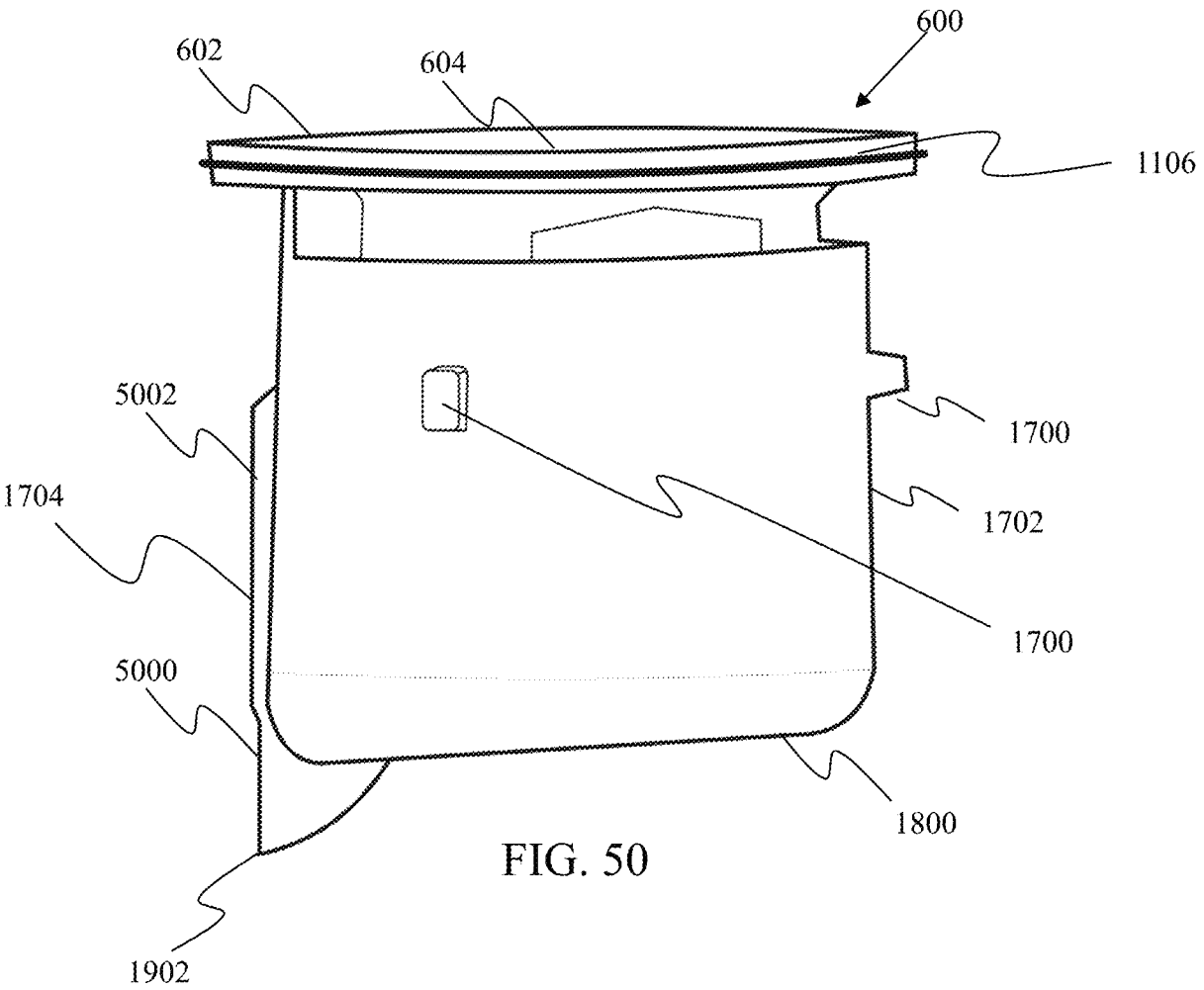
FIG. 50 is an illustration of a left side view a cartridge with a pour spout, which channels and aims the flushing water, according to the present invention.
Figure 51:
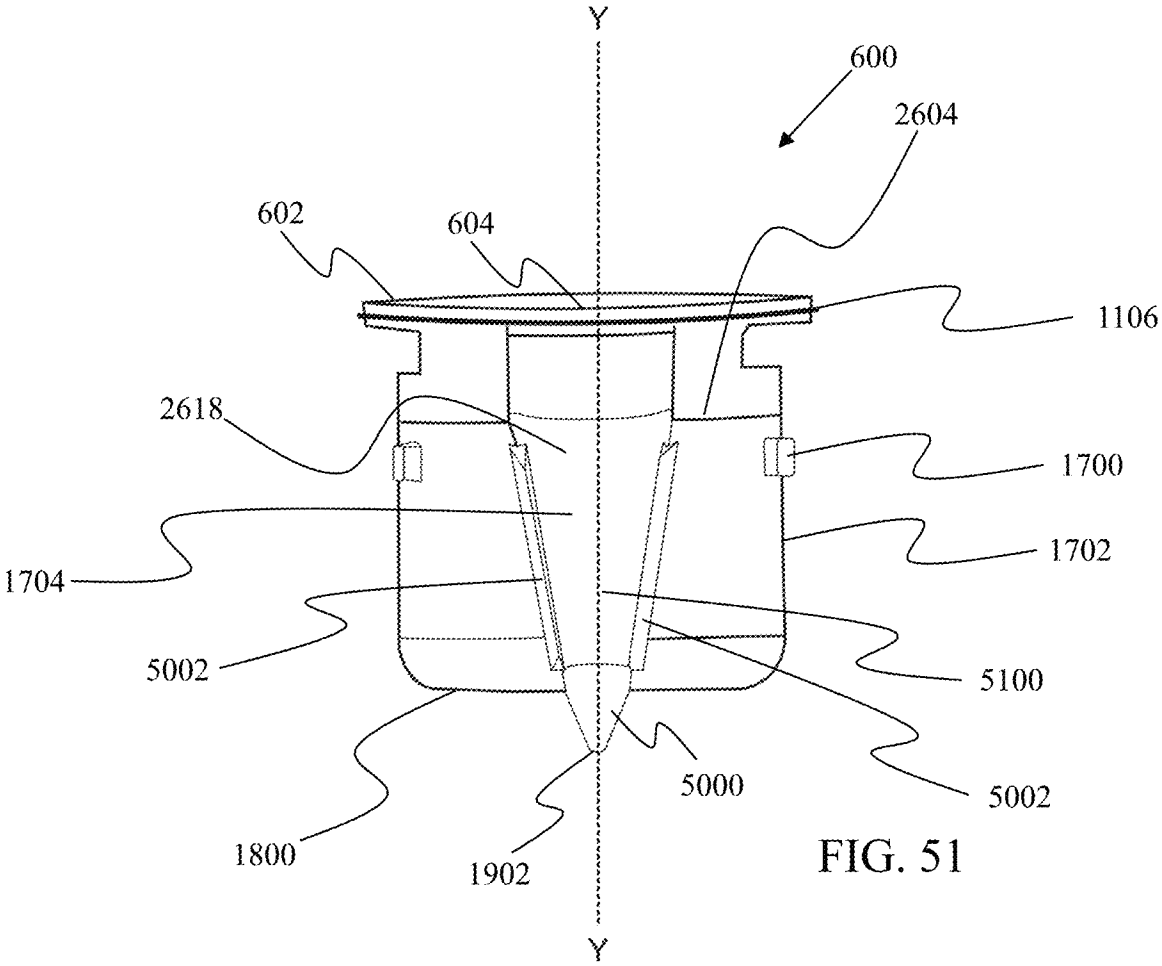
FIG. 51 is an illustration of a back view of a cartridge, as seen in FIG. 50, here a discharge section is shaped in a downwardly tapered fashion, creating a narrowing channel and a pour spout is shown at the end of channel, according to the present invention.

A left side view of another fluid trap type cartridge 600 according to the present invention is presented in FIG. 50. The cartridge 600 has a pour spout 5000 which channels and aims the flushing water once introduced. A side seal 5002 protrudes from the cartridge 600 so that when the cartridge 600 is inserted into a housing (not shown), flushing water can be focused into the pour spout 5000. A back view of the cartridge 600 of FIG. 50 is shown in FIG. 51. In this case, the discharge section 2618 is shaped in a downwardly tapered fashion, creating a narrowing channel. The pour spout 5000 can be seen at end of the channel. The discharge section 2618 has a dividing wall 5100 that is angled in a non-perpendicular fashion with respect to the top wall flange 602.

Figure 52:
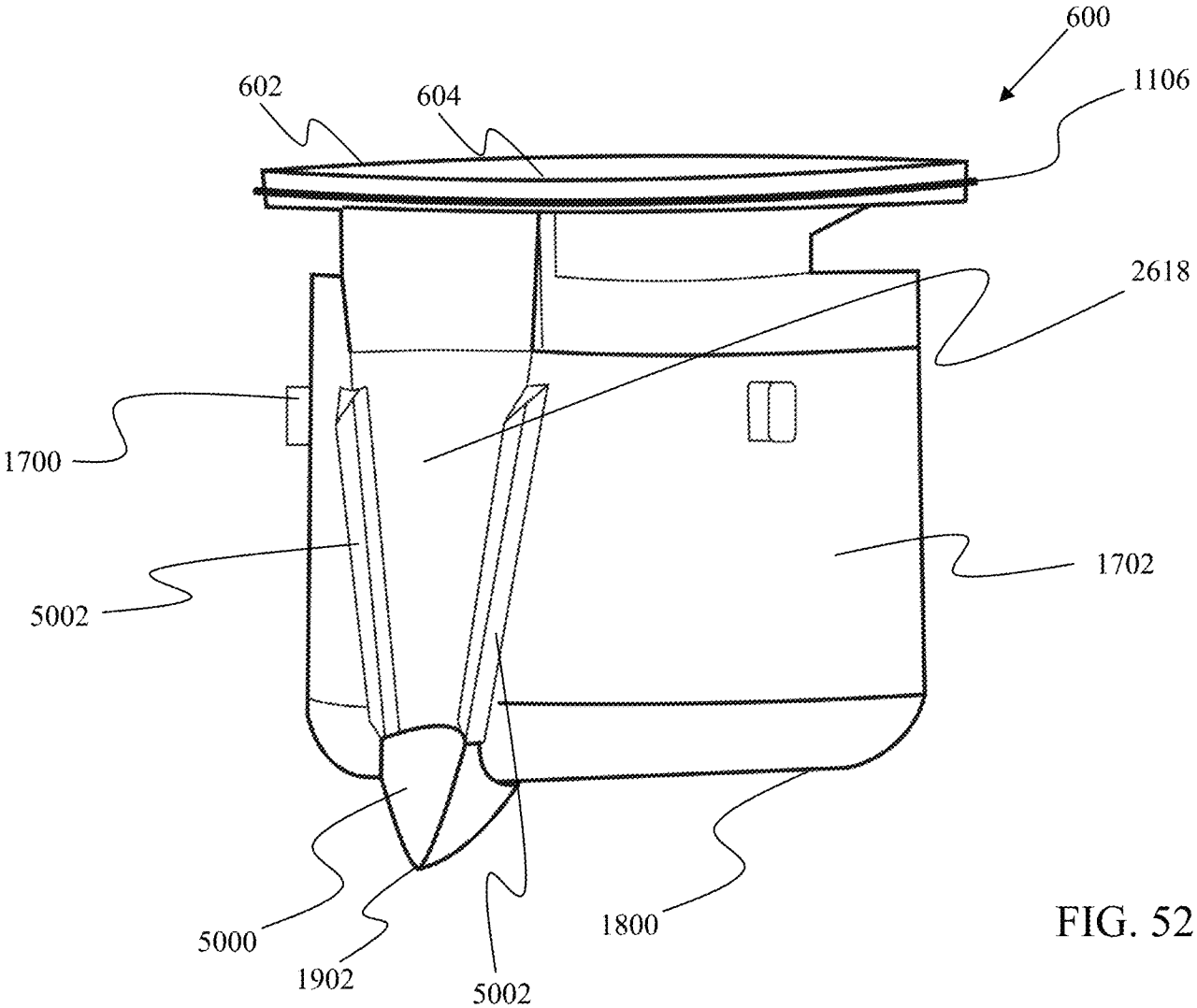
FIG. 52 is an illustration of an isometric view of a cartridge, as seen in FIGS. 50 and 51, here a seal is shown protruding from the cartridge wall, according to the present invention.

An isometric view of a cartridge 600, seen in FIGS. 50 and 51 is shown in FIG. 52. The side seal 5002 can be seen protruding from the cartridge wall 1702 so that when the cartridge 600 is inserted into the housing (not shown) flushing water can be focused in the tapering discharge section 2618.

Figure 53:
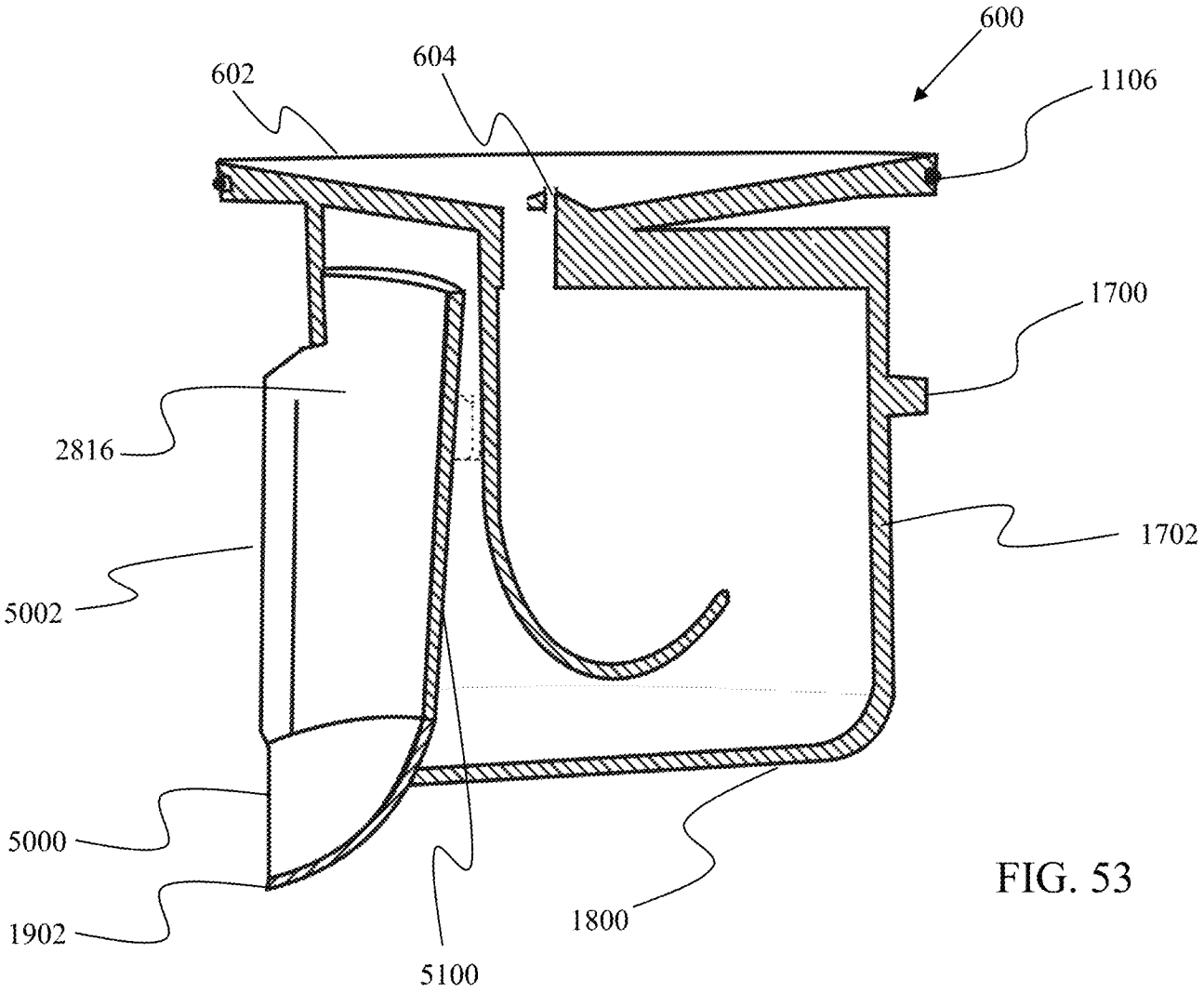
FIG. 53 is an illustration of a left side cutaway view of the cartridge as seen in FIGS. 50, 51, and 52; here a discharge section is shown to have a dividing wall which is angled in a non-perpendicular fashion in respect to a top flange, according to the present invention.

A left side cutaway view of the same cartridge 600 shown in FIGS. 50, 51, and 52 is shown in FIG. 53. Here, the discharge section 2618 can be seen to have a dividing wall 5100 which is angled in a non-perpendicular fashion in respect to the top flange 602. The seal 5002 can be seen protruding from the cartridge 600.

Figure 54:
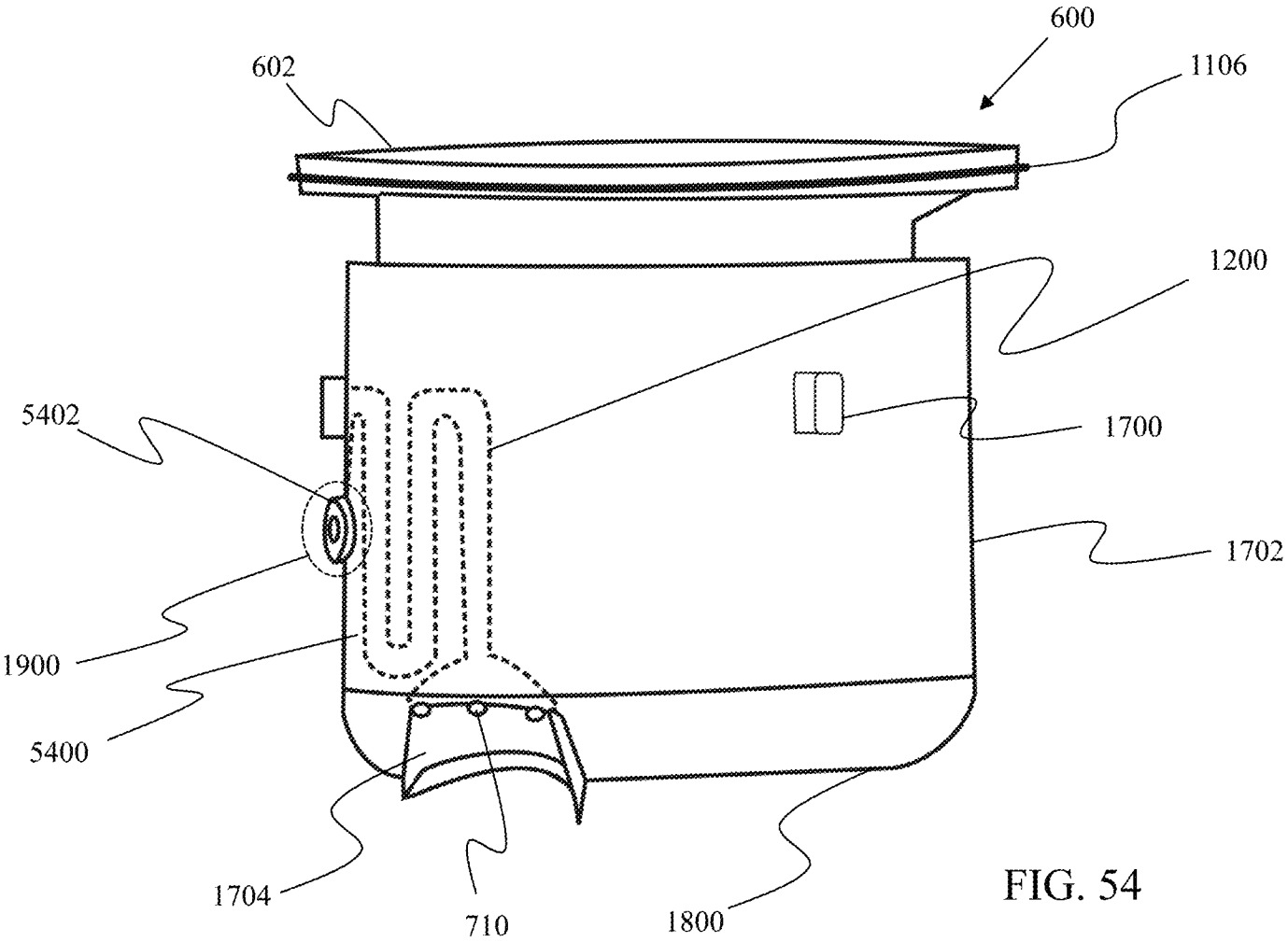
FIG. 54 is an illustration of an isometric view of a cartridge for a waterless urinal, according to the present invention.

An isometric view of another cartridge for a waterless urinal according to the present invention is shown in FIG. 54. This cartridge 600 has an integral trap 5400 as part of the built-in fluid channel 1200. The flushing water forms a trap 5400 in the cartridge 600, sealing the flushing system from potentially harmful gasses. A compliant sealing surface 5402 is provided at the flushing fluid receiving portion 1900. A side cutaway view of a cartridge 600 with a sealing mechanism similar to that shown in FIG. 54 is presented in FIG. 55, but inserted into a housing 200. As shown in FIG. 54, the cartridge 600 has a compliant sealing surface 5402, which forms a water-tight seal with an area of the housing wall sealing surface 5500 that protrudes in a proud manner. In this way, the compliant sealing surface 5402 is only in contact with the housing wall sealing surface 5500 when the cartridge is fully inserted, making insertion and removal more user-friendly and easier. Once the compliant sealing surface 5402 and the wall sealing surface 5500 are mated, a water tight seal is formed that allows the channel to be fluidly coupled with the fluid directing portions 710 (spray heads).

Figure 55:
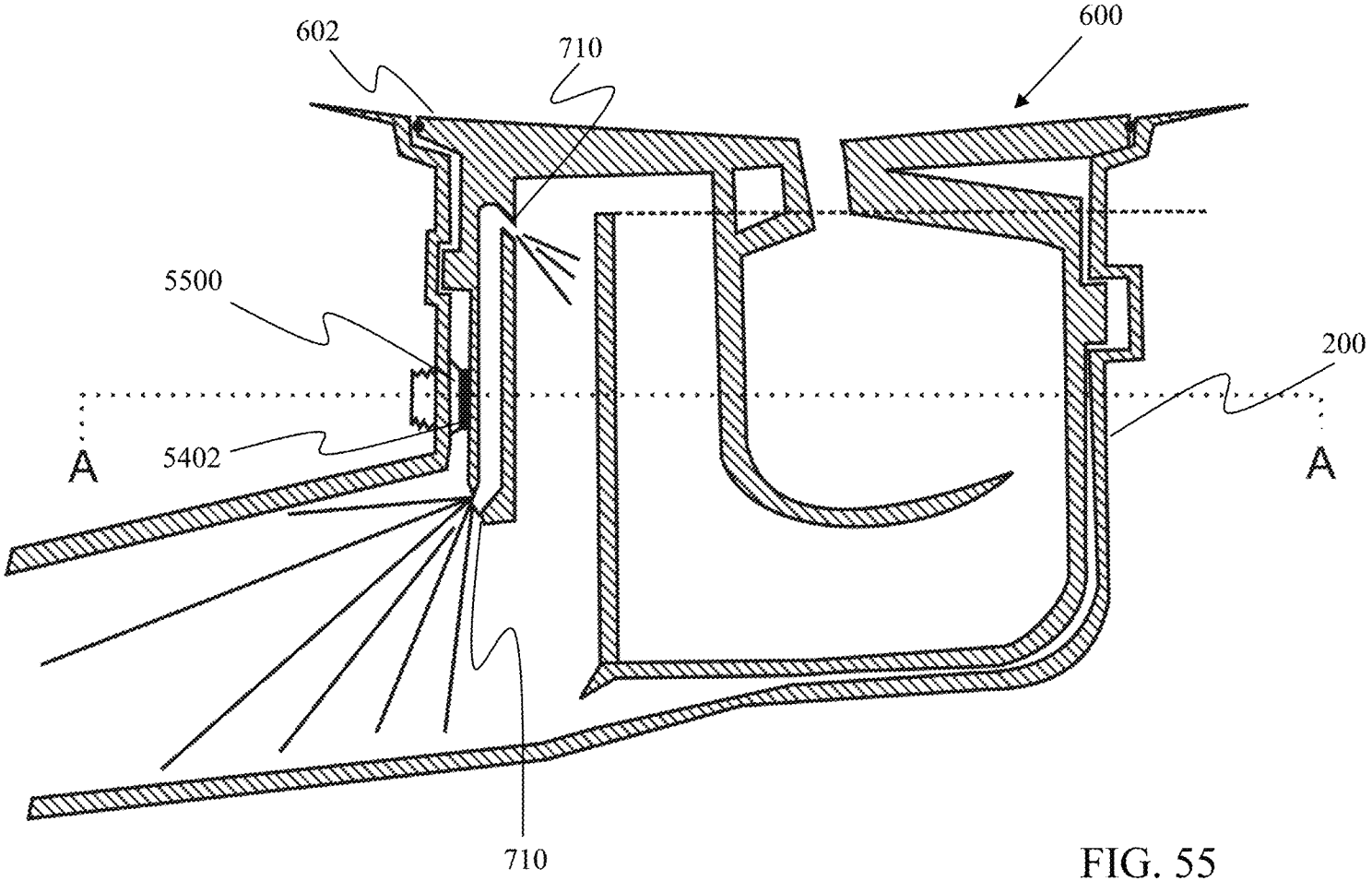
FIG. 55 is an illustration of a side cutaway view of the cartridge shown in FIG. 54 and inserted into a housing, according to the present invention.
Figure 56:
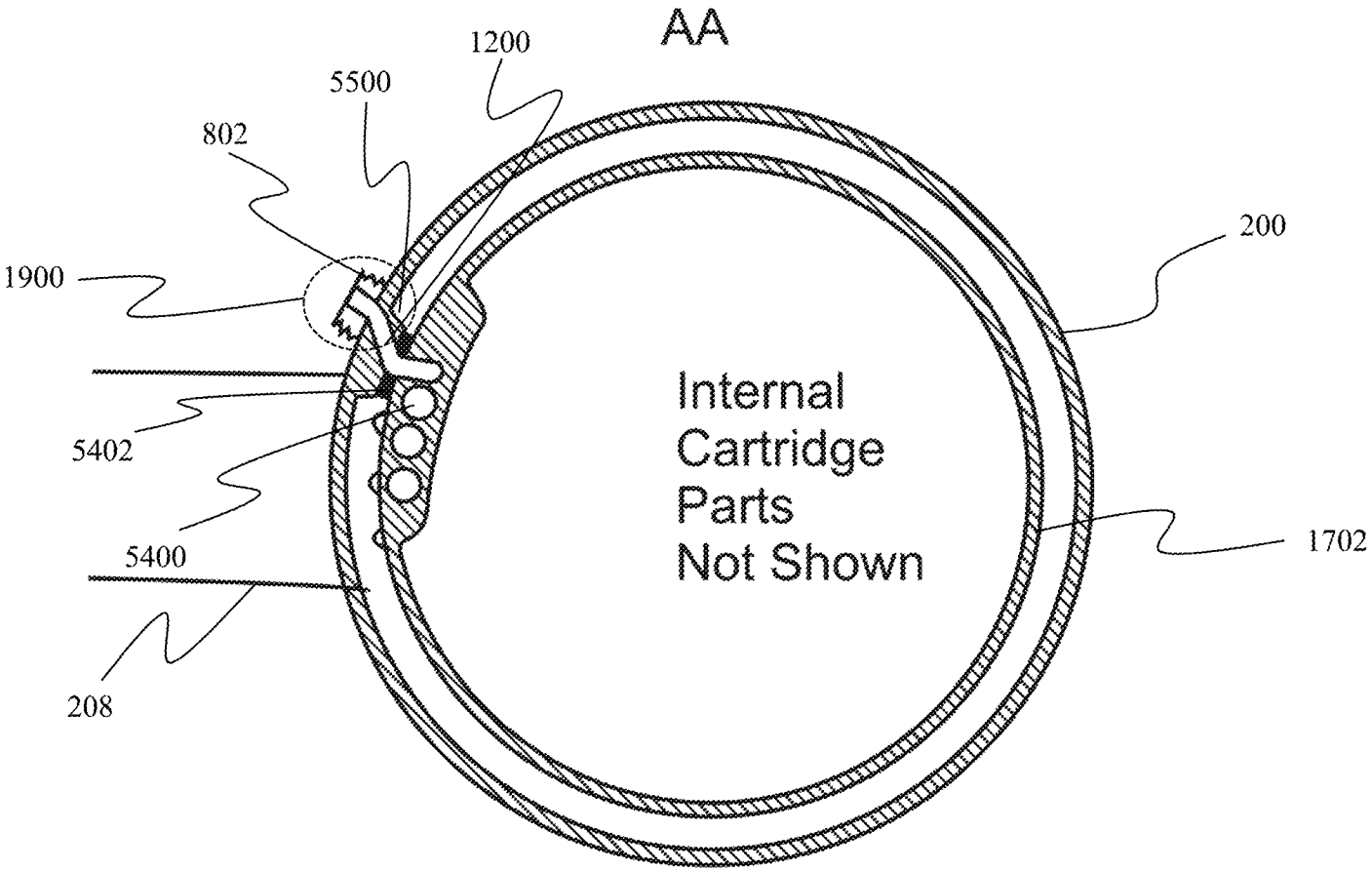
FIG. 56 is an illustration of a cross section (taken through line AA seen in FIG. 55) showing a compliant sealing surface mating with a raised sealing surface when a cartridge is fully inserted (internal cartridge parts are not shown), according to the present invention.

A cross section taken through the line AA shown in FIG. 55 is depicted in FIG. 56, illustrating the compliant sealing surface 5402 mating with the raised sealing surface 5500 when the cartridge is fully inserted. The fluid channel 1200 enters at an oblique angle to allow the flushing water to swirl in a tangential manner with respect to the inside of the housing wall 200.

Figure 57:
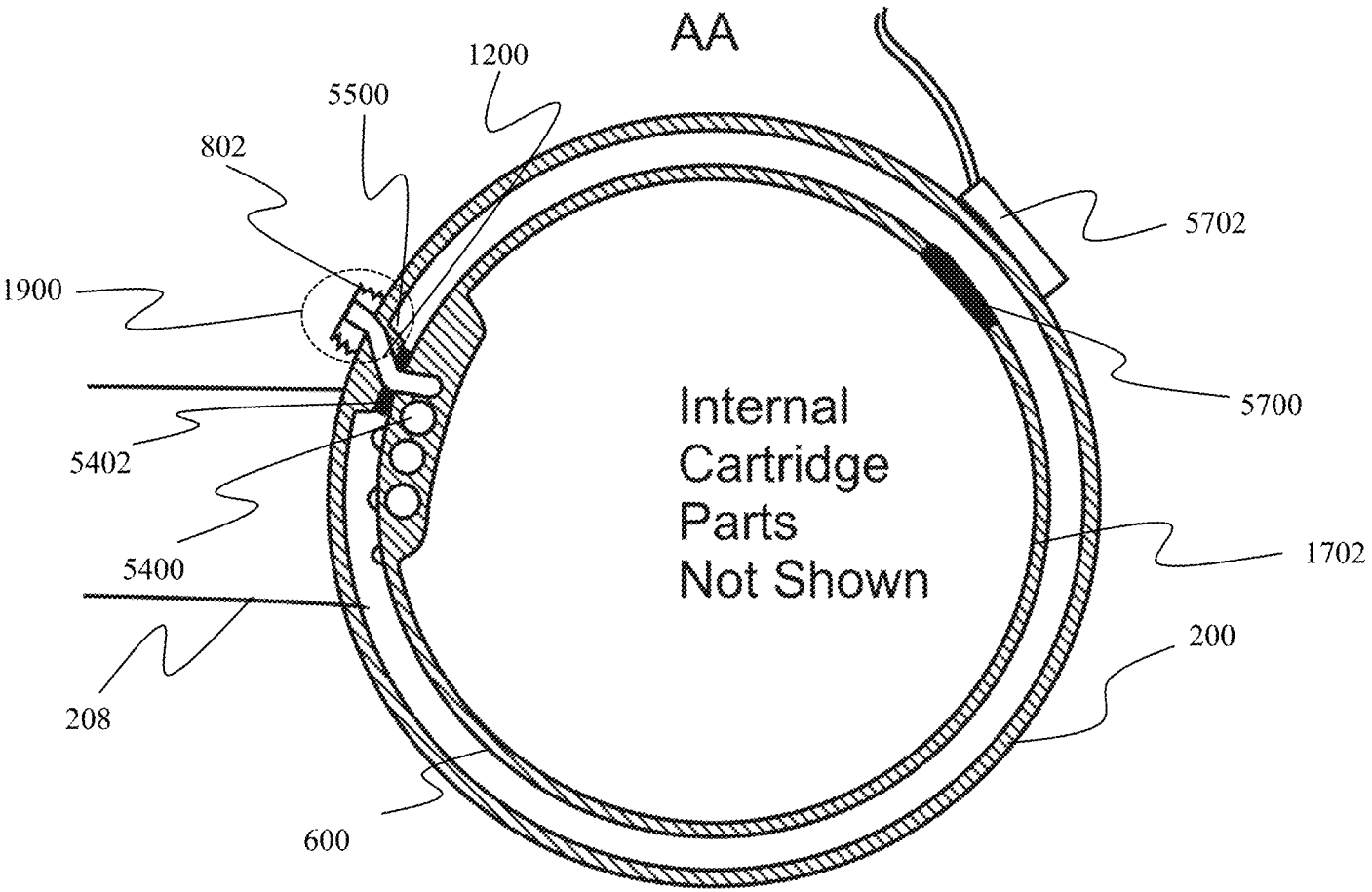
FIG. 57 is an illustration of a cross section (taken through line AA seen in FIG. 55) of a cartridge and a housing for a hybrid flushing system urinal where an actuator has been built into the cartridge wall, so that when fully inserted into the housing, the cartridge serves the purpose of turning the switch on, allowing a flushing system to operate, according to the present invention.

A cross sectional view, taken through the line AA shown in FIG. 55, of the cartridge and the housing for the hybrid flushing system is presented in FIG. 57. In this case, an actuator 5700 has been built into the cartridge wall 1702, so that when the cartridge 600 is fully inserted into the housing 200, the presence of the cartridge 600 is detected by a detector 5702 on the housing 200. When the presence of a cartridge 600 is detected, the flushing system is allowed to operate. Non-limiting examples of detection mechanisms include activation by magnet, a radio frequency-identification (RFID) detector, electrical detection of the presence of a cartridge, feature recognition, and other non-touching detection mechanisms such as laser/infrared sensing, and barcode scanning.

Figure 58:
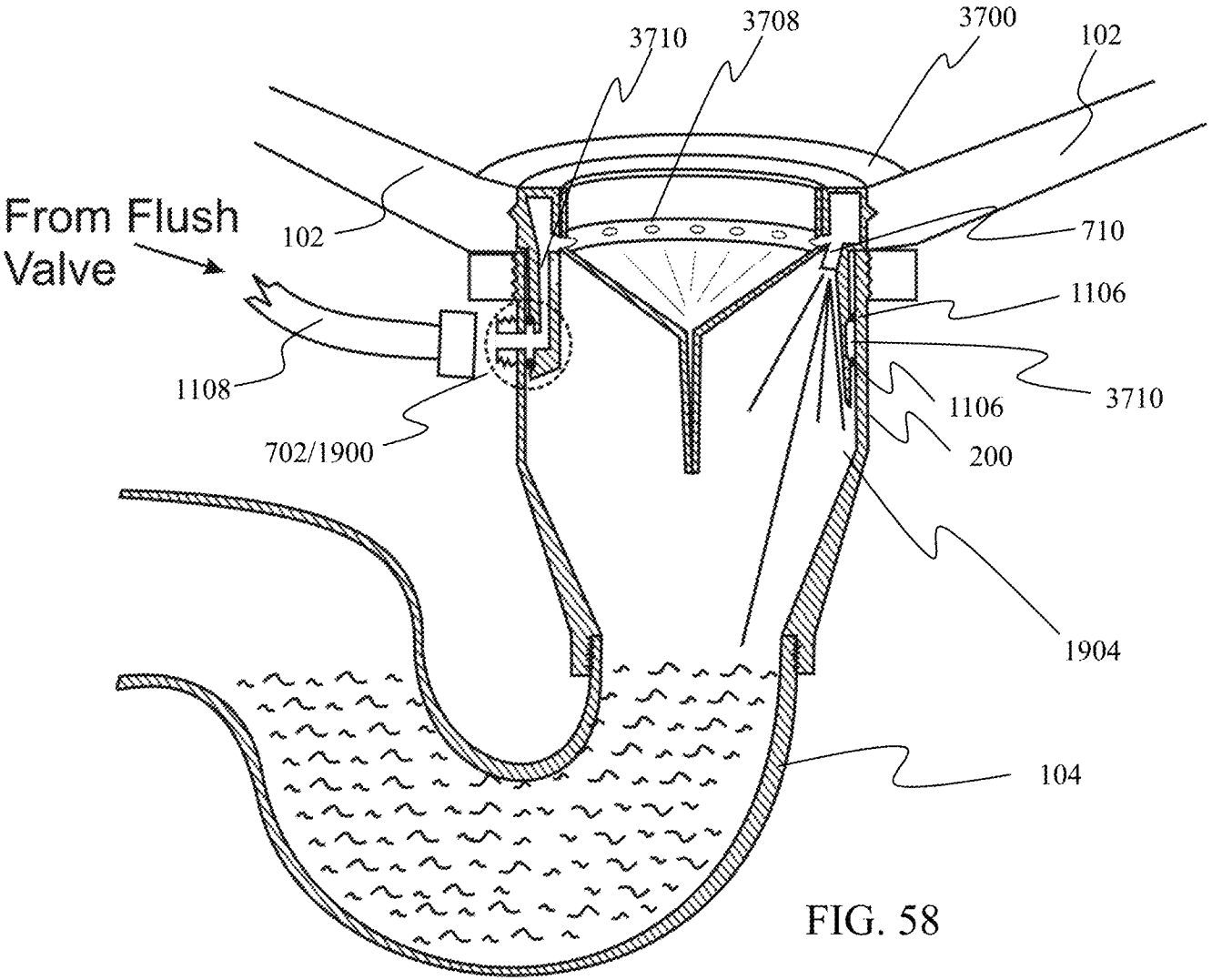
FIG. 58 is an illustration of a hybrid flushing system with a mechanical valve cartridge, a housing, and a P-trap assembled to a urinal and cross sectioned, according to the present invention.
Figure 59:
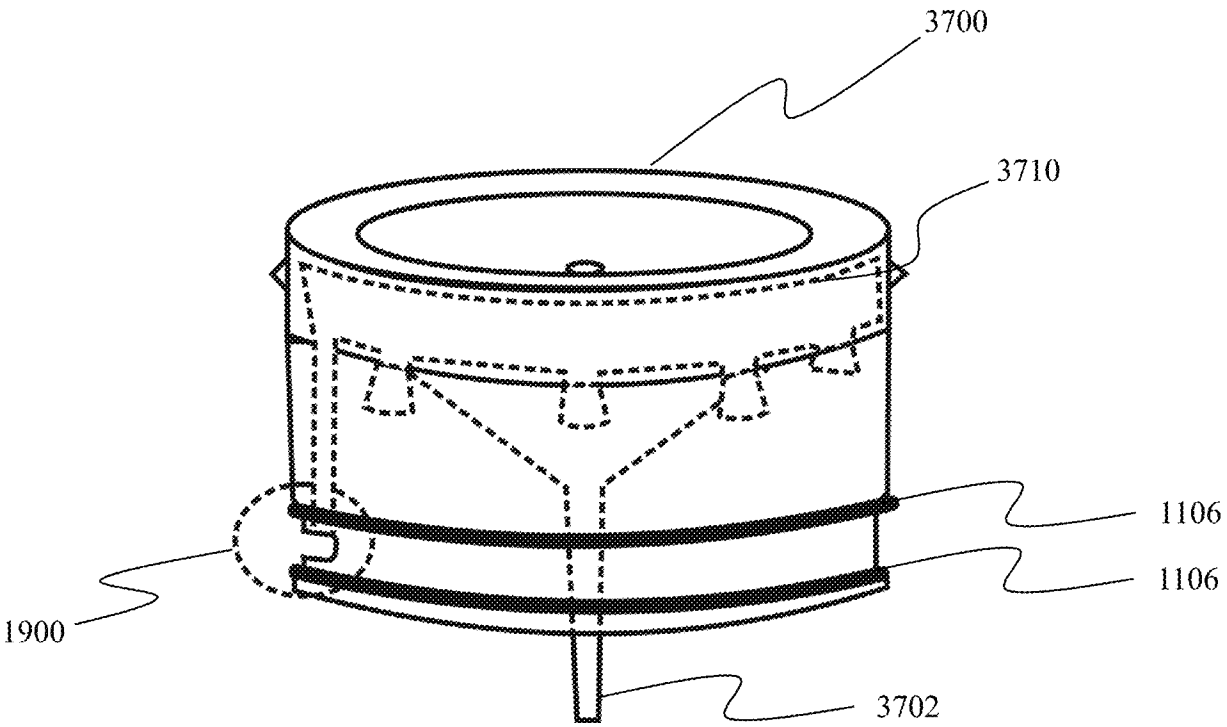
FIG. 59 is an illustration of a mechanical valve cartridge with the O-rings wrapping around the valve helping to form a fluid channel once inserted into a housing as seen in FIG. 58, according to the present invention.

A cross-section of a hybrid flushing system with a mechanical cartridge 3700, a housing 200, and a P-trap 104 assembled to a urinal 102 is shown in FIG. 58. Although, the P-trap 104 is not required for functionality, it can be added to meet legal (code) requirements. Here, the housing fluid interface 702 and the cartridge fluid interface 706 are mated together when the cartridge is installed into the housing body 200. The O-rings 1106 form a fluid-tight seal, keeping the flushing water in the fluid communication channel 3710. The flushing fluid enters through the supply line 1108, through the housing flushing fluid interface 702 and the cartridge flushing fluid receiving portion 1900, up the fluid communication channel 3710, and out the spray nozzles 710. The spray 1904 can be seen cleaning the walls of the housing body and replacing the P-trap fluid. The standing urine in the P-trap 104 will precipitate solids which will eventually clog the P-trap 104 if it is not rinsed out. The O-rings 1106 form a circumferential fluid channel between the housing body wall 200 and the valve cartridge 3700. A cartridge 3700 with the O-rings 1106 wrapping thereabout is shown in FIG. 59. The O-rings 1106 help to form a fluid channel once the cartridge 3700 is inserted into the housing as seen in FIG. 58. The cartridge flushing fluid receiving portion 1900, depicted as communicating with the internal fluid communication channel 3710 (shown with a dashed line), directs flushing fluid through the cartridge to the spray nozzles 710 and the rinse holes 3708.

Figure 60:
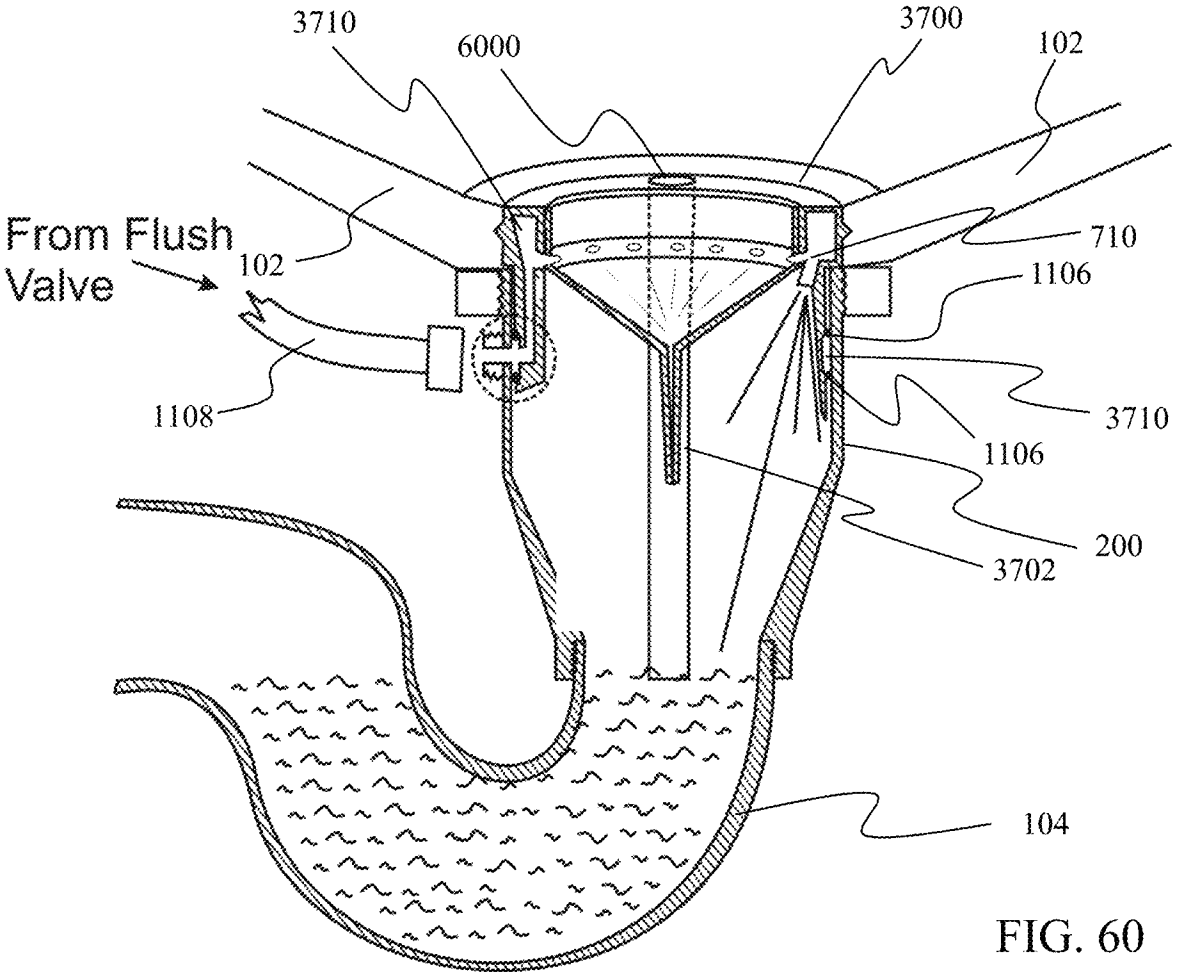
FIG. 60 is an illustration of a side cross section of a mechanical valve cartridge with the spray heads and an internal fluid channel inserted into a urinal, where a vent has been added to allow back pressure, should it occur, to flush back to the upstream side of the valve thus protecting the flushing water line, according to the present invention.
Figure 61:
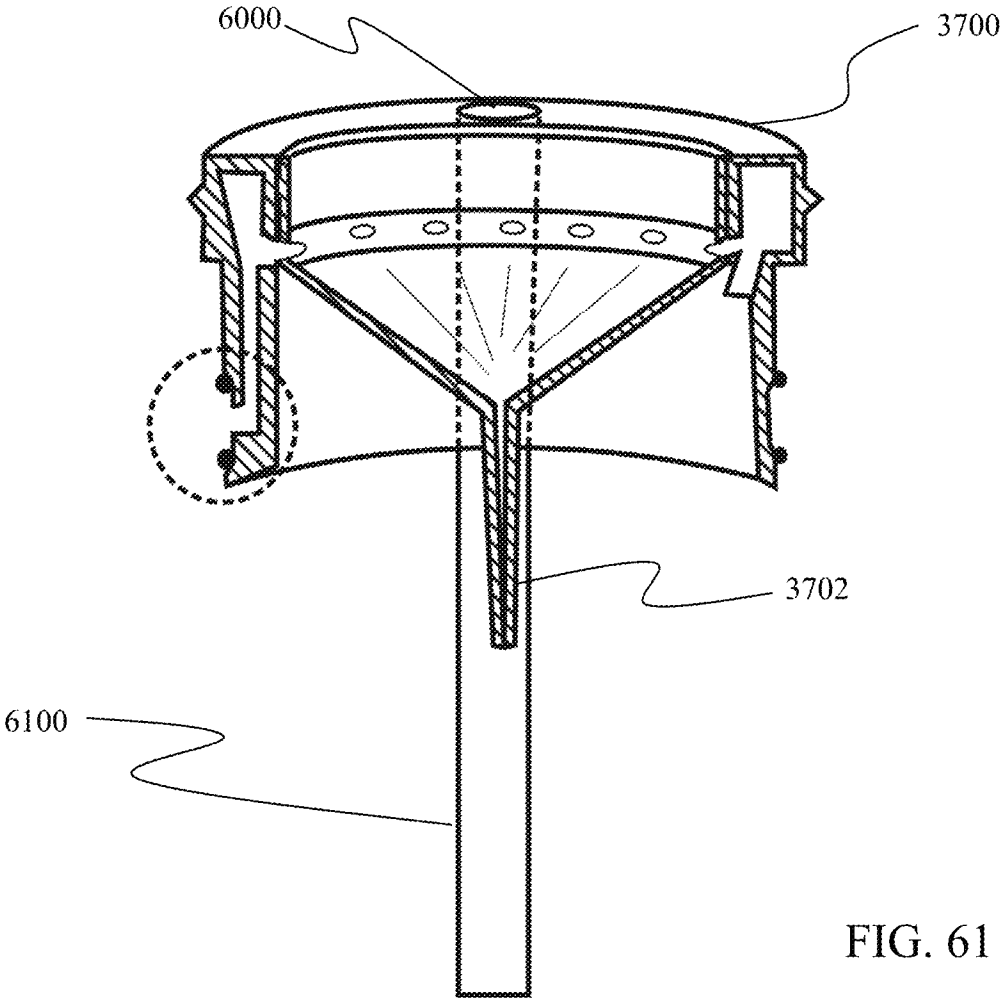
FIG. 61 is an illustration of a side cross section of the mechanical valve cartridge seen in FIG. 60, according to the present invention; now removed and shown separately.

A side cross section of a cartridge 3700 with the spray heads 710 and an internal fluid channel 3710 and inserted into a urinal 102 is shown in FIG. 60. In this configuration, a vent 6000 has been added to allow the back pressure to flush back to the upstream side of the valve. The vent 6000 has a vent tube extending down into the liquid resting in the trap 104, so that it is not exposed to any gas that may build up in the housing 200 between the upstream side of the P-trap 104 and the downstream side of the valve 3702. A mechanical valve 3702 for a hybrid flushing system is shown in FIG. 61, with vents installed to allow communication between the atmosphere and the trap—should a back flow occur. FIG. 61 illustrates the cartridge 3700 as seen in FIG. 60, but now removed and shown separately. The vent 6000 and the vent tube 6100 are also shown. The vent tube 6100 can be designed to be long enough to reach down into the fluid resting in the trap so that any gas that builds up between the top level of the fluid and the bottom of the duck bill style valve will not be pushed into the atmosphere with each use as the trap fluid level rises during a flush or use of the urinal.

Figure 62:
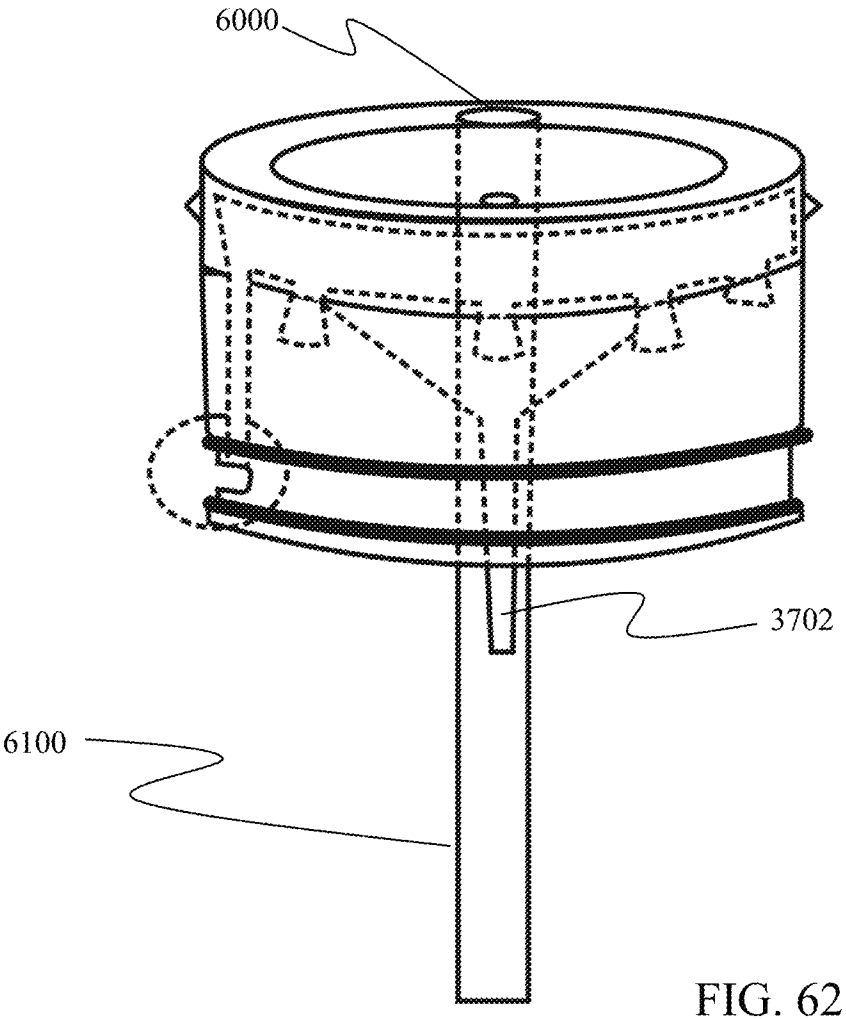
FIG. 62 is an illustration of the same mechanical valve cartridge as seen in FIG. 61, not cross sectioned, but shown with transparent walls, according to the present invention.
Figure 63:
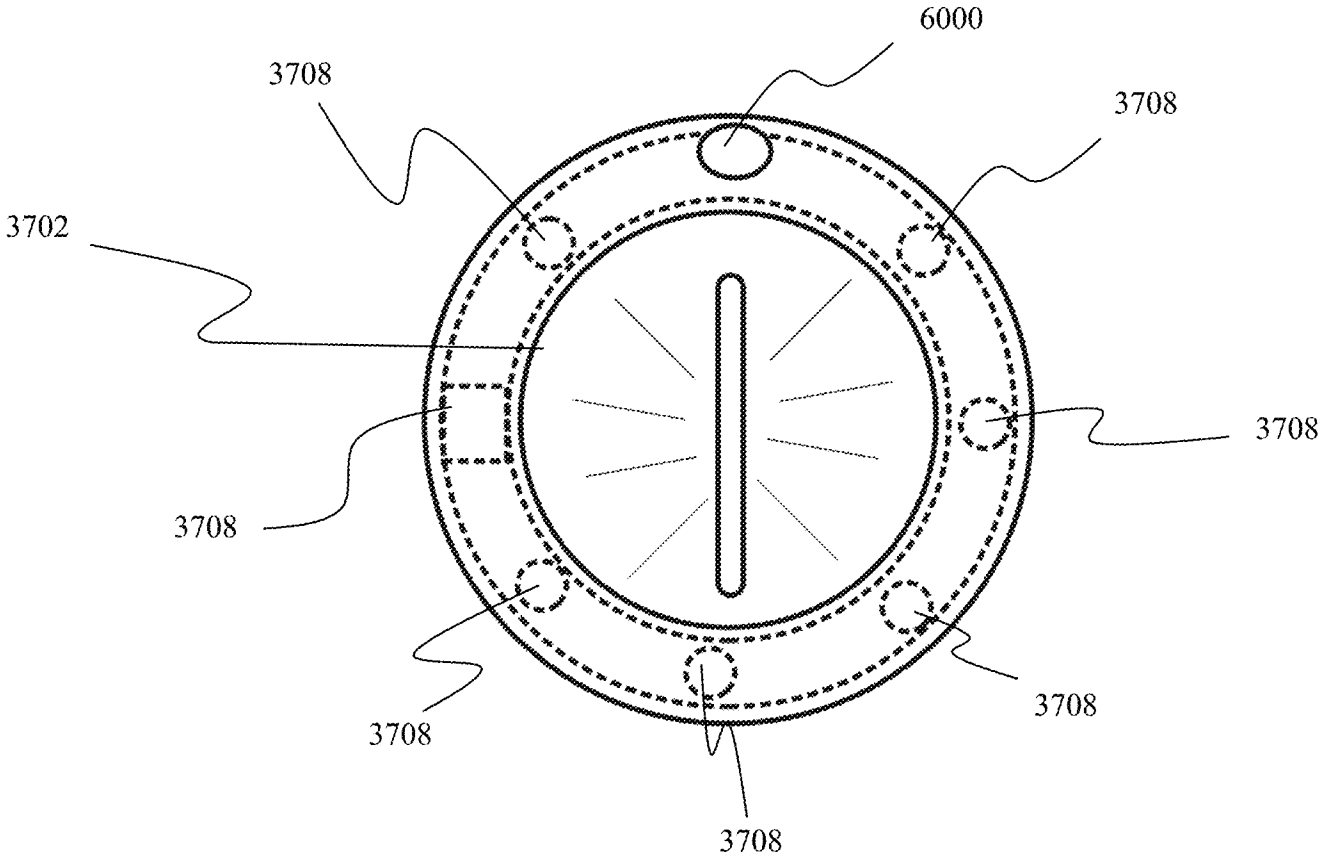
FIG. 63 is an illustration of the mechanical valve cartridge seen in FIGS. 60, 61, and 62 in top view looking down on the upstream side of the cartridge, according to the present invention.

The same cartridge 3700 as seen in FIG. 61 is shown in FIG. 62, but here it is not cross sectioned. The vent tube 6100 can be seen extending below the valve 3702, with the vent 6000 on the upstream side of the valve 3702. This vent 6000 and the vent tube 6100 serve to create a valve bypass for the air and water. The same cartridge 3700 as seen in FIGS. 60, 61, and 62 is shown in FIG. 63. In this case, a top view is shown looking down on the upstream side of the cartridge 3700. The vent 6000, which serves as a bypass to the valve 3702, can be seen on the upper most portion of the cartridge 3700.

(4) Housing/Cartridge Combinations and Other Aspects

To this point, the housing and cartridge aspects of the invention have been described along with some housing/cartridge combinations. This section will explore further aspects more directed toward the housing/cartridge combinations. Reference to prior figures will be made as necessary for a better understanding of the invention. Before delving into further aspects of the invention, a discussion of the prior art cartridge/housing combinations are presented.

Figure 64:
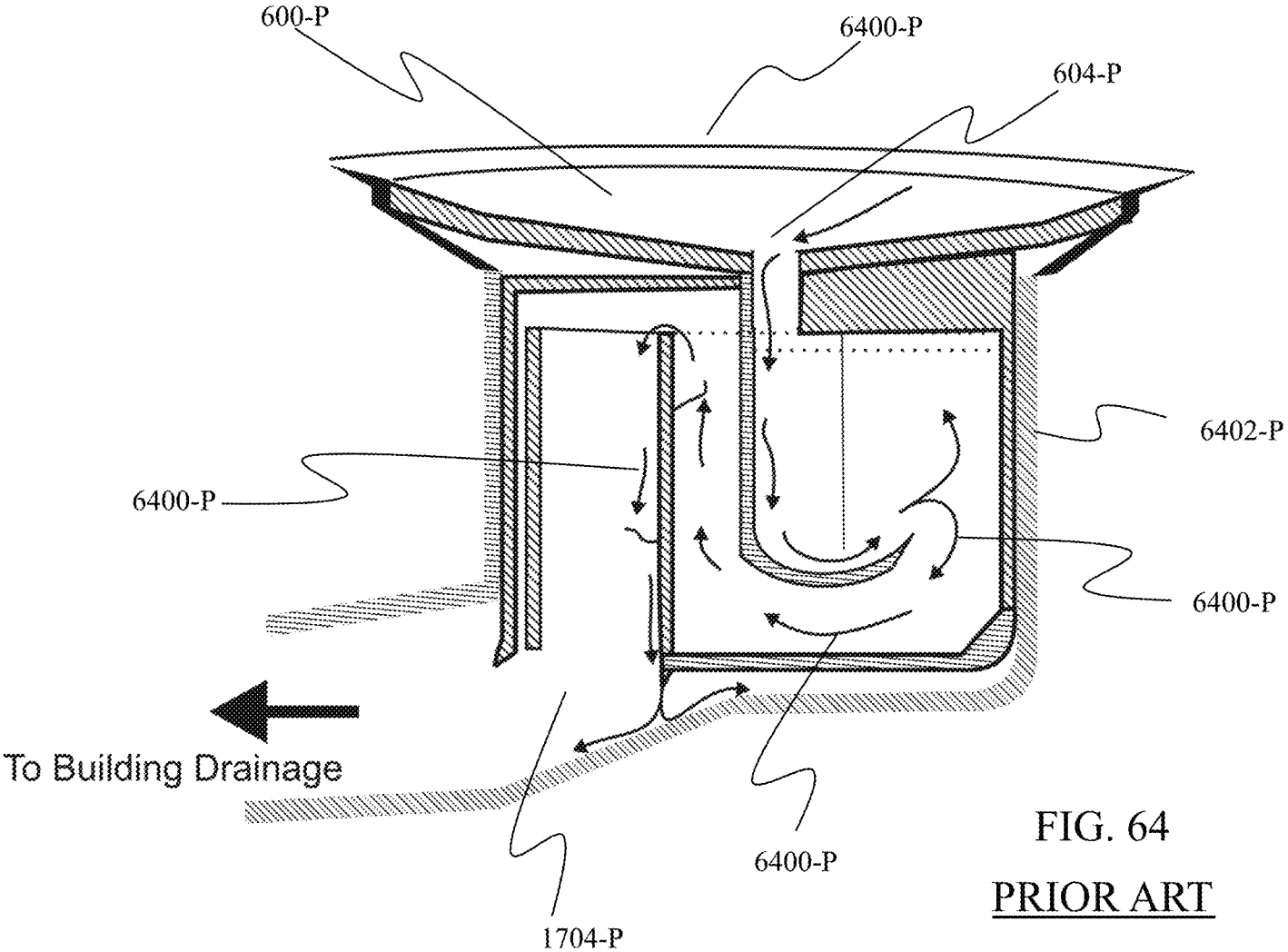
FIG. 64 PRIOR ART
FIG. 64 is an illustration of a left side cutaway view of a prior art cartridge inserted into a prior art housing with the arrows depicting the flow of effluent.

A left side cutaway view of a prior art cartridge 600-P inserted into a prior art housing 200-P is shown in FIG. 64. The arrows 6400-P depict how the flow of the effluent enters the cartridge 600-P at inlet 604-P, travels through the cartridge 600-P, and exits the cartridge at exit 1704-P. The various components and chambers of the cartridge 600-P are as previously described.

Figure 65:
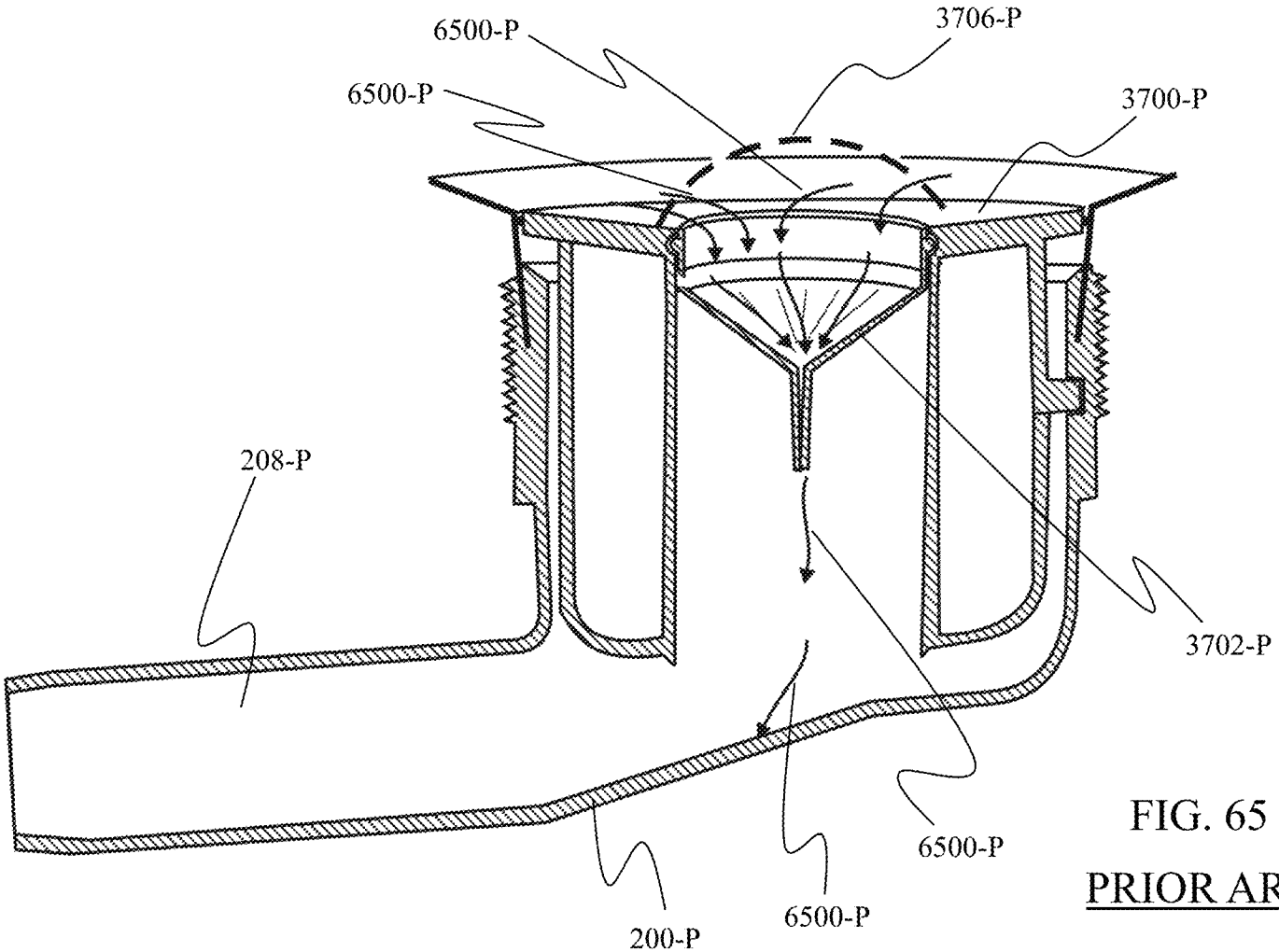
FIG. 65 PRIOR ART
FIG. 65 is an illustration of a left side cutaway view of a prior art mechanical cartridge, inserted into a prior art housing.
Figure 66:
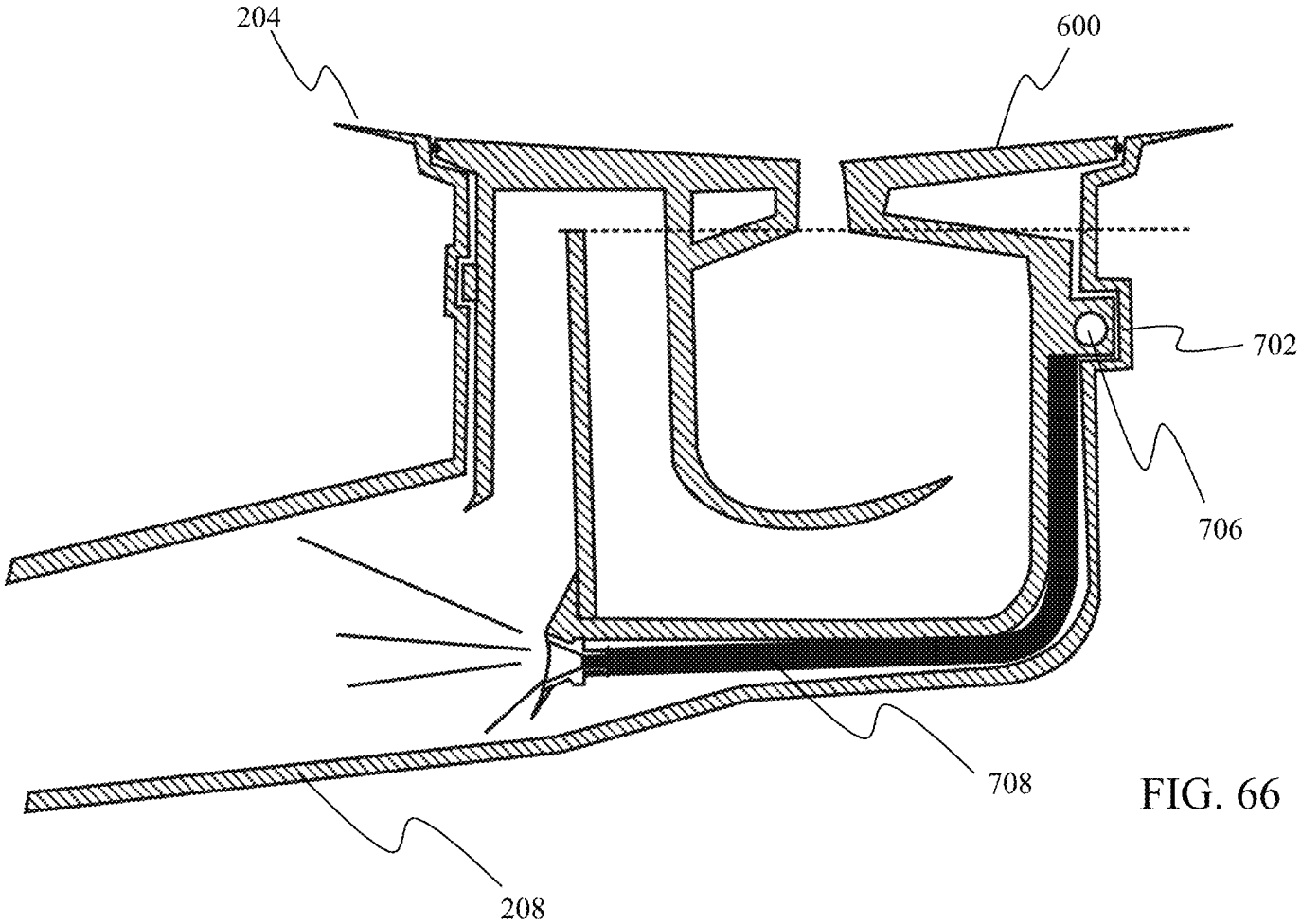
FIG. 66 is an illustration of a cutaway side view of a housing with a housing fluid interface at a side wall of the housing and with a cartridge and an under-mount self-clean mechanism focused on a housing exit tube, according to the present invention.

A left side cutaway view of a prior art mechanical valve cartridge 3700-P is shown in FIG. 65, which includes a mechanical valve 3702-P, inserted into a prior art housing 200-P. The arrows 6500-P depict how the flow of the effluent enters the cartridge through the debris screen 3706-P and exits the housing 200-P at exit 208-P An illustration of a cutaway side view of a housing 200 with a housing fluid interface 702 at a side wall of the housing 200 and with a cartridge 600 and an under-mount self-clean mechanism focused on a housing exit tube is shown in FIG. 66. Note that the cartridge configuration is similar to that of FIG. 29 and the housing 200 is similar to that of FIG. 7A. The housing fluid interface 702 mates with a cartridge fluid interface 706 to provide flushing fluid thereto.

Figure 67:
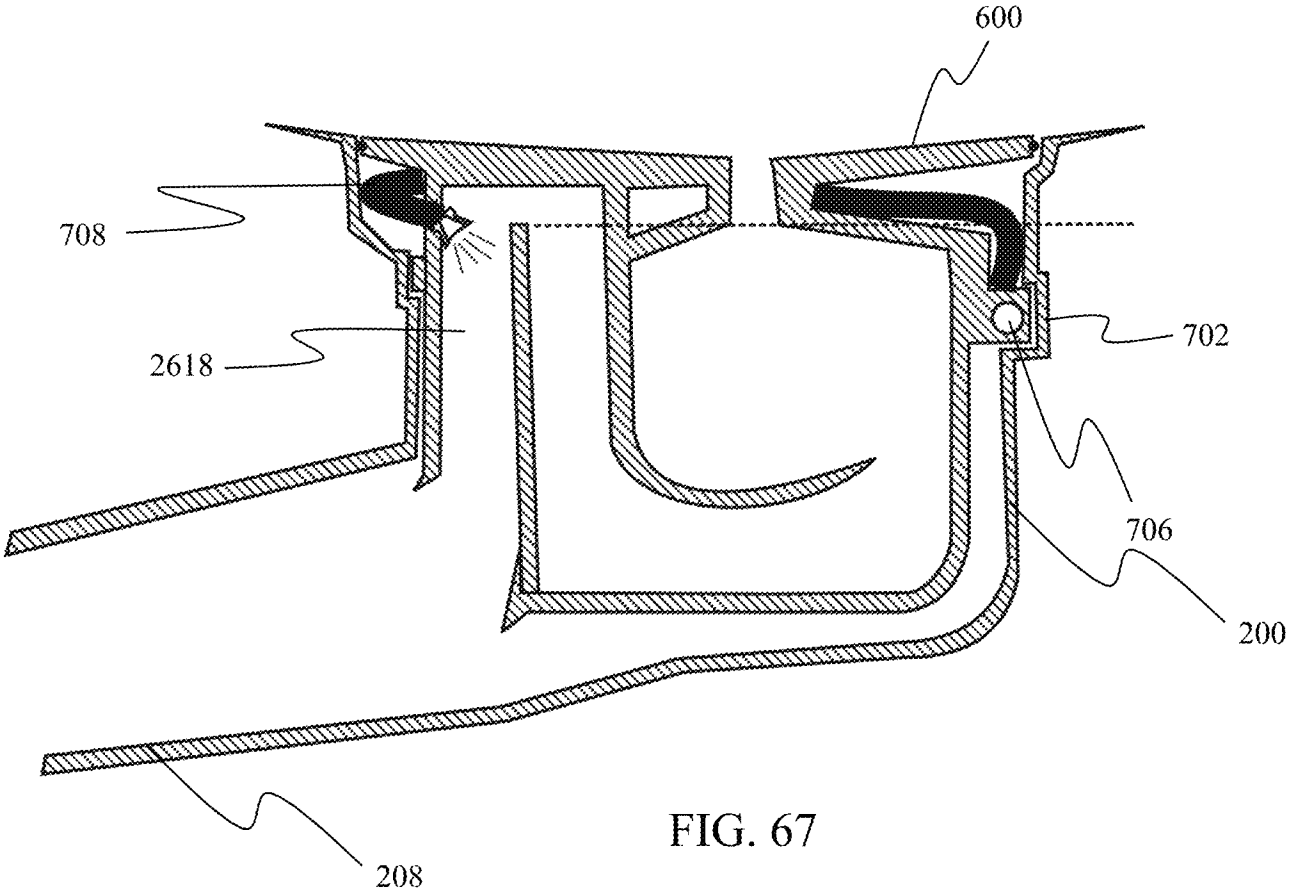
FIG. 67 is an illustration of a cutaway side view of a housing with a housing fluid interface at a side wall of the housing and with a cartridge and a side-mount self-clean mechanism focused on the cartridge discharge section, according to the present invention.

An illustration of a cutaway side view of a housing 200 with a housing fluid interface 702 at a side wall of the housing 200 and with a cartridge 600 and a side-mount self-clean mechanism focused on the cartridge discharge section 2618 is shown in FIG. 67. Note that the cartridge 600 configuration is similar to that of FIG. 30 and the housing 200 is similar to that of FIG. 7A.

Figure 68:
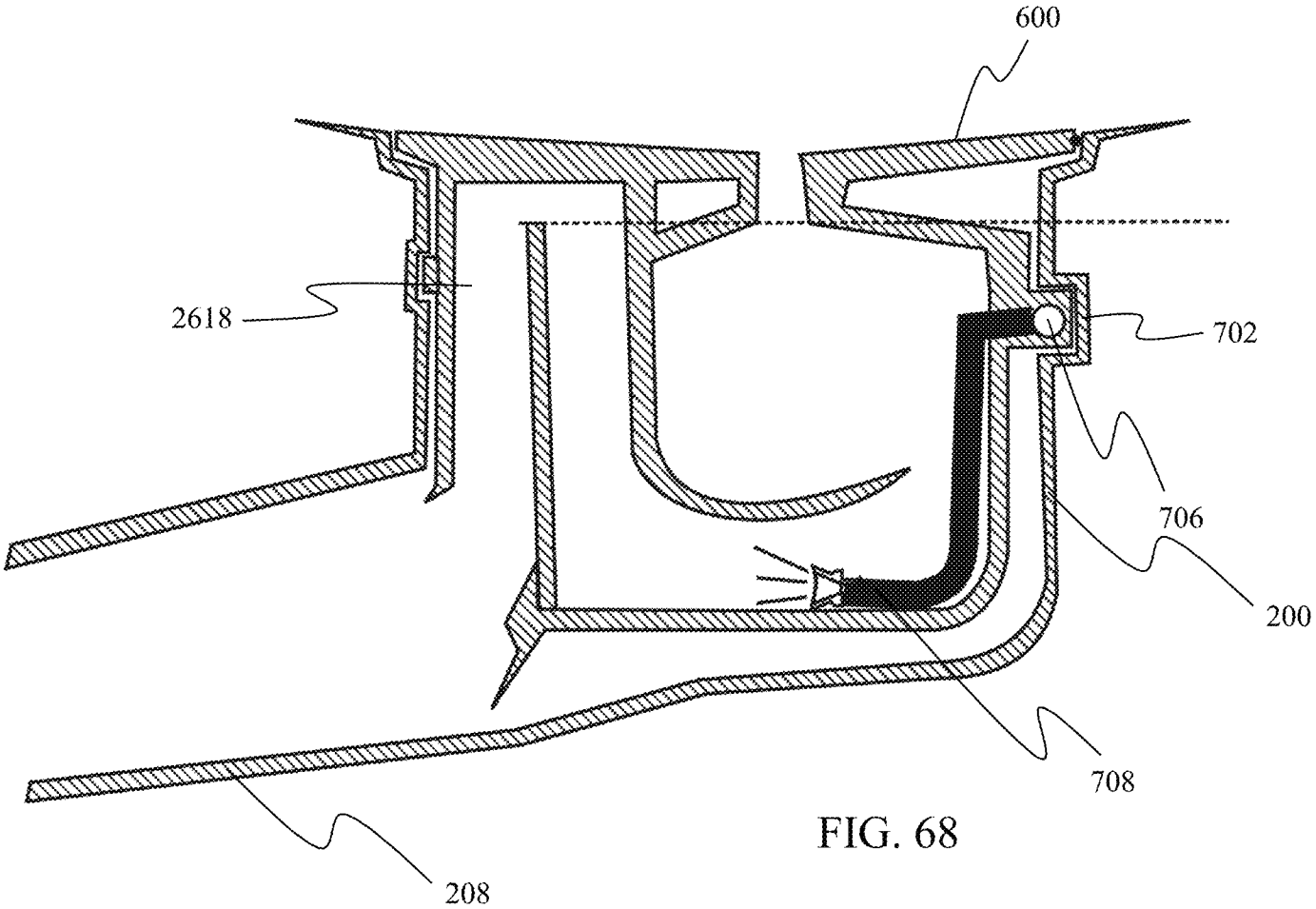
FIG. 68 is an illustration of a cutaway side view of a housing with a housing fluid interface at a side wall of the housing and with a cartridge and an internal self-clean mechanism focused on the cartridge internal chambers, according to the present invention.

An illustration of a cutaway side view of a housing 200 with a housing fluid interface 706 at a side wall of the housing 200 and with a cartridge 600 and an internal self-clean mechanism focused on the inside of the cartridge 600 is shown in FIG. 68. Note that the cartridge 600 configuration is similar to that of FIG. 31 and the housing 200 is similar to that of FIG. 7A.

Figure 69:
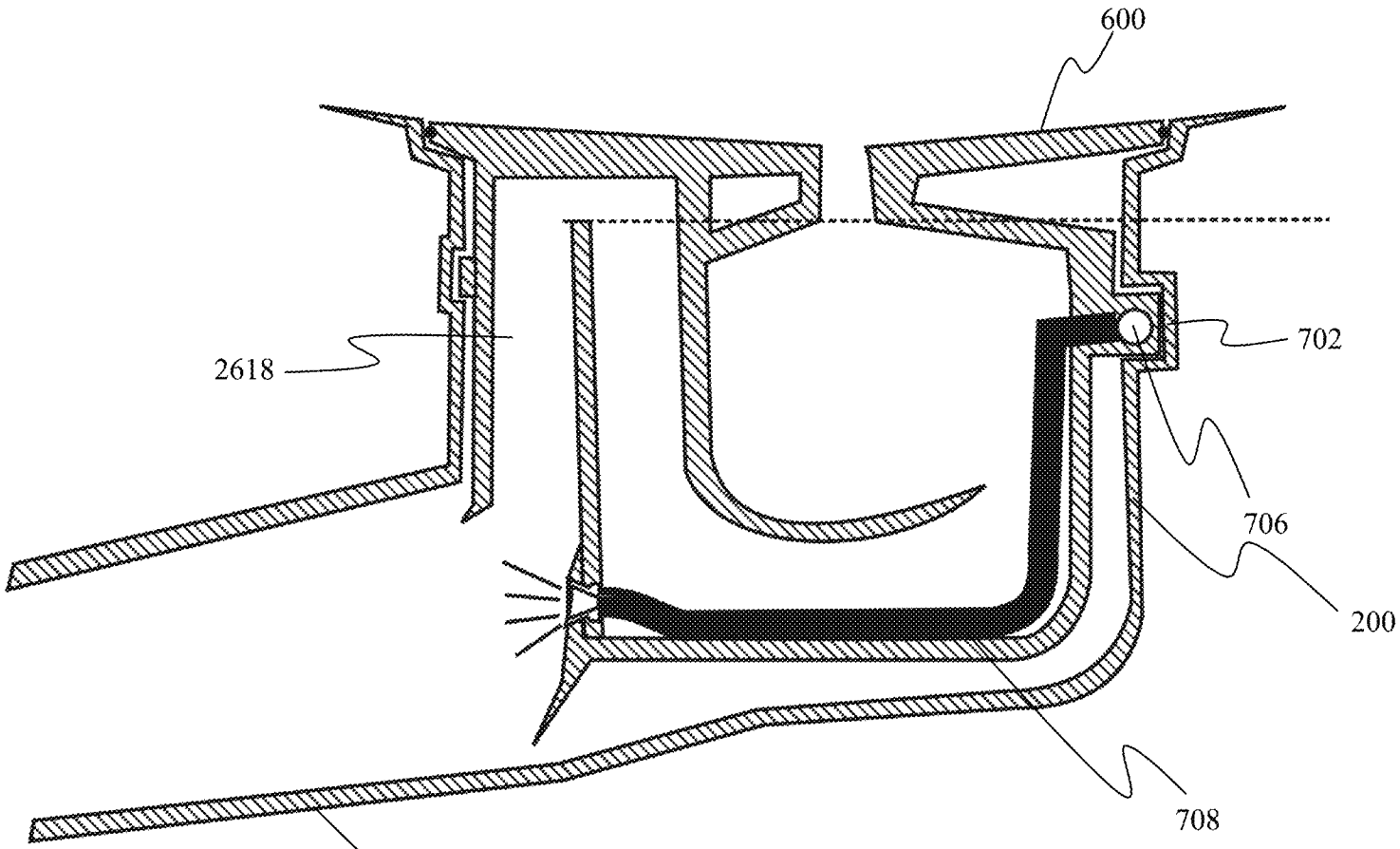
FIG. 69 is an illustration of a cutaway side view of a housing with a housing fluid interface at a side wall of the housing and with a cartridge and an internal self-clean mechanism focused on a housing exit tube, according to the present invention.

An illustration of a cutaway side view of a housing 200 with a housing fluid interface 706 at a side wall of the housing 200 and with a cartridge 600 and an internal self-clean mechanism focused into the exit tube 208 of the housing 200 is presented in FIG. 69. Note that the cartridge 600 configuration is similar to that of FIG. 32 and the housing 200 is similar to that of FIG. 7A.

Figure 70:
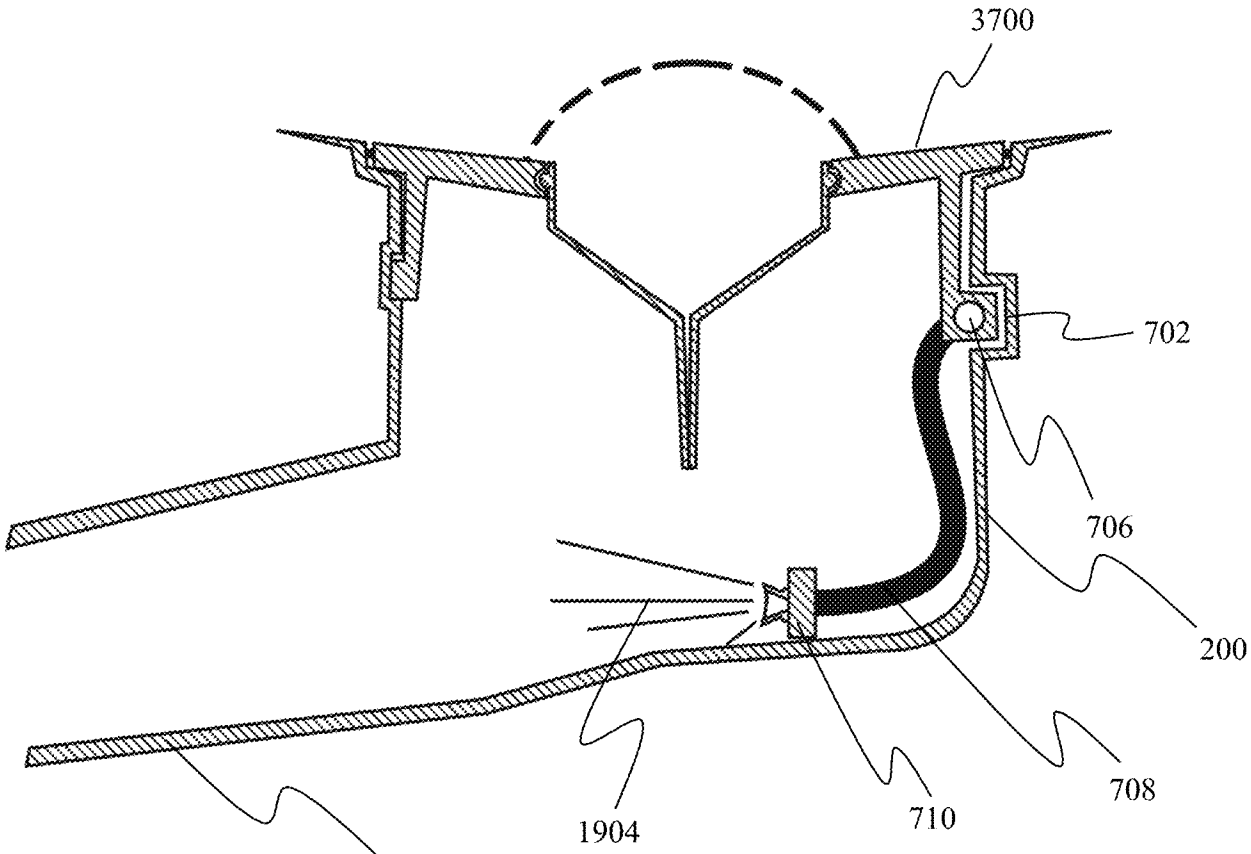
FIG. 70 is an illustration of a cutaway side view of a mechanical valve cartridge with a spray kit installed in a housing with a housing fluid interface on a side wall, according to the present invention.

An illustration of a cutaway side view of a mechanical valve cartridge 3700 with a spray kit installed in a housing 200 with a housing fluid interface 702 on a side wall of the housing 200 is presented in FIG. 70. Note that the cartridge 3700 configuration is similar to that of FIG. 37 and the housing 200 is similar to that of FIG. 7A.

Figure 71:
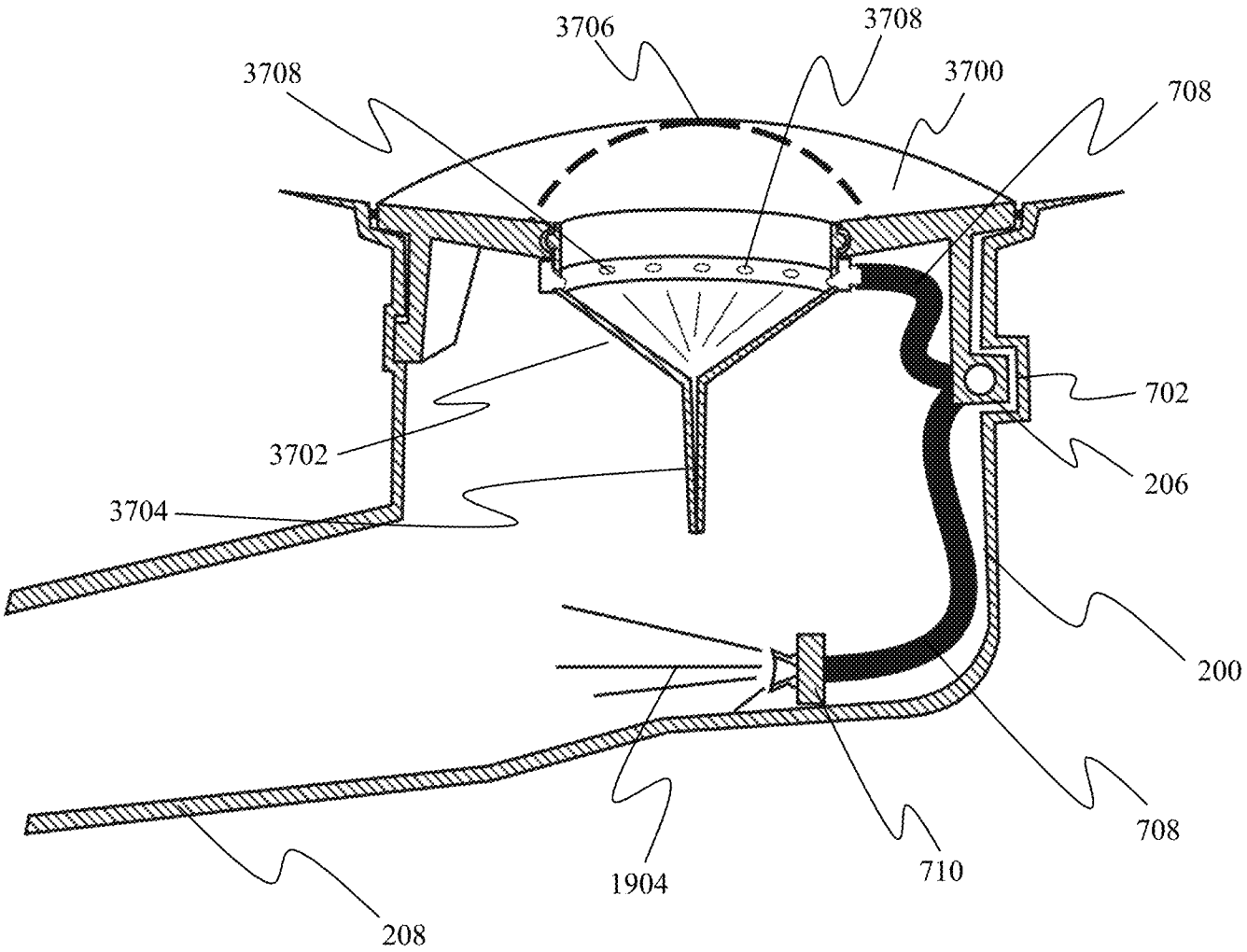
FIG. 71 is an illustration of a cutaway side view of a mechanical valve and a cartridge with a spray kit and a self-rinse valve installed in the cartridge and connected to a water transfer tube above a valve sealing section, according to the present invention.
Figure 72:
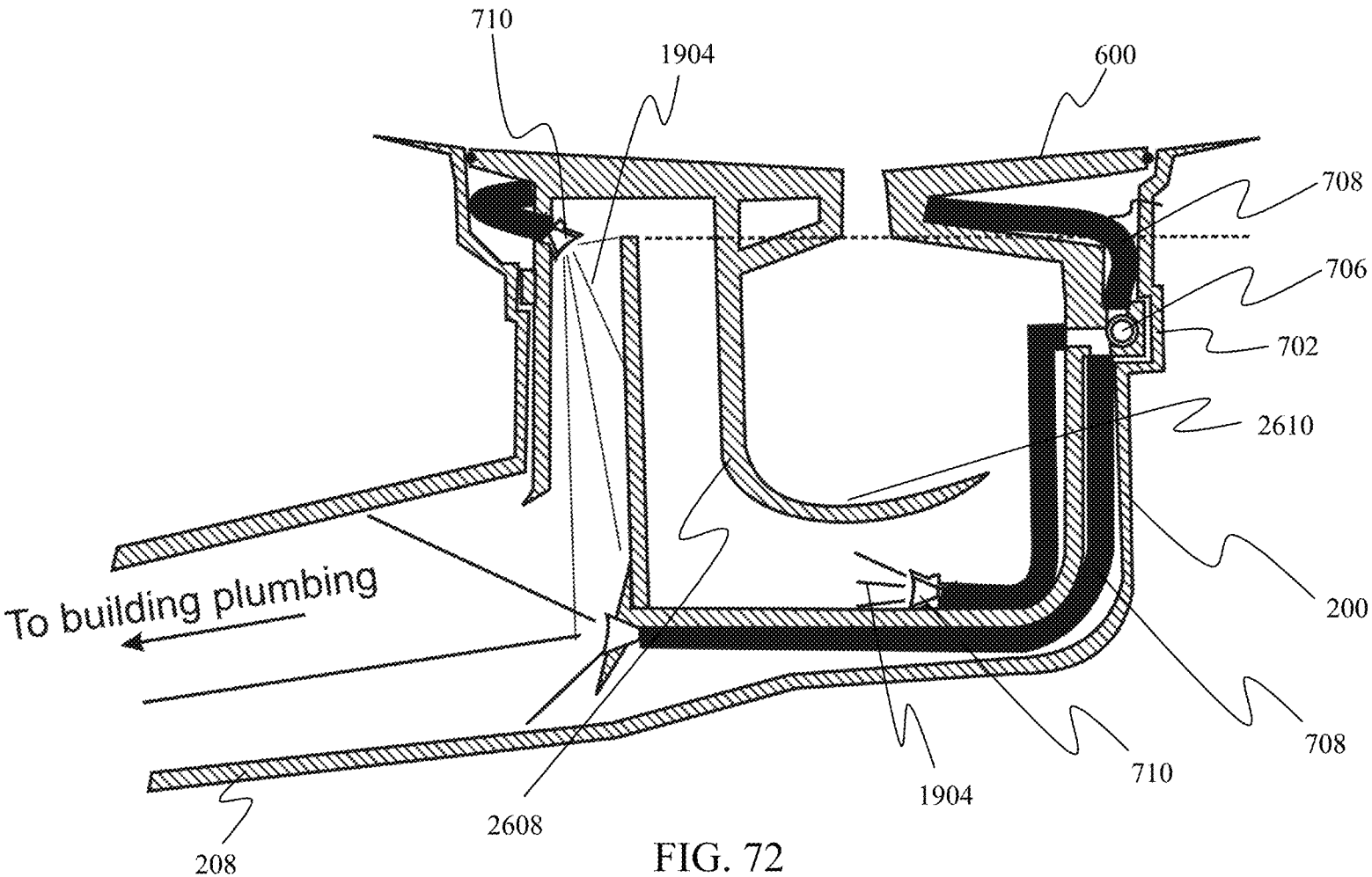
FIG. 72 is an illustration of a cutaway side view of a cartridge and a housing where the water for pressure cleaning the struvite buildup areas enters from a side through the housing and the cartridge fluid interfaces, passing from the housing to the cartridge in a water tight seal, according to the present invention.

FIGS. 71 and 72 both depict examples of the combination spray locations. FIG. 71 shows a mechanical cartridge 3700 which can provide flushing fluid both inside the housing 200 toward the housing exit tube 208 and surrounding areas and into the mechanical valve 3702 via rinse holes 3708. Note that the cartridge 3700 configuration is similar to that of FIG. 37 and the housing 200 is similar to that of FIG. 7A. The effect of this setup is that it rinses the valve sealing section 3704, removing buildup and odor while hitting the inside of the housing 200 with a high pressure spray.

The amount of flushing fluid that goes to either the flushing fluid directing portion 710 or the rinse holes 3708 of the mechanical valve 3702 can be controlled, for example, by the inside diameter of the water transfer tube 708 (whether it is a separate channel or built-in). For example, one of the two water transfer tubes 708 shown in FIG. 71 could be a percentage of the size of the other, thus decreasing the overall flow to one or the other. Length, tube material, rinse hole size, and the spray head are all factors in creating back pressure in the tubes and have an effect on the balance of the total volume each outlet will allow as well as overall volume.

A fluid barrier cartridge 600 in a housing 200 with multiple fluid directing portions 710 (nozzles) is shown in FIG. 72. Note that the cartridge configuration is similar to that of a combination of FIGS. 29, 30, and 31, and the housing 200 is similar to that of FIG. 7A. In this scenario, the various fluid directing portions 710 are able to focus flushing fluid into different areas of the cartridge 600 and housing 200. The amount of water sprayed from each spray head can be controlled by using different spray head diameters and/or shapes, or by varying hose diameters. Thus, the system of spray heads can be tuned to optimize where the most water goes or if the water is distributed equally to each spray head. Because the spray head 710 is placed underneath the level of the baffle 2610, the cartridge 600 will experience a washing out of a critical area. That is because a common area of buildup occurs as sediments like the struvite settle in the bottom of the cartridge. Using this high-performance combination, the cartridge 600 can be flushed out periodically, replacing the urine with flushing fluid/fresh water, diminishing the sediment from falling out of the urine as there is less urine in the trap, then flushing any existing sediment out and over outlet compartment vertical separator 2608. From there, the sediment discharge section would be rinsed and finally the housing exit 208 would be flushed out.

All of this could be done on a timed basis. Thus, in a situation with high traffic, for example, a sports arena where a traditional urinal might get flushed 30 to 40 times in an hour, a urinal utilizing the present invention could be set to flush a single time after the crowds had left, while never allowing odor to come back into the restroom. This results in a significant water savings and a significant performance improvement with the end users never having to touch the urinal at all.

In terms of components, the high pressure spray heads 710 can be an off-the-shelf type or can be built into a cartridge during the injection molding process. The cartridge is often injection molded from Acrylonitrile-Butadiene-Styrene (ABS) plastic for its inexpensive nature and toughness, but many other materials such as Dow ST801 and other nylons are also appropriate.

Figure 73:
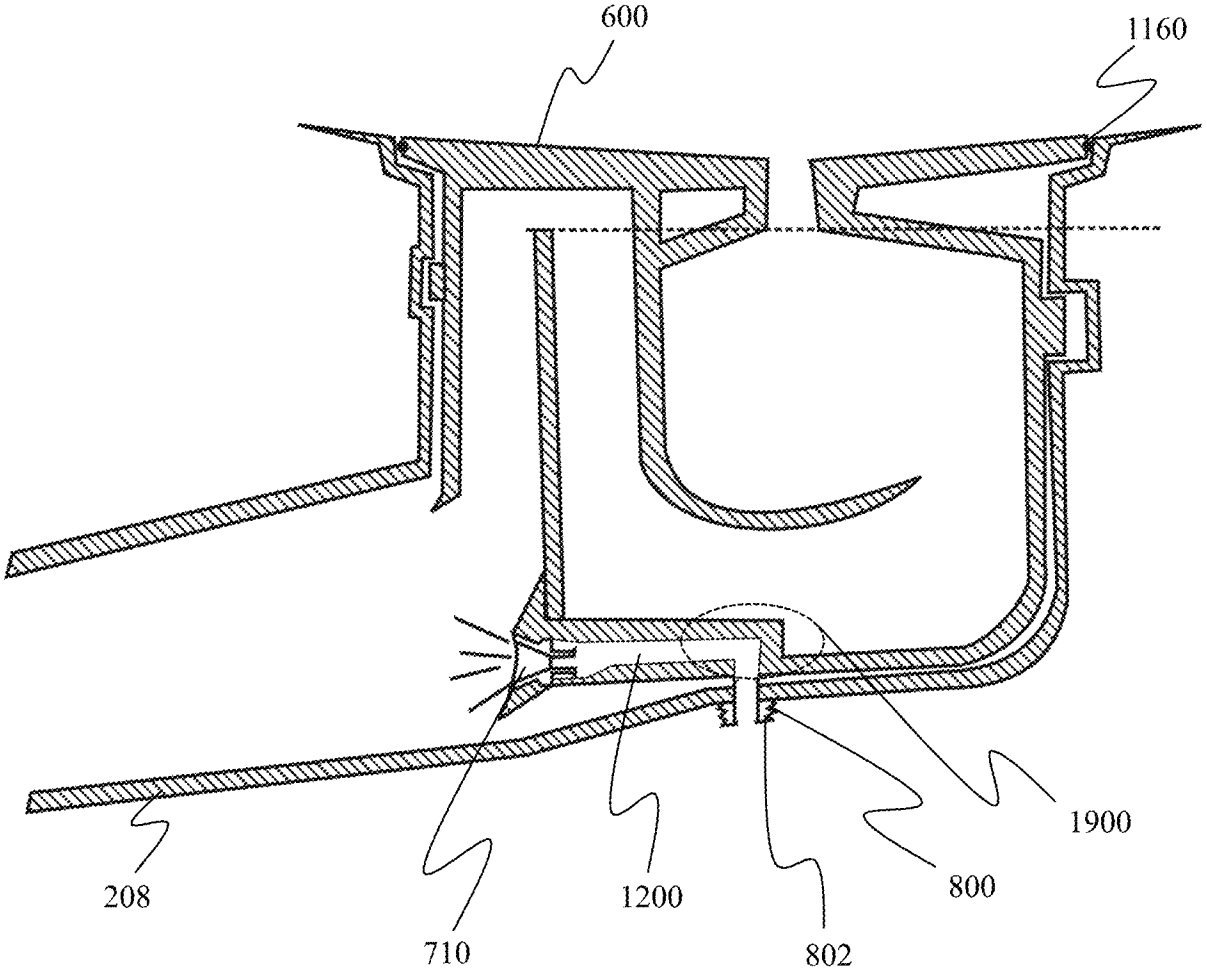
FIG. 73 is an illustration of a cutaway side view of a housing with a housing fluid interface on a bottom wall of the housing and a cartridge with integrated self-clean mechanism on a bottom interfacing with the housing, and a cleaning spray focused on a housing exit tube, according to the present invention.

A cartridge 600 with a built-in fluid channel 1200 and a cartridge flushing fluid receiving portion 1900 on the bottom rather than the side is presented in FIG. 73. This interfaces with a housing 200 with a (male) supply line 800, also placed on the bottom and disposed to mate with the cartridge 600 when it is inserted into the housing 200. As this area can become wet during use, it is important that a watertight seal exists between the supply fitting 802 (the fluid interface) and the housing 200. Note that the cartridge 600 configuration is similar to that of FIG. 28 and the housing 200 is similar to that of FIG. 8.

Figure 74:
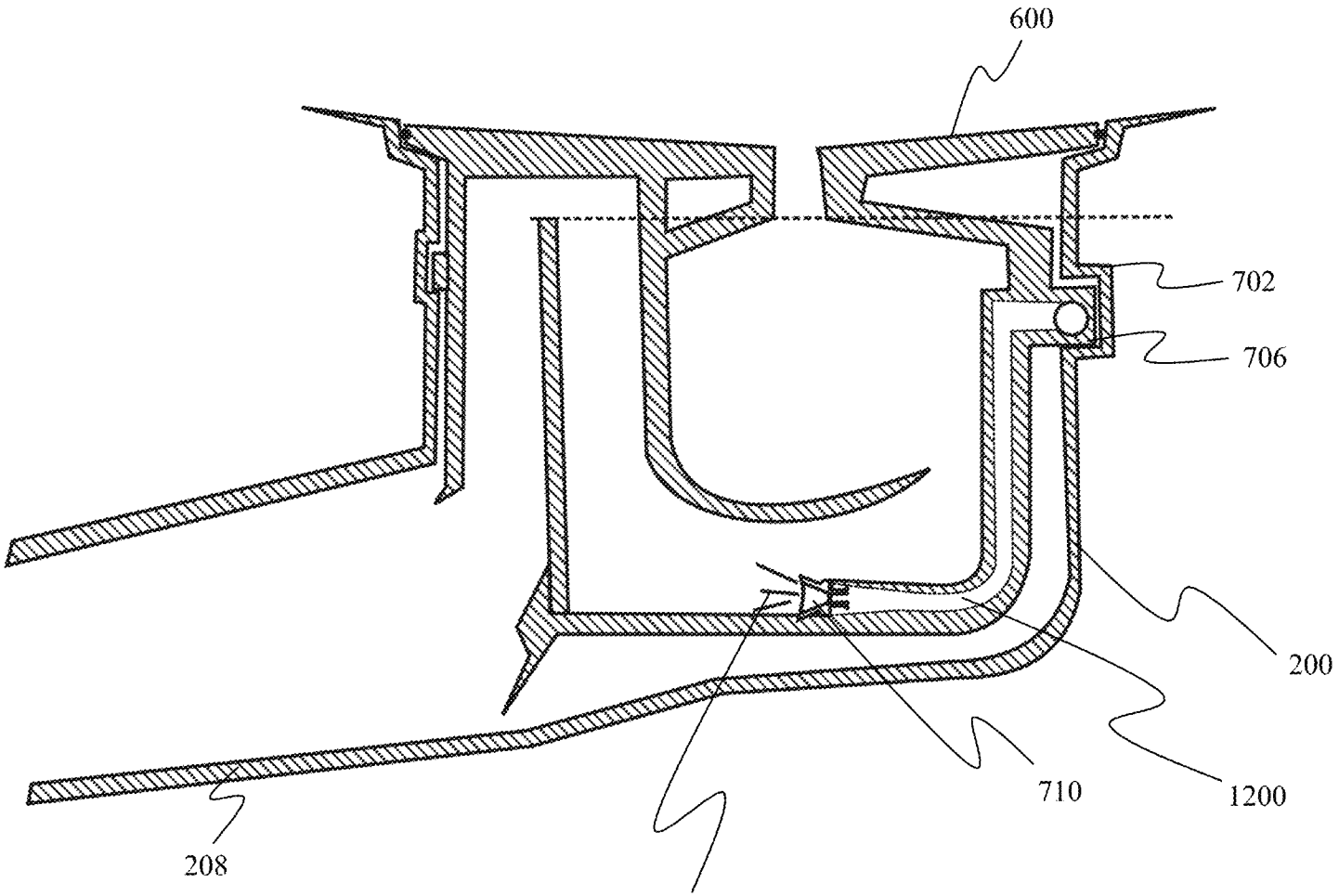
FIG. 74 is an illustration of a cutaway side view of a housing with a housing fluid interface on a side wall of the housing and a cartridge with an integrated self-clean mechanism interfacing with the housing on the side, and a cleaning spray focused on the cartridge internal chambers, according to the present invention.

An illustration of a cutaway side view of a housing 200 with a housing fluid interface 702 on a side wall of the housing 200 and a cartridge 600 with an integrated self-clean mechanism interfacing with the housing 200 on the side, and a cleaning spray 1904 focused on the cartridge 600 internal chambers is presented in FIG. 74. Note that the cartridge 600 configuration is similar to that of FIG. 26 and the housing 200 is similar to that of FIG. 7A.

Figure 33:
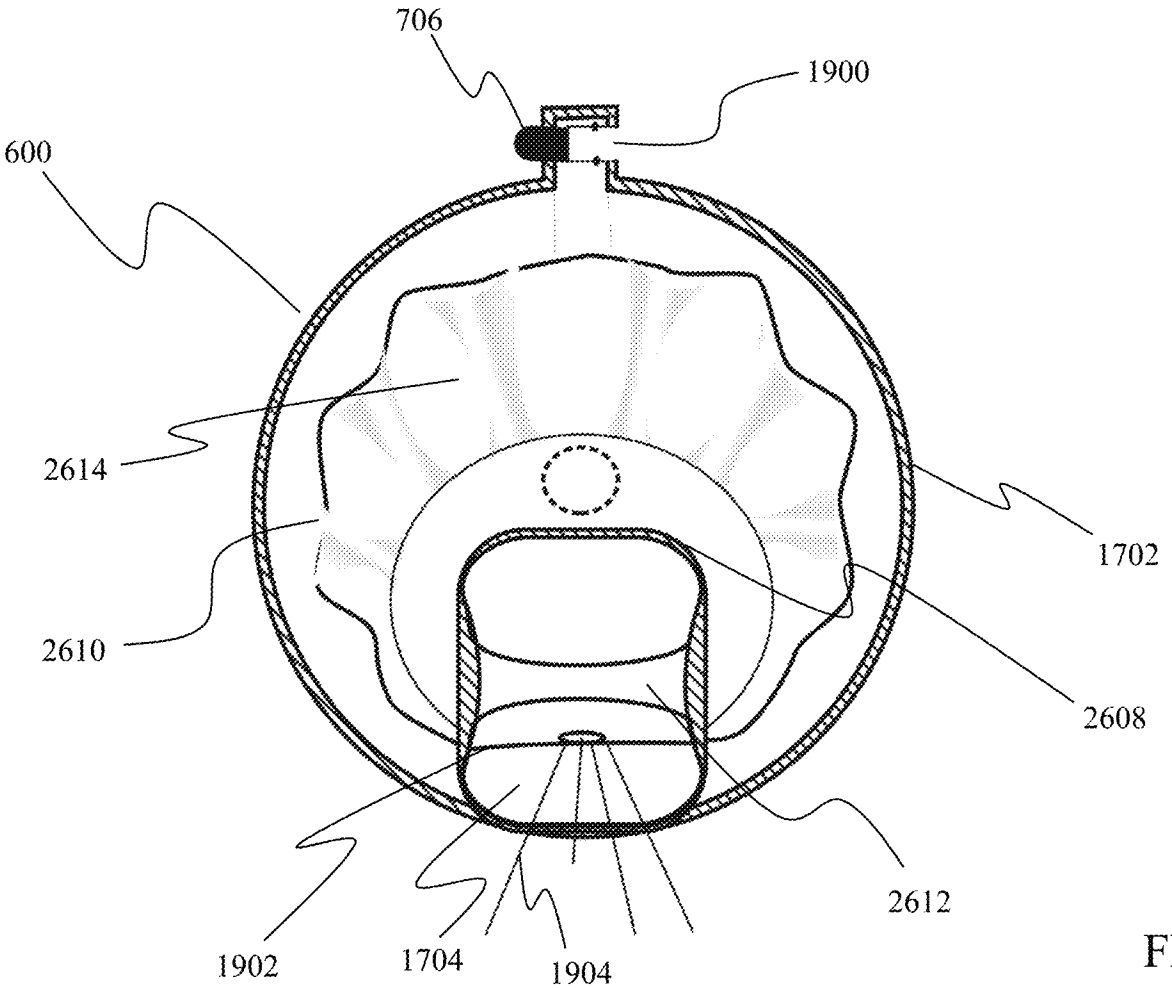
FIG. 33 is an illustration of a cutaway top view of a cartridge with an under-mount self-clean mechanism with a spray focused on a housing exit tube, according to the present invention.
Figure 75:
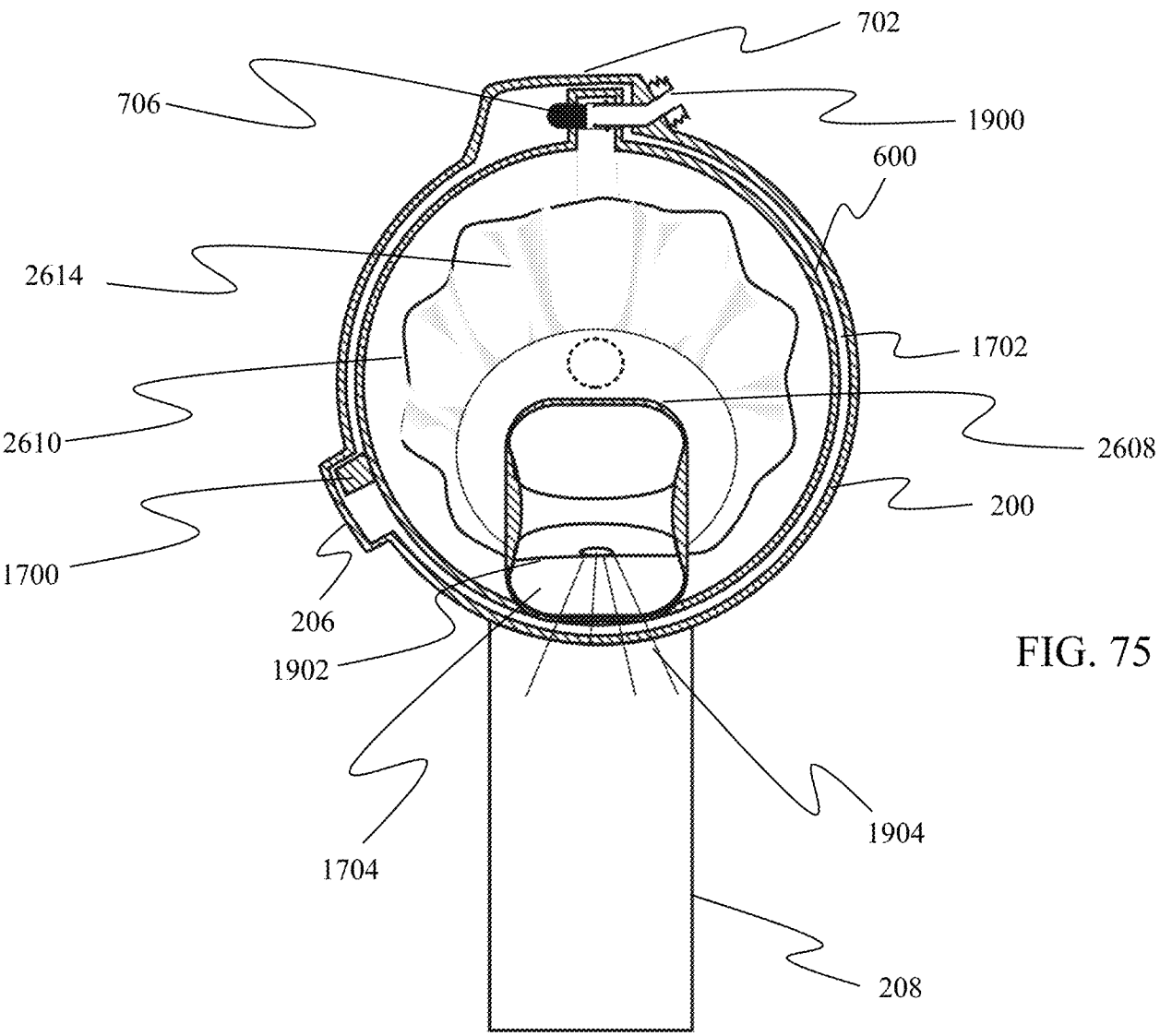
FIG. 75 is an illustration of a cutaway top view of a housing and a cartridge where the cutaway was taken through a fluid interface height of both the cartridge and the housing, the fluid interface is on a side wall of both the cartridge and the housing, an under-mount self-clean mechanism is installed on the cartridge and the cartridge is in a locked position after being twisted clockwise into the locked position from an unlocked position to allow respective fluid interfaces to interface (the unlocked position is shown in FIG. 76), according to the present invention.
Figure 76:
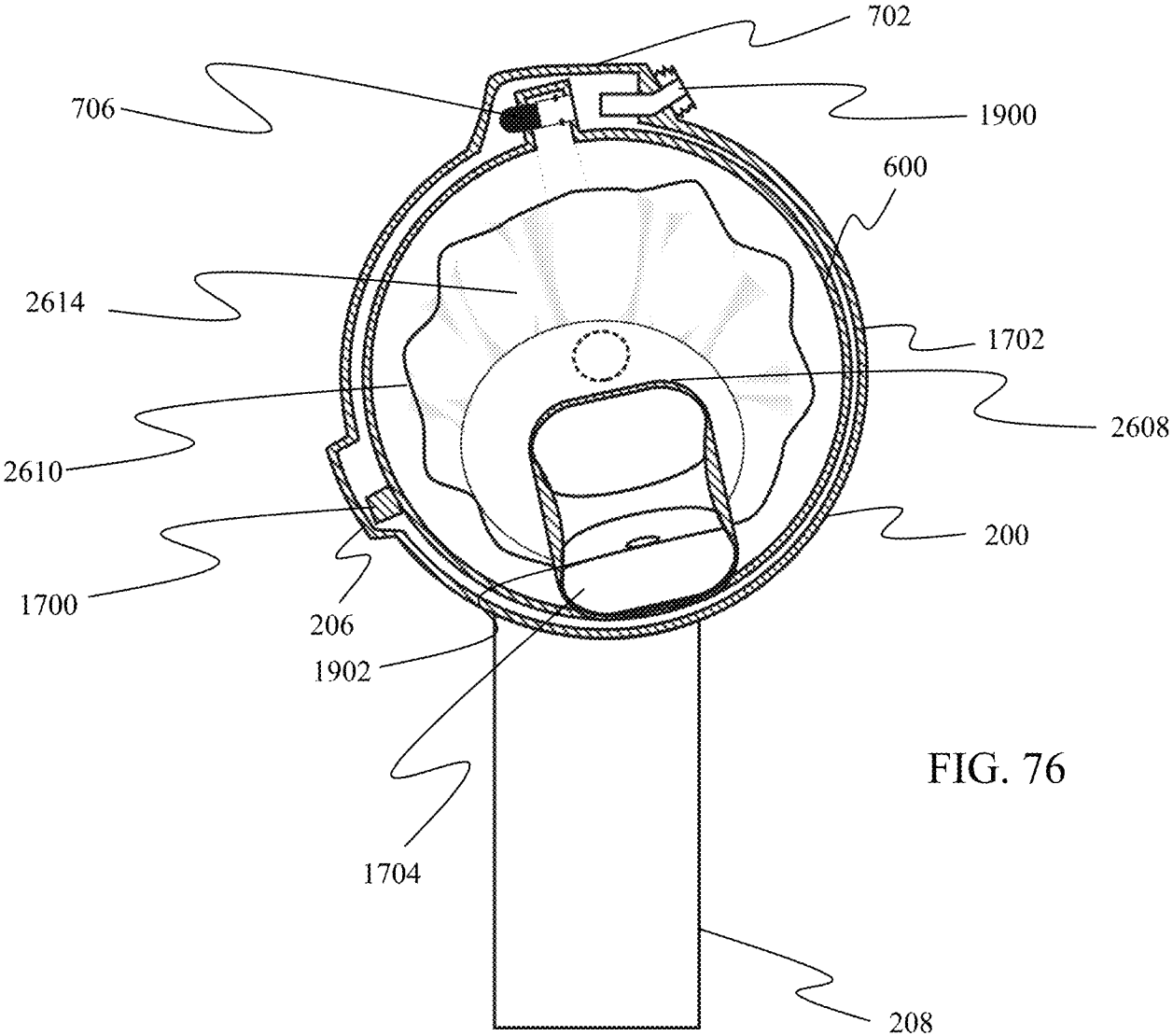
FIG. 76 is an illustration of a top cutaway view of a housing and a cartridge where the cutaway was taken through a fluid interface height of both the cartridge and the housing, the fluid interface is on a side wall of both the cartridge and the housing, an under-mount self-clean mechanism is installed on the cartridge and the cartridge is in an unlocked position prior to being twisted clockwise into a locked position to allow respective fluid interfaces to interface, according to the present invention.

An illustration of a cutaway top view of a housing 200 and a cartridge 600 where the cutaway was taken through a fluid interface height of both the cartridge 600 and the housing 200 is presented in FIG. 75. The fluid interfaces are on a side wall of both the cartridge and the housing (represented by reference numbers 706 and 702, respectively), an under-mount self-clean mechanism is installed on the cartridge 600 and the cartridge 600 is in a locked position after being twisted clockwise into the locked position from an unlocked position to allow respective fluid interfaces to interface (the unlocked position is shown in FIG. 76). Note that the cartridge 600 configuration is similar to that of FIG. 33 and the housing 200 is similar to that of FIG. 10.

An illustration of a top cutaway view of a housing 200 and a cartridge 600, where the cutaway was taken through a fluid interface height of both the cartridge 600 and the housing 200 is shown in FIG. 76. The fluid interface is on a side wall of both the cartridge and the housing(represented by reference numbers 706 and 702, respectively), an under-mount self-clean mechanism is installed on the cartridge 600, and the cartridge 600 is in an unlocked position prior to being twisted clockwise into a locked position to allow respective fluid interfaces to mate. Note that the cartridge 600 configuration is similar to that of FIG. 33 and the housing 200 is similar to that of FIG. 10.

Figures 77A, 77B:
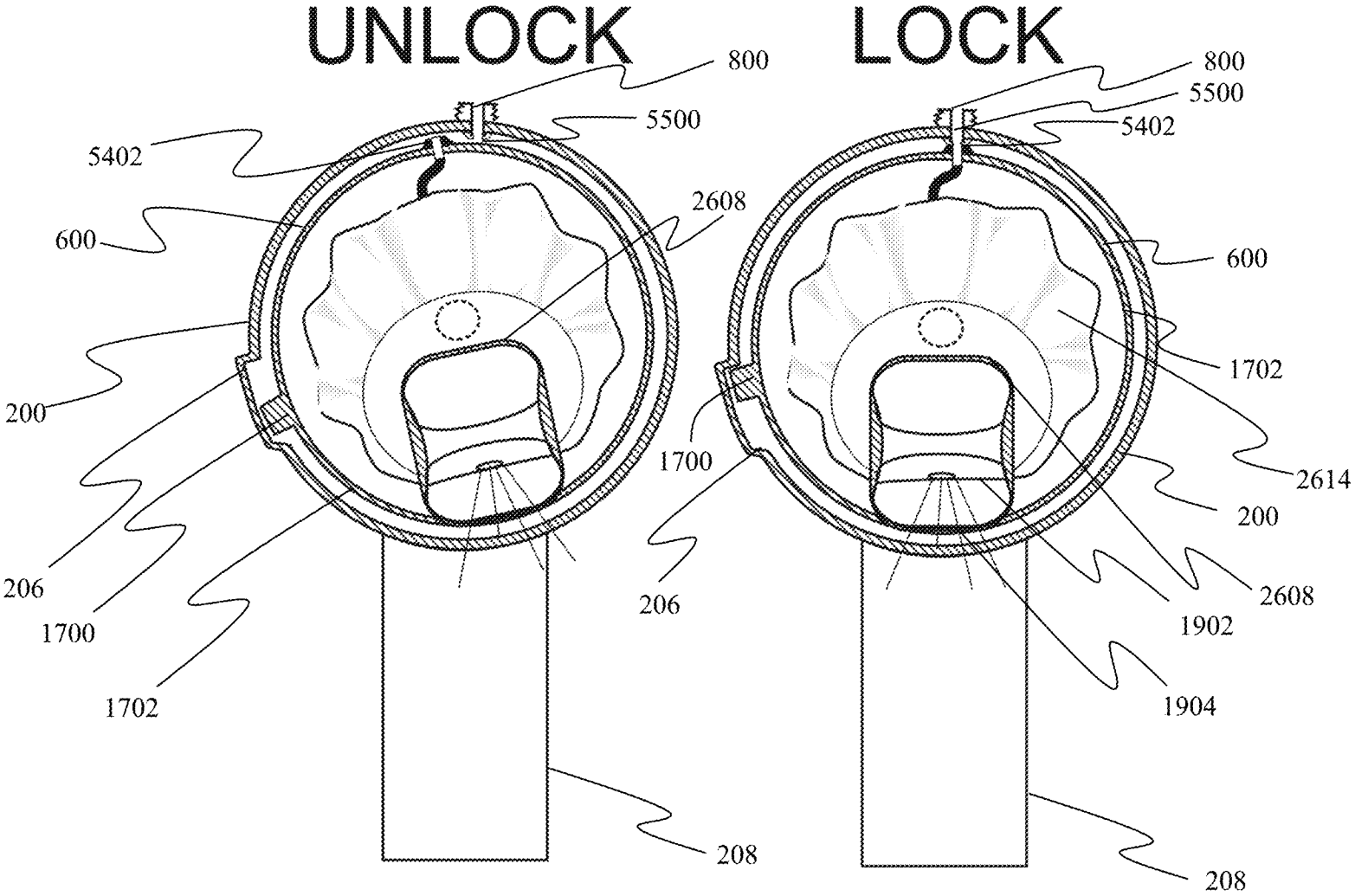
FIGS. 77A and 77B are the illustrations of a cutaway top view of a housing and a cartridge where the cutaway was taken through a fluid interface height of both the cartridge and the housing, the fluid interface is on a side wall of both the cartridge and the housing, with an under-mount self-clean mechanism is installed on the cartridge.

A simple locking interface between the housing 200 and the cartridge 600 is shown in FIGS. 77A and 77B. In this case, as the cartridge 600 is twisted into the locked position (see FIG. 77B), similar to the Falcon Waterfree Technologies locking system outlined in the U.S. Pat. No. 6,644,339 (incorporated by reference herein), two mating surfaces come together to form a water tight seal. In this case a proud sealing surface 5500 is attached to the inner part of the housing wall 200 and integrally connected with the male supply line 800. The cartridge 600 has a slightly protruding compliant sealing surface 5402 that mates with the housing's proud sealing surface 5500, sufficiently compressing it to form a water tight seal as the cartridge 600 is twisted into position. Flushing fluid is then free to pass through the housing wall and into the cartridge fluid inlet to be routed to the desired location for flushing. Through the housing exit 208 (as described in detail already), flushing fluid can be transferred to a single or multiple locations inside and outside the cartridge 600 for flushing and cleaning purposes. Note that FIG. 77A shows the cartridge 600 in an unlocked position. Additionally, any of the above described systems could incorporate a traditional flush valve as was shown in FIG. 1, where water flows through an inlet; however this would introduce water into the porcelain bowl and thus would not be as free from bacteria as a water-free porcelain bowl.

Figure 78:
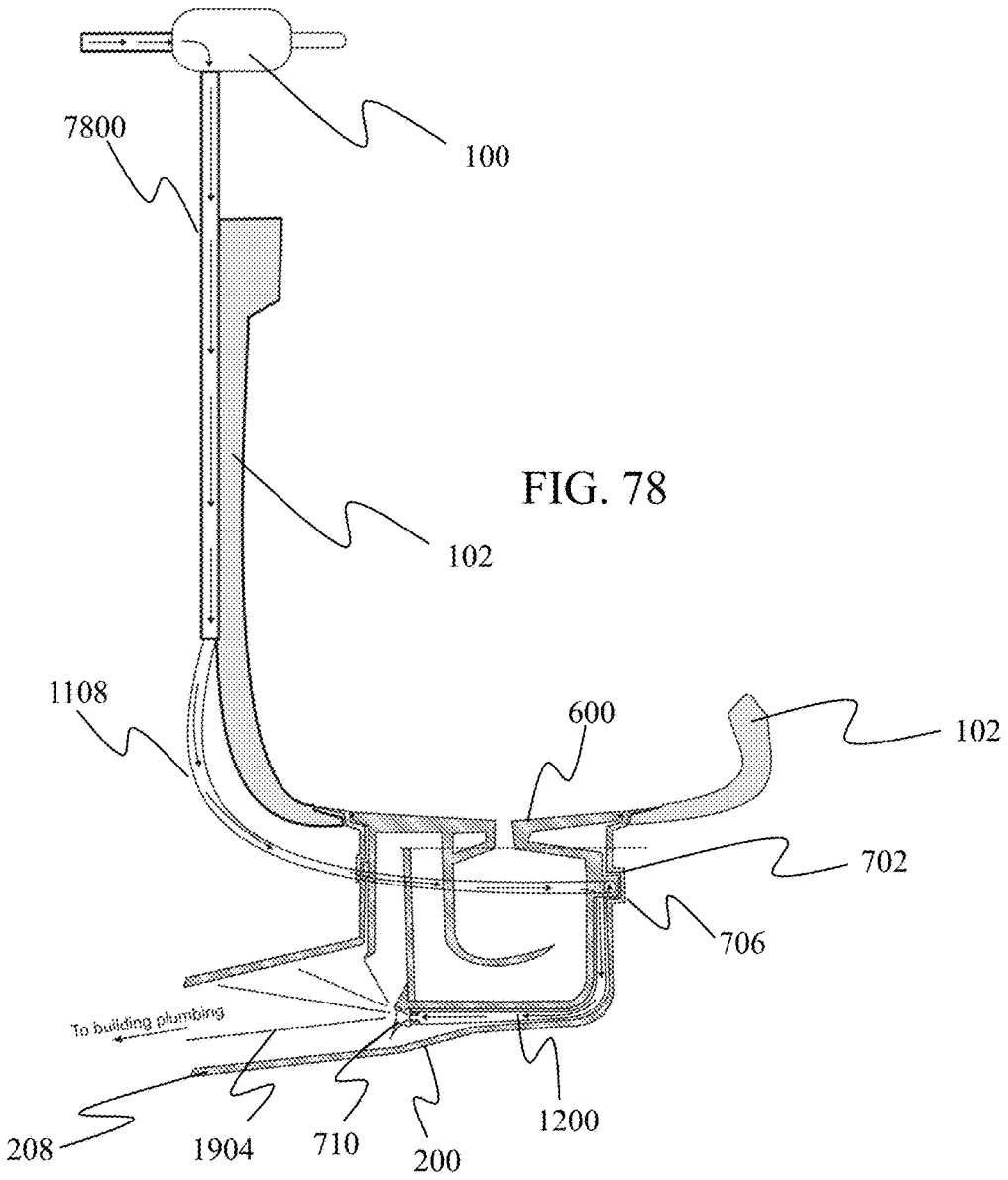
FIG. 78 is an illustration of a cutaway side view schematic showing a non-flushing cartridge and a housing installed in a urinal with a flush valve and a self-clean mechanism, and the housing with fluid interface, according to the present invention.

A cutaway side view schematic of the present invention in a full system is shown in FIG. 78. Here the urinal 102 does not utilize water to flush the upper porcelain bowl. Instead, the flushing action occurs in the housing 200. The advantage of flushing in this way is that a non-flushing urinal cartridge can be used. Non-flushing urinal cartridges such as those manufactured by Falcon Waterfree Technologies, LLC do a good job of sealing out sewer gasses from the bathroom environment. Further, the lack of water introduced to the porcelain has been shown to grow fewer bacteria then the traditional urinals which mix urine and water on the porcelain's surface.

In FIG. 78, it can be seen that the flush valve 100, or any valve that can control water flow on and off, sits between the building's water supply line and the urinal. When the flush valve 100 is actuated—using known means such as manual, sensor, or timed actuation—the valve within the flush valve 100 opens and water goes through a vertical supply pipe 7800 and through the supply line 1108 which is integrally connected with the housing 200 with a supply fitting (see FIG. 79 below). Flushing fluid then passes through a supply fitting (not shown) and through the male supply line (not shown) which is part of the housing fluid interface 702 (see FIG. 79 below). The fluid is then transferred between the housing fluid interface 702 and the cartridge flushing fluid interface 706. In this example, the cartridge fluid interface 706 has a generally female shape which receives the male supply line of the housing 200. A small O-ring 1160 (not shown) can be fitted in between the male supply line and the female cartridge fluid inlet which is a part of the cartridge flushing fluid interface 706. Thus the cartridge fluid interface 706 and the housing fluid interface 702 can be joined in a generally water tight fit when the cartridge 600 is positioned fully in the housing 200.

To enable an easy turn for the cartridge 600 while still creating a fluid tight seal between the housing 200 and cartridge 600, the housing fluid interface 702 includes a proud portion 5500 which compresses the O-ring 1160 to create the seal. This arrangement could be inverted if desired where the cartridge fluid interface 706 fits underneath the housing fluid interface 702 as the cartridge 600 is turned into the locking position. Generally, in any of the aspects presented herein, functionally similar inversions may be applied—thus, any of the fluid interfaces, whether on a cartridge 600 or on a housing 200 may be male or female in variety, as long as when mated, they form a fluid tight seal.

Fluid is then transferred through the self-clean mechanism (see FIG. 29 for details regarding a similar self-clean mechanism) which comprises a fluid transfer tube 708 (or integrated built-in fluid channel 1200, see FIG. 26 as an example) and a flushing fluid directing portion 710, which uses commonly known technology to increase water velocity by diminishing the supply pipe's inside diameter. Many spray heads are commercially available and marketed by companies such as Everloy Shoji Co., Ltd. (2-24, 4-chome, Sagisu, Fukushima-ku, Osaka, JP 553-002) which offer a range of spray heads for operation under many different pressures and for outputting many different spray patterns, for example: conical or flat spray patterns. Models 1/4KPF, 3/8KPF, 1/4KSF, and 3/8KSF are examples that could be used and are available on the market.

Figure 79:
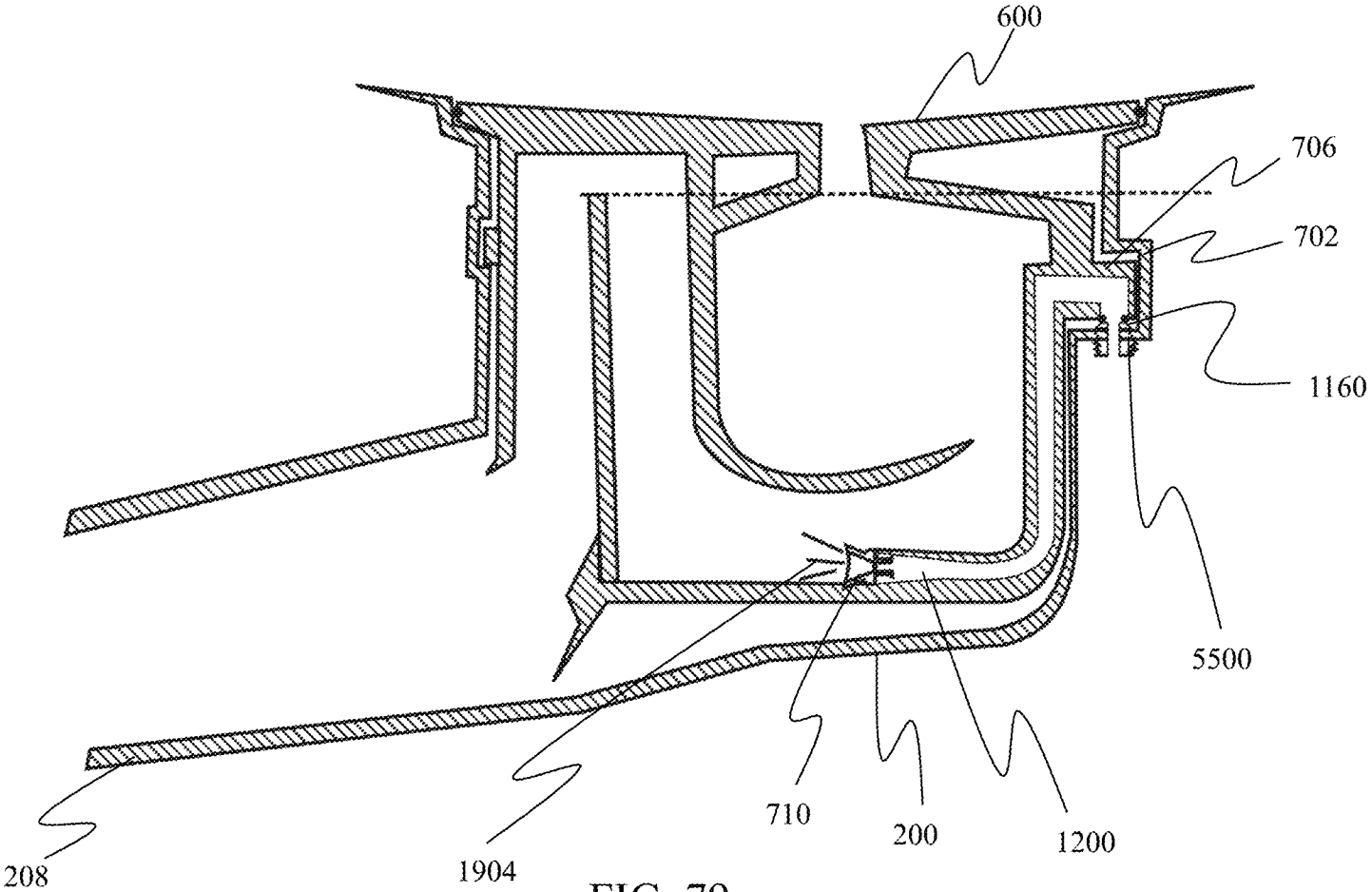
FIG. 79 is an illustration of a side view cutaway of a housing with a housing fluid interface on a side wall of the housing and a cartridge with an integrated self-clean mechanism interfacing with the housing on the side wall in an up-down rather than side-to-side configuration where the cartridge fluid interface and the housing fluid interface overlap one above the other respectively, and a cleaning spray focused on the cartridge internal chambers, according to the present invention.

A cartridge 600 and housing 200 combination for use in a urinal 102 such as that shown in FIG. 78 is shown in FIG. 79.

Figure 80A:
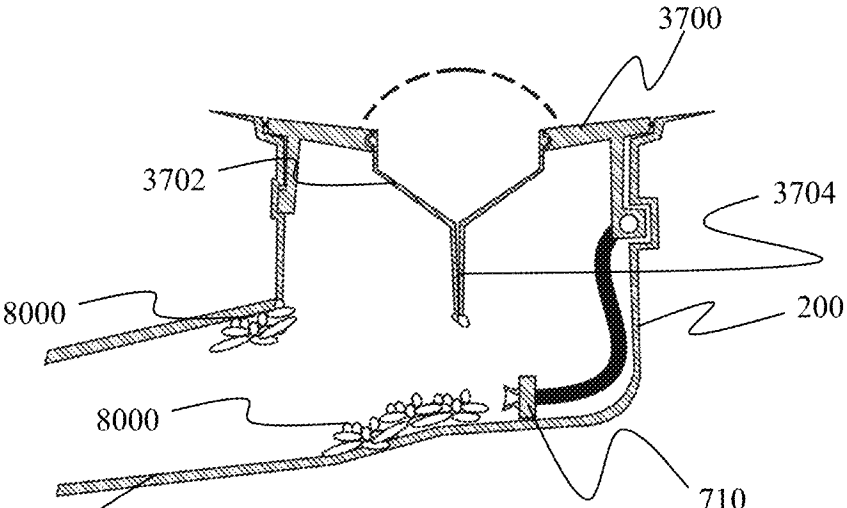
FIGS. 80A through 80C are the illustrations of a cutaway side view of a mechanical type cartridge in a housing, with a self-clean mechanism targeted at specific areas prone to the struvite buildup, according to the present invention.
Figure 80C:
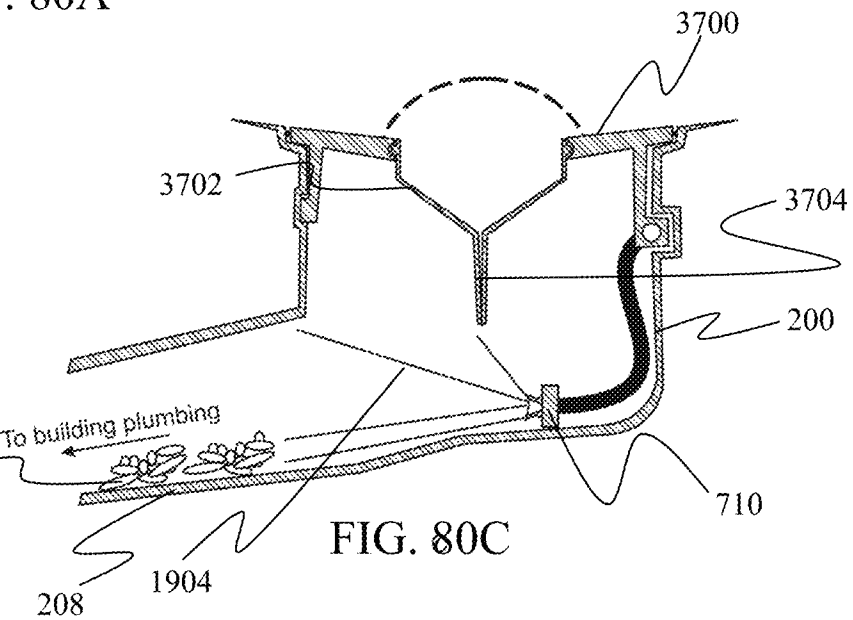
Figure 80B:
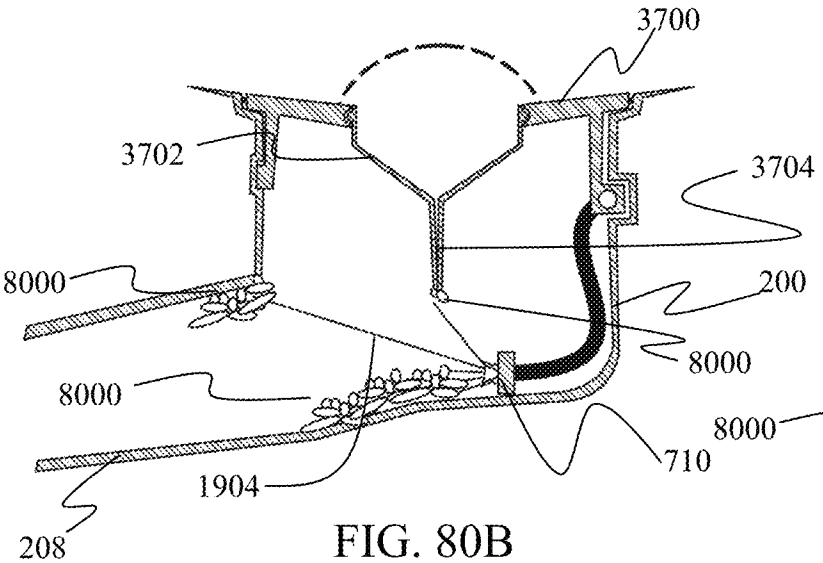

Further, FIGS. 80A-80C depict the use of a self-clean mechanism where the flushing fluid directing portion 710 is configured to send flushing fluid to clean up several different parts of a housing 200 and a mechanical valve 3702, as represented by buildup areas 8000 (typically, the buildup is struvite). The figures show a sequence where buildup areas 8000 exist in FIG. 80A, the flushing system is activated in FIG. 80B with flushing fluid impinging upon the buildup areas 8000, and finally, the buildup areas 8000 being washed away to the building plumbing. The goal of the fluid directing portions 710 in these figures is to direct flushing fluid to specific areas most prone to buildup. The areas shown are exemplary and are not intended to be limiting. Also, the duration of the flushing is typically determined by the need for cleaning. Further, in some cases, it may be desired to cause flushing fluid to be switched into a subset of the fluid directing portions depending on the amount of buildup in the different buildup areas 8000.

Figure 81A:
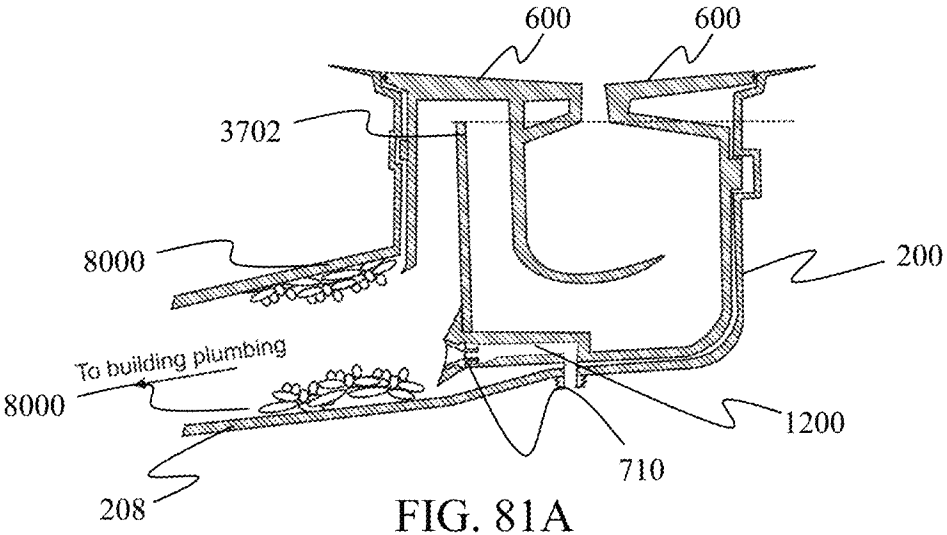
FIGS. 81A through 81C are the illustrations of a cutaway side view of a fluid trap style cartridge in a housing, with a self-clean mechanism targeted at specific areas prone to the struvite buildup, according to the present invention.
Figure 81C:
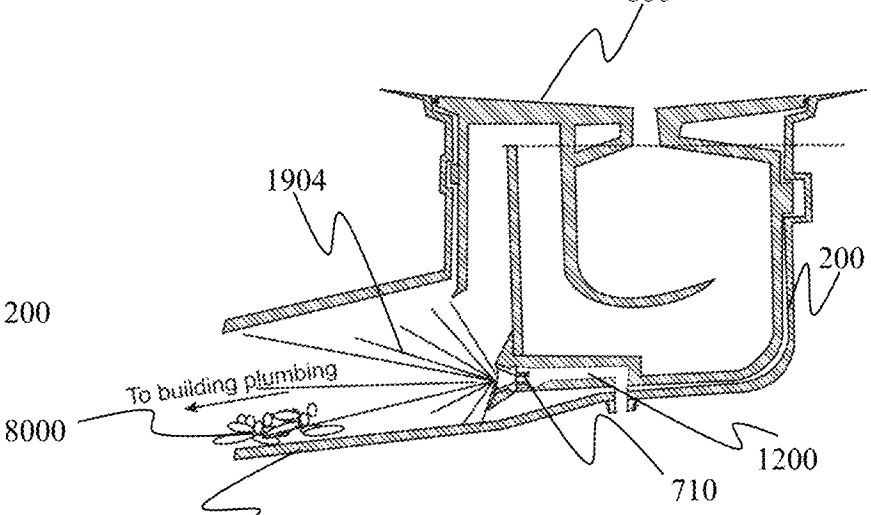
Figure 81B:
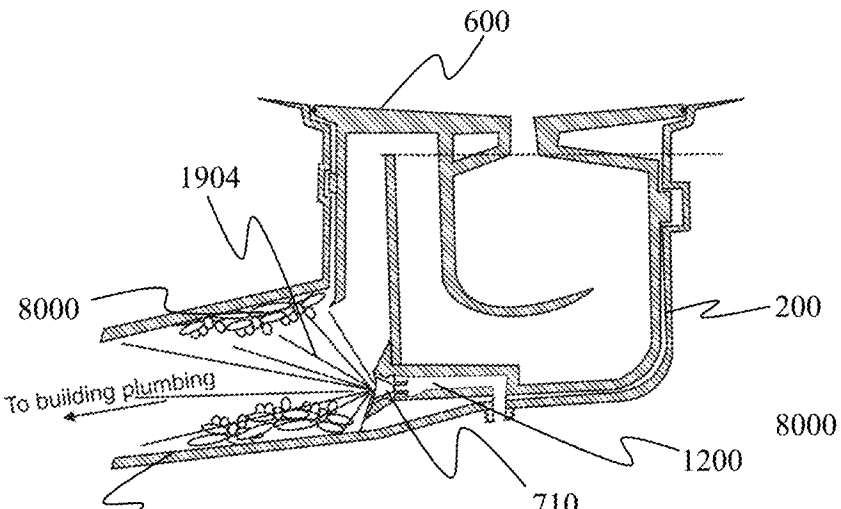

Essentially the same sequence that was shown in FIGS. 80A-80C is shown in FIGS. 81A-81C, except with a fluid trap cartridge 600 instead of a mechanical cartridge 3700. In this case, the fluid line 1200 and spray head 710 are formed integrally with the cartridge 600 and housing 200.

Again, the urinal system of the present invention does not have to flush each time, but can still be cleaned, more effectively than current flushing units, by using high pressure spray heads strategically placed to pressure wash the critical areas on a pre-determined schedule or after a certain number of uses.

It is understood that the self-clean mechanism could be operated without a high pressure head attached to the end of it and would do substantially the same job. However, it should be noted that the area 8000 of transition between the housing body 200 and the housing tube 208 is particularly prone to the struvite buildup as illustrated in FIGS. 80A-80C and 81A-81C. It should also be noted that this area is visible to the person servicing it, so it is particularly important to keep it clean. Further, a service person comes in close contact with this area and the struvite has a very malodorous smell; thus avoiding the struvite buildup in this area is very important. Use of the present invention for struvite elimination extends the life of the cartridge (600 or 3700) while reducing the need for maintenance.

For clarity, a brief discussion of struvite is worthwhile here. Struvite has a relatively soft consistency similar to mayonnaise. As with cleaning mayonnaise from a spoon or a fork, the pressure of the water can play an important role. For example, though water leaving a faucet tap always has some level of pressure, if one were to put their thumb over the tap, it would create a high pressure spray. This spray has much better scrubbing power than the line pressure coming initially from the tap. Often kitchen sinks will have a high pressure spray head attached to or next to the main spray head. This high pressure spray dramatically increases the cleaning power of the water, and when used on the spoon or the knife with thick mayonnaise stuck to it, the washer can much more effectively "power wash" the implement without a need to scrub it by hand. Another example would be to put a high pressure spray head at the end of a hose in order to increase the velocity of the water exiting the hose pipe. In this manner, one can benefit from the higher pressure and more directed and forceful flow. Anyone who has ever tried to rinse off their car knows the benefits of putting a high pressure spray head on the end of the hose—for its improved cleaning power. In fact, it is common for a building's sewer pipes to need cleaning from buildup. One popular method is to have the building's pipes "jet cleaned." "Jet cleaning" of pipes is a commonly understood term in the plumbing industry. It is widely recognized that "jet cleaning," using water at high pressure, will clean what simply flushing water repeatedly through the system will not.

Flushing water that has been transferred through the housing interface 702 and the cartridge interface 706 is routed through the water transfer tube 708 (or integrated built-in fluid channel 1200) and can be aimed directly at critical buildup areas. Thus, in combination with the known liquid trap non-flushing cartridges (for example the C1M2+ cartridge by Falcon Waterfree Technologies), this self-clean mechanism can substantially improve operation of the non-flushing system providing all the benefits of the non-flushing system while keeping the pipes clean. There are other advantages associated with the invention's system as described, and other configurations, some of which will be discussed later in this application.

One of the other advantages of the system shown in FIG. 78, is that instead of having to flush the urinal after each use to clear the trap of all the urine as in a traditional urinal or an HEU, the invention allows the benefits of the water-free cartridge at sealing out odor—using, for example, the floating oil and the urine liquid trap—while cleaning the pipe on pre-set timing, and with pre-set amounts of water. Instead of flushing a pint of water each use, like a "pint flush" HEU does, this system could be flushed a few times a day to clean out any buildup in the pipes.

Because urinals are connected to the building's other plumbing, most pipes in the building get flushed out during the course of a day with water from urinals, sinks, and other sources. With the focused and timed flushes of the invention, the short section of the pipe between the urinal and the building's main plumbing now has a means to be flushed out using a minimal amount of water. The advantage comes from both placement and pressure. By using a high pressure head as the flushing fluid directing portion 710 and placing it proximate the entrance of the housing exit 208, the system can be designed to use a minimal amount of water and aim it right at the point that needs it most.

Figure 82:
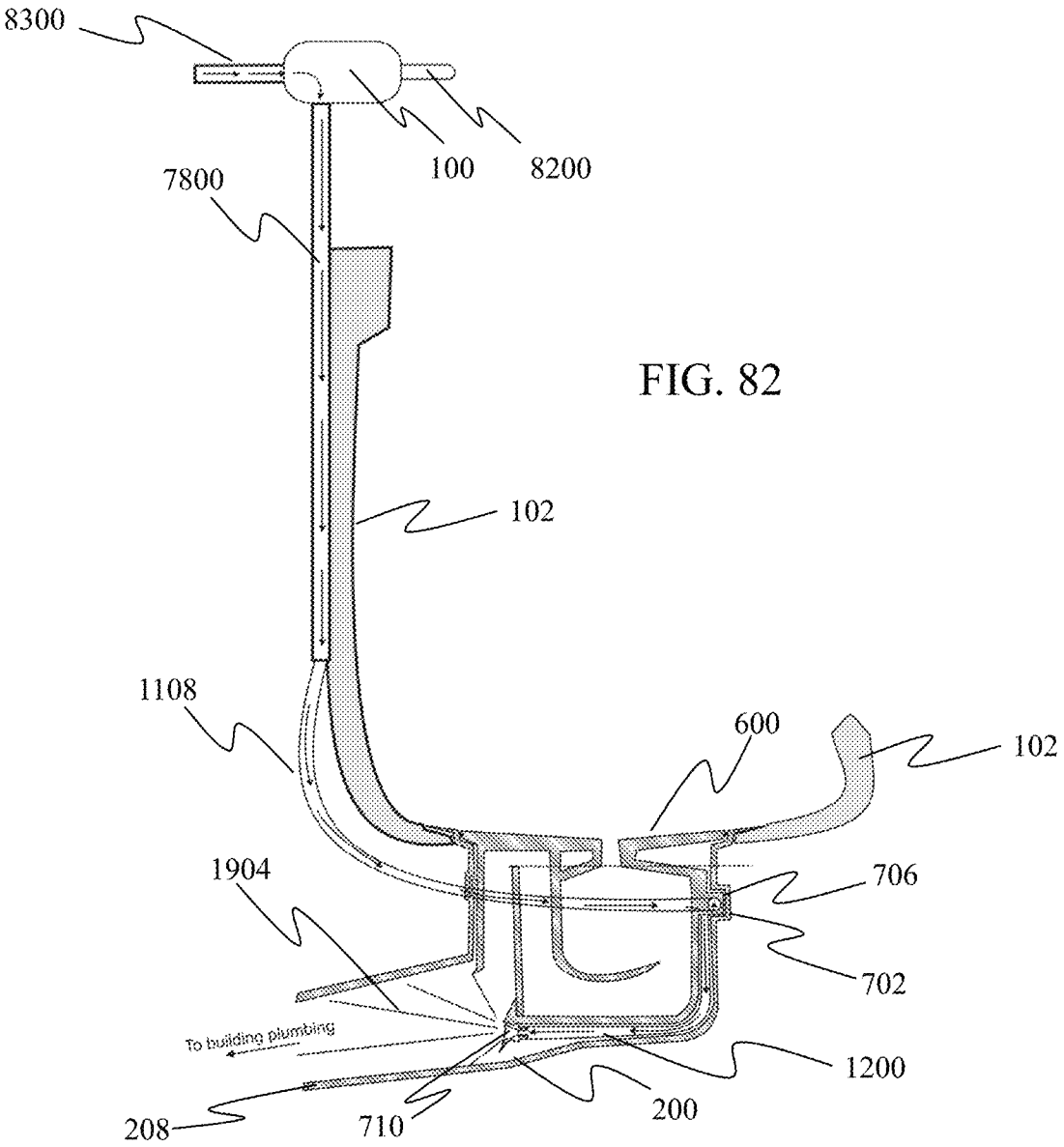
FIG. 82 is an illustration of a cutaway side view schematic showing a non-flushing cartridge and a housing installed in a urinal with a flush valve and a self-clean mechanism and the housing with a fluid interface, according to the present invention.

When the flush valve 100 is opened according to above-described preset parameters by actuation of a flush actuator 8200, the clean flushing fluid flows from a horizontal supply pipe 8202 through the flush valve 100 into and through the vertical supply pipe 7800 to the supply line 1108 as shown in FIG. 82. The supply line 1108 is coupled to the male supply line 800 via the supply fitting 802 and the corresponding fitting on the end of the supply line 8300, the details of which can be seen in FIG. 83 which is a cross section taken through the cartridge 600 and the housing 200 along the line AA from above, looking down at the connection of the cartridge 600 and the housing 200 where the water is passed in a water tight configuration (substantially preserving the line pressure as the water moves through the cleaning system). A tight coupling can be enhanced by the use of an O-ring 1160 or other means known in the trade. Depending upon the kind of trap involved, and the specific needs of the owner, the male supply line 800 and the fitting 802 may be on a vertical wall of the housing body 200, the underside of the housing body 200 as shown in FIG. 84, or elsewhere. The clean water then flows through the male supply line 800, into the flush fluid receiving portion 1900 of the cartridge 600 and into and through the water transfer tubes 708. The water transfer tubes 708 can be a separate tube or built into the cartridge 600 (examples of which are numbered with element number 1200 throughout) or the housing 200 or a combination thereof. An example of a fluid supply line that could be used in this aspect (either as a fluid supply line 1108 or as a flushing fluid transfer tube 708) is model LFSPFC20-88 made by the Watts Company (815 Chestnut Street, North Andover, Mass. 01845 USA), though any supply line that can withstand the water pressure of the building's plumbing would suffice. The supply line 1108 can be connected with the housing at the fitting 802 by mechanisms such as screw-on or quick connectors, for example, connectors manufactured and sold under the Shark Bite brand name (Shark Bite USA, 2727 Paces Ferry Rd SE, Suite 1800, Building Two, Atlanta Ga., 30339).

An alternative connection method from the housing 200 to the cartridge 600 is shown in FIG. 84. In this example, the cartridge fluid interface 706 and the housing fluid interface 702 are in the bottom center. This means that when the cartridge 600 is inserted from above, and twisted into a locked position, the cartridge fluid interface 706 simply spins around the male supply line 800 of the housing fluid interface 702. The cartridge 600 is inserted and the cartridge flushing fluid receiving portion 1900 slips past the male supply line 800. The male supply line 800 extends far enough into the cartridge flushing fluid receiving portion 1900 that the O-ring 1106 can compress against the male supply line 800 to form a substantially water-tight seal in order to pass the line pressure on to the built-in fluid channel—so that it can be carried all the way to pass through the flushing fluid directing portion 710. A supply line 1108, similar to the model LFSPFC20-88 made by the Watts Company, is incorporated (though any supply line 1108 that can withstand the water pressure of the building's plumbing would also suffice). The supply line 1108 can be connected with any standard means of connection to the housing 200 at the supply fitting 802. This includes screw-on or quick connection, for example, the connectors manufactured and sold under the Shark Bite brand name as previously mentioned.

In operation, a user will urinate into a urinal 102 and urine will flow into the inlet 604 to the cartridge 600 (which could also be a mechanical cartridge 3700). In the case of a liquid trap cartridge, for example the C1M2+ cartridge from Falcon Waterfree Technologies, LLC, fresh urine will displace older urine that has been sitting in the cartridge 600 (or 3700). The older urine will run down into the housing 200 and most of it will drain out through the housing exit 208 and into the building's plumbing to the sewer system. However, each time urine passes through the cartridge and out through the housing exit tube, it leaves behind some sediment. This sediment will mostly be the struvite buildup 8000 (see FIGS. 80A through 80C and 81A-81C), which has previously been described. The struvite tends to precipitate out of urine when the urine experiences either a rise in the PH or when the urine experiences shock/turbulence, for example, splashing or dripping. Consequently, the struvite often builds up in and around the cartridge exit 1704, the bottom wall 1800 of the cartridge, and the housing exit 208. The process of fresh urine displacing existing urine repeats through many uses. With each use, a bit more struvite is left in the pipes. Such buildup can require that the struvite get cleaned out with a brush each time the cartridge is replaced. However, with the present invention, the urinal can pressure wash itself and the surrounding pipes. This occurs when the flush valve 100 is opened, which can be set to do so by timer, number of users, or other parameters. For example, one might set the urinal to pressure wash itself after the flush actuator 8200 counts a pre-determined number of uses or the wash may occur on a timed interval, e.g., every 12 hours. Thus, where a traditional urinal, even one that uses only a pint of water to flush itself, flushes with each use to avoid the odor and the struvite buildup, the present invention can simply clean itself once a day, while using the known waterless cartridge technology to block the sewer gasses and the urine odor.

Figure 85:
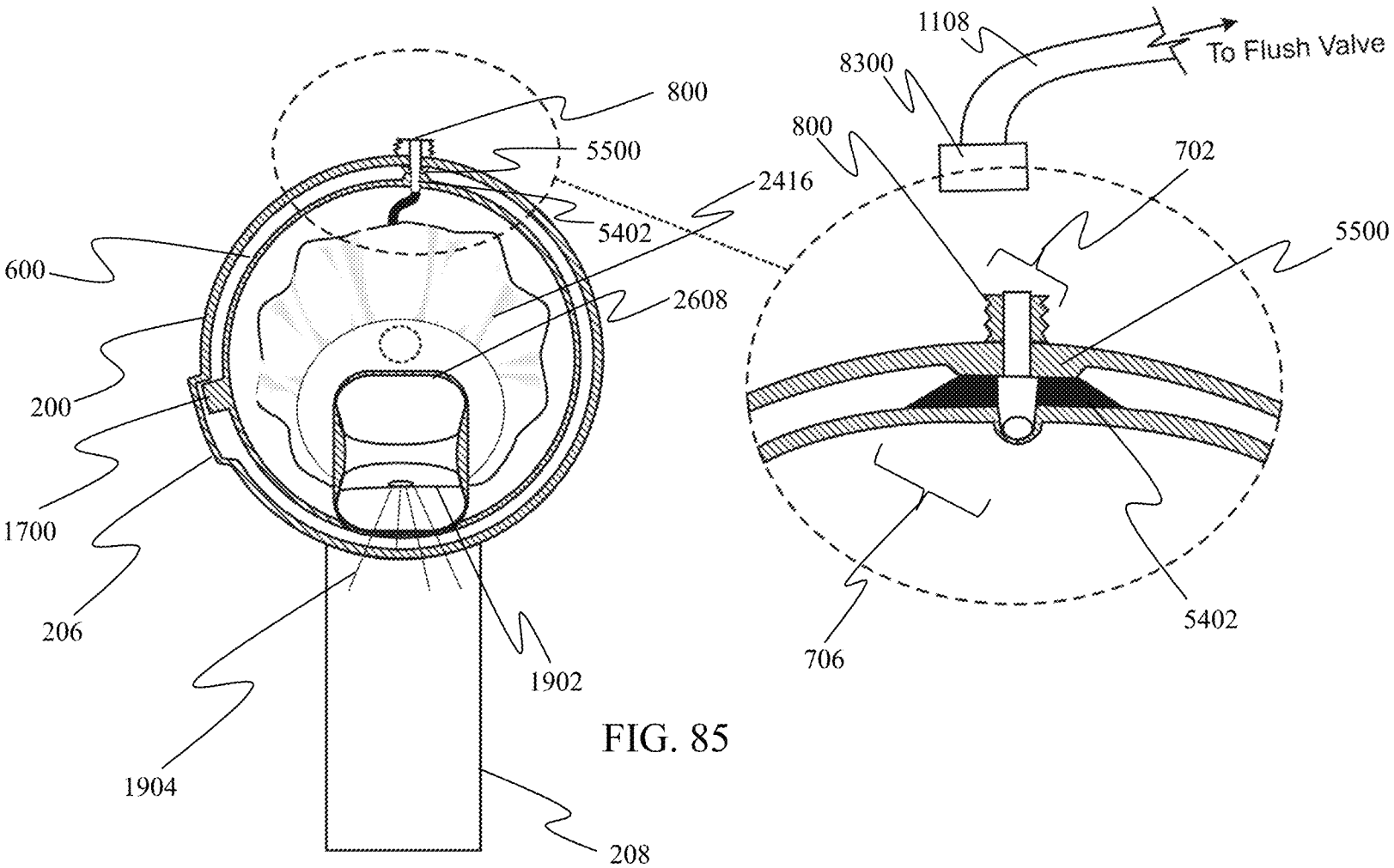
FIG. 85 is an illustration of a different fluid interface where a cartridge and a housing are seen from a top cross section, and with a blown-up detailed view of a fluid interface area, according to the present invention.

Another fluid interface is shown in FIG. 85. Here, the cartridge 600 and the housing 200 are seen from a top cross section—with a blown-up detailed view of the fluid interface area out to the right. In this instance the fluid is introduced from the side of the housing 200 and the cartridge 600, but unlike the example shown in FIG. 83, the male supply line 800 does not insert into the cartridge 600. Instead, this configuration uses a compliant sealing surface 5402 disposed on the cartridge 600 which deforms when in contact with the housing proud sealing surface 5500. This occurs as the cartridge 600 is twisted into a locking position (the locking and unlocking positions are also shown in FIGS. 77A and 77B, respectively). If the cartridge 600 is of the press fit type that relies on friction as it is inserted from above and does not use a twist locking system, then when the cartridge 600 is press fit into the housing 200, compliant sealing surface 5402 of the cartridge 600 and the housing proud sealing surface 5500 interact in functionally the same manner. That is, the compliant sealing surface 5402 of the cartridge fluid interface 706 is forced against the housing proud sealing surface 5500 the housing fluid interface 702, so that a water tight seal is formed between the cartridge 600 and the housing 200 between the respective fluid interfaces. This arrangement allows water pressure to be passed from the supply line 1108 into the cartridge 600 and into either the built-in fluid channel 1200 or the water transfer tube 708, depending on which configuration the cartridge uses to deliver the pressurized water to the flushing fluid directing portion 710 (high pressure spray head).

Figure 83:
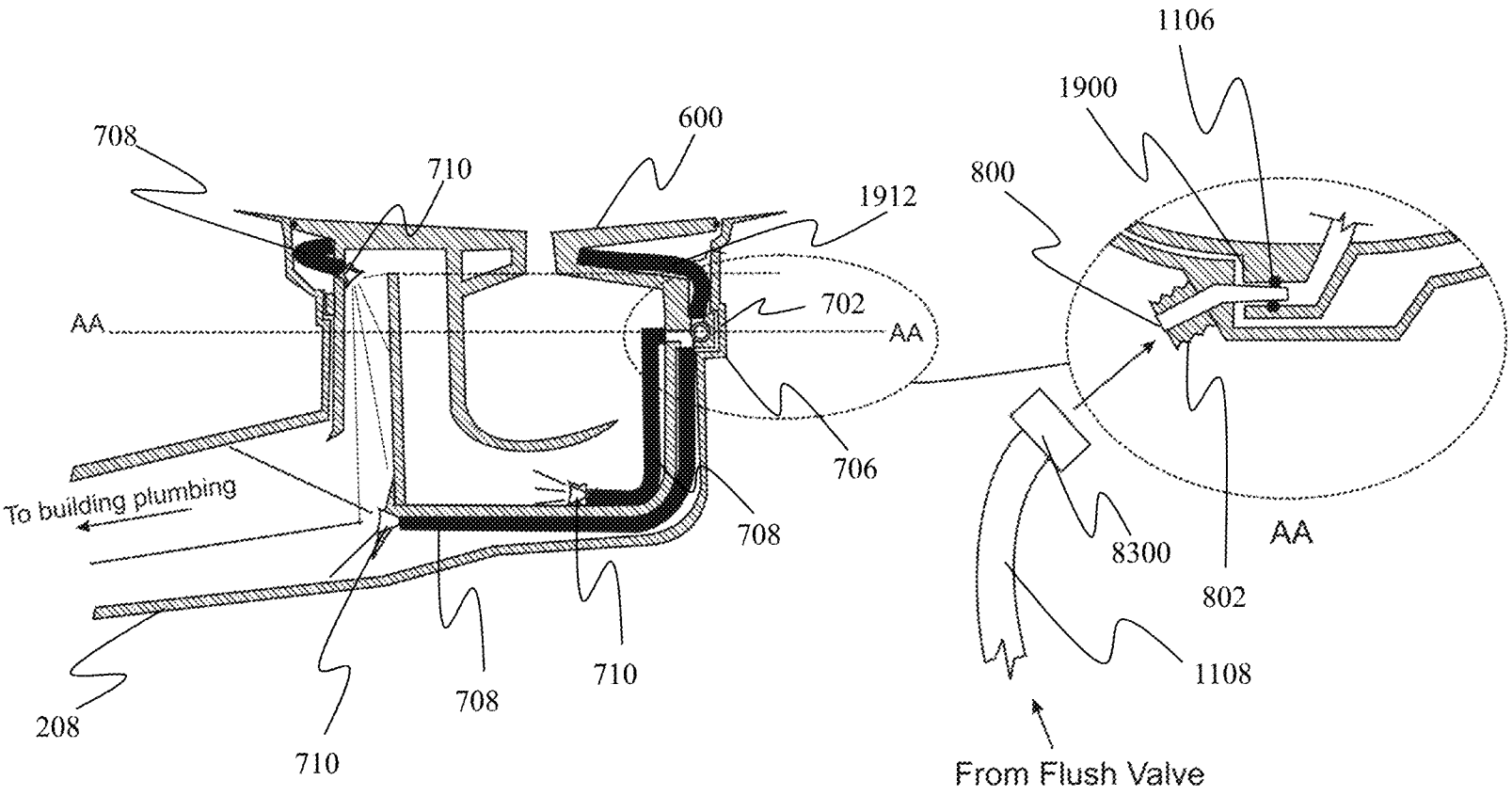
FIG. 83 is an illustration of a cartridge and a housing from FIG. 72, with a detailed blown-up view of the cartridge and the housing fluid interface areas, according to the present invention.
Figure 84:
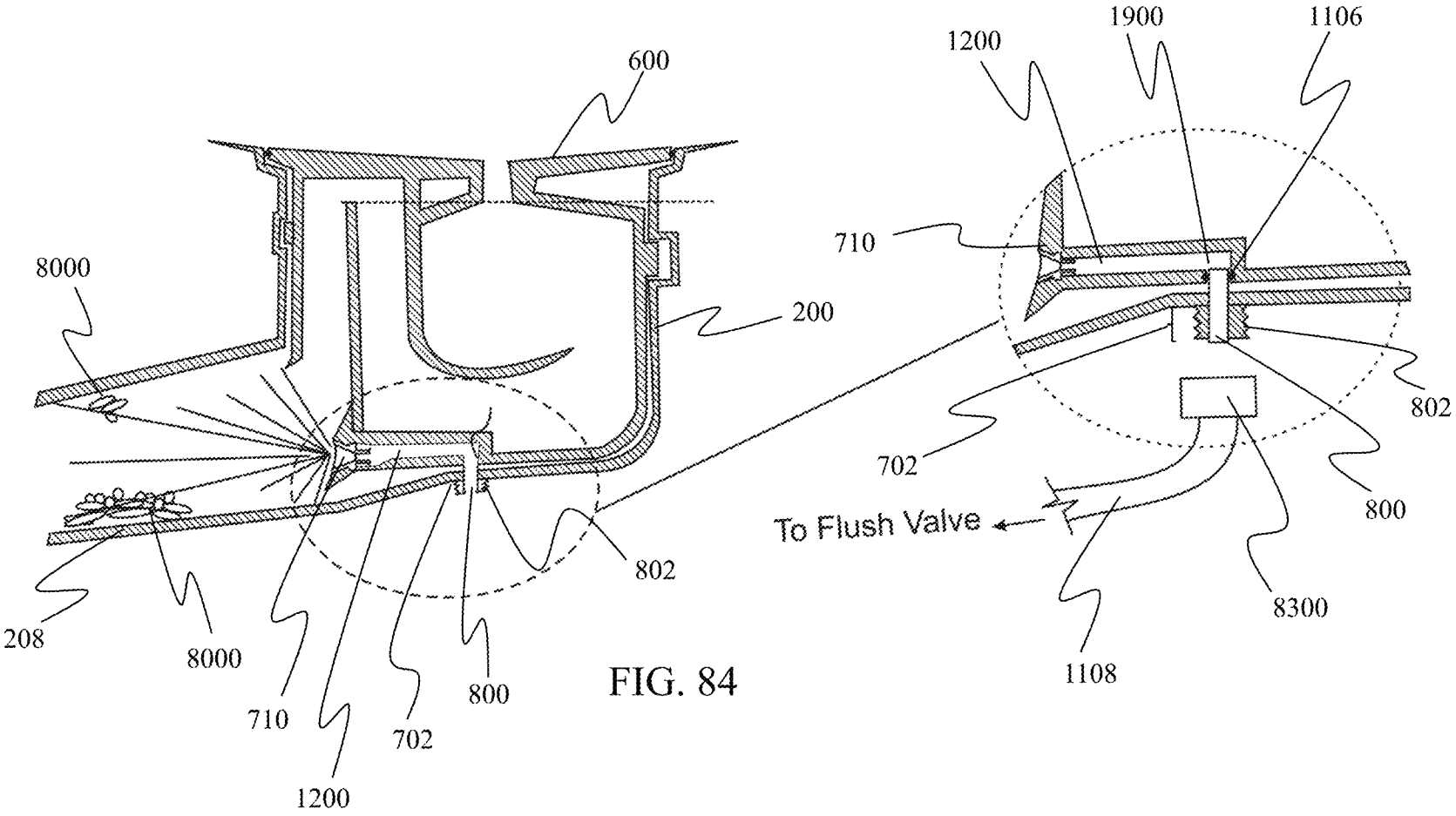
FIG. 84 is an cutaway side view illustration of a cartridge within a housing where the fluid interface occurs through the bottom of the cartridge and housing, according to the present invention.

It is understood that any of the described fluid interface configurations, for example, those depicted in detail in FIGS. 83, 84, and 85, could be inverted; turning males into females or flipping the compliant sealing surface 5402 from the cartridge 600 to the housing 200 and moving the sealing surface 5500 from the housing 200 to the cartridge 600. Regardless of the geometry, the soft compressible O-ring or compliant sealing surface would ordinarily be made of silicone or other compliant material with a good shape memory and not prone to break down from chemicals in the water like chloramine. The combination of a compliant surface and a hard surface (in this case, an O-ring pressing against a harder structure such as a metal or hard plastic) deforms the compliant surface against the hard surface, forming a seal therebetween. In this case, the seal allows fluid to be passed from the housing to the cartridge while maintaining substantially all of the water pressure and without leakage.

Figure 86:
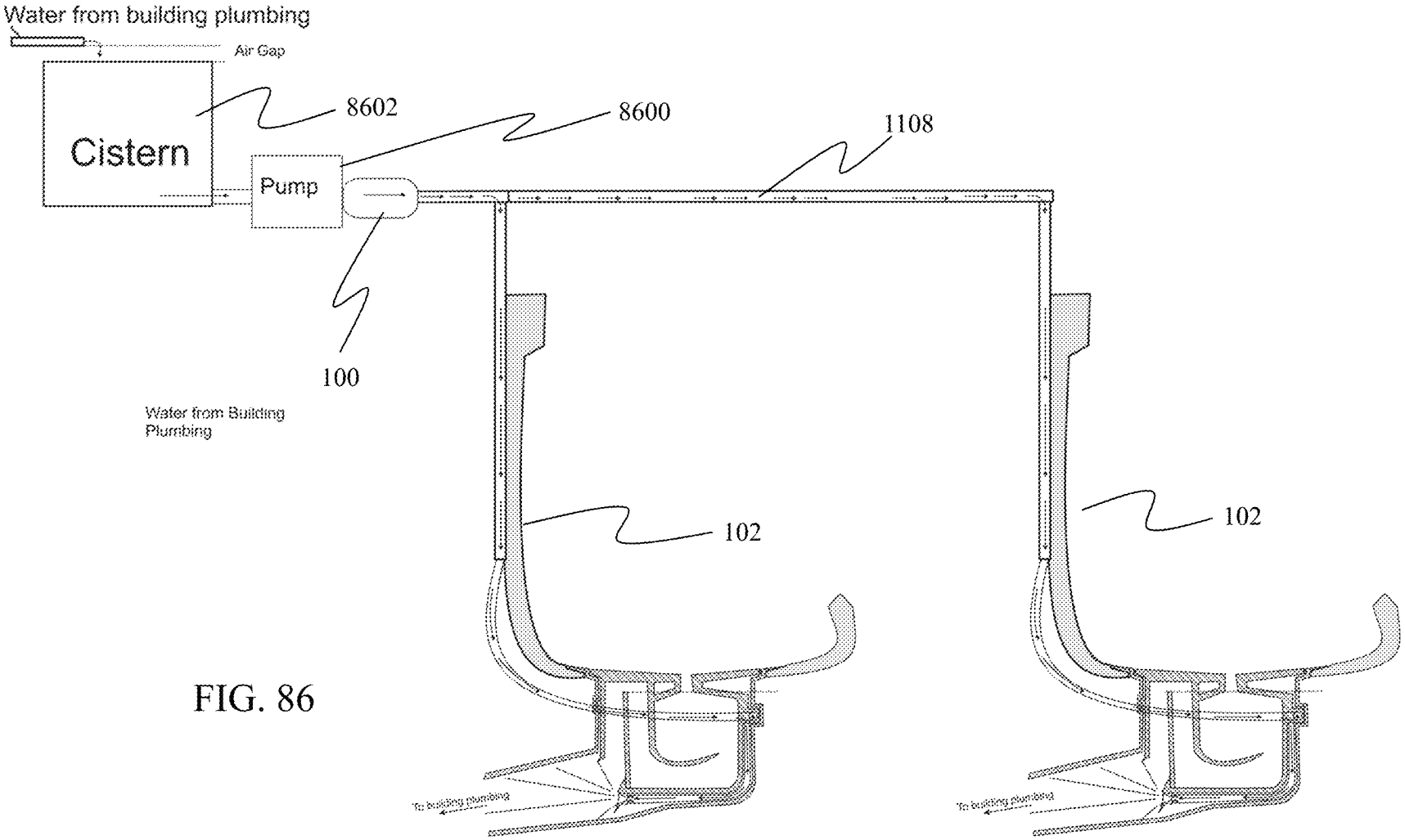
FIG. 86 is an illustration of a configuration of multiple hybrid urinals fed water through a single valve, according to the present invention.
Figure 87:
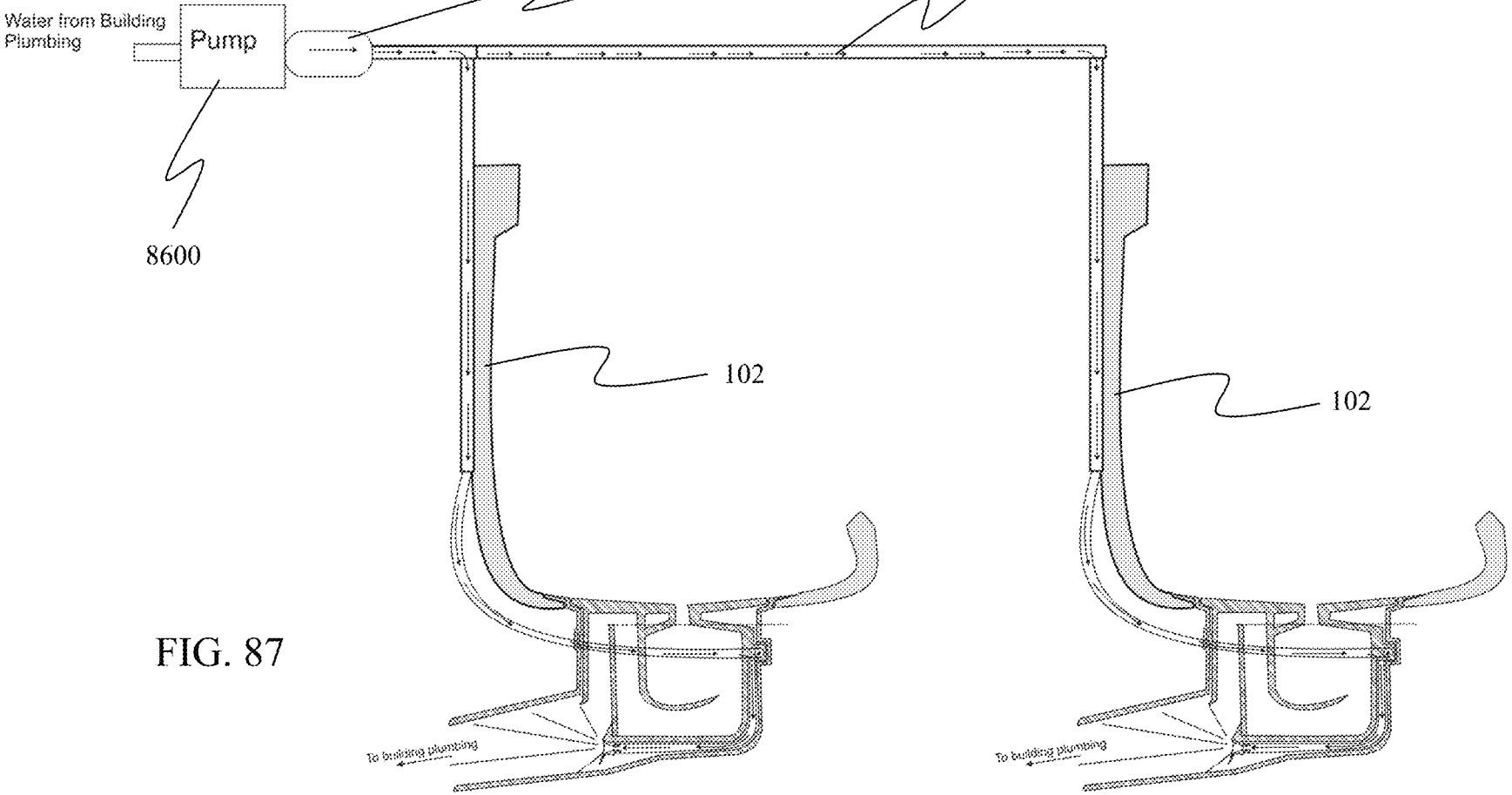
FIG. 87 is an illustration of a configuration of multiple urinals fed water through a single pump to create a more cost efficient set up where a single pump feeds water to one or more urinals, here a cistern acts to separate potable and non-potable water, according to the present invention.

An illustration of a configuration of multiple hybrid urinals 102 fed water through a single valve 100 is shown in FIG. 86. By chaining the urinals 102 together in a line, a single valve 100 can be used to control multiple urinals 102. As shown, the urinal set also includes a single pump 8600 and a cistern 8602 in-line with the urinals 102. A configuration of multiple urinals 102 fed water through a single pump 8600 is shown in FIG. 87. In this manner, a more cost efficient set up can be created where a single valve/actuator 100 or a pump 8600 (as shown in FIG. 86 as well) feeds water to more than one urinal 102. In use, a cistern 8602 (as shown in FIG. 86) can act to separate potable and non-potable water prior to feeding into the pump 8600 (acting as an air gap). The pump 8600 pressurizes the flushing water as it is fed to the urinals. In this configuration, the potable and non-potable water are separated while still providing pressurized flushing water to the system.

Figure 88:
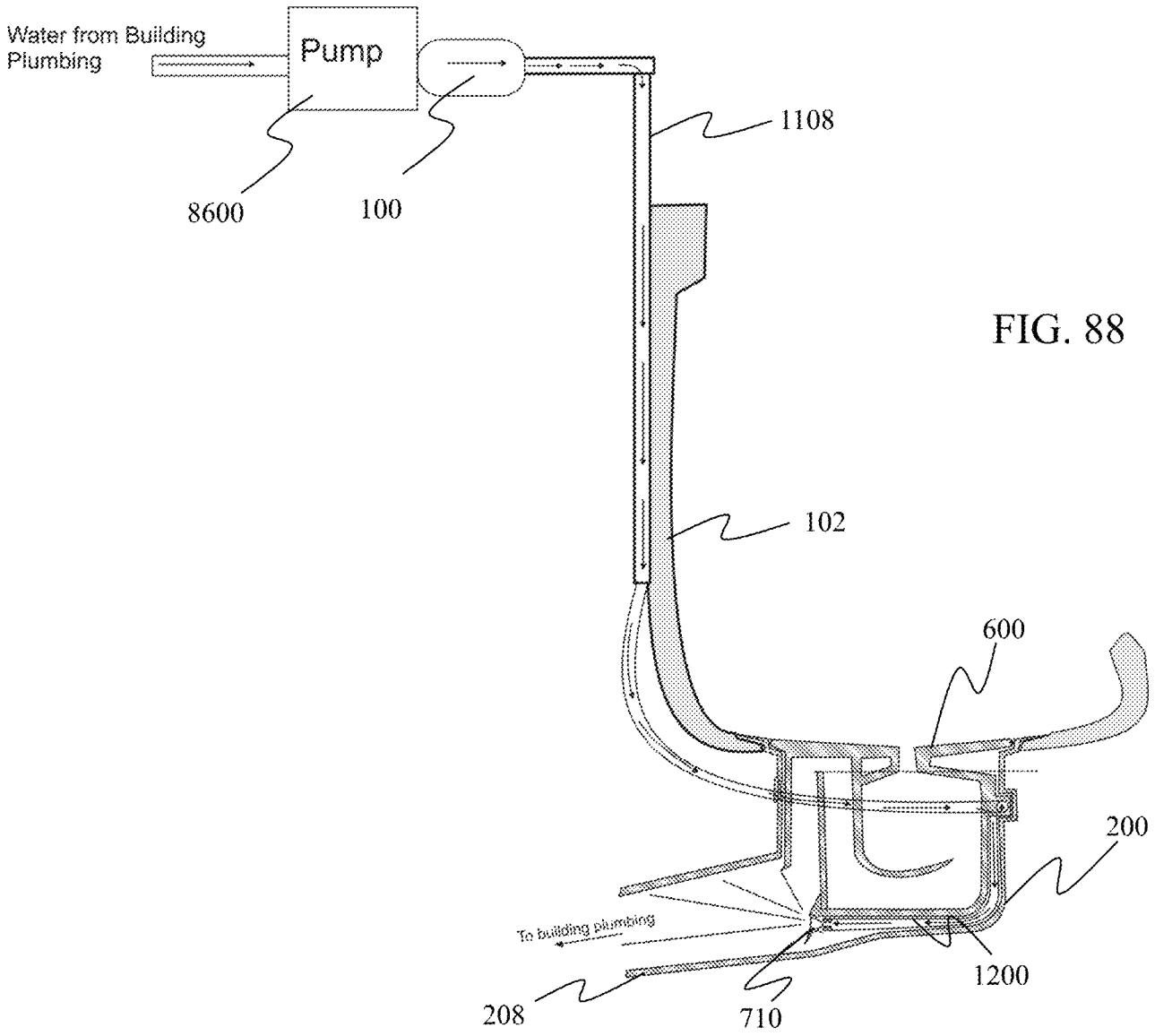
FIG. 88 is an illustration of a cutaway side view of a hybrid flushing system, according to the present invention.

A cutaway side view of a hybrid flushing system according to the present invention is presented in FIG. 88. There is both a pump 8600 and a valve 100 to allow flushing water to enter the system. Flushing water is carried through the piping 1108 and transfers from the housing 200 to the cartridge 600 in a water tight seal when the cartridge 600 is inserted in the housing 200, as seen here. When the flush valve 100 is open, the water travels through a water transfer tube 1200 and through a flushing fluid directing portion 710, such as an intensifying aperture or high pressure spray head, before spraying out of the cartridge and into the exit 208.

Figure 89:
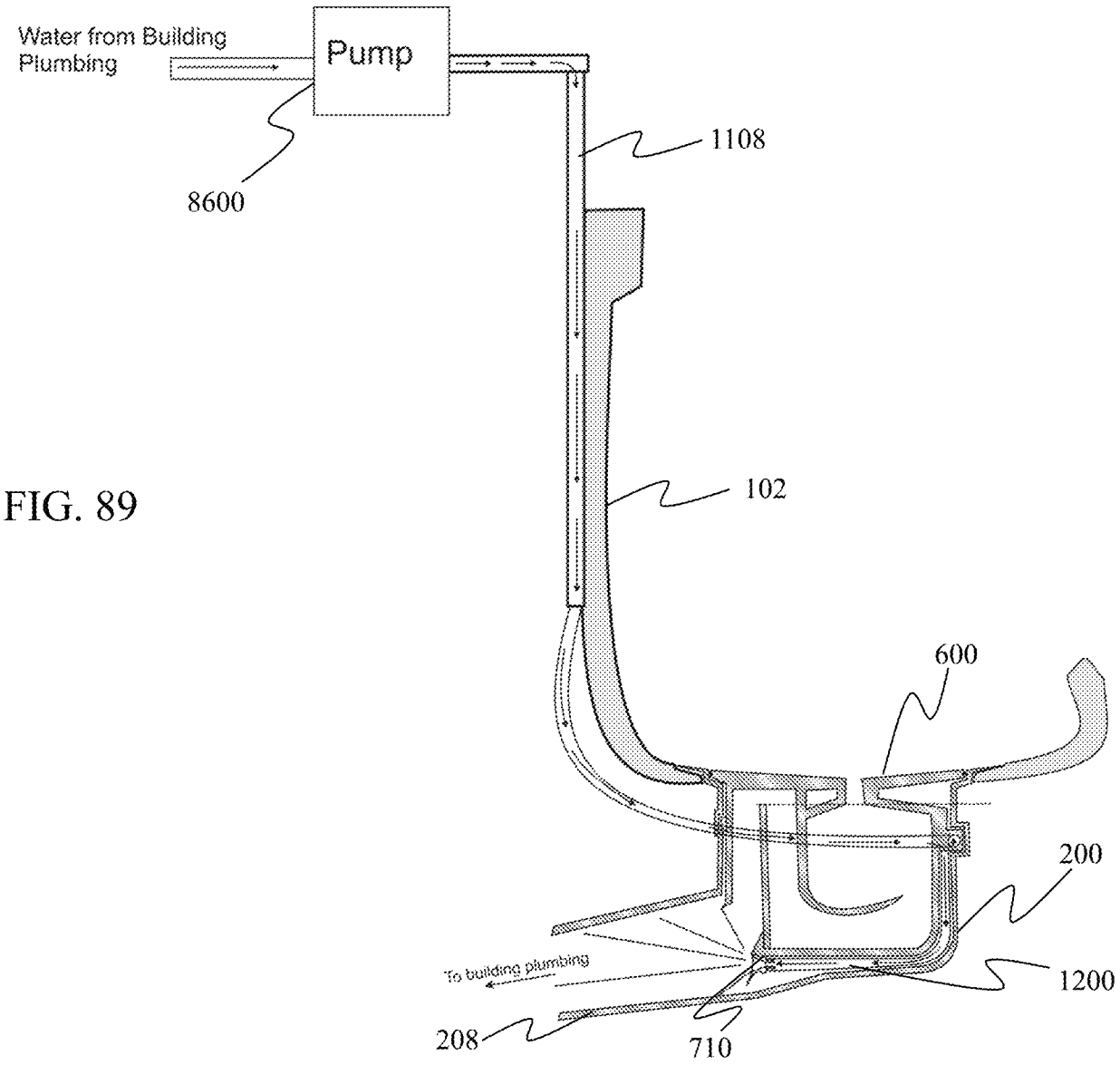
FIG. 89 is an illustration of a cutaway side view of a hybrid flushing system, similar to FIG. 88, but without a valve, according to the present invention.

A cutaway side view of a hybrid flushing system similar to that shown in FIG. 88 is shown in FIG. 89 but without the valve 100. There is only a pump 8600 to allow the flushing water to enter the system under pressure. The flushing water is carried through the pipes that form the supply line 1108 and transfers from the housing 200 to the cartridge 600 in a water tight seal when the cartridge 600 is inserted in the housing 200, as seen here. When the pump 8600 is activated, the flushing fluid travels through the system all the way through the fluid channel 1200 and through a flushing fluid directing portion 710 such as a fluid intensifying aperture or a high pressure spray head, before spraying out of the cartridge and into the housing exit tube 208.

Figure 90:
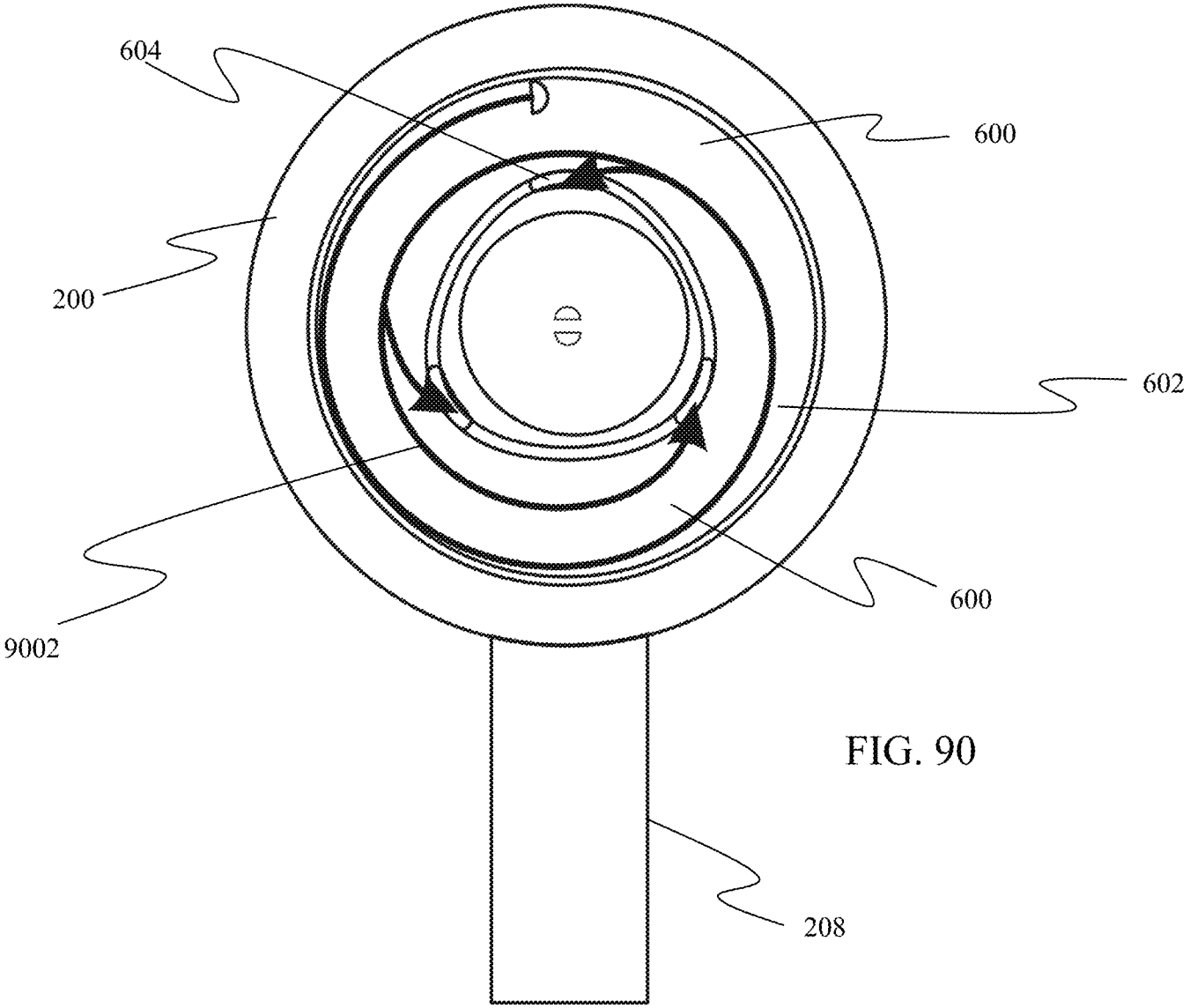
FIG. 90 is an illustration of a top view of a cartridge and a housing with flushing water swirling through the housing, according to the present invention.

A top view of the cartridge 600 and the housing 200 is shown in FIG. 90. A rinse outlet 9000 (there can be a plurality of rinse outlets) allows the flushing fluid to exit the top flange 602 of the cartridge 600, where it rinses the top flange 602 and then enters the cartridge inlets 604 and goes into the cartridge 600, displacing the older urine and water. The flushing fluid 9002 is illustrated by a dark spiral line, showing that it swirls before entering the inlet 604. The swirling action is not required, but it can be beneficial for cleaning.

Figure 91:
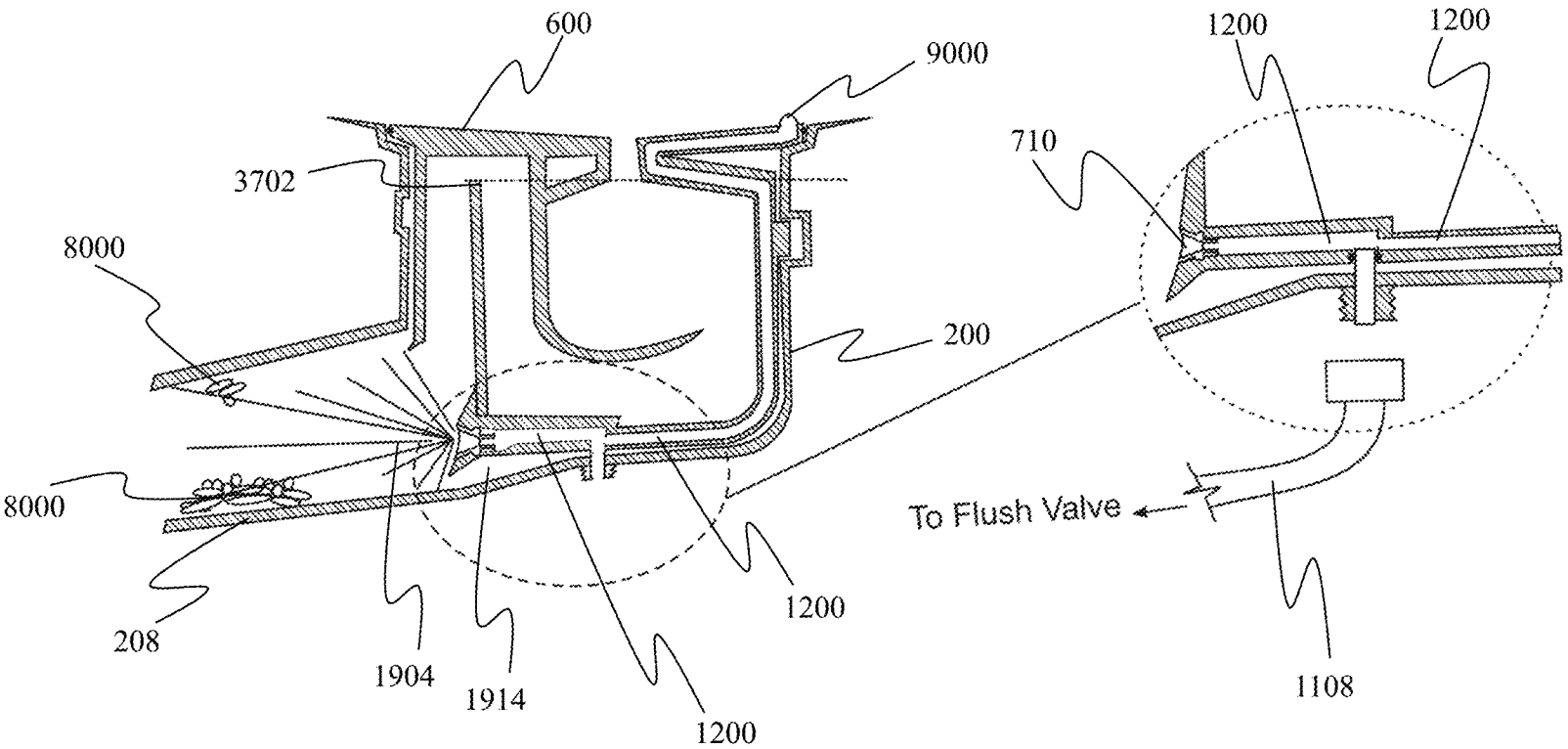
FIG. 91 is an illustration of a cutaway side view of a cartridge and a housing body with built-in channel to carry flushing water both to a high pressure spray head and to a rinse outlet, according to the present invention.
Figure 92:
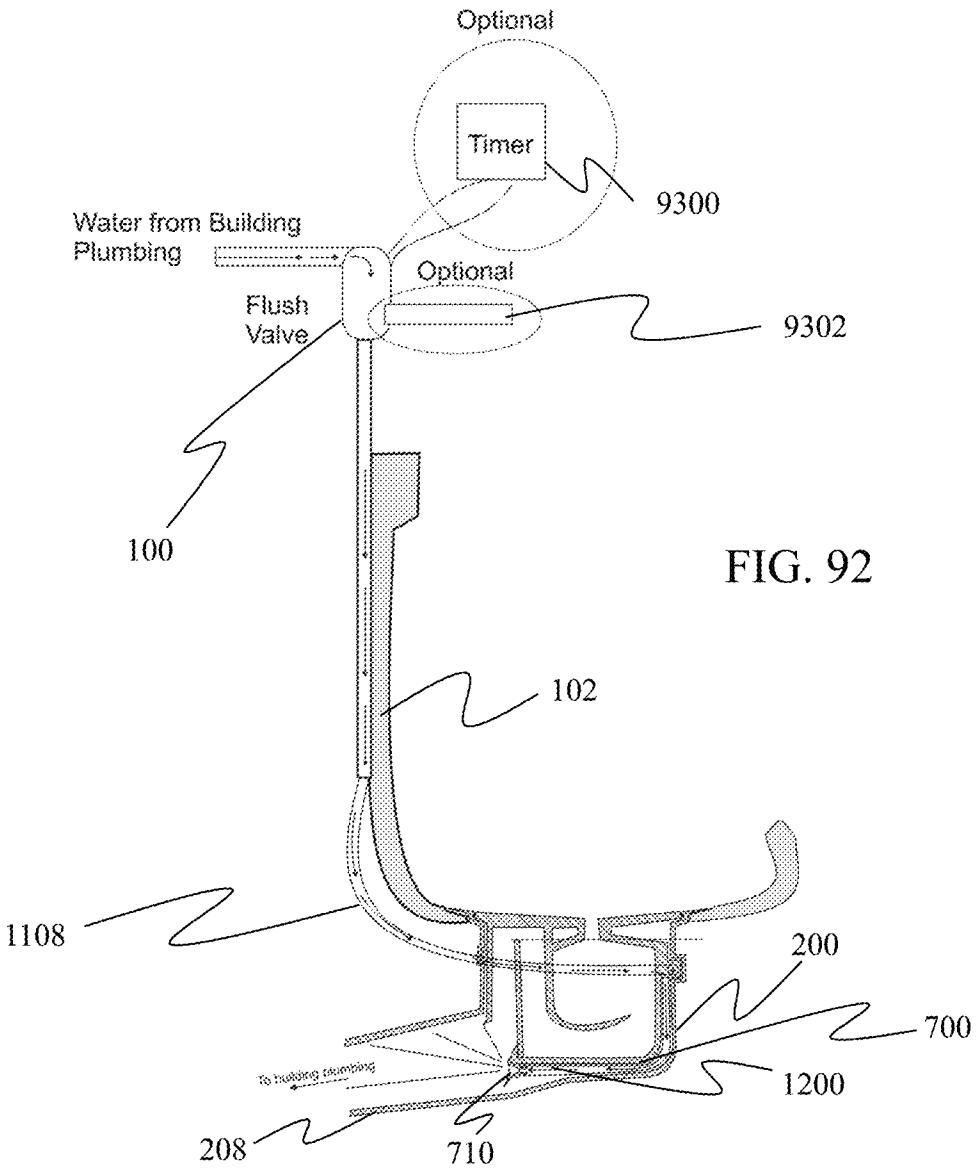
FIG. 92 is an illustration of a cutaway side view of a self-clean urinal system in one of its preferable embodiments where a valve is shown to be operable by different means, according to the present invention.

A side cutaway view of a cartridge 600 and a housing body 200 is shown in FIG. 91. This is the same type of the cartridge 600 and the housing body 200 as shown in FIG. 90 above. In this side cutaway view, the built-in channel 1200 can be seen to carry the flushing water both to the flushing fluid directing portion 710 (high pressure spray head) and to the rinse outlet 9000. By varying the inside diameter of the channel 1200, a desired balance of water dispersed between the rinse outlet 9000 and the flushing fluid directing portion 710 can be achieved. The smaller the diameter, lesser the volume of water that will pass to either component. A side cutaway view of a self-clean urinal system is shown in FIG. 92. Here a valve 100 is shown to be operable by a different means. As one option, a timer 9300 can be set to open the valve on the timed intervals. As another option, a mechanical actuator 9302 can be manually operated to open and close the valve. As will be appreciated by one of skill in the art, the valve 100 may be activated by many mechanisms, non-limiting examples being manual activation, lighting levels, a timer, a usage counter, and a remote control.

Figure 93:
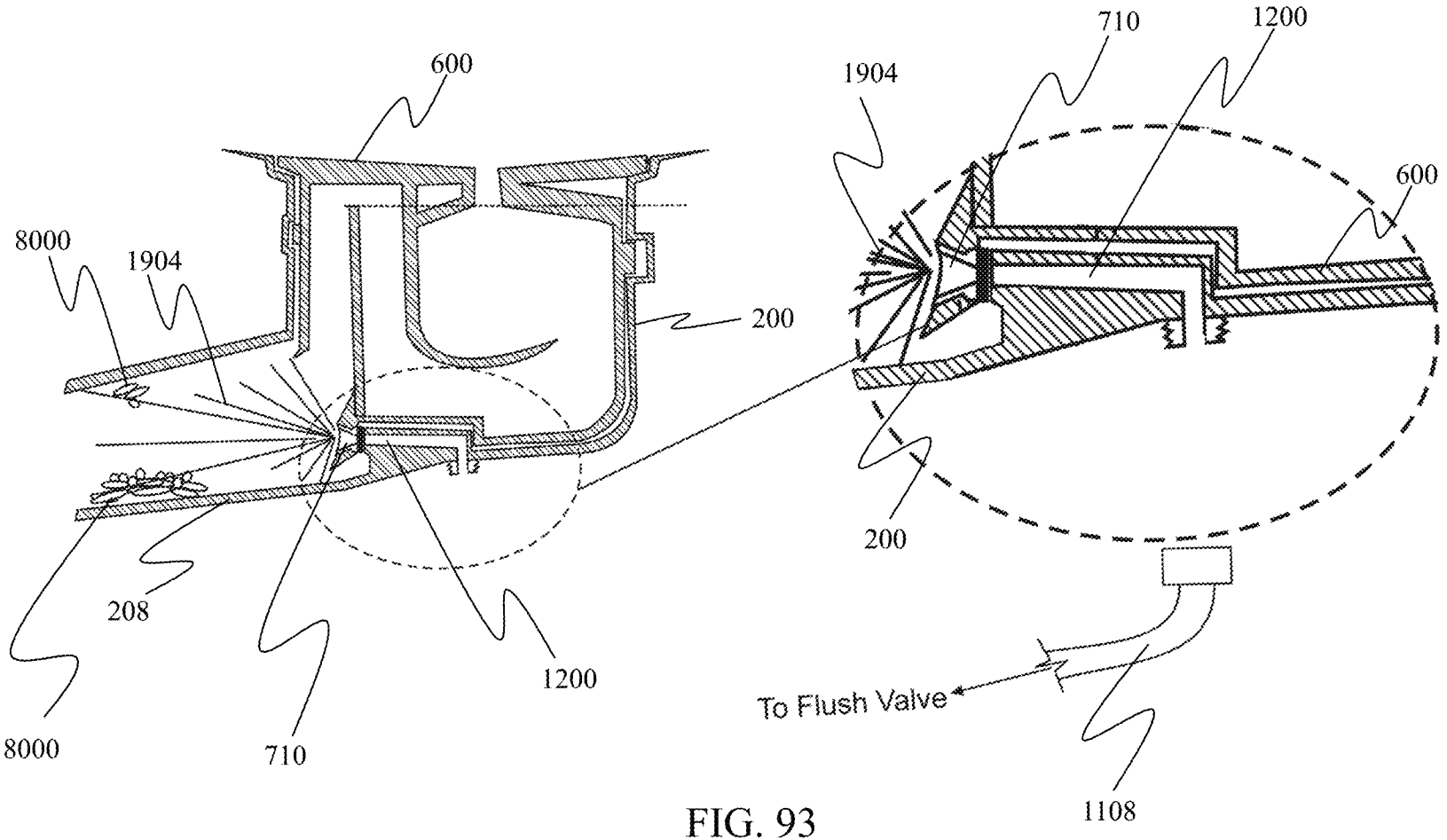
FIG. 93 is an illustration of a cross section of a housing that has a built-in high pressure spray head where the high pressure spray head is integrally connected to a cartridge, according to the present invention.

Another embodiment of a housing 200 and cartridge 600 is presented in FIG. 93. The housing 200 in this example is similar to the housing presented in FIG. 12 and the cartridge is similar to that presented in FIG. 28. The fluid directing portion 710 (spray head) is integrally connected to the cartridge 600, which also includes a built-in fluid channel 1200. This allows the fluid directing portion 710 to be removed with the cartridge. Because the fluid directing portion 710 is a "wear" part, prone to eventual clogging after some use, it can be beneficial to have simplified replacement such as is depicted here, where the cartridge 600 has the fluid directing portion 710 integrally connected.

Figure 94:
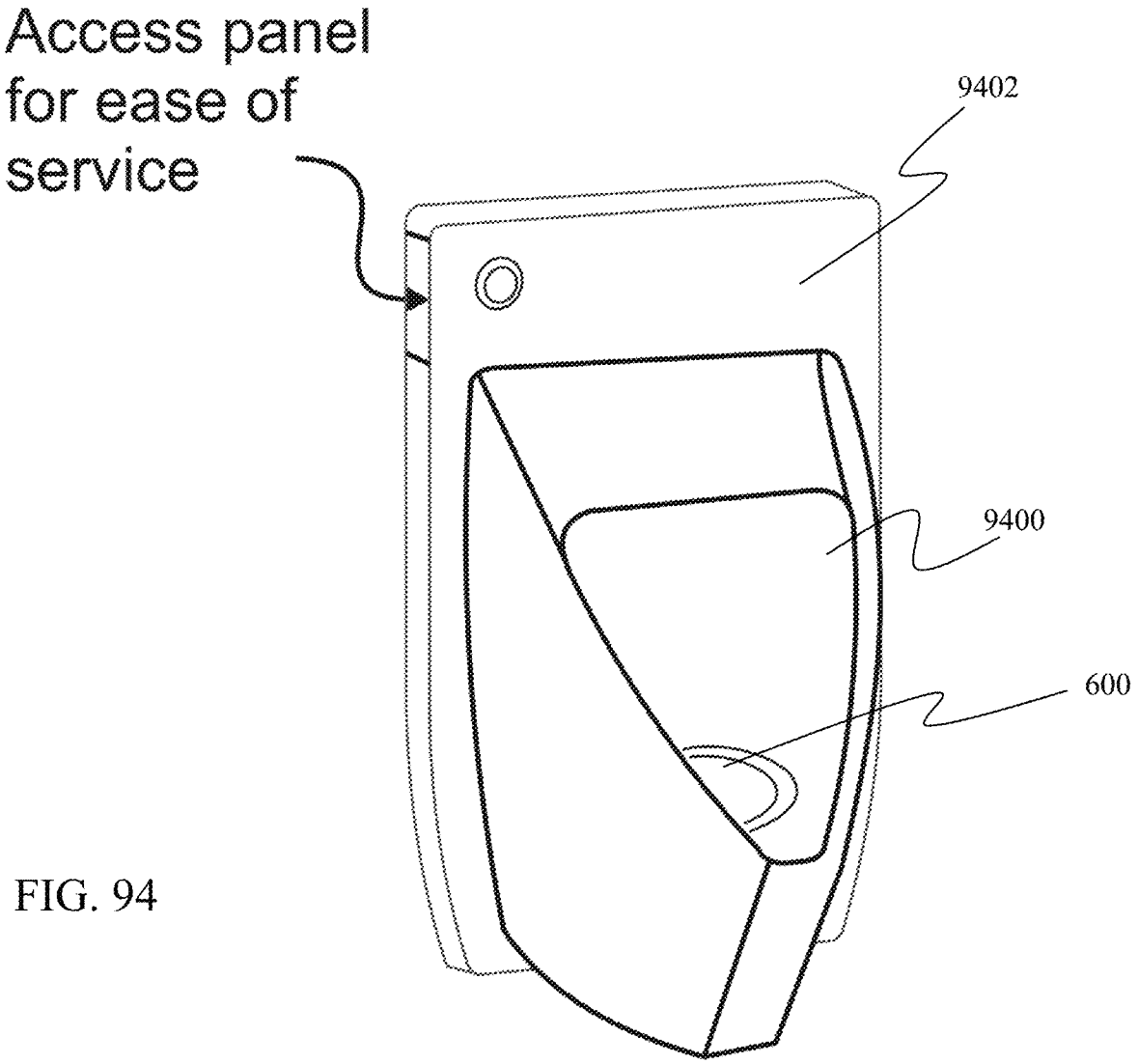
FIG. 94 is an illustration of an isometric view of a self-clean urinal system where a cartridge can be seen in a bowl of a urinal, according to the present invention.

An isometric view of a self-clean urinal system is presented in FIG. 94. Here, a cartridge 600 can be seen in the bowl of the urinal 9400. Further, there is a backing plate 9402 which covers any mechanical parts (for example: a flush valve, a horizontal supply line, and a vertical supply line) or a timer. This provides the advantage of utilizing existing urinal molds (a large expense) and urinals, while converting them to the self-clean models by hiding the mechanical portions behind the added backing plate 9402.

Figure 95:
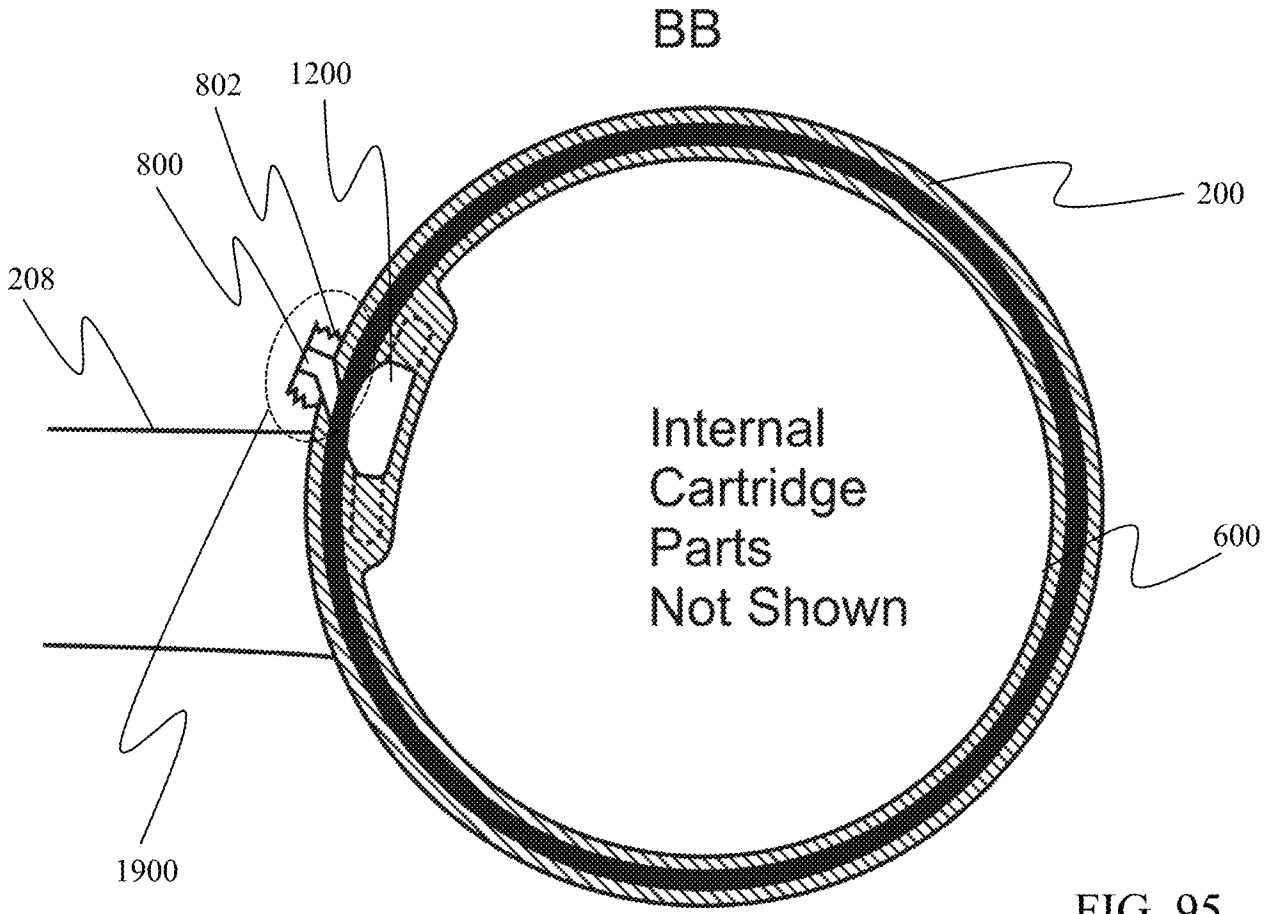
FIG. 95 is an illustration of a cross section (though line BB) of a cartridge as shown in FIG. 70, where a channel can be seen to enter through a housing body at an oblique angle (the internal cartridge parts are not shown), according to the present invention.
Figure 96:
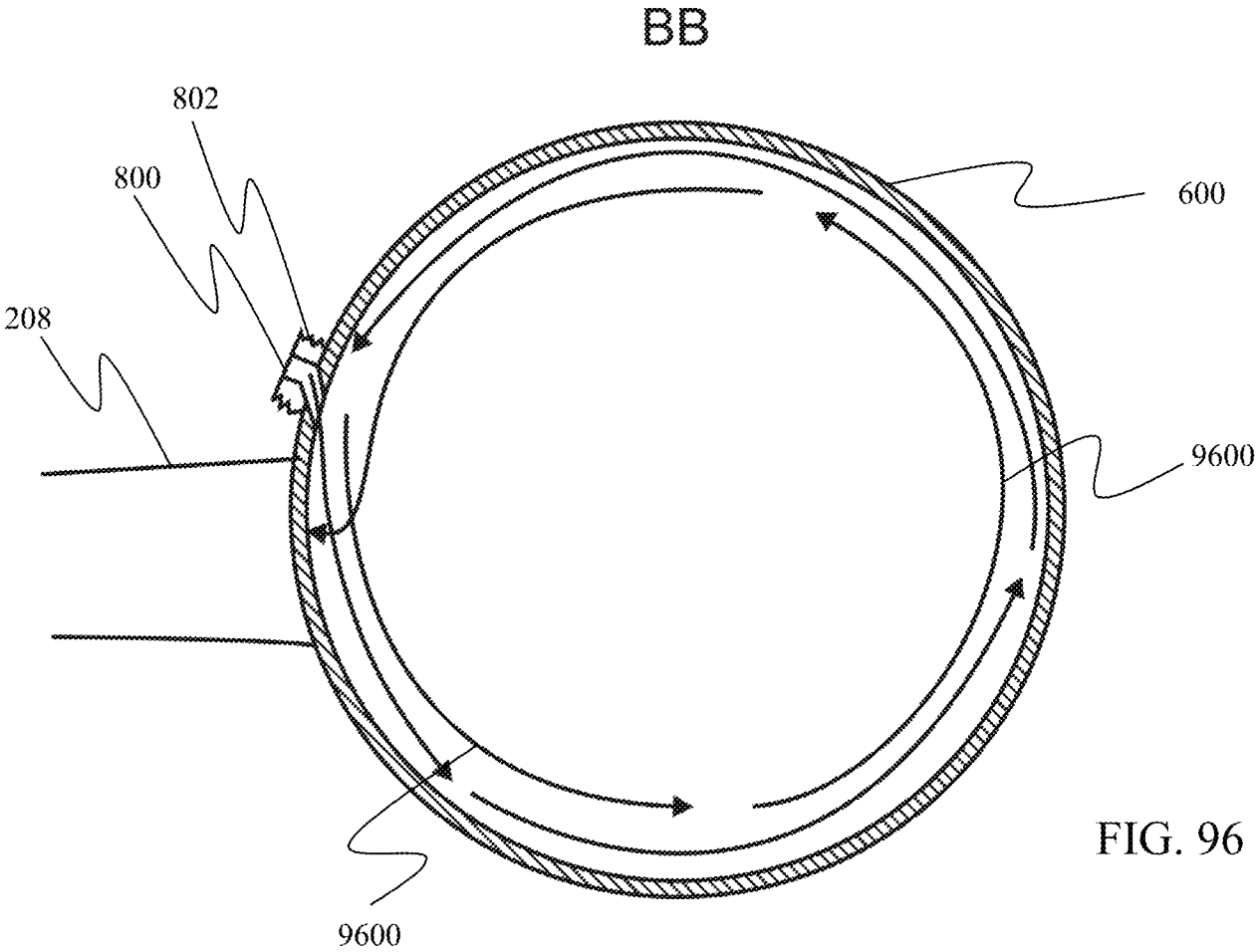
FIG. 96 is an illustration of the same housing seen in FIG. 95, with no cartridge inserted, where the channel, which enters the housing wall through an oblique angle, can be seen flushing water substantially tangent to the housing wall, according to the present invention.
Figure 97:
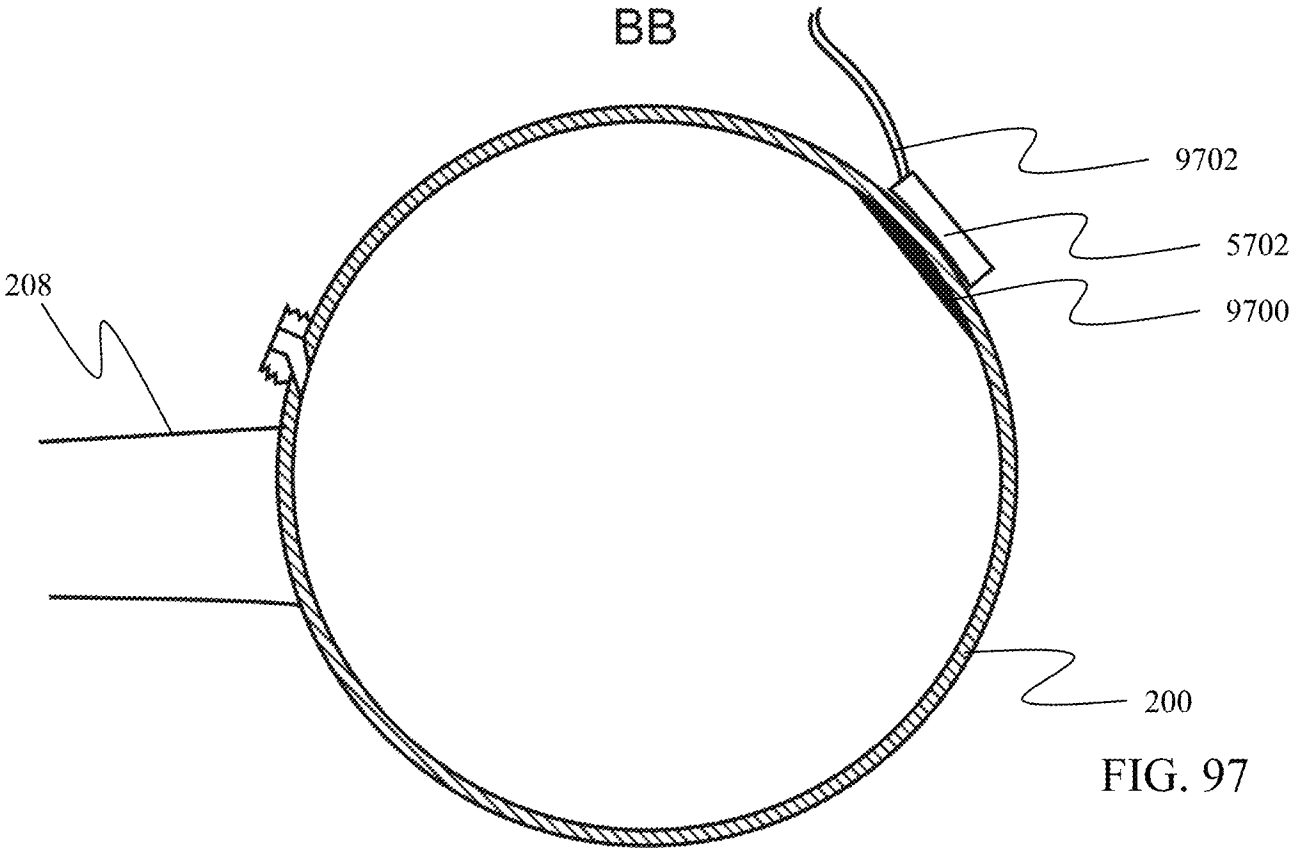
FIG. 97 is an illustration of the same housing seen in FIG. 96, with the addition of a sensing switch unit on the outer wall of the housing, according to the present invention.

A cross section of the cartridge 600 that was shown in FIG. 47 further above is shown in FIG. 75, cut though the line BB. The flushing fluid receiving portion 1900 can be seen to enter through the housing body 200 at an oblique angle. The same housing 200 seen in FIG. 95 is presented in FIG. 96, but with no cartridge inserted. In this case, the flushing fluid receiving portion 1900 which enters the wall of the housing body 200 through an oblique angle can be seen to direct the flushing water substantially tangent to the wall of the housing 200. The arrows 9600 depict the swirling path of the flushing water as it swirls before exiting the housing exit 208 to enter the building's plumbing. The same housing 200 seen in FIG. 96 is shown in FIG. 97, with the addition of a sensing switch unit 5702 on the outer wall of the housing 200. The sensing switch 5702 can cause the flushing system to be activated or deactivated. Additionally, an override adapter 9700 is shown as inserted on the inner wall of the housing 200 so that the sensor switch 5702 will allow the flushing valve to be operated. This override adapter 9700 can allow the unit to be flushed in the absence of a cartridge or with a cartridge that does not have the ability to activate the sensing switch 5702. Connection wires 9702 are shown for providing power to the switch unit 5702 and/or for connecting the switch unit 5702 with other electronics.

Figure 98:
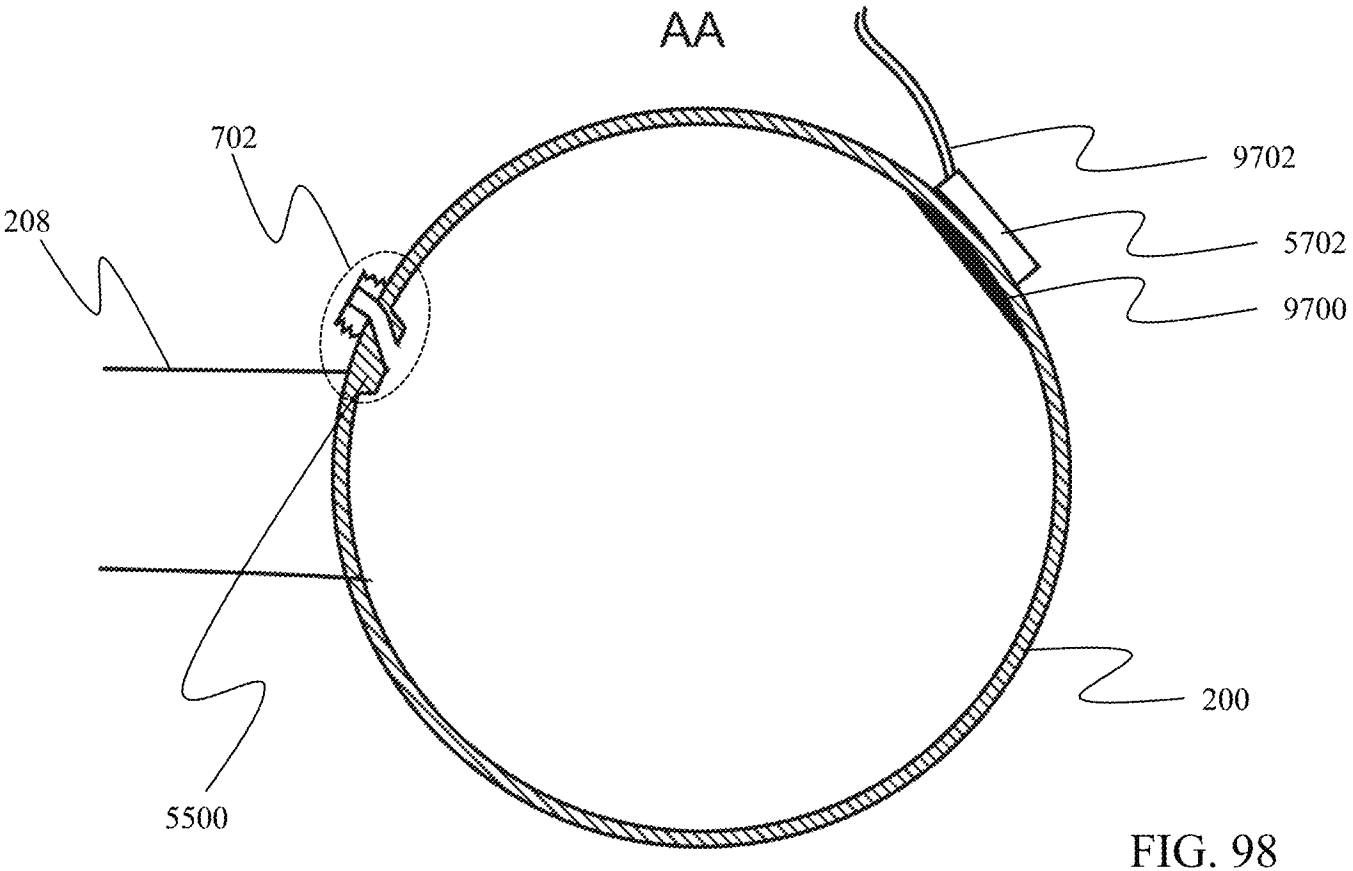
FIG. 98 is an illustration of the cross section (taken through line AA seen in FIG. 55) similar to the cross section shown in FIG. 97, but with a slightly different housing fluid interface, where it has a proud sealing surface and an override adapter inserted to actuate the switch, according to the present invention.

A configuration similar to FIG. 97 is presented in FIG. 98, with a slightly different housing fluid interface 702. In this case, the housing fluid interface 702 has a proud sealing surface 5500. Again, an override adapter 9700 has been inserted proximate the switch 5702. The methods for accomplishing this are well known in the electronics industry and can be readily acquired. The switch 5702 is activated by non-limiting mechanisms such as a magnet, radio-frequency identification (RFID), feature recognition, and other non-touching means.

Figure 99:
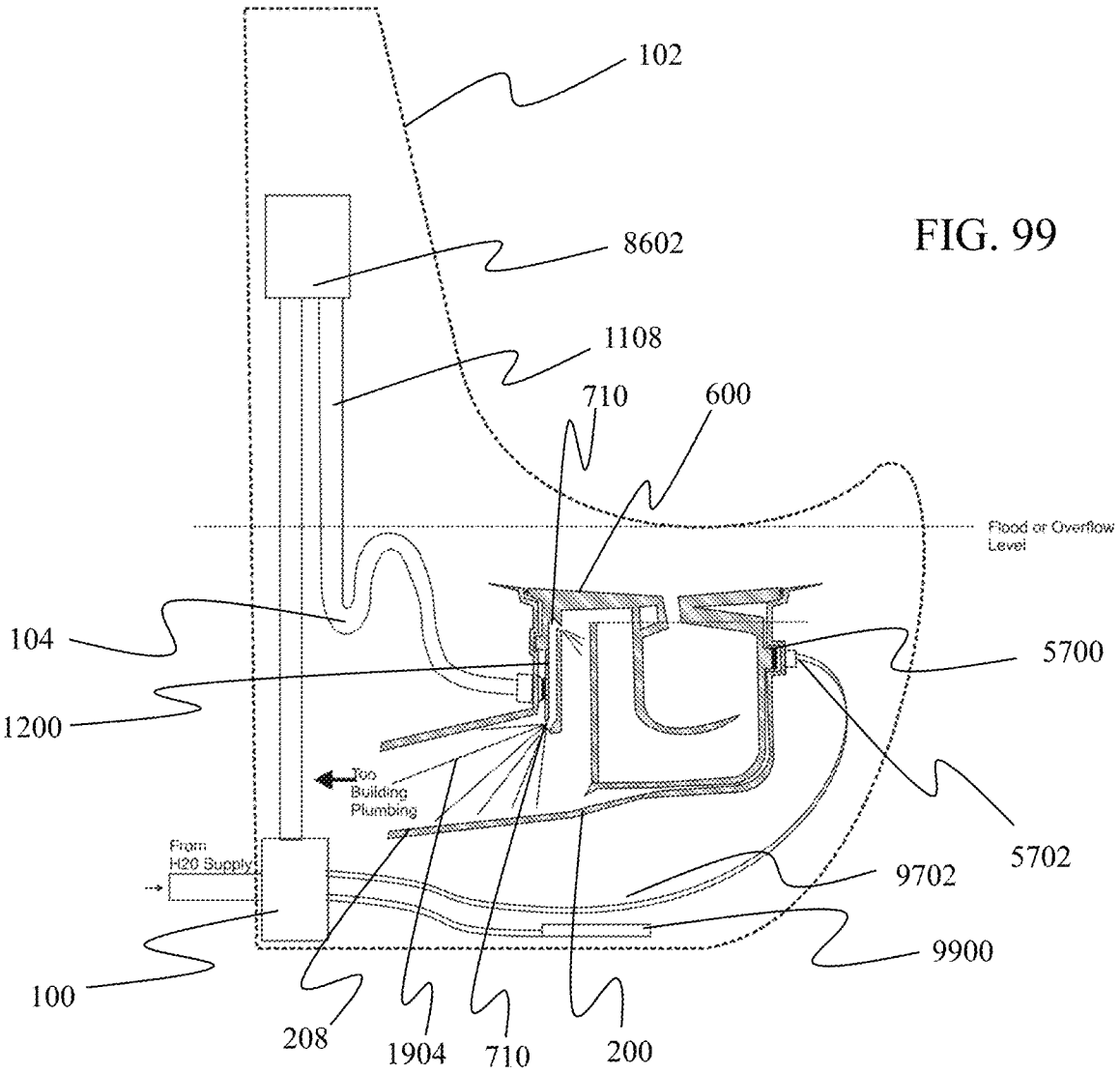
FIG. 99 is an illustration of a hybrid flushing system in a complete form and installed in a urinal (which is depicted with a dashed line), according to the present invention.

An illustration of the system in a complete form, installed in a urinal 102 (depicted with a dashed line) is presented in FIG. 99. The fluid enters through the control box, which can have a valve, a power supply, and a brain/processor, all built into a single unit or separated. The control box can be activated with a sensor 9900, via a built-in timer, or both. A switch 5702 can prevent the valve 100 (or pump 8600) from opening. The cartridge 600, when placed, can have an actuator 5700 integral with the cartridge 600 or separately disposed to open the switch 5702. Once the valve 100 is open, flushing fluid enters the system traveling through the vacuum breaker (air gap device) 8602, which is held above the flood level (as shown). The flushing fluid then travels through the system and through the trap 104 before entering the housing 200 and the cartridge 600 which are fluidly coupled. The flushing fluid is then directed by the cartridge 600 to the key areas of the housing 200 for cleaning. The flushing fluid directing portions 710 (velocity intensifying apertures) can be placed strategically to form a high pressure spray against the walls of the housing and the building pipes, to scrub them and keep them clean with each flush.

Figure 100:
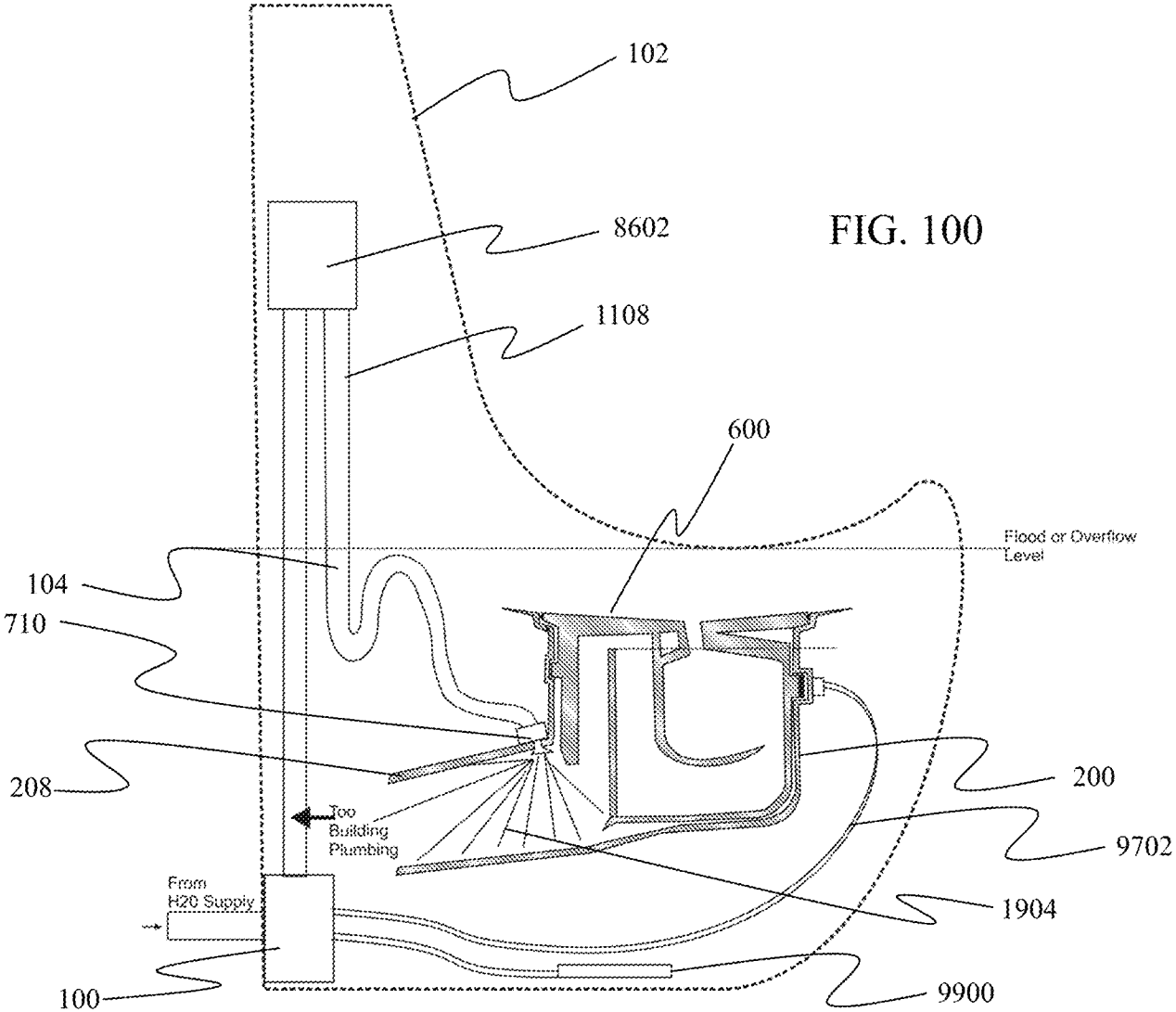
FIG. 100 is an illustration of a valve similar to the one shown in FIG. 99, but the flushing water is directly sprayed into the housing through a velocity-intensifying aperture, according to the present invention.

Another urinal 102 is presented in FIG. 100 and is similar to that shown in FIG. 99, however here, the flushing water is directly sprayed into the housing 200 through a vertically aligned housing fluid directing portion 710 disposed thereon.

Figure 101:
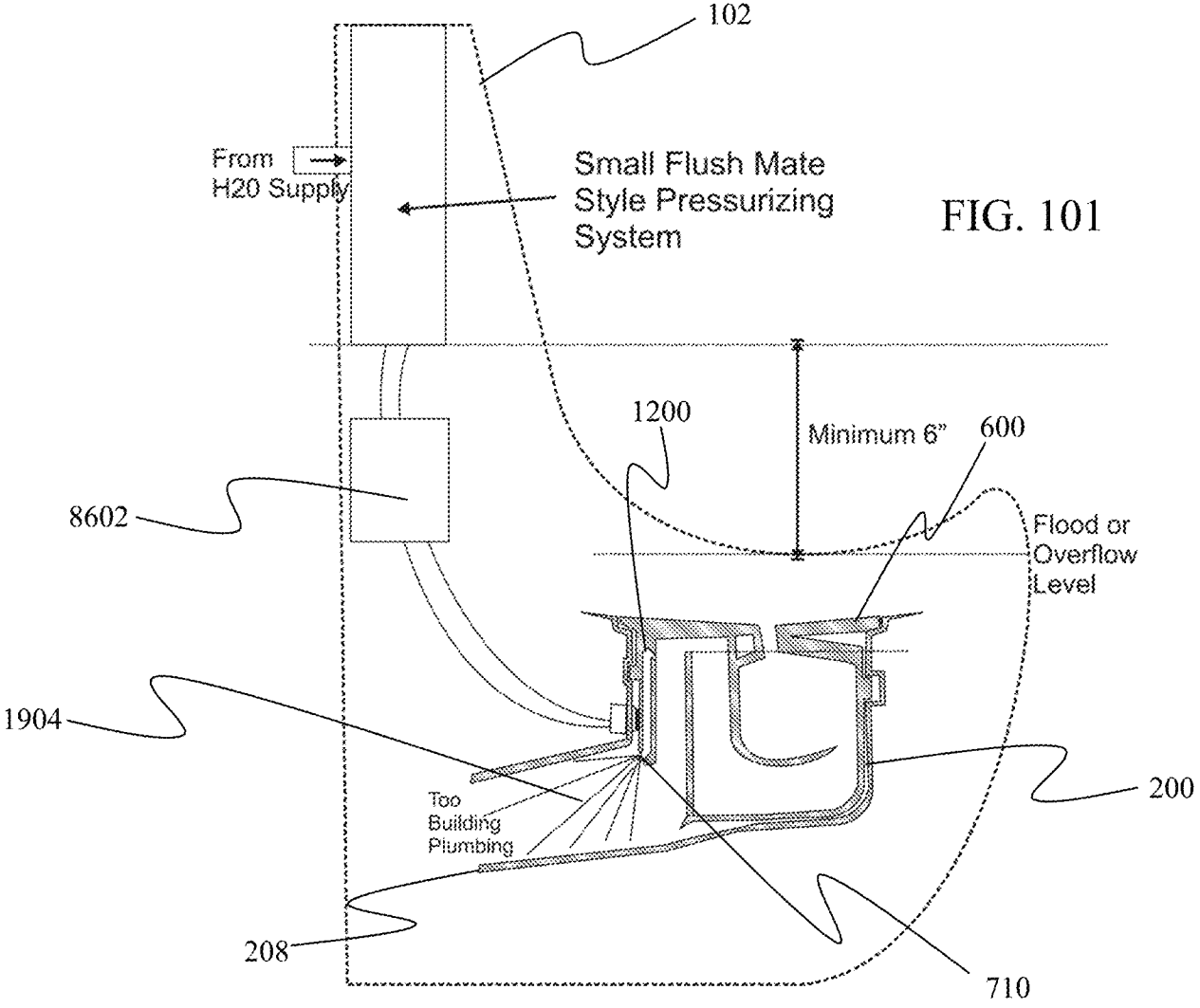
FIG. 101 is an illustration of a cutaway side view of a hybrid flushing system where the flushing water is provided by a pressurizing device, according to the present invention.

A schematic illustration of a hybrid flushing system incorporating the invention where the flushing water is provided by a pressurizing device 8602, such as the one made by the Flushmate Corporation (a division of Sloan Valve Co., 10500 Seymour Avenue, Franklin Park, Ill. 60131), is presented in FIG. 101. This provides a lower cost means of a pressurizing system without having to utilize electronics—thus it can be configured to operate manually, but providing service group a key required for flushing unit urinal for service purposes.

A hybrid flushing system schematic that embodies the invention in a configuration especially applicable to gravity feed or lower pressure situations, as discussed earlier, is shown in FIG. 102. Here the urinal 102 counts on a more significant volume of water fed by gravity, then shaped and or redirected by the cartridge 600. A deflector 10200 can focus the flowing water, through known means like a narrowing or tapering of the cartridge exit area as taught in Falcon the U.S. Provisional Patent Application No. 61/828,153 (hereinafter patent application '153 and to which the present application claims priority, incorporated herein by reference). In this case it is shown with a liquid style cartridge 600. The mechanism for shaping and improving the velocity and the aim of the fluids exiting a mechanical or fluid trap style waterless urinal cartridge have been taught in the U.S. Provisional Patent Application No. 61/911,594 (hereinafter patent application '594 and to which the present application claims priority, incorporated herein by reference), owned by Falcon Waterfree Technologies, LLC. A P-trap 104 is placed in line with the flushing fluid and, along with an air gap device 8602 forms an air column 10202 to prevent restroom exposure to wastewater gasses.

Figure 102:
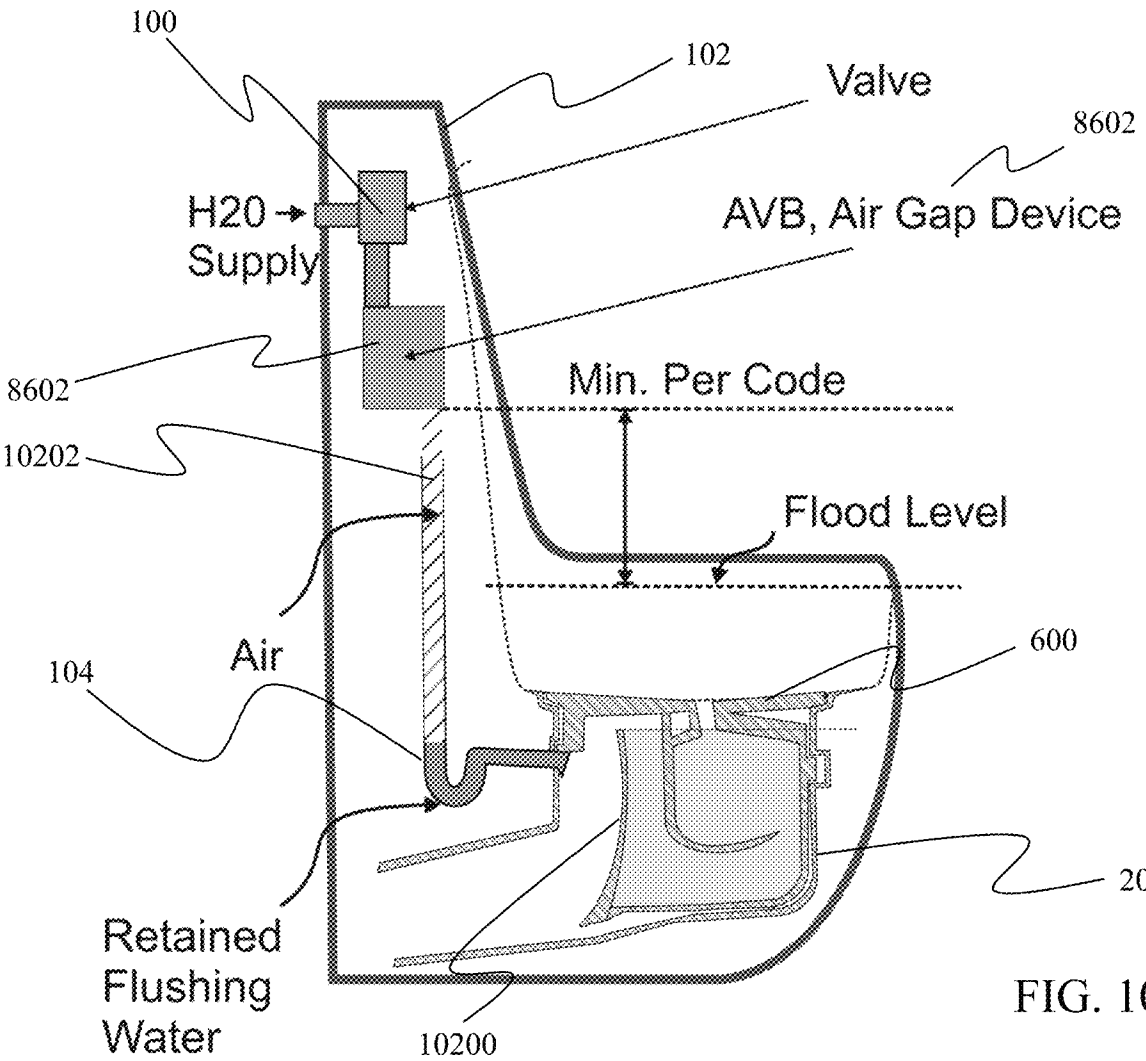
FIG. 102 is an illustration of a cutaway side view of a hybrid flushing system with a configuration that is especially useful in gravity feed or lower pressure situations and where the urinal counts on a more significant volume of water fed by gravity, then shaped and/or redirected by the cartridge, according to the present invention.
Figure 103:
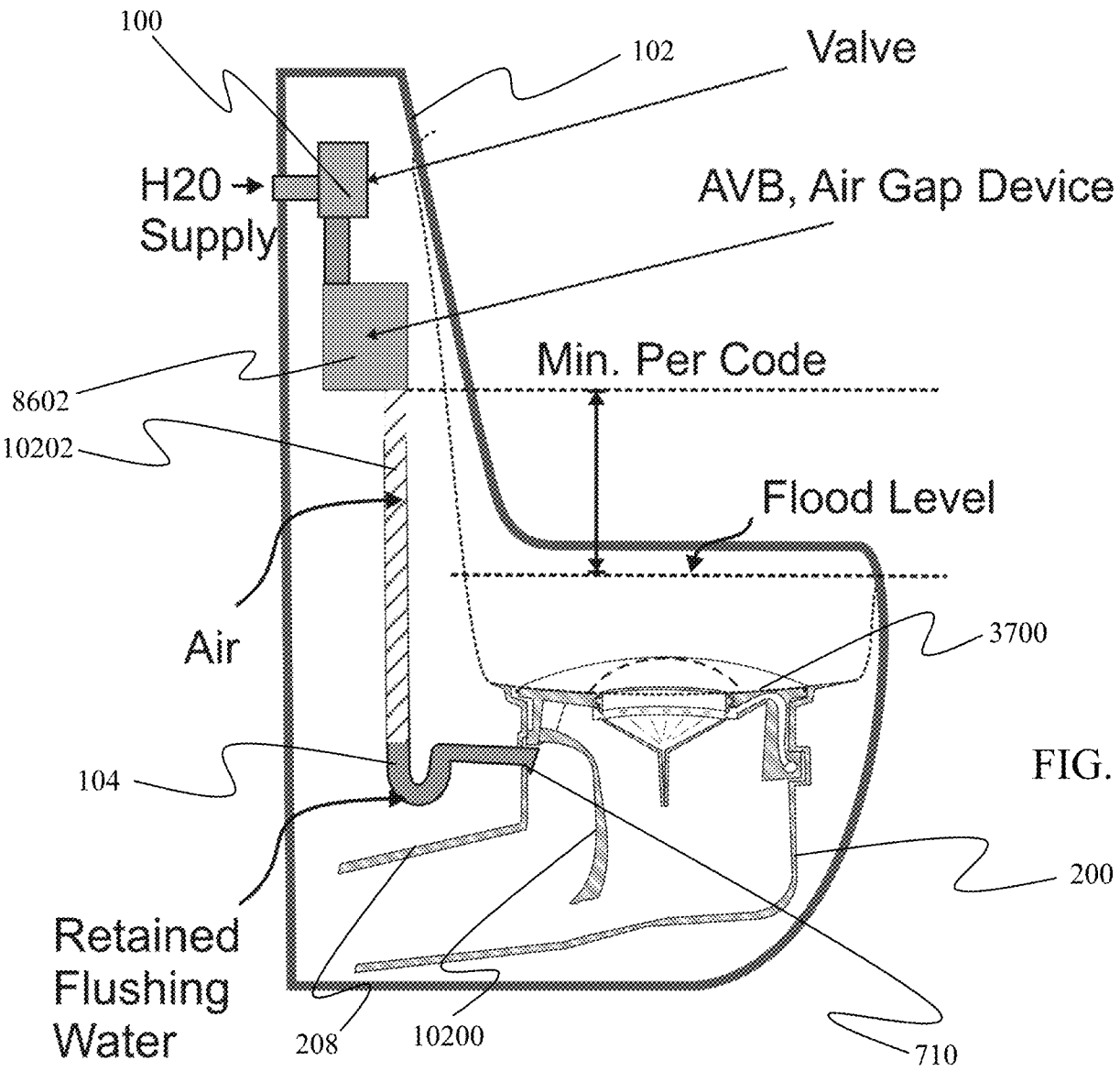
FIG. 103 is an illustration of a cutaway side view of a hybrid flushing system similar to that shown in FIG. 102, however here it incorporates a mechanical valve cartridge rather than a liquid trap cartridge, according to the present invention.

A similar configuration to that presented in FIG. 102 is shown in FIG. 103, with the main difference being that FIG. 103 incorporates a mechanical cartridge 3700 rather than a liquid trap cartridge 600. Ways for shaping and improving the velocity and the aim of the fluids exiting a mechanical trap cartridge 3700 or a fluid trap style waterless urinal cartridge 600 have been taught in the patent application '594. Further, the high pressure spray heads 710 may be configured to create a vortex shape of the water flushing down the pipes to improve cleaning. This swirling motion is known to carry solids to the center of the vortex as it flushes and scrubs the pipe surfaces.

Figure 104:
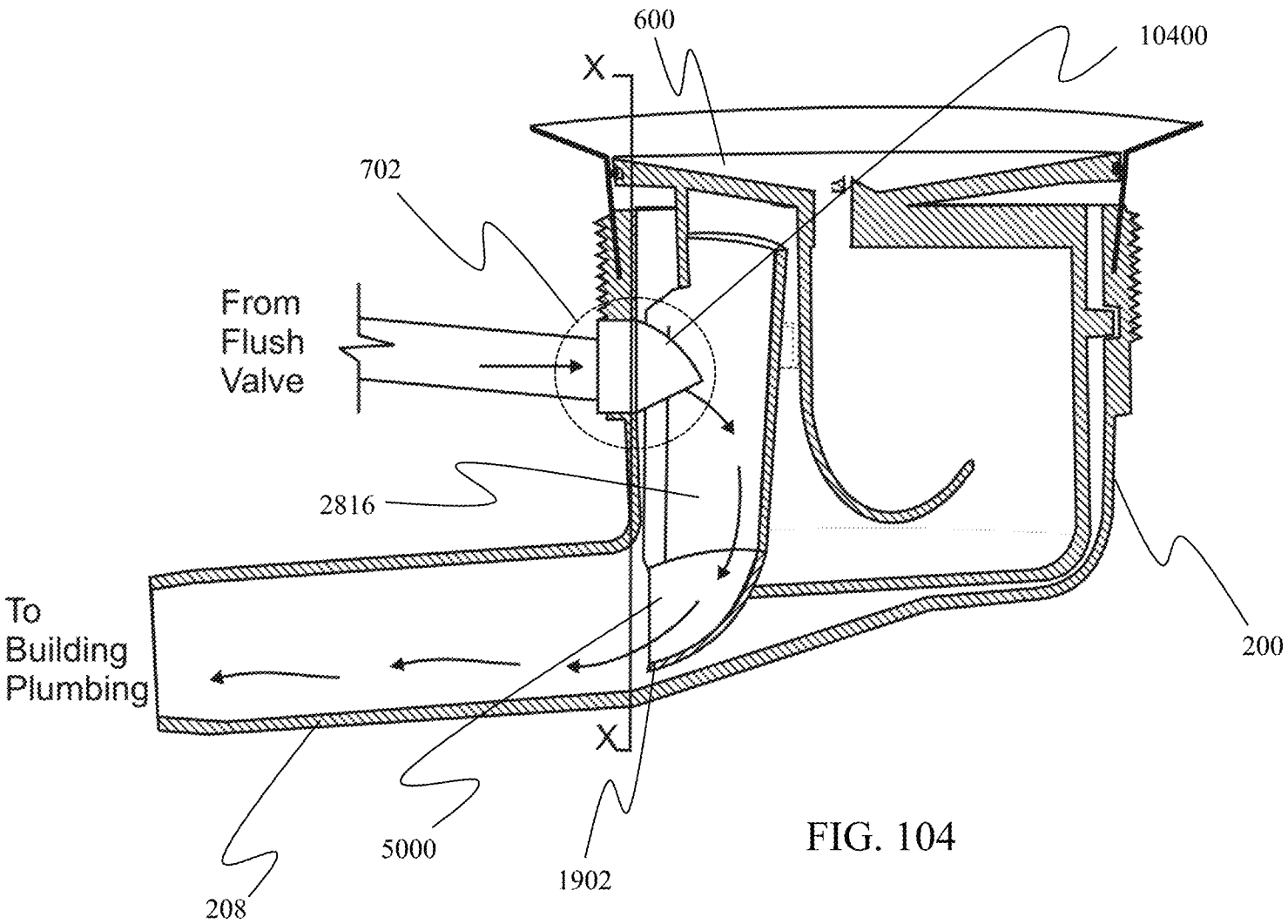
FIG. 104 is an illustration of a left side cross sectional view of the cartridge as seen in FIGS. 50, 51, 52, and 53, here seen placed in a housing, which incorporates a housing fluid interface and an inlet director, according to the present invention.

A left side cross sectional view of the cartridge 600 previously shown in FIGS. 50 to 53, now seen placed in a housing 200, which incorporates a housing fluid interface 702, and an inlet director 10400 is shown in FIG. 104. In this version, it is not required to have a watertight seal between the cartridge 600 and the housing 200. Instead, the inlet director 10400 helps point flushing water in the desired direction as it enters the housing 200. The inlet director 10400 may be made of a compliant elastomeric material allowing it to flex out of the way when the cartridge 600 is inserted, then flex back into position once the cartridge has been fully inserted into position.

Figure 105:
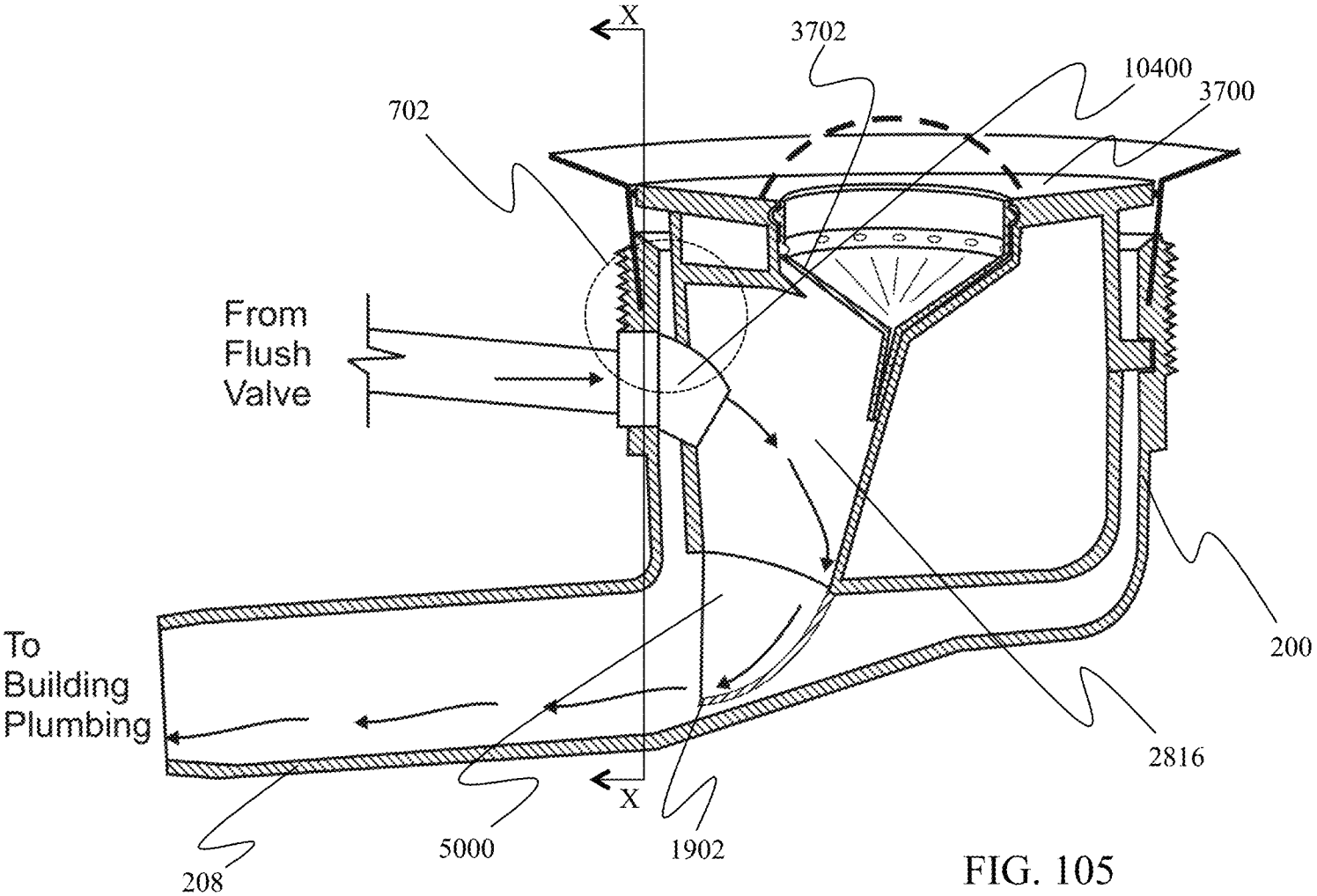
FIG. 105 is an illustration of a left side cross sectional view of a mechanical cartridge seen placed in a housing, which incorporates a housing fluid interface and an inlet director, where a watertight seal between a cartridge and a housing is not required, according to the present invention.

A left side cross sectional view of a mechanical cartridge 3700, placed in a housing 200, which incorporates a housing fluid interface 702 and an inlet director 10400, as was shown in FIG. 104, is presented in FIG. 105. In this aspect, it is not required to have a watertight seal between the cartridge 3700 and the housing 600. Instead, the inlet director 10400 helps point the flushing water in the desired direction as it enters the housing. The inlet director 10400 may be made of a compliant elastomeric material allowing it to flex out of the way when the cartridge is inserted, then flex back into position once the cartridge has been fully inserted into position.

Figure 106:
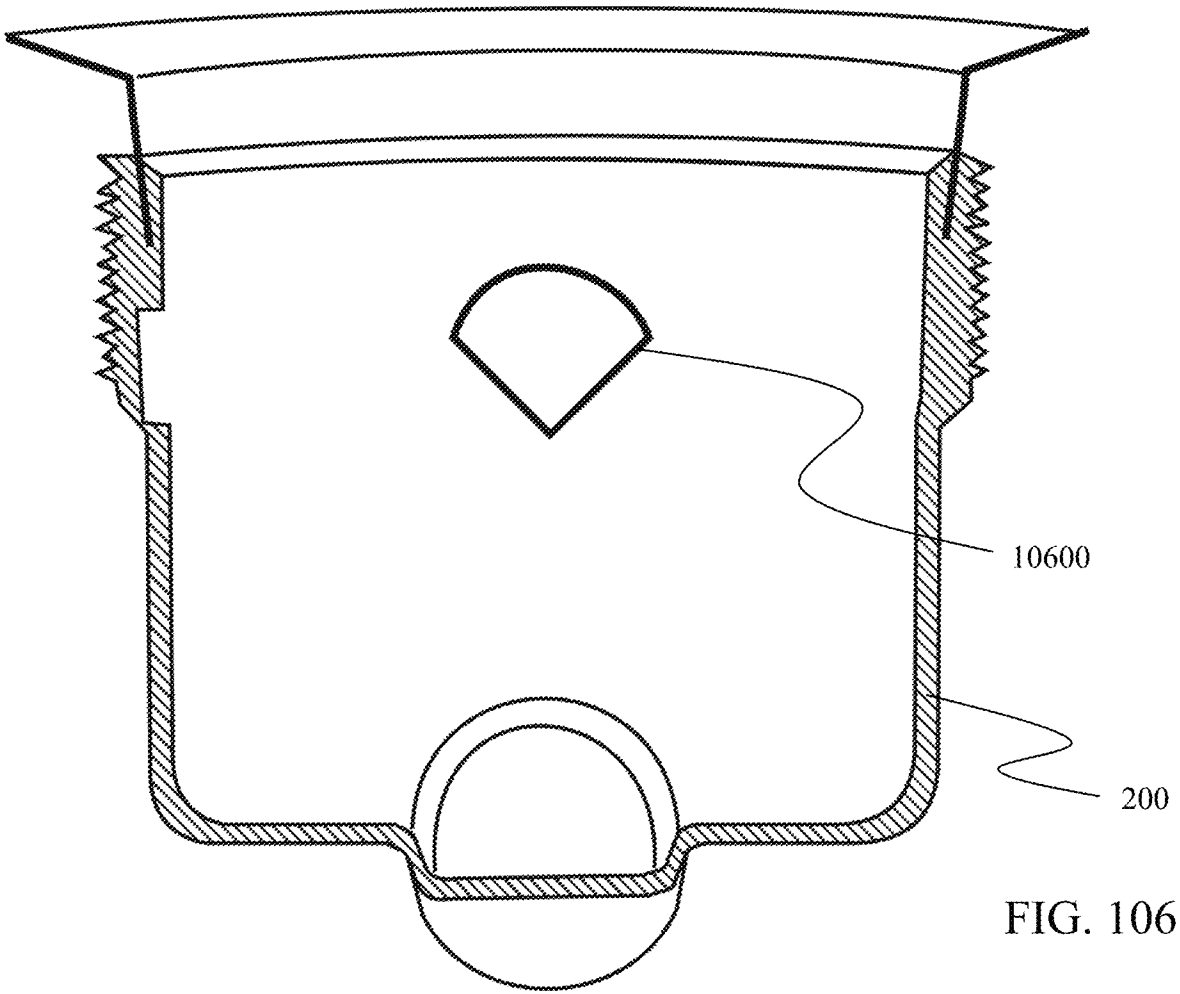
FIG. 106 is an illustration of a cross section view of the same type of housing as seen in FIG. 104, here a V shaped inlet is shown, according to the present invention.

A cross section of the same type of housing as seen in FIG. 104, taken through the line X-X is shown in FIG. 106. The inlet 10600 is V-shaped, creating a narrowing channel for which flushing water can flow through. This narrowing portion creates an example of an inlet portion with a directing portion. The V-shape creates a higher velocity for the flushing fluid entering the housing, even when the flushing fluid is only gravity fed and has no other means to increase its velocity.

Figure 107:
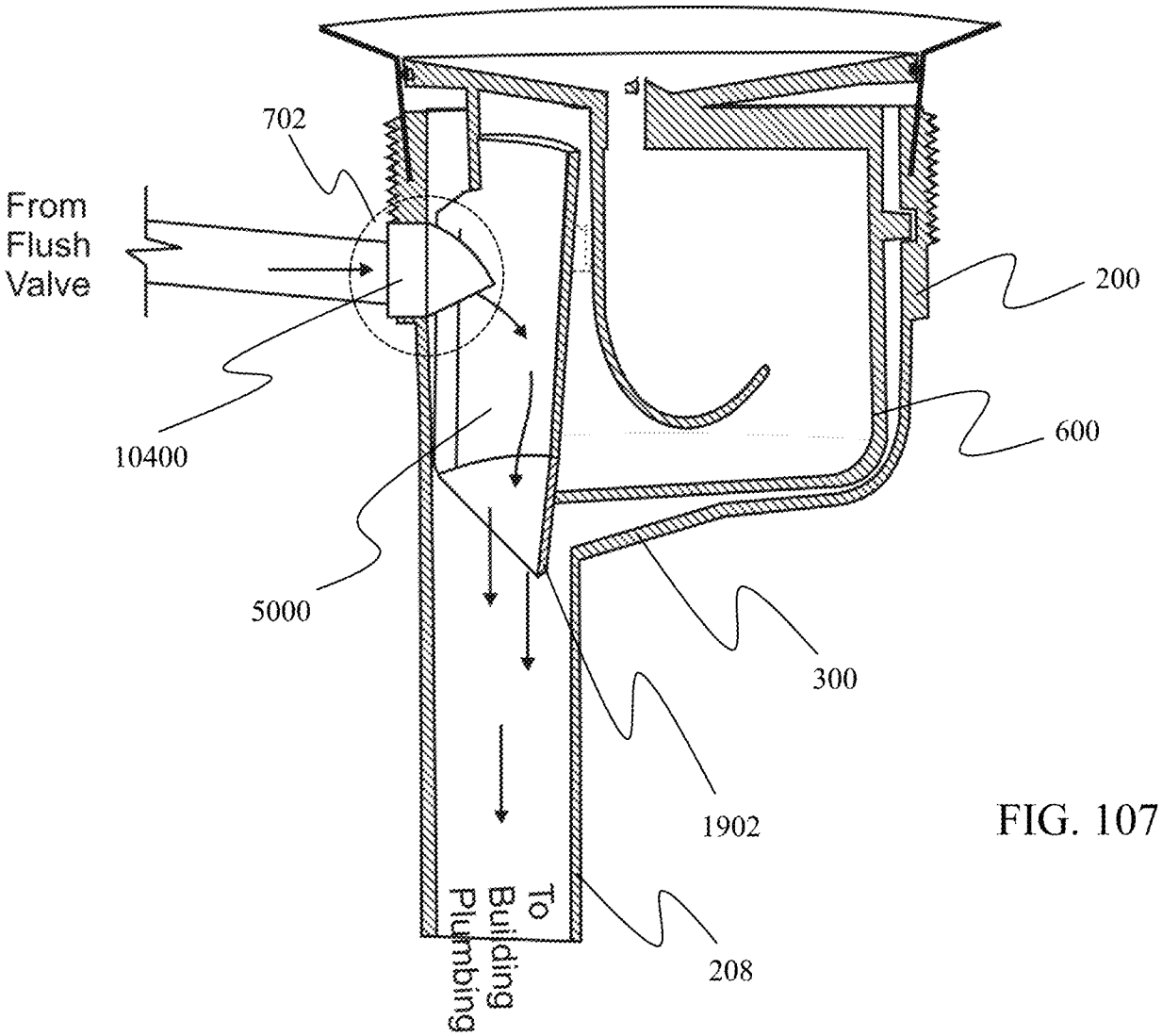
FIG. 107 is a left side cross sectional view of the cartridge with a pour spout shaped to direct the fluid substantially down rather than substantially horizontally.

A left side cross sectional view of a cartridge 600 with a pour spout 5000 shaped to direct the fluid substantially down rather than substantially horizontally is presented in FIG. 107. The cartridge 600 is placed in a housing 200 which has an exit pipe 208 oriented in a down or vertical direction rather than side or horizontal direction. The pour spout 5000 is shaped to have an exit drip edge 1902 which extends past the housing trough 300 (i.e., the bottom wall of the housing 200). The housing 200 incorporates housing fluid interface 702, and inlet director 10400. In this version, it is not required to have a watertight seal between cartridge 600 and housing 200. The inlet director 10400 helps point flushing water in desired direction as it enters the housing 200. The inlet director 10400 may be made of compliant elastomeric material allowing it to flex out of the way when the cartridge 600 is inserted, then flex back into position once the cartridge 600 has been fully inserted into position. The pour spout 5000 may also be made of a compliant elastomeric material allowing the cartridge to be inserted and twisted into position, while still allowing the drip edge 1902 to reside below the housing trough 300 (i.e., the bottom wall of the housing 200) when locked fully into place. In another variation, a high pressure version of this configuration, a water tight seal between the cartridge 600 and housing 200 is used along with a spray head 710 pointing down the vertical housing exit 208.

(5) Additional Considerations

An example of a flush valve for use with the present invention is Sloan Royal 186-0.125, which can be programmed to flush on a timer, manually, or from sensing a user, or after a certain number of users. Optimal efficiency will come from using timed flushes with the new invented system disclosed herein. Sensors can also be used inside of the housing to alert the flush valve to the existing buildup, telling it to flush. Other flush valves, for example, the Keremag Flush Control 1000 (by Keramag, Keramische Werke GmbH, Postfach 10 14 20, D—40834 Ratingen, Germany), can also be used. This type of a flush valve is equipped with timing control which can work well with the invention in helping it use as little water as possible by setting the high pressure spray action to occur on predetermined time intervals. Additionally, urinal service personnel may want to use a non-flushing cartridge that they are familiar with in the new inventive system. To accommodate this, a self-clean kit as depicted in FIG. 7B, can be installed. FIG. 11A shows a conversion kit similar to the one shown in FIG. 7B, installed in a housing 600. In this manner, a traditional cartridge (provided it does not interfere with the spray kit) can be used and still receive many of the performance benefits of the invention.

With certain devices that create an air gap, if too much flushing water is introduced at one time to the flushing line, the air gap device can overflow. By setting the system to introduce water in a pulse or a series of pulses, overflow of the air gap device can be prevented. A kill mechanism can be added to the flushing line so that if the air gap device is about to overflow, the valve shuts off any additional water. In this way the flushing can be optimized without concern of water leaking out of the air gap device. Additionally, flushing water can be introduced slowly to the air gap device, then more rapidly once the flow has commenced. In this way, the air gap device does not receive a single rush of water all at once which can cause overflow. By ramping up the volume of water introduced, the air gap device can reach its maximum flow rate without spilling over. One type of an air gap device category is the ASME a112.1.3. Additionally, by pulsing the flushing water in a pressurized system, there is an advantage to having high cleaning power yet with less water used from the start and stop of the spray on the various components at which it is aimed.

One of the most significant challenges facing all water conserving urinals, both HEU and non-flushing, is "line carry." Line carry is a measure of how far down the plumbing pipes waste is carried when a urinal is flushed or used. With flushing urinals, as less and less water is being used in an effort to conserve, the distance any waste can be carried has also been diminished. One way to improve line carry, given a set amount of water, is to speed the velocity of the flow. This can be accomplished, for example, by increasing the fall or tilt of the building's plumbing pipes. Of course, this would require an entire re-plumbing of a building which can be cost prohibitive.

Another way to speed up the flow is to either pressurize the flushing water or introduce a narrowing of the channel in which the flushing water flows. Bernoulli's principle holds that any volume of fluid sent through a pipe will increase in velocity in the narrowed segment of the piping. For a hybrid urinal, one means of increasing the velocity of the flushing water is to use a velocity intensifying aperture as previously taught in this patent.

Yet another means for increasing the velocity of flushing water is to provide for a channel to be created between the inner housing wall and the outer cartridge wall when the cartridge is inserted into the housing. The cartridge can be shaped to optimize this channel, both directing and speeding flow down the exit of the housing. This can cause flushing fluid water to enter the housing exit and the building's plumbing section with a high velocity, even if the flushing water is fed with nothing more than gravity. This increased velocity can then carry waste further down the pipes, improving line carry. Even a few inches of improved line carry can be meaningful to the performance of a building's plumbing. The difference between waste not reaching the plumbing's vertical section, or "stacks," by a few inches can mean the difference between a system that clogs and a system that remains open.

It will be appreciated to one of skill in the art that the invention disclosed herein may also be in the form of a method for cleaning a hybrid flushing system comprising an act of directing a flushing fluid into an area selected from a group consisting of a cartridge for a hybrid flushing system, a housing for a hybrid flushing system, and a plumbing system connected with the hybrid flushing system.

Further, in the act of directing the flushing fluid, the flushing fluid is directed through a fluid path, where the fluid path passes through an area selected from a group consisting of a housing for a hybrid flushing system, a cartridge for a hybrid flushing system, and a path formed by a combination of a housing for a hybrid system and a cartridge for a hybrid flushing system.

(6) Elements List

Following is a list of element names associated with element numbers in the figures. This list and these names are provided simply as a quick reference guide to assist the reader in more easily understanding the invention and are not meant to limit the invention to particular components/embodiments. Rather, they are intended to provide non-limiting examples for ease of reference.

100 Flush Valve/Pump/Actuator
102 Porcelain Urinal
104 Trap
106 Drain
200 Housing/Housing Body
202 Housing (Cavity)
204 Housing Flange
206 Housing Locking Mechanism
208 Housing Exit Tube
300 Housing Trough
600 Cartridge
602 Top Wall Flange
604 Inlet
700 Wall Portion
702 Housing Fluid Interface
704 Self-Cleaning Mechanism/Kit
706 Fluid Interface (Cartridge)
708 Flushing Fluid Transfer Tube
710 Flushing Fluid Directing Portion (High Pressure Spray Head)
712 Retainer Clip
800 Male Supply
802 Supply Fitting
1100 Connector Fitting
1102 Locking Pin
1104 Locking Slot
1106 O-Ring
1108 Supply Line
1200 Fluid Channel (Built-In)
1300 Locking Nut
1304 Arrow
1400 Swirling Lines
1500 Vent
1502 Air
1504 Plumbing Vent
1506 Water/Urine Combination
1700 Lock Tine (Cartridge)
1702 Cartridge Side Wall
1704 Cartridge Exit
1800 Bottom Wall (Cartridge)
1900 Flushing Fluid Receiving Portion
1902 Exit Drip Edge
1904 High Pressure Spray
2600 Throat
2602 Ceiling
2604 Overflow Level
2606 Inlet Compartment
2608 Vertical Separator
2610 Baffle
2612 Outlet Compartment Vertical Separator
2614 Outlet Compartment
2616 Overflow Gap
2618 Discharge Section
3700 Mechanical Valve Cartridge
3702 Mechanical Valve
3704 Sealing Section
3706 Debris Screen
3708 Rinse Holes
3710 Fluid Communication Channel
4800 Fluid Pass-Through Portion
5000 Pour Spout
5002 Side Seal
5100 Dividing Wall
5400 Integrated Trap
5402 Compliant Sealing Surface
5500 Sealing Surface (Proud)
5700 Switch Actuator Device
5702 Sensing Switch or Reader (Detector)
6000 Vent

6100 Vent Tube
6400 Arrows
6500 Arrows
7800 Vertical Supply Pipe
8000 Buildup Area (Struvite)
8200 Flush Actuator
8202 Horizontal Supply Pipe
8300 Supply Line
8600 Pump
8602 Back Pressure Prevention Device (Air Gap, Cistern, AVB, etc.)
9000 Rinse Outlet (Top)
9002 Rinsing Water
9300 Timer
9302 Manual Actuator
9400 Urinal Bowl
9402 Backing Plate
9600 Arrows
9700 Override Adapter
9702 Connection Wires
9900 Sensor
10200 Shaped Exit Area/Deflector/Concentrator
10202 Air Column
10400 Inlet Director
10600 V-Shaped Inlet

What is claimed is:

1. A housing for a hybrid flushing system, the housing comprising:

a wall forming a cavity for receiving a cartridge;

a housing fluid interface formed in a side portion of the wall;

an internal self-clean mechanism inside the cavity, wherein the internal self-clean mechanism comprises:

a flushing fluid inlet portion for receiving a flushing fluid at the housing fluid interface; and a flushing fluid directing portion in connection with the flushing fluid inlet portion and configured to receive the flushing fluid from the flushing fluid inlet portion and to direct the flushing fluid towards a bottom portion of the wall.

2. The housing for a hybrid flushing system as set forth claim 1, wherein the flushing fluid directing portion is integral with the flushing fluid inlet portion.

3. The housing for a hybrid flushing system as set forth claim 1, wherein the flushing fluid directing portion is configured to direct the fluid from the flushing fluid inlet into the cavity such that the flushing fluid flows substantially tangentially with respect to the wall and exits through a fluid exit portion.

4. The housing for a hybrid flushing system as set forth claim 1, wherein the housing further comprises a fluid exit portion oriented in a downward direction to accelerate the flushing fluid.

5. The housing for a hybrid flushing system as set forth claim 1, wherein the housing further comprises a sealing surface for connecting the housing with a cartridge such that flushing fluid may flow therebetween in a fluid-tight manner.

6. The housing for a hybrid flushing system as set forth claim 1, wherein the housing further comprises a fluid exit portion comprising a compliant inlet director configured to point flushing fluid in a desired direction, wherein the compliant inlet director is further configured to flex out of the way when the cartridge is inserted.

7. A housing for a hybrid flushing system as set forth in claim 1, further comprising a vent channel from a plumbing vent pipe to the housing cavity to allow airflow therethrough.

* * * * *